US012747510B2

(12) United States Patent
Stone et al.

(10) Patent No.: US 12,747,510 B2
(45) Date of Patent: Sep. 29, 2026

(54) MULTI-CELL $CO_x$ ELECTROLYZER STACKS

(71) Applicant: Twelve Benefit Corporation, Berkeley, CA (US)

(72) Inventors: Simon Gregory Stone, Arlington, MA (US); Steven George Goebel, Victor, NY (US); Timothy A. Bekkedahl, Fremont, CA (US); Emerson Gallagher, Vancouver (CA); Bevan Moss, Vancouver (CA); Sichao Ma, Dublin, CA (US); Noel Farrell, Vancouver (CA); Dave Whittaker, Richmond, CA (US)

(73) Assignee: Twelve Benefit Corporation, Berkeley, CA (US)

( * ) Notice: Subject to any disclaimer, the term of this patent is extended or adjusted under 35 U.S.C. 154(b) by 229 days.

(21) Appl. No.: 18/329,524

(22) Filed: Jun. 5, 2023

(65) Prior Publication Data

US 2024/0060194 A1 Feb. 22, 2024

Related U.S. Application Data

(60) Provisional application No. 63/373,035, filed on Aug. 19, 2022.

(51) Int. Cl.
*C25B 9/75* (2021.01)
*C25B 1/23* (2021.01)
(Continued)

(52) U.S. Cl.
CPC ..... *C25B 9/75* (2021.01); *C25B 1/23* (2021.01); *C25B 3/26* (2021.01); *C25B 9/19* (2021.01);
(Continued)

(58) Field of Classification Search
CPC ..... C25B 9/73–9/77
See application file for complete search history.

(56) References Cited

U.S. PATENT DOCUMENTS 4,029,565 A * 6/1977 Bender ..... C25B 9/73 204/266
4,309,264 A * 1/1982 Bender ..... C25B 9/73 204/290.14
(Continued)

FOREIGN PATENT DOCUMENTS

CN 110453236 A 11/2019
DE 102020205393 A1 11/2021
(Continued)

OTHER PUBLICATIONS

Machine translation of Jo KR-20070057370-A (Year: 2007).*
(Continued)

*Primary Examiner* — Harry D Wilkins, III
(74) *Attorney, Agent, or Firm* — Weaver Austin Villeneuve & Sampson LLP

(57) ABSTRACT

Various $CO_x$ electrolyzer multi-cell architectures are provided, including various frame, flow field, gas diffusion layer, and repeat unit designs that may be particularly useful in the context of multi-cell $CO_x$ electrolyzer cells.

21 Claims, 72 Drawing Sheets

(51) Int. Cl.

| | |
|---|---|
| ***C25B 3/26*** | (2021.01) |
| ***C25B 9/19*** | (2021.01) |
| ***C25B 9/40*** | (2021.01) |
| ***C25B 9/63*** | (2021.01) |
| ***C25B 9/77*** | (2021.01) |
| ***C25B 11/032*** | (2021.01) |
| ***C25B 13/00*** | (2006.01) |
| ***C25B 15/08*** | (2006.01) |

(52) U.S. Cl.
CPC ..... *C25B 9/40* (2021.01); *C25B 9/63* (2021.01); *C25B 9/77* (2021.01); *C25B 11/032* (2021.01); *C25B 13/00* (2013.01); *C25B 15/08* (2013.01)

(56) References Cited

U.S. PATENT DOCUMENTS

| | | | | |
|---|---|---|---|---|
| 4,561,946 | A | 12/1985 | Suhara et al. | |
| 6,080,290 | A | 6/2000 | Stuart et al. | |
| 6,669,826 | B1 * | 12/2003 | Milgate, Jr. | H01M 8/248 204/254 |
| 8,475,973 | B2 * | 7/2013 | Lev | H01M 8/0206 429/512 |
| 8,679,305 | B2 * | 3/2014 | Nakazawa | C25B 1/04 204/266 |
| 10,570,524 | B2 | 2/2020 | Matthews et al. | |
| 10,975,480 | B2 | 4/2021 | Masel | |
| 10,975,481 | B2 | 4/2021 | Guo et al. | |
| 12,077,874 | B2 | 9/2024 | Corp et al. | |
| 2002/0070123 | A1 * | 6/2002 | Andrews | C01B 13/10 205/626 |
| 2004/0191606 | A1 | 9/2004 | Lee et al. | |
| 2005/0106450 | A1 | 5/2005 | Castro et al. | |
| 2006/0016685 | A1 | 1/2006 | Hawkins et al. | |
| 2006/0246341 | A1 | 11/2006 | Jörissen et al. | |
| 2008/0318093 | A1 | 12/2008 | Lee et al. | |
| 2009/0155102 | A1 | 6/2009 | Park et al. | |
| 2009/0301868 | A1 * | 12/2009 | Swalla | C25B 1/04 29/25.03 |
| 2012/0328942 | A1 | 12/2012 | Thomas-Alyea et al. | |
| 2014/0238845 | A1 * | 8/2014 | Domit | C25B 1/04 204/228.4 |
| 2015/0030957 | A1 * | 1/2015 | Van Boeyen | H01M 8/0276 204/252 |
| 2015/0122637 | A1 * | 5/2015 | Haryu | C25B 9/73 204/253 |
| 2016/0060775 | A1 | 3/2016 | Domit et al. | |
| 2016/0115603 | A1 * | 4/2016 | Gashi | C25B 15/08 204/255 |
| 2016/0161869 | A1 | 6/2016 | Avneri et al. | |
| 2017/0012299 | A1 | 1/2017 | Itou et al. | |
| 2018/0265440 | A1 | 9/2018 | Kudo et al. | |
| 2019/0016616 | A1 | 1/2019 | Harvey et al. | |
| 2019/0085470 | A1 | 3/2019 | Ono et al. | |
| 2019/0177860 | A1 | 6/2019 | Tembhurne et al. | |
| 2019/0242021 | A1 | 8/2019 | Blanchet et al. | |
| 2020/0376479 | A1 | 12/2020 | Masel | |
| 2021/0002775 | A1 | 1/2021 | Matsumoto et al. | |
| 2022/0243348 | A1 | 8/2022 | Bekkedahl et al. | |
| 2022/0259745 | A1 * | 8/2022 | Danyi | C25B 3/26 |
| 2023/0332306 | A1 | 10/2023 | Corp et al. | |
| 2024/0368780 | A1 | 11/2024 | Corp et al. | |
| 2024/0401214 | A1 | 12/2024 | Duran et al. | |

FOREIGN PATENT DOCUMENTS

| | | | | |
|---|---|---|---|---|
| EP | 3378968 | A1 | 9/2018 | |
| EP | 3378969 | A1 | 9/2018 | |
| EP | 3460103 | A1 | 3/2019 | |
| JP | S5129394 | A | 3/1976 | |
| KR | 20070057370 | A * | 6/2007 | H01M 8/0247 |
| KR | 100962903 | B1 | 6/2010 | |
| KR | 20110044051 | A | 4/2011 | |
| WO | WO-2017192788 | A1 | 11/2017 | |
| WO | WO-2020240218 | A1 | 12/2020 | |
| WO | WO-2021132137 | A1 | 7/2021 | |
| WO | WO-2024040252 | A2 | 2/2024 | |

OTHER PUBLICATIONS

Fuel Cell Store: "Freudenberg Gas Diffusion Layers Technical Data," 2019, pp. 1-2, Retrieved from the Internet: URL:https://www.fuelcellstore.com/spec-sheets/freudenberg-gdl-technical-data.pdf.

Hwang, C., et al., "Influence of properties of gas diffusion layers on the performance of polymer electrolyte-based unitized reversible fuel cells," International Journal of Hydrogen Energy, 2010, vol. 36(2), pp. 1740-1753.

International Search Report and Written Opinion dated Sep. 18, 2024 in PCT Application No. PCT/US2024/031696.

Lee, J.K., et al., "Optimizing Porous Transport Layer Design Parameters via Stochastic Pore Network Modelling: Reactant Transport and Interfacial Contact Considerations," Journal of The Electrochemical Society, 2020, vol. 167, pp. 1-11.

Lee, J.K., et al., "Pore Network Modelling to Enhance Liquid Water Transport Through Porous Transport Layers for Polymer Electrolyte Membrane Electrolyzers," Journal of Power Sources, 2019, vol. 437, pp. 1-9.

Ornetzeder, S., et al., "Industrial Manufacturing Technologies of Porous Transport Layers for a Proton Exchange Membrane Electrolyser," FH Burgenland, 2020, pp. 1-123.

Parra-Restzrepo, J., et al., "Influence of the Porous Transport Layer Properties on the Mass and Charge Transfer in a Segmented Pem Electrolyzer," International Journal of Hydrogen Energy, 2020, vol. 45(15), pp. 8094-8106.

U.S. Restriction Requirement dated Aug. 19, 2024 in U.S. Appl. No. 17/649,662.

Yen-Chun, C., et al., "Determination of The Porosity and Its Heterogeneity of Fuel Cell Microporous Layers by X-ray Tomographic Microscopy," Journal of Power Sources, 2022, vol. 539, pp. 1-14.

Badami, M. "Leakage effects on the performance characteristics of a regenerative blower for the hydrogen recirculation of a PEM fuel cell," Energy Conversion and Management, vol. 55, Mar. 2012, pp. 20-25.

Badami, M., "Theoretical model with experimental validation of a regenerative blower for hydrogen recirculation in a PEM fuel cell system," Energy Conversion and Management, vol. 51, Issue 3, Mar. 2010, pp. 553-560.

Blaszczyk, J., "In-Situ Anode Recirculation Rate Measurement Method (Draft)," Ogura Industrial Corporation, Ballard Power Systems, Full Cell Seminar & Exposition 2011, Oct. 31-Nov. 3, 2011, 22 pages.

Eckl, R et al., "Current Distribution Mapping in Polymer Electrolyte Fuel Cells-A Finite Element Analysis of Measurement Uncertainty Imposed by Lateral Currents," Journal of Power Sources, 2006, vol. 154(1), pp. 171-179.

Endrodi, B., "Multilayer Electrolyzer Stack Converts Carbon Dioxide to Gas Products at High Pressure with Multilayer Electrolyzer Stack Converts Carbon," acs Energy Lett. 2019, 4, 1770-1777.

Hori, Y., "Chapter 48: Co2-reduction, catalyzed by metal electrodes," Handbook of Fuel Cells—Fundamentals, Technology and Applications, vol. 2, Electrocatalysis, 2003. pp. 720-733.

International Preliminary Report on Patentability dated Aug. 17, 2023, in Application No. PCT/US2022/070462.

International Search Report and Written Opinion dated Jun. 24, 2022, in PCT Application No. PCT/US2022/070462.

International Search Report and Written Opinion dated Oct. 17, 2023, in Application No. PCT/US2023/065800.

James, B.D., et al. 2017 DOE Hydrogen and Fuel Cells Program Review, Fuel Cell Systems Analysis, Strategic Analysis, Project IDI FC163, Jun. 8, 2017, 34 pages.

Li, et al., "Electrolysis of Co2 to Syngas in Bipolar Membrane-Based Electrochemical Cells," ACS Publications, ACS Energy Letters, 2016, 1, pp. 1149-1153.

(56) References Cited

OTHER PUBLICATIONS

Li, et al., "Electrolytic Conversion of Bicarbonate into CO in a Flow Cell," Cell Press, Joule 3, Jun. 19, 2019, pp. 1487-1497.
Sharma, et al., "Electrocatalytic conversion of carbon dioxide to fuels: a review on the interaction between CO2 and the liquid electrolyte," WIREs Energy Environ 2017, 6:e239. doi: 10.1002/wene.239, pp. 1-21.
U.S. Non-Final Office Action dated Jul. 5, 2023, in U.S. Appl. No. 18/300,908.
U.S. Notice of Allowance dated Jan. 19, 2024 in U.S. Appl. No. 18/300,908.
U.S. Notice of Allowance dated May 1, 2024 in U.S. Appl. No. 18/300,908.
Verma, et al., "The effect of electrolyte composition on the electroreduction of CO2 to CO on Ag based gas diffusion electrodes," Phys. Chem. Chem. Phys., 2016, 18, pp. 7075-7084.
Xia, Chuan, et al., "Continuous production of pure liquid fuel solutions via electrocatalytic CO2 reduction using solid electrolyte devices," Nature Energy, http://www.nature.com/natureenergy ; https://doi.org/10.1038/s41560-019-0451-x, Sep. 2019.
Yim S D., et al., "The Influence of Stack Clamping Pressure on the Performance of PEM Fuel Cell Stack," Current Applied Physics, 2010, vol. 10(2), pp. S59-S61.
International Preliminary Report on Patentability and Written Opinion dated Mar. 6, 2025 in PCT Application No. PCT/US2023/072522.
International Search Report and Written Opinion dated Jul. 3, 2024 in PCT Application No. PCT/US2023/072522.
Liang S., et al., "Electrolytic Cell Design for Electrochemical CO2 Reduction," Journal CO2 Utilization, Jan. 2020, vol. 35, pp. 90-105.
U.S. Non-Final Office Action dated Mar. 20, 2025 in U.S. Appl. No. 17/649,662.
U.S. Restriction Requirement dated Jun. 9, 2025 in U.S. Appl. No. 18/679,249.
U.S. Final Office Action dated Oct. 10, 2025 in U.S. Appl. No. 17/649,662.
U.S. Non-Final Office Action dated Oct. 22, 2025 in U.S. Appl. No. 18/679,249.

* cited by examiner

FIG. 104
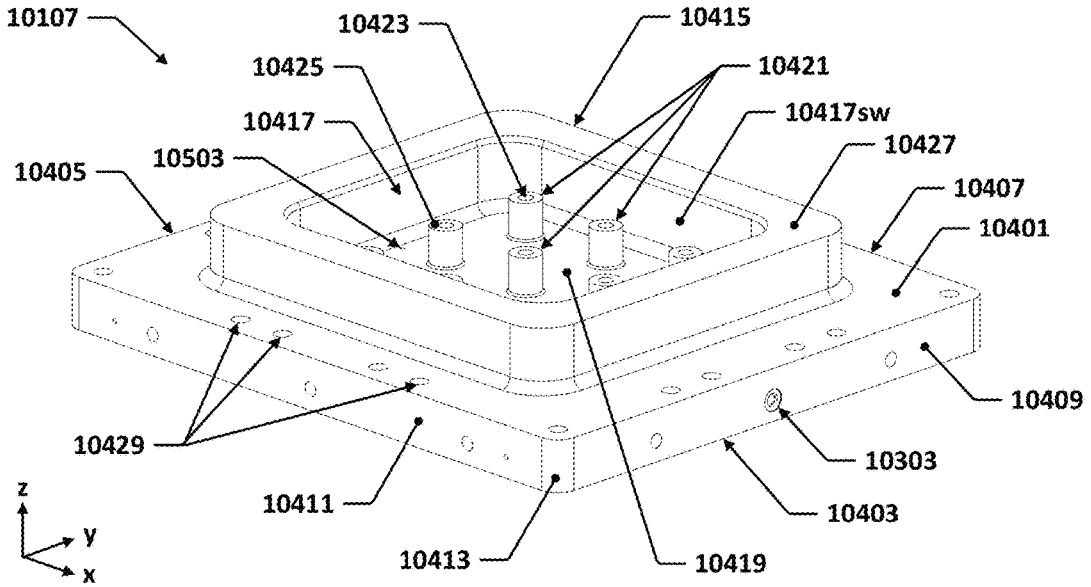
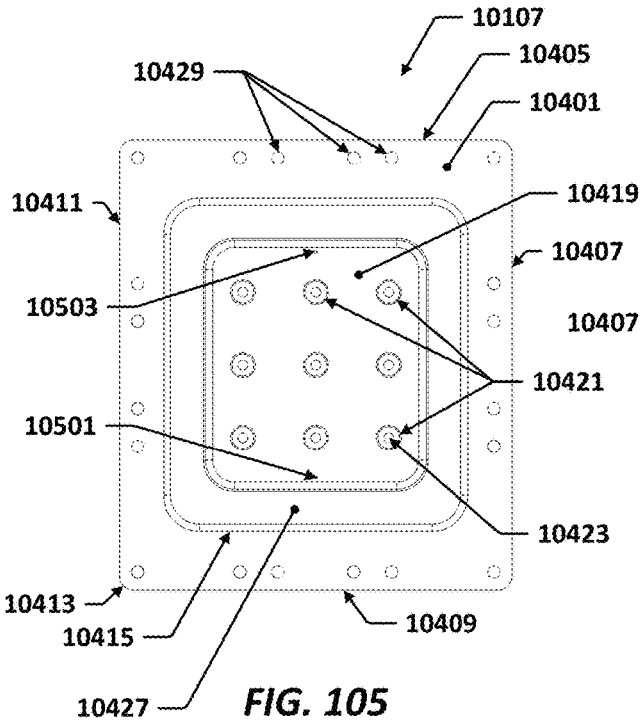
FIG. 105
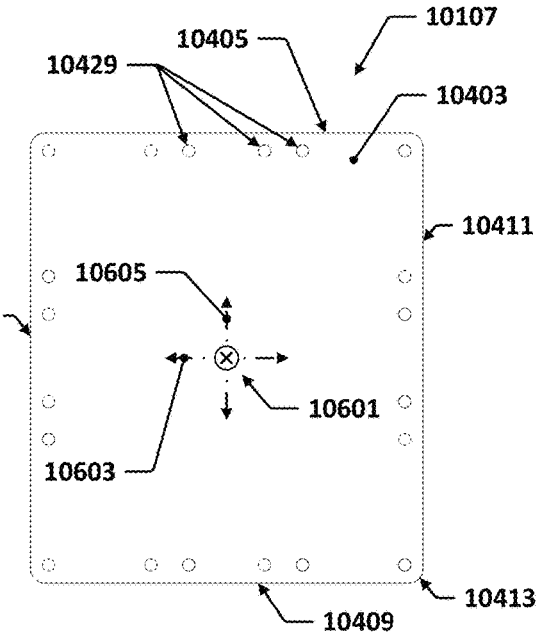
FIG. 106

FIG. 107
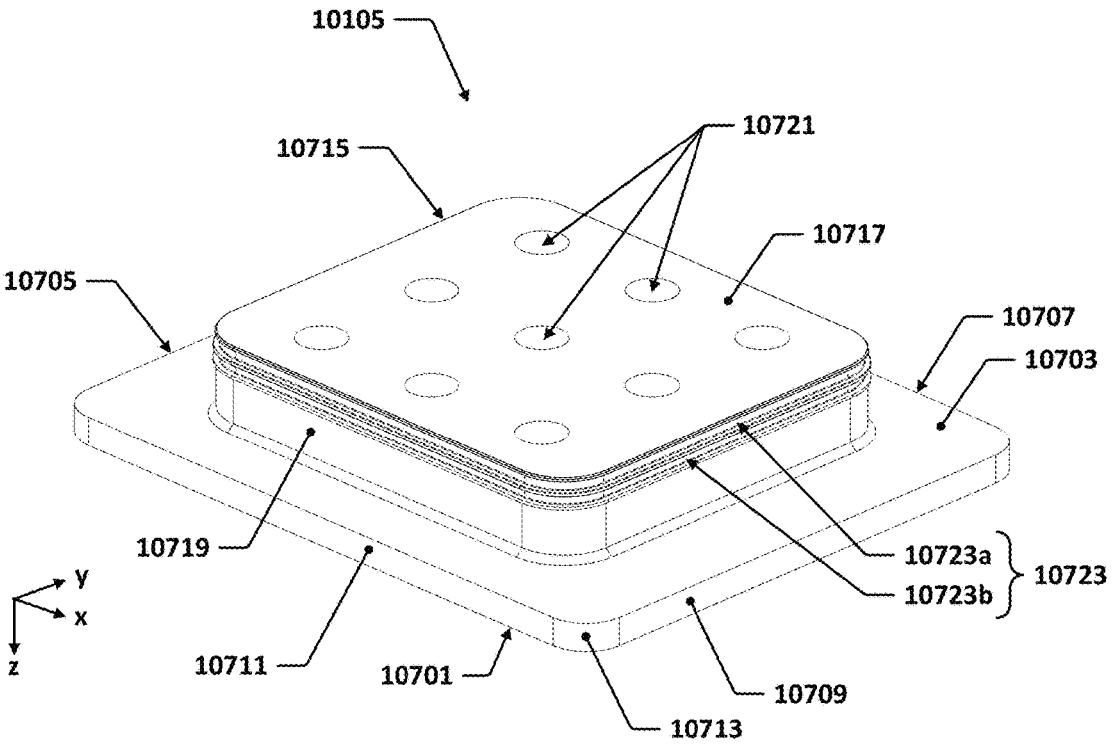
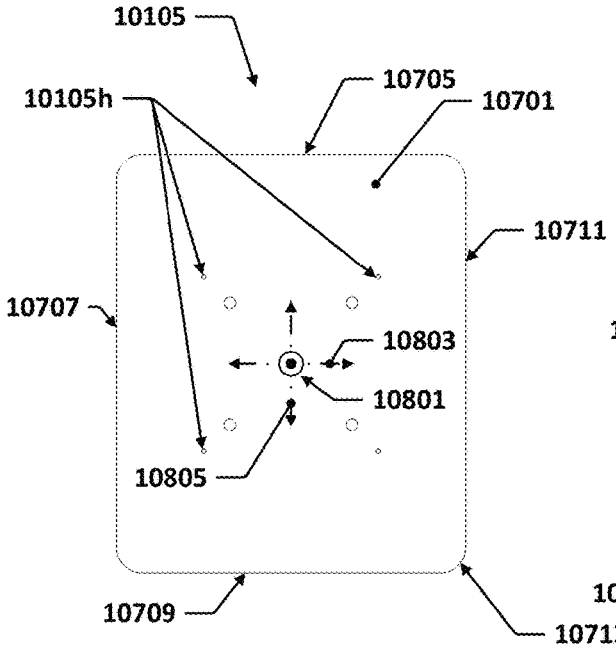
FIG. 108
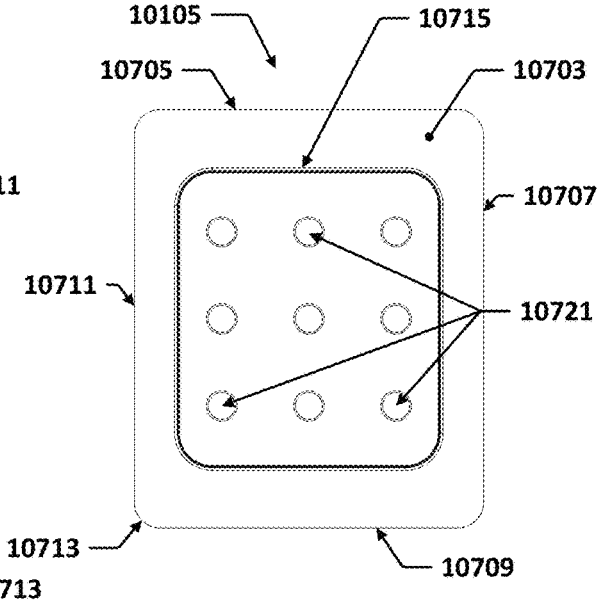
FIG. 109

MULTI-CELL $CO_x$ ELECTROLYZER STACKS

RELATED APPLICATIONS

An Application Data Sheet is filed concurrently with this specification as part of the present application. Each application that the present application claims benefit of or priority to as identified in the concurrently filed Application Data Sheet is incorporated by reference herein in its entirety and for all purposes.

BACKGROUND $CO_x$ electrolyzers offer a potential route for converting or reducing $CO_x$ gas, e.g., CO or $CO_2$, into one or more desired carbon-based byproducts, such as industrial chemicals or fuels, thereby allowing for waste $CO_x$ gas that would normally be released into the atmosphere to instead be converted into industrially useful products.

Background and contextual descriptions contained herein are provided solely for the purpose of generally presenting the context of the disclosure. Much of this disclosure presents work of the inventors, and simply because such work is described in the background section or presented as context elsewhere herein does not mean that such work is admitted prior art.

SUMMARY

Details of one or more implementations of the subject matter described in this specification are set forth in the accompanying drawings and the description below. Other features, aspects, and advantages will become apparent from the description, the drawings, and the claims.

One or more embodiments provide a $CO_x$ electrolyzer apparatus capable of converting or reducing $CO_x$ gas into one or more desired byproducts.

One or more embodiments provide a frame capable of facilitating fluid flow in a $CO_x$ electrolyzer apparatus.

One or more embodiments provide a $CO_x$ electrolyzer apparatus capable of constraining expansion of a plurality of $CO_x$ electrolyzer cells in an axial direction in an operational state of the $CO_x$ electrolyzer apparatus.

Additional aspects will be set forth in the detailed description which follows, and, in part, will be apparent from the disclosure, or may be learned by practice of the inventive concepts.

According to some embodiments, a $CO_x$ electrolyzer apparatus ("apparatus") includes a first end assembly, a second end assembly, a plurality of separator plates, and a plurality of $CO_x$ electrolyzer cells ("cells"). The second end assembly is coupled to the first end assembly via a plurality of tensioning members. The plurality of $CO_x$ electrolyzer cells ("cells") are interposed between the first and second end assemblies and arranged in a stack along an axial direction. Each cell among the cells includes an instance of first components and an instance of second components. The first components include a membrane electrode assembly ("MEA"), a cathode frame, and a cathode flow field. The MEA has a cathodic part, an anodic part, and a separator between the cathodic part and the anodic part. The cathode frame is adjacent to the cathodic part. The cathode flow field is at least partially disposed in a first opening in the cathode frame. The second components include an anode frame adjacent to the anodic part of the MEA and an anode flow field at least partially disposed in a second opening in the anode frame. The cathode and anode frames of adjacent cells among the cells are coupled to one another via a corresponding plurality of frame fasteners with a separator plate among the separator plates interposed therebetween. The frame fasteners are different from the tensioning members.

In some embodiments, the first components may further include a cathode gas diffusion layer (GDL) adjacent to the cathode frame and covering the cathode flow field. The cathode GDL and the cathode flow field may be configured to guide a flow of gaseous $CO_x$ across the first opening in a first direction transverse to the axial direction and in a distributed manner with respect to at least a second direction transverse to each of the axial and first directions. The second components may further include an anode porous transport layer (PTL) adjacent to the anode frame and covering the anode flow field. The anode PTL and the anode flow field may be configured to guide a flow of anolyte across the second opening in a third direction transverse to the axial direction and in a distributed manner with respect to at least the second direction.

In some embodiments, the cathode frame may include the first opening arranged in a central portion of the cathode frame, at least one first fluidic inlet passage fluidically connected to the anodic parts of the cells, at least one first fluidic outlet passage fluidically connected to the anodic parts of the cells at least one second fluidic inlet passage fluidically connected to the first opening, and at least one second fluidic outlet passage fluidically connected to the first opening.

In some embodiments, the anode frame may include the second opening arranged in a central portion of the anode frame, at least one third fluidic inlet passage fluidically connected to the second opening, at least one third fluidic outlet passage fluidically connected to the second opening, at least one fourth fluidic inlet passage fluidically connected to the cathodic parts of the cells, and at least one second fluidic outlet passage fluidically connected to the cathodic parts of the cells.

In some embodiments, each of the separator plates may include a plurality of fastener orifices through which the frame fasteners respectively extend, at least one first hole through which an inlet anolyte flow path extends, at least one second hole through which an outlet anolyte flow path extends, at least one third hole through which an inlet gaseous $CO_x$ flow path extends, and at least one fourth hole through which an outlet $CO_x$ reduction byproduct flow path extends.

In some embodiments, the cathode frame may include a first surface facing the MEA and a second surface facing away from the first surface. The second surface of the cathode frame may include at least one first protrusion through which the at least one first fluidic inlet passage extends, at least one second protrusion through which the at least one first fluidic outlet passage extends, at least one third protrusion through which the at least one second fluidic inlet passage extends, and at least one fourth protrusion through which the at least one second fluidic outlet passage extends.

In some embodiments, the at least one first protrusion of the cathode frame may be arranged and may be configured to extend through the at least one first hole in a first separator plate among the separator plates and may abut against the anode frame of a first adjacent cell among the cells such that the at least one first fluidic inlet passage of the cathode frame is substantially aligned in the axial direction with the at least one third fluidic inlet passage of the anode frame of the first adjacent cell. The at least one second protrusion of the cathode frame may be arranged and may be configured to extend through the at least one second hole in the first separator plate and may abut against the anode frame of the first adjacent cell such that the at least one first fluidic outlet passage of the cathode frame is substantially aligned in the axial direction with the at least one third fluidic outlet passage of the anode frame of the first adjacent cell. The at least one third protrusion of the cathode frame may be arranged and may be configured to extend through the at least one third hole in the first separator plate and may abut against the anode frame of the first adjacent cell such that the at least one second fluidic inlet passage of the cathode frame is substantially aligned in the axial direction with the at least one fourth fluidic inlet passage of the anode frame of the first adjacent cell. The at least one fourth protrusion of the cathode frame may be arranged and may be configured to extend through the at least one fourth hole in the first separator plate and may abut against the anode frame of the first adjacent cell such that the at least one second fluidic outlet passage of the cathode frame is substantially aligned in the axial direction with the at least one fourth fluidic outlet passage of the anode frame of the first adjacent cell.

In some embodiments, at least one of the first to fourth protrusions may be sized to form a clearance fit with a corresponding one of the first to fourth holes.

In some embodiments, the cathode frame may further include a plurality of first cathode fastener orifices arranged about a peripheral area of the cathode frame. The peripheral area may encircle the first opening of the cathode frame. The anode frame may further include a plurality of first anode fastener orifices and a plurality of first swage nuts. The plurality of first anode fastener orifices may be arranged about a peripheral area of the anode frame. The peripheral area of the anode frame may encircle the second opening of the anode frame. The first cathode fastener orifices may be substantially aligned with the first anode fastener orifices in the axial direction. Each first swage nut among the first swage nuts may be disposed in one or the other of a corresponding one of the first anode fastener orifices and a corresponding one of the first cathode fastener orifices. The first swage nuts may be configured to interface with corresponding frame fasteners among the frame fasteners.

In some embodiments, each of the cathode fastener orifices and anode fastener orifices may be counterbored. The counterbored portions of those cathode fastener orifices and/or anode fastener orifices not including a first swage nut among the first swage nuts may be configured to form a clearance fit with a respective frame fastener among the frame fasteners.

In some embodiments, the frame fasteners may be shoulder screws.

In some embodiments, the first components may further include a first support frame and a second support frame. The first support frame may be interposed between the cathode GDL and the cathode frame. The first support frame may include a first frame opening exposing a portion of the cathode GDL to the cathode flow field. The portion of the cathode GDL may abut against the cathode flow field. The second support frame may be interposed between the MEA and the anode PTL. The second support frame may include a second frame opening exposing a portion of the MEA to the anode PTL. The portion of the MEA may abut against the anode PTL. The first support frame, the cathode GDL, the MEA, and the second support frame may form a unitized MEA assembly.

In some embodiments, the first components may further include a first cathode gasket interposed between the first support frame and the cathode frame. The first cathode gasket may encircle the first opening in the cathode frame to form a first fluidic seal around the cathode flow field. The second components may further include a first anode gasket set. The first anode gasket set may include a first anode gasket, at least one second anode gasket, at least one third anode gasket, at least one fourth anode gasket, and at least one fifth anode gasket. The first anode gasket may be interposed between the second support frame and the anode frame. The first anode gasket may encircle the second opening in the anode frame to form a first fluidic seal around the anode flow field. The at least one second anode gasket may be interposed between the cathode frame and the anode frame. The at least one second anode gasket may encircle the at least one first fluidic inlet passage of the cathode frame and the at least one third fluidic inlet passage of the anode to form at least one fluidic seal. The at least one third anode gasket interposed between the cathode frame and the anode frame, the at least one third anode gasket encircling the at least one first fluidic outlet passage in the cathode frame and the at least one third fluidic outlet passages in the anode frame to form at least one fluidic seal. The at least one fourth anode gasket may be interposed between the cathode frame and the anode frame. The at least one third anode gasket may encircle the at least one second fluidic inlet passage in the cathode frame and the at least one fourth fluidic inlet passage in the anode frame to form at least one fluidic seal. The at least one fifth anode gasket may be interposed between the cathode frame and the anode frame. The at least one fifth anode gasket may encircle the at least one second fluidic outlet passage and the at least one fourth fluidic outlet passage in the anode frame to form at least one fluidic seal.

In some embodiments, the first components may further include a second cathode gasket interposed between a first separator plate among the separator plates and the cathode frame. The second cathode gasket may encircle the first opening in the cathode frame to form a second fluidic seal around the cathode flow field. The second components may further include a second anode gasket set. The second anode gasket set may include a sixth anode gasket, at least one seventh anode gasket, at least one eighth anode gasket, at least one ninth anode gasket, and at least one tenth anode gasket. The sixth anode gasket may be interposed between the anode frame and a second separator plate among the separator plates. The sixth anode gasket may encircle the second opening in the anode frame to form a second fluidic seal around the anode flow field. The at least one seventh anode gasket may be interposed between the anode frame and the second separator plate. The at least one seventh anode gasket may encircle the at least one first hole in the second separator plate and the at least one third fluidic inlet passage in the anode frame to form at least one fluidic seal. The at least one eighth anode gasket may be interposed between the anode frame and the second separator plate. The at least one eighth anode gasket may encircle the at least one second hole in the second separator plate and the at least one third fluidic outlet passage in the anode frame to form at least one fluidic seal. The at least one ninth anode gasket may be interposed between the anode frame and the second separator plate. The at least one ninth anode gasket may encircle the at least one third hole in the second separator plate and the at least one fourth fluidic inlet passage in the anode frame to form at least one fluidic seal. The at least one tenth anode gasket may be interposed between the anode frame and the second separator plate. The at least one ninth anode gasket may encircle the at least one fourth hole in the second separator plate and the at least one fourth fluidic outlet passage in the anode frame to form at least one fluidic seal.

In some embodiments, the cells may be formed of a plurality of repeat units. Each repeat unit among the repeat units may include an instance of the first components, an instance of the second components, and the separator plate that may be interposed between the cathode frame of that instance of the first components and the anode frame of that instance of the second components, that separator plate may be interposed between that instance of the first components and that instance of the second components.

In some embodiments, the first end assembly may include a first end plate and a cathode interface assembly. The cathode interface assembly may include an instance of the first components and a cathode interface separator plate interposed between the first end plate and a first repeat unit among the repeat units. A first end cell may be formed between the cathode interface assembly and the instance of the second components of the first repeat unit. The first end cell may be interposed between the first end plate and the plurality of cells.

In some embodiments, the first end assembly may further include a first insulation plate, a manifold, and a first bus plate between the first end plate and the cathode interface assembly. The manifold may include at least one first inlet fluidically connected to the anodic parts of the cells via the inlet anolyte flow path, at least one first outlet fluidically connected to the anodic parts of the cells via the outlet anolyte flow path, at least one second inlet fluidically connected to the cathodic parts of the cells via the inlet gaseous $CO_x$ flow path, and at least one second outlet fluidically connected to the cathodic parts of the cells via the outlet $CO_x$ reduction byproduct flow path. The first bus plate may be configured to receive a first electric potential. The first insulation plate may be configured to electrically insulate the first end plate from the first bus plate.

In some embodiments, the first bus plate, the manifold, and the first insulation plate may be sequentially stacked on the cathode interface assembly.

In some embodiments, the inlet anolyte flow path, the outlet anolyte flow path, the inlet gaseous $CO_x$ flow path, and the outlet $CO_x$ reduction byproduct flow path may not extend into the bus plate and the first insulation plate.

In some embodiments, the first bus plate, the insulation plate, and the manifold may be sequentially stacked on the cathode interface assembly.

In some embodiments, the first end assembly may further include a capping plate, an inlet runner, and an outlet runner. The inlet and outlet runners may be coupled to the manifold such that the inlet and outlet runners are stacked in the axial direction between the capping plate and the manifold.

In some embodiments, the inlet anolyte flow path, the outlet anolyte flow path, the inlet gaseous $CO_x$ flow path, and the outlet $CO_x$ reduction byproduct flow path may extend through the first insulation plate.

In some embodiments, the first bus plate may be coupled to the manifold via a plurality of first fasteners different from the tensioning members and the frame fasteners. The first insulation plate may be coupled to the first end plate via a plurality of second fasteners different from the tensioning members, the frame fasteners, and the first fasteners.

In some embodiments, the first bus plate may be coupled to the first insulation plate via a plurality of first fasteners different from the tensioning members and the frame fasteners. In some embodiments, the first insulation plate may be coupled to the manifold via the first fasteners.

In some embodiments, the second end assembly may include a second end plate and an anode interface assembly. The anode interface assembly may include an instance of the second components and an anode interface separator plate interposed between a second repeat unit among the repeat units and the second end plate. A second end cell may be formed between the instance of the first components of the second repeat unit and the anode interface assembly. The second end cell may be interposed between the plurality of cells and the second end plate.

In some embodiments, the second end assembly may further include a second bus plate and a second insulation plate sequentially stacked in the axial direction between the anode interface assembly and the second end plate. The second bus plate may be configured to receive a second electric potential. The second insulation plate may be configured to electrically insulate the second end plate from the second bus plate.

In some embodiments, the second insulation plate may be coupled to the second end plate via a plurality of third fasteners different from the tensioning members and the frame fasteners.

In some embodiments, the second end assembly may further include a bladder gasket. The second insulation plate may include a first recess, a second recess, and an orifice. The first recess may be formed in a central portion of the second insulation plate. The second recess may encircle a central region of the central portion. The second recess may support the bladder gasket therein. The orifice may be configured to receive one or more control fluids. The bus plate may be slidably disposed in the first recess and may be configured to abut against the bladder gasket and/or a surface of the first recess facing the bus plate in the axial direction. A distance in the axial direction between the bus plate and the surface of the first recess facing the bus plate in the axial direction may be configured to increase in response to accumulation of the one or more control fluids in an area between the bus plate and the insulation plate that may be fluidically sealed via at least the bladder gasket.

In some embodiments, the second end plate may include a first main body, a second end plate protrusion extending from the first main body in the axial direction, and a second end plate opening extending into a central portion of the second end plate protrusion in a direction opposite the axial direction and terminating at a recessed surface facing the cells. The second end assembly may further include a piston interposed between the second insulation plate and the second end plate. The piston may include a second main body and a piston protrusion extending from the second main body in the direction opposite the axial direction and terminating at a protruded surface facing the recessed surface. At least a portion of the piston protrusion may be slidably disposed in at least a portion of the second end plate opening.

In some embodiments, the second end assembly may further include a plurality of biasing members. The piston protrusion may include a plurality of piston protrusion openings extending into the protruded surface in the axial direction. The second end plate may further include a plurality of support protrusions extending in the axial direction from the recessed surface and may be arranged in correspondence with the piston protrusion openings. The biasing members may be respectively supported in the second end plate opening via corresponding support protrusions among the support protrusions such that, in a first compressed state of the second end assembly, the biasing members are compressed between the protruded surface and the recessed surface and respective portions of the support protrusions may at least partially extend into corresponding piston protrusion openings among the piston protrusion openings.

In some embodiments, the second end plate may further include one or more orifices fluidically connected to the second end plate opening. The one or more orifices may be configured to receive one or more control fluids. The piston protrusion may include a plurality of piston gaskets encircling the piston protrusion and offset from one another in the axial direction. The piston gaskets may interface with one or more inner sidewalls of the second end plate opening such that the second end plate opening, the piston protrusion, and the piston gaskets form a cavity within the second end assembly. A distance in the axial direction between the protruded surface and recessed surface may be configured to increase in response to accumulation of the one or more control fluids in the cavity.

In some embodiments, the cells may be configured to reduce input gaseous $CO_x$ into one or more byproducts, and the one or more control fluids and the input gaseous $CO_x$ may be equivalent.

In some embodiments, the apparatus may further include a source of gaseous $CO_x$. The source may be configured to input the gaseous $CO_x$ to the cells and the second end assembly at substantially equivalent pressures.

In some embodiments, the apparatus may further include a source of gaseous $CO_x$. The source may be configured to input the gaseous $CO_x$ to the cells at a first pressure and to the second end assembly at a second pressure. The first and second pressures may, at steady state, be in equilibrium.

In some embodiments, the apparatus may further include a plurality of datum rods extending in the axial direction along peripheral surfaces of the cells. The second insulation plate may include a plurality of openings configured to respectively support corresponding datum rods among the datums rods therein.

In some embodiments, the cathode and anode frames may be formed of one or more polymers.

In some embodiments, the cathode and anode frames may include at least one of polyethylene terephthalate (PET), polycarbonate (PC), polyimide (PI), polyamide (PA), poly (methylmethacrylate) (PMMA), polyethylene naphthalate (PEN), polyetherketone (PEK), polyetheretherketone (PEEK), polystyrene (PS), polyetherimide (PEI), polyphenylene sulfide (PPS), polyarylate (PAR), polyether sulfone (PES), cyclic olefin copolymer (COC), polyvinyl alcohol (PVA), ethylene chlorotrifluoroethylene (ECTFE), polytetrafluoroethylene (PTFE), polybutylene terephthalate (PBT), polychlorotrifluoroethylene (PCTFE), and polyethylene terephthalate glycol (PETG).

In some embodiments, the separator plates may be formed of one or more metals.

In some embodiments, the separator plates may include at least one of aluminum, aluminum alloy, copper, copper alloy, tin, tin alloy, titanium, titanium alloy, tungsten, tungsten alloy, zinc, zinc alloy, steel, and stainless steel.

In some embodiments, when viewed in the axial direction, the tensioning members may encircle the cells such that the cells are spaced apart from the tensioning members.

According to some embodiments, a $CO_x$ electrolyzer frame ("frame") may include a main body portion, an opening, a first fluidic passage, a first recess, a second recess, and a first connecting riser. The main body portion may have a first surface opposing a second surface in an axial direction. The opening may extend through a central region of the main body portion in the axial direction. The first fluidic passage extending through the main body portion in the axial direction. The first recess may be in the first surface. The first recess may be fluidically connected to the opening and may extend in a second direction transverse to the axial direction. The second recess may in the second surface. The second recess may be fluidically connected to the first fluidic passage and may extend in a third direction transverse to the axial direction. The first connecting riser may extend in the axial direction and may be fluidically interposed between the first recess and the second recess such that the opening is fluidically connected to the first fluidic passage.

In some embodiments, the frame may further include a third recess in the first surface. The third recess may encircle the opening and the first recess.

In some embodiments, when viewed in the axial direction, the second recess may cross underneath the third recess.

In some embodiments, the frame may further include a fourth recess in the first surface. The fourth recess may encircle the first fluidic passage.

In some embodiments, when viewed in the axial direction, the second recess may cross underneath the fourth recess.

In some embodiments, the frame may further include a fifth recess in the second surface and encircling the opening. When viewed in the axial direction, the first recess may cross above the fifth recess.

In some embodiments, the first recess may include a proximal end, a distal end, and a plurality of sidewalls connecting the proximal end and the distal end to one another. A first sidewall among the sidewalls may extend in a first oblique direction with respect to the second direction. A second sidewall among the sidewalls may extend in a second oblique direction with respect to the second direction. The second oblique direction may be different from the first oblique direction.

In some embodiments, the first connecting riser may extend into the proximal end of the first recess, and the distal end of the first recess may extend into the opening.

In some embodiments, the frame may further include a plurality of protrusions extending in the axial direction from a surface of the first recess. The surface may be recessed from the first surface.

In some embodiments, at least one of the protrusions may have a different cross-sectional area than at least another one of the protrusions.

In some embodiments, the protrusions may include one or more first protrusions, one or more second protrusions, and at least one third protrusion. The one or more first protrusions may have respective first cross-sectional areas in a plane perpendicular to the axial direction. The one or more second protrusions may have respective second cross-sectional areas in the plane perpendicular to the axial direction. The second cross-sectional areas may be respectively smaller than the first cross-sectional areas. The at least one third protrusion may have a third cross-sectional area in the plane perpendicular to the axial direction. The third cross-sectional area may be smaller than each of the second cross-sectional areas. The one or more second protrusions may be disposed closer to the proximal end of the first recess than each of the one or more first protrusions and the at least one third protrusion. A majority of the one or more first protrusions may be disposed closer to the opening than each of the one or more second protrusions and the at least one third protrusion. The at least one third protrusion may be disposed between the one or more second protrusions and the majority of the one or more first protrusions.

In some embodiments, the third recess may include first sides extending generally in the second direction, and second sides extending between the first sides. Each of the second sides may include a first portion extending in a fourth direction transverse to the axial and second directions, a second portion extending from a first side of the first portion in a third oblique direction forming a first angle with the fourth direction, a third portion arcuately extending between and connecting the second portion to one of the first sides, a fourth portion extending from a second side of the first portion in a fourth oblique direction forming a second angle with the fourth direction, and a fifth portion arcuately extending between and connecting the fourth portion to another one of the first sides.

In some embodiments, the frame may further include a second fluidic passage extending through the main body portion in the axial direction, and a third fluidic passage extending through the main body portion in the axial direction. Within the frame, the second and third fluidic passages may be fluidically isolated from the first fluidic passage and the opening.

In some embodiments, the frame may further include a first protrusion extending from the second surface in the axial direction. The first fluidic passage, the second recess, and the first connecting riser may be formed in the first protrusion.

In some embodiments, the frame may further include a second protrusion extending from the second surface in the axial direction, and a third protrusion extending from the second surface in the axial direction. The second fluidic passage may extend through the second protrusion, and the third fluidic passage may extend through the third protrusion.

In some embodiments, the second fluidic passage may be arranged adjacent to a first side of the first fluidic passage. The third fluidic passage may be arranged adjacent to a second side of the first fluidic passage. The second side of the first fluidic passage may oppose the first side of the first fluidic passage in a fourth direction transverse to the axial direction and the second direction.

In some embodiments, the frame may further include a sixth recess in the first surface. The sixth recess may be fluidically connected to the first connecting riser and a proximal end of the first recess. The sixth recess may extend in a fourth direction transverse to the axial direction and the second direction.

In some embodiments, the frame may further include a second fluidic passage, a seventh recess, and a second connecting riser. The second fluidic passage may extend through the main body portion in the axial direction. The seventh recess may be in the second surface. The seventh recess may be fluidically connected to the second fluidic passage and may extend in a fifth direction transverse to the axial direction. The second connecting riser may extend in the axial direction and may be fluidically interposed between the seventh recess and the first recess such that the opening is fluidically connected to the second fluidic passage. The first connecting riser may be fluidically connected to a first side of the sixth recess. The second connecting riser may be fluidically connected to a second side of the sixth recess opposing the first side of the sixth recess in the fourth direction.

In some embodiments, the first recess may be one of a plurality of first recesses in the first surface that extend parallel to one another in the second direction.

In some embodiments, the first recesses may include a first group of the first recesses, a second group of the first recesses, and a third group of the first recesses. The first recesses of the first group may be spaced apart from one another according to a first pitch. The second group of the first recesses may be arranged adjacent to a first side of the first group of the first recesses. The first recesses of the second group may be spaced apart from one another according to a second pitch different from the first pitch. The third group of the first recesses may be arranged adjacent to a second side of the first group of the first recesses. The first recesses of the third group may be spaced apart from one another according to a third pitch different from the first and second pitches.

In some embodiments, the first pitch may be a constant pitch, the second pitch may be a first variable pitch, and the third pitch may be a second variable pitch.

In some embodiments, the first and second variable pitches may increase in size with increasing distance from the first group of the first recesses.

In some embodiments, the second recess may be one of a plurality of second recesses in the second surface extending parallel to one another in the third direction.

In some embodiments, the seventh recess may be one of a plurality of seventh recesses in the second surface extending parallel to one another in the fifth direction, and the third and fifth directions may extend obliquely with respect to the second direction.

In some embodiments, the frame may further include a third fluidic passage, a fourth fluidic passage, eighth recesses, and ninth recesses. The third fluidic passage may extend through the main body portion in the axial direction and may being separated from the first fluidic passaged by a first septal wall. The fourth fluidic passage may extend through the main body portion in the axial direction and may be separated from the second fluidic passaged by a second septal wall. The eighth recesses may be in the second surface and may extend parallel to one another in a sixth direction. The eighth recesses may be fluidically interposed between the third fluidic passage and the first connecting riser such that the third fluidic passage is fluidically connected to the opening. The ninth recesses may be in the second surface and may extending parallel to one another in a seventh direction. The ninth recesses may be fluidically interposed between the fourth fluidic passage and the second connecting riser such that the fourth fluidic passage is fluidically connected to the opening.

In some embodiments, the third direction may form a first oblique angle with respect to the second direction, the fifth direction may form a second oblique angle with respect to the second direction, the second oblique angle may be different from the first oblique angle, the sixth direction may form a third oblique direction with respect to the second direction, the third oblique angle may be different from the first and second oblique angles, the ninth direction may forms a fourth oblique direction with respect to the second direction, and the fourth oblique angle may be different from the first to third oblique angles.

In some embodiments, the first oblique angle may be greater than the third oblique angle, the second oblique angle may be greater than the fourth oblique angle, an absolute value of the first and second oblique angles may be substantially equivalent, and an absolute value of the third and fourth oblique angles may be substantially equivalent.

In some embodiments, the frame may further include a tenth recess in the second surface, an eleventh recess in the second surface, and a twelfth recess in the first surface. The fourth recess may encircle the first fluidic passage and the third fluidic passage. The tenth recess may encircle the first fluidic passage, the third fluidic passage, the second recesses, the eighth recesses, and the first connecting riser. The eleventh recess may encircle the second fluidic passage, the fourth fluidic passage, the seventh recesses, the ninth recesses, and the second connecting riser. The twelfth recess may encircle the second fluidic passage and the fourth fluidic passage. When viewed in the axial direction, the second recesses and the eighth recesses may cross underneath the fourth recess, and the seventh recesses and the ninth recesses may cross underneath the twelfth recess.

In some embodiments, the frame may further include a fifth fluidic passage extending through the main body portion in the axial direction. Within the frame, the fifth fluidic passage may be fluidically isolated from the first fluidic passage, the second fluidic passage, and the opening.

In some embodiments, the first fluidic passage may be arranged adjacent to a first side of the fifth fluidic passage. The second fluidic passage may be arranged adjacent to a second side of the fifth fluidic passage. The second side of the fifth fluidic passage may oppose the first side of the fifth fluidic passage in the fourth direction.

In some embodiments, the frame may further include a plurality of first fastener orifices arranged in a peripheral area of the main body portion and encircling the opening.

In some embodiments, the frame may further include a plurality of second fastener orifices arranged in an intermediate area interposed between the first opening and the peripheral area. A pitch between adjacent second fastener orifices among the second fastener orifices may be smaller than a pitch between adjacent first fastener orifices among the first fastener orifices.

In some embodiments, the first and second fastener orifices may be counterbored.

In some embodiments, the frame may be formed of one or more polymers.

In some embodiments, the frame may include at least one of polyethylene terephthalate (PET), polycarbonate (PC), polyimide (PI), polyamide (PA), poly(methylmethacrylate) (PMMA), polyethylene naphthalate (PEN), polyetherketone (PEK), polyetheretherketone (PEEK), polystyrene (PS), polyetherimide (PEI), polyphenylene sulfide (PPS), polyarylate (PAR), polyether sulfone (PES), cyclic olefin copolymer (COC), polyvinyl alcohol (PVA), ethylene chlorotrifluoroethylene (ECTFE), polytetrafluoroethylene (PTFE), polybutylene terephthalate (PBT), polychlorotrifluoroethylene (PCTFE), and polyethylene terephthalate glycol (PETG).

According to some embodiments, a $CO_x$ electrolyzer apparatus ("apparatus") includes a first end assembly, a second end assembly, and a plurality of $CO_x$ electrolyzer cells ("cells"). The second end assembly is coupled to the first end assembly. The plurality of $CO_x$ electrolyzer cells ("cells") are interposed between the first end assembly and the second end assembly and arranged in a stack along an axial direction. Each cell among the cells is configured to reduce input gaseous $CO_x$ into one or more byproducts. In an operational state of the $CO_x$ electrolyzer apparatus in which the cells reduce the input gaseous $CO_x$ into the one or more byproducts, the second end assembly is configured to expand in the axial direction in response to accumulation of one or more control fluids in an internal cavity of the second end assembly. The expansion of the second end assembly is configured to constrain expansion of the cells in the axial direction. A flow path of the one or more control fluids is fluidically connected to a flow path of the input gaseous $CO_x$.

In some embodiments, each cell among the cells may include a membrane electrode assembly ("MEA"), a cathode frame, a cathode flow field, a cathode gas diffusion layer (GDL), an anode frame, an anode flow field, and an anode porous transport layer (PTL). The MEA may have a cathodic part, an anodic part, and a separator between the cathodic part and the anodic part. The cathode frame may be adjacent to the cathodic part. The cathode flow field may be at least partially disposed in a first opening in the cathode frame. The cathode GDL may be adjacent to the cathode frame and may cover the cathode flow field. The anode frame may be adjacent to the anodic part of the MEA. The anode flow field may be at least partially disposed in a second opening in the anode frame. The anode PTL may be adjacent to the anode frame and may cover the anode flow field.

In some embodiments, the second end assembly may include a first plate, a first gasket, and a second plate. The first plate may include a recess in a central portion of the first plate, a second recess encircling a central region of the central portion, and a first orifice configured to receive one or more control fluids. The first gasket may be at least partially disposed in the second recess. The second plate may be slidably disposed in the first recess and may be configured to abut against the first gasket and/or a recessed surface of the first recess facing the second plate in the axial direction such that the first recess, the first gasket, and the second plate define a cavity internal to the second end assembly. A distance in the axial direction between the second plate and the recessed surface of the first recess may be configured to increase in response to the accumulation of the one or more control fluids in the cavity.

In some embodiments, the second plate may be a first bus plate configured to receive a first electric potential, and the first plate may be an insulation plate configured to electrically insulate the first bus plate from at least one other component of the first and/or second end assemblies.

In some embodiments, the second end assembly may further include a second end plate. The first plate may be interposed between the second plate and the second end plate.

In some embodiments, the first insulation plate may be coupled to the second end plate via a plurality of first fasteners.

In some embodiments, the first orifice may be formed in the recessed surface and may extend through the first plate in the axial direction.

In some embodiments, the second end plate may include a second orifice having a proximal end fluidically connected to the first orifice in the first plate and a distal end fluidically connected to a fluidic inlet coupling.

In some embodiments, the first and second orifices may be substantially aligned in the axial direction.

In some embodiments, the apparatus may further include a gasket interposed between the first plate and the second end plate. The gasket may encircle the first and second orifices to form a fluidic seal.

In some embodiments, the second end assembly may include a first plate, a piston, and one or more gaskets. The first plate may include a first main body, a first protrusion extending from the first main body in the axial direction, a first blind opening extending into a central portion of the first protrusion in a second direction opposite the axial direction, and at least one first orifice fluidically connected to the first blind opening and configured to receive one or more control fluids. The piston may include a second main body and a second protrusion extending from the second main body in the second direction, at least a portion of the second protrusion may be slidably received in at least a portion of the first blind opening in the first protrusion. The one or more gaskets may encircle the second protrusion and may be configured to interface with one or more outer sidewalls of the second protrusion and one or more inner sidewalls of the first blind opening such that the first opening, the second protrusion, and the at least one gasket define a cavity internal to the second end assembly. The first blind opening may terminate at a first recessed surface. The second protrusion may terminate at a first protruded surface facing the first recessed surface in the second direction. A distance in the axial direction between the first protruded surface and the first recessed surface may be configured to increase in response to the accumulation of the one or more control fluids in the cavity.

In some embodiments, the one or more gaskets may be a plurality of gaskets, and the gaskets may be offset from one another in the axial direction.

In some embodiments, the second protrusion may include one or more recesses extending into the one or more outer sidewalls of the second protrusion in one or more directions transverse to the axial direction. The one or more gaskets may be respectively supported in corresponding recesses among the one or more recesses.

In some embodiments, the second end assembly may further include a plurality of biasing members, the second protrusion may further include a plurality of second blind openings extending into the first protruded surface in the axial direction, and the first plate may further include a plurality of third protrusions extending from the first recessed surface in the axial direction. The biasing members may be respectively supported in the first blind opening via corresponding third protrusions among the third protrusions such that, in a first compressed state of the second end assembly, the biasing members may be compressed between the first protruded surface and the first recessed surface and respective portions of the third protrusions may at least partially extend into corresponding second blind openings among the second blind openings.

In some embodiments, respective widths of the second blind openings in a direction perpendicular to the axial direction may be greater than respective widths of the third protrusions in the direction perpendicular to the axial direction.

In some embodiments, respective heights of the third protrusions from the first recessed surface in the axial direction may be greater than respective depths of the second blind openings from the first protruded surface in the axial direction.

In some embodiments, the first plate may be a second end plate of the apparatus configured to be coupled to the first end plate via a plurality of tensioning members extending in the axial direction.

In some embodiments, the second end assembly may further include an insulation plate and a first bus plate sequentially stacked in the axial direction from the piston such that the first bus plate and the insulation plate are interposed between the cells and the piston. The first bus plate may be configured to receive a first electric potential. The insulation plate may be configured to electrically insulate the first bus plate from at least one other component of the second end assembly and/or the first end plate.

In some embodiments, the first bus plate and the insulation plate may be coupled to the piston via a plurality of fasteners.

In some embodiments, the at least one first orifice may be a plurality of first orifices configured to receive one or more control fluids.

In some embodiments, in the operational state of the apparatus, the cavity may be dead-headed.

In some embodiments, the first plate may further include at least one second orifice fluidically connected to the first blind opening. The at least one second orifice may be configured to bleed off excess accumulation of the one or more control fluids in the cavity in response to the accumulation of the one or more control fluids exceeding a predefined threshold.

In some embodiments, the one or more control fluids and the input gaseous $CO_x$ may be substantially equivalent.

In some embodiments, the apparatus may further include at least one source configured to input the gaseous $CO_x$ to the cells at a first pressure and the one or more control fluids to the second end assembly at a second pressure. The first and second pressures may be substantially equivalent.

In some embodiments, the apparatus may further include at least one source configured to input the gaseous $CO_x$ to the cells at a first pressure and the one or more control fluids to the second end assembly at a second pressure. At steady state, the first and second pressures may be in equilibrium.

In some embodiments, the at least one source may be configured to input the gaseous $CO_x$ to the cells and the one or more control fluids to the second end assembly substantially simultaneously.

In some embodiments, the at least one source may be configured to delay the input of the one or more control fluids with respect to the input of the gaseous $CO_x$.

In some embodiments, the at least one source may be configured to delay the input of the one or more control fluids until the expansion of the cells reaches a defined threshold.

In some embodiments, the flow path of the one or more control fluids may not be routed through the cells.

The foregoing general description and the following detailed description are illustrative and explanatory and are intended to provide further explanation of the claimed subject matter.

BRIEF DESCRIPTION OF THE DRAWINGS

Various embodiments disclosed herein are illustrated by way of example, and not by way of limitation, in the figures of the accompanying drawings, in which like reference numerals refer to similar elements.

FIG. 104 depicts a perspective view of an example end plate of the example piston side assembly of FIG. 101.

FIGS. 105 and 106 depict a top and bottom plan views of the example end plate of FIG. 104.

FIG. 107 depicts a perspective view of an example piston of the piston side assembly of FIG. 101.

FIGS. 108 and 109 depict top and bottom plan views of the example piston of FIG. 107.

DETAILED DESCRIPTION OF SOME EMBODIMENTS $CO_x$ electrolyzers, e.g., $CO_2$ electrolyzers, using membrane electrode assemblies may share some structural similarities with existing polymer electrolyte membrane (PEM) water electrolyzers, although there are several respects in which $CO_x$ electrolyzers may differ significantly from such PEM water electrolyzer systems.

In a typical $CO_x$ electrolyzer, a membrane electrode assembly (MEA) may be one of multiple elements that are stacked together in what may be referred to as a "cell"; in the discussion below, the term "cell" is used to refer to this multi-element assembly.

Figure 1:
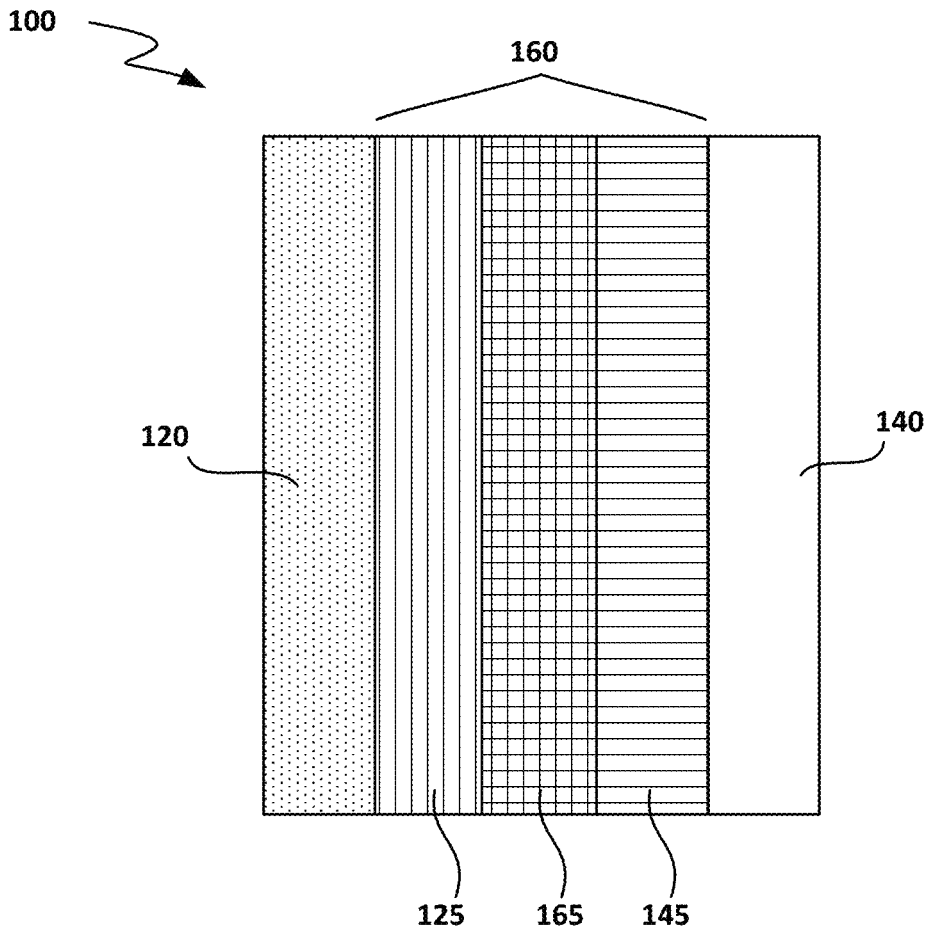
FIG. 1 depicts a diagram of an example MEA for use in $CO_x$ reduction.

An example MEA 100 for use in $CO_x$ reduction is shown in FIG. 1. The MEA 100 has a cathode layer 120 and an anode layer 140 separated by an ion-conducting polymer layer 160 that provides a path for ions to travel between the cathode layer 120 and the anode layer 140. In certain embodiments, the cathode layer 120 includes an anion-conducting polymer and/or the anode layer 140 includes a cation-conducting polymer. In certain embodiments, the cathode layer 120 and/or the anode layer 140 of the MEA 100 are porous. The pores may facilitate gas and/or fluid transport and may increase the amount of catalyst surface area that is available for reaction.

The ion-conducting layer 160 may, for example, include two or three sublayers: a polymer electrolyte membrane (PEM) 165, an optional cathode buffer layer 125, and/or an optional anode buffer layer 145. One or more layers in the ion-conducting layer 160 may be porous. In certain embodiments, at least one layer is nonporous so that reactants and products of the cathode cannot pass via gas and/or liquid transport to the anode and vice versa. In certain embodiments, the PEM layer 165 is nonporous. Example characteristics of anode buffer layers and cathode buffer layers are provided elsewhere herein. In some cases, the ion-conducting layer 160 includes only a single layer or two sublayers.

Figure 2:
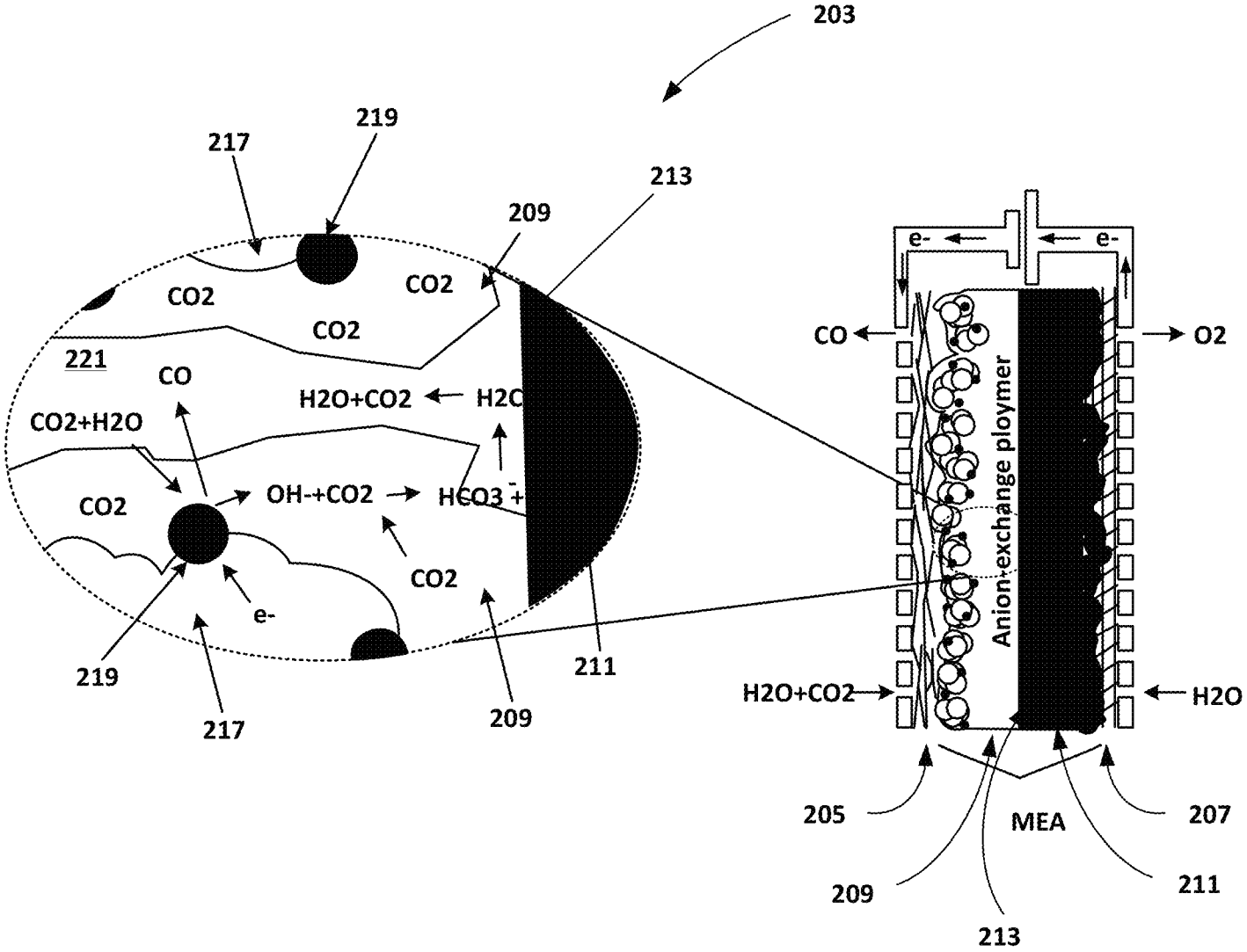
FIG. 2 depicts a $CO_2$ electrolyzer configured to receive water and $CO_2$ as a reactant at a cathode and expel CO as a byproduct.

FIG. 2 shows $CO_2$ electrolyzer 203 configured to receive water ($H_2O$) and $CO_2$ (e.g., humidified or dry gaseous $CO_2$) as a reactant at a cathode 205 and expel CO as a product. Electrolyzer 203 is also configured to receive water as a reactant at an anode 207 and expel gaseous oxygen ($O_2$). Electrolyzer 203 includes bipolar layers having an anion-conducting polymer 209 adjacent to cathode 205 and a cation-conducting polymer 211 (illustrated as a proton-exchange membrane) adjacent to anode 207.

As illustrated in the magnification inset of a bipolar interface 213 in electrolyzer 203, the cathode 205 includes an anion exchange polymer (which, in this example, is the same anion-conducting polymer 209 that is in the bipolar layers), electronically conducting carbon support particles 217, and metal nanoparticles 219 supported on the support particles. $CO_2$ and water are transported via pores (such as pore 221) and reach metal nanoparticles 219 where they react, in this case with hydroxide ($OH^-$) ions, to produce bicarbonate (HCO 3) ions and reduction reaction products (not shown). $CO_2$ may also reach metal nanoparticles 219 by transport within anion exchange polymer 209.

Hydrogen ions are transported from anode 207, and through the cation-conducting polymer 211, until they reach bipolar interface 213, where they are hindered from further transport toward the cathode 205 by anion exchange polymer 209. At interface 213, the hydrogen ions may react with bicarbonate or carbonate ions to produce carbonic acid ($H_2CO_3$), which may decompose to produce $CO_2$ and water. As explained herein, the resulting $CO_2$ may be provided in gas phase and may be provided with a route in the MEA back to the cathode 205 where it can be reduced. The cation-conducting polymer 211 hinders transport of anions, such as bicarbonate ions, to the anode 207 where they could react with protons and release $CO_2$, which would be unavailable to participate in a reduction reaction at the cathode 205.

As illustrated, a cathode buffer layer having an anion-conducting polymer may work in concert with the cathode 205 and its anion-conductive polymer to block transport of protons to the cathode 205. While MEAs employing ion conducting polymers of appropriate conductivity types in the cathode 205 and cathode buffer layer may hinder transport of cations to the cathode 205 and, if present, an anode buffer layer may similarly hinder transport of the anions to the anode 207, cations and anions may still come in contact in the MEA's interior regions, such as in the membrane layer.

As illustrated in FIG. 2, bicarbonate and/or carbonate ions combine with hydrogen ions between the cathode layer and the anode layer to form carbonic acid, which may decompose to form gaseous $CO_2$. It has been observed that MEAs sometimes delaminate, possibly due to this production of gaseous $CO_2$, which does not have an easy egress path.

The delamination issue can be addressed by employing a cathode buffer layer having inert filler and associated pores. One possible explanation of its effectiveness is that the pores create paths for the gaseous carbon dioxide to escape back to the cathode 205 where it can be reduced. In some embodiments, the cathode buffer layer is porous, but at least one layer between the cathode layer and the anode layer is nonporous. This can prevent the passage of gases and/or bulk liquid between the cathode and anode layers while preventing delamination. For example, the nonporous layer can prevent the direct passage of water from the anode 207 to the cathode 205. The porosity of various layers in an MEA is described further at other locations herein.

Examples of Bipolar MEAs

As an example, an MEA includes a cathode layer including a reduction catalyst and a first anion-conducting polymer (e.g., Sustainion, FumaSep FAA-3, or Tokuyama anion exchange polymer), an anode layer including an oxidation catalyst and a first cation-conducting polymer (e.g., PFSA polymer), a membrane layer including a second cation-conducting polymer and arranged between the cathode layer and the anode layer to conductively connect the cathode layer and the anode layer, and a cathode buffer layer including a second anion-conducting polymer (e.g., Sustainion, FumaSep FAA-3, or Tokuyama anion exchange polymer) and arranged between the cathode layer and the membrane layer to conductively connect the cathode layer and the membrane layer. In this example, the cathode buffer layer can have a porosity between about 1 and 90 percent by volume but can additionally or alternatively have any suitable porosity (including, e.g., no porosity). In other examples the cathode buffer layer can have any suitable porosity (e.g., between 0.01-95%, 0.1-95%, 0.01-75%, 1-95%, 1-90%, etc.).

Too much porosity can lower the ionic conductivity of the buffer layer. In some embodiments, the porosity is 20% or below, and in particular embodiments, between 0.1-20%, 1-10%, or 5-10%. Porosity in these ranges can be sufficient to allow movement of water and/or $CO_2$ without losing ionic conductivity. Porosity may be measured as described further below.

In a related example, the membrane electrode assembly can include an anode buffer layer that includes a third cation-conducting polymer, and is arranged between the membrane layer and the anode layer to conductively connect the membrane layer and the anode layer. The anode buffer layer preferably has a porosity between about 1 and 90 percent by volume, but can additionally or alternatively have any suitable porosity (including, e.g., no porosity). However, in other arrangements and examples, the anode buffer layer can have any suitable porosity (e.g., between 0.01-95%, 0.1-95%, 0.01-75%, 1-95%, 1-90%). As with the cathode buffer layer, in some embodiments, the porosity is 20% or below, e.g. 0.1-20%, 1-10%, or 5-10%.

In an example, an anode buffer layer may be used in an MEA having a cathode catalyst layer with anion exchange polymer, a cathode buffer layer with anion-exchange polymer, a membrane with cation-exchange polymer, and an anode buffer layer with anion-exchange polymer. In such a structure, the anode buffer layer may be porous to facilitate water transport to the membrane/anode buffer layer interface. Water will be split at this interface to make protons that travel through the membrane and hydroxide that travels to the anode catalyst layer. In some cases, at least one catalyst (e.g., a carbon catalyst, a metal catalyst, etc.) may be utilized to promote the splitting of the water at this interface. For instance, the at least one catalyst may include a cobalt-based catalyst, an iron-nickel-based catalyst, a palladium-based catalyst, platinum-based catalyst, ruthenium (IV) dioxide ($RuO_2$), nickel-stabilized, ruthenium dioxide (Ni—$RuO_2$), iridium (IV) dioxide ($IrO_2$), graphene, graphene oxide (GO), reduced graphene oxide (rGO), graphitic carbon nitride (g-$C_3N_4$), graphene quantum dots (GQDs), graphene quantum sheets (GQSs), and/or the like. One advantage of this structure is the potential use of low-cost water oxidation catalysts (e.g., $NiFeO_x$) that are only stable in basic conditions.

In another specific example, the membrane electrode assembly includes a cathode layer including a reduction catalyst and a first anion-conducting polymer (e.g., Sustainion, FumaSep FAA-3, Tokuyama anion exchange polymer), an anode layer including an oxidation catalyst and a first cation-conducting polymer, a membrane layer including a second anion-conducting polymer (e.g., Sustainion, FumaSep FAA-3, Tokuyama anion exchange polymer) and arranged between the cathode layer and the anode layer to conductively connect the cathode layer and the anode layer, and an anode buffer layer including a second cation-conducting polymer and arranged between the anode layer and the membrane layer to conductively connect the anode layer and the membrane layer.

An MEA containing an anion-exchange polymer membrane and an anode buffer layer containing cation-exchange polymer may be used for CO reduction. In this case, water would form at the membrane/anode buffer layer interface. Pores in the anode buffer layer could facilitate water removal. One advantage of this structure would be the use of an acid-stable (e.g., $IrO_x$) water oxidation catalyst.

In a related example, the membrane electrode assembly can include a cathode buffer layer that includes a third anion-conducting polymer and is arranged between the cathode layer and the membrane layer to conductively connect the cathode layer and the membrane layer. The third anion-conducting polymer can be the same or different from the first and/or second anion-conducting polymer. The cathode buffer layer preferably has a porosity between about 1 and 90 percent by volume but can additionally or alternatively have any suitable porosity (including, e.g., no porosity). However, in other arrangements and examples, the cathode buffer layer can have any suitable porosity (e.g., between 0.01-95%, 0.1-95%, 0.01-75%, 1-95%, 1-90%). In some embodiments, the porosity is 20% or below, and in particular embodiments, between 0.1-20%, 1-10%, or 5-10%.

In an example, a cathode catalyst layer composed of Au nanoparticles 4 nm in diameter supported on Vulcan XC72 or XC72R carbon and mixed with TM1 (mTPN-1) anion exchange polymer electrolyte may be used. The cathode catalyst layer may be about 15 μm thick, have a gold to gold+carbon ratio by weight (Au/(Au+C)) of 20%, have a TM1 to catalyst mass ratio of 0.32, have mass loading of 1.4-1.6 mg/cm$^2$ (total Au+C), and have estimated porosity of 0.56. In another example, an anion-exchange polymer layer composed of TM1 and PTFE particles may be provided. The PTFE particles may be approximately 200 nm in diameter and the TM1 molecular weight may be approximately 30 k-45 k. The thickness of such an example anion-exchange polymer layer may be about 15 μm, and the PTFE particles may introduce a porosity of about 8%. A proton-exchange membrane layer composed of perfluorosulfonic acid polymer (e.g., Nafion 115 or Nafion 117) may also be provided, with a thickness of approximately 100 μm to approximately 200 μm. The proton-exchange membrane may form a continuous layer that prevents significant movement of gas ($CO_2$, CO, $H_2$) through the layer. An anode catalyst layer composed of Ir or $IrO_x$ nanoparticles (100-200 nm aggregates) that is 10 μm thick may also be provided. $CO_x$ Anion Exchange Membrane-Only MEA for $CO_x$ Reduction In some embodiments, an MEA does not contain a cation-conducting polymer layer. In such embodiments, the electrolyte is not a cation-conducting polymer and the anode, if it includes an ion-conducting polymer, does not contain a cation-conducting polymer. Various examples thereof are provided below.

An AEM-only MEA allows conduction of anions across the MEA. In embodiments in which none of the MEA layers has significant conductivity for cations, hydrogen ions have limited mobility in the MEA. In some implementations, an AEM-only membrane provides a neutral or an alkaline pH environment (e.g., at least about pH 7) and may facilitate $CO_2$ and/or CO reduction by suppressing the hydrogen evolution parasitic reaction at the cathode. As with other MEA designs, the AEM-only MEA allows ions, notably anions such as hydroxide, bicarbonate, or carbonate ions, to move through polymer-electrolyte. The pH may be lower in some embodiments; a pH of 4 or greater may be sufficient to suppress hydrogen evolution. The AEM-only MEA also permits electrons to move to, and through, metal and carbon in catalyst layers. In embodiments, the AEM-only MEA may include pores in the anode layer, pores in the cathode layer, and/or pores in the PEM, thereby permitting liquids and gas to move through such pores.

In certain embodiments, the AEM-only MEA comprises an anion-exchange polymer electrolyte membrane positioned between a cathode and an anode. The cathode and the anode are each electrocatalyst layers. In some embodiments, one or both electrocatalyst layers also contain anion-exchange polymer-electrolyte.

In certain embodiments, an AEM-only MEA is formed by depositing cathode and anode electrocatalyst layers onto porous conductive supports, such as gas diffusion layers, porous transport layers, and/or the like, to form gas diffusion electrodes (GDEs). An anion-exchange membrane is then sandwiched between the gas diffusion electrodes.

In certain embodiments, an AEM-only MEA is used for $CO_2$ reduction. The use of an anion-exchange polymer electrolyte avoids a low pH environment that disfavors $CO_2$ reduction. Further, water is transported away from the cathode catalyst layer when an AEM is used, thereby preventing water build up (flooding) which can block reactant gas transport in the cathode of the cell.

Water transport in the MEA occurs through a variety of mechanisms, including diffusion and electro-osmotic drag. In some embodiments, at current densities of the $CO_2$ electrolyzers described herein, electro-osmotic drag is the dominant mechanism. Water is dragged along with ions as they move through the polymer electrolyte. For a cation-exchange membrane such as Nafion membrane, the amount of water transport is well characterized and understood to rely on the pre-treatment/hydration of the membrane. Protons move from positive to negative potential (anode to cathode) with each carrying 2-4 water molecules with it, depending on pretreatment.

In certain embodiments, an AEM-only MEA may be employed in CO reduction reactions. Unlike the $CO_2$ reduction reaction, CO reduction does not produce carbonate or bicarbonate anions that could transport to the anode and release valuable reactant.

Figure 3:
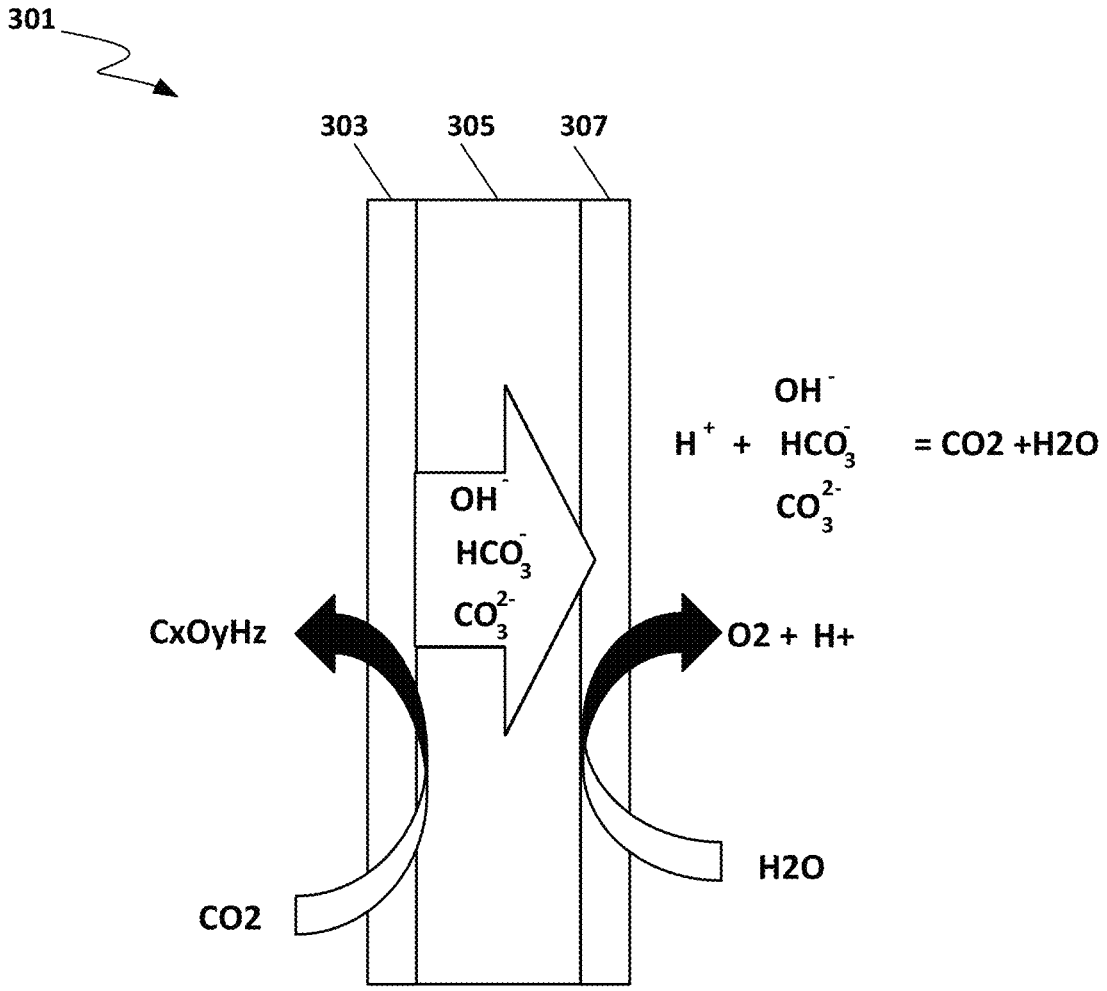
FIG. 3 depicts an example construction of a $CO_2$ reduction MEA having a cathode catalyst layer, an anode catalyst layer, and an anion-conducting PEM.

FIG. 3 illustrates an example construction of a $CO_2$ reduction MEA 301 having a cathode catalyst layer 303, an anode catalyst layer 305, and an anion-conducting PEM 307. In certain embodiments, cathode catalyst layer 303 may include metal catalyst particles (e.g., nanoparticles) that are unsupported or supported on a conductive substrate such as carbon particles. In some implementations, cathode catalyst layer 303 additionally includes an anion-conducting polymer. The metal catalyst particles may catalyze $CO_2$ reduction, particularly at or within a non-acidic environment. In certain embodiments, anode catalyst layer 305 includes metal oxide catalyst particles (e.g., nanoparticles) that are unsupported or supported on a conductive substrate such as metal oxides, carbides, etc. In some implementations, the anode catalyst layer 305 may additionally include an anion-conducting polymer. Examples of metal oxide catalyst particles for anode catalyst layer 305 may include iridium oxide, nickel oxide, nickel iron oxide, iridium ruthenium oxide, platinum oxide, and the like. The anion-conducting PEM 307 may include any of various anion-conducting polymers such as, for example, HNNS/HNN8 by Ionomr, FumaSep by Fumatech, TM1 by Orion, PAP-TP by W7energy, Sustainion by Dioxide Materials, and the like. These and other anion-conducting polymers that have an ion exchange capacity (IEC) ranging from 1.1 to 2.6, working pH ranges from 0-14, limited solubility in some organic solvents, reasonable thermal stability and mechanical stability, good ionic conductivity/ASR, and acceptable water uptake/swelling ratio may be used. The polymers may be chemically exchanged to certain anions, such as bicarbonate, carbonate, etc., instead of halogen anions prior to use.

As illustrated in FIG. 3, $CO_2$, such as $CO_2$ gas, may be provided to cathode catalyst layer 303. In certain embodiments, the $CO_2$ may be provided via a gas diffusion electrode. At the cathode catalyst layer 303, the $CO_2$ reacts to produce a reduction product indicated generically as $C_xO_yH_z$. Anions produced at the cathode catalyst layer 303 may include hydroxide, carbonate, and/or bicarbonate. These may diffuse, migrate, or otherwise move to the anode catalyst layer 305. At the anode catalyst layer 305, an oxidation reaction may occur such as oxidation of water or hydroxide ion to produce diatomic oxygen and hydrogen ions or water. In some applications, the hydrogen ions may react with hydroxide, carbonate, and/or bicarbonate to produce water, carbonic acid, and/or $CO_2$. In some cases, fewer interfaces may provide lower resistance for the reaction(s) to occur. In some embodiments, a relatively highly basic environment (e.g., at least a pH above 7) is maintained for C2 and C3 hydrocarbon synthesis.

Figure 4:
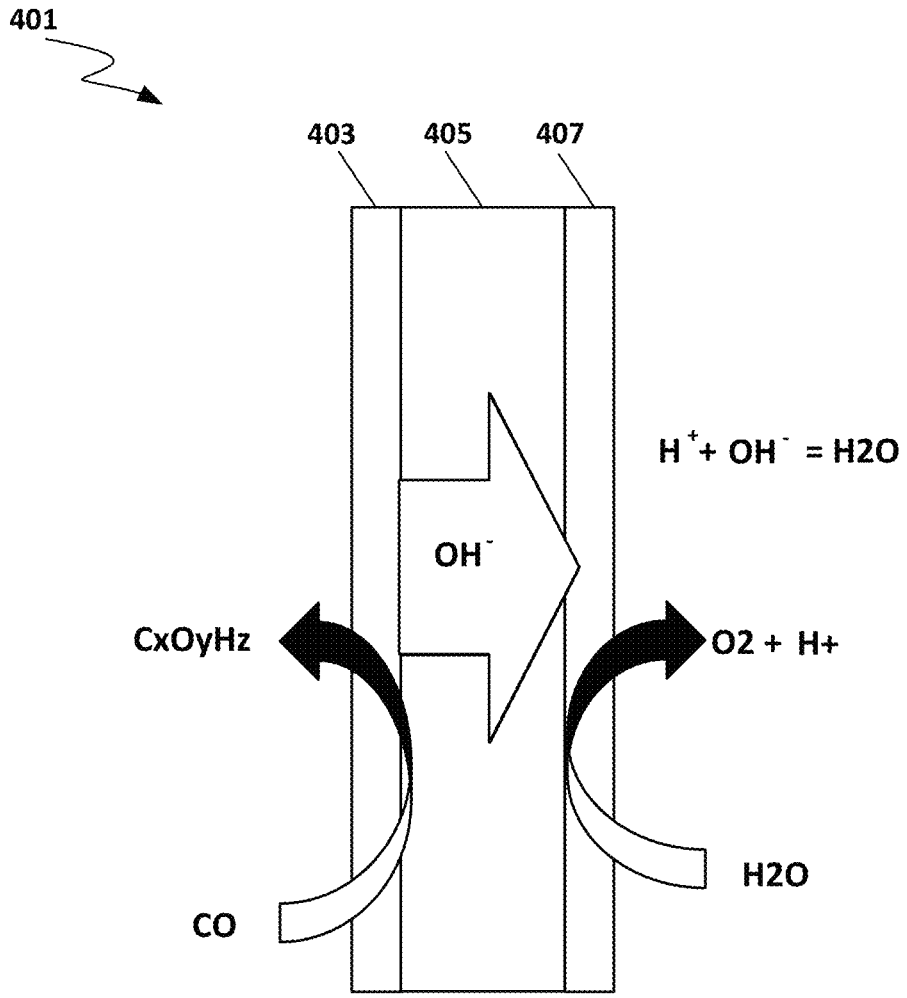
FIG. 4 depicts an example construction of a CO reduction MEA having a cathode catalyst layer, an anode catalyst layer, and an anion-conducting PEM.

FIG. 4 illustrates an example construction of a CO reduction MEA 401 having a cathode catalyst layer 403, an anode catalyst layer 405, and an anion-conducting PEM 407. Overall, the constructions of MEA 401 may be similar to that of MEA 301 in FIG. 3. However, the cathode catalyst may be chosen to promote a CO reduction reaction, which means that different reduction catalysts would be used in CO and $CO_2$ reduction embodiments.

In some embodiments, an AEM-only MEA may be advantageous for CO reduction. The water uptake number of the AEM material can be selected to help regulate moisture at the catalyst interface, thereby improving CO availability to the catalyst. AEM-only membranes can be favorable for CO reduction due to this reason. Bipolar membranes can be more favorable for $CO_2$ reduction due to better resistance to $CO_2$ dissolving and crossover in basic anolyte media.

In various embodiments, cathode catalyst layer 403 may include metal catalyst particles (e.g., nanoparticles) that are unsupported or supported on a conductive substrate such as carbon particles. In some implementations, cathode catalyst layer 403 may additionally include an anion-conducting polymer. In certain embodiments, anode catalyst layer 405 includes metal oxide catalyst particles (e.g., nanoparticles) that are unsupported or supported on a conductive substrate such as metal oxides, carbides, etc. In some implementations, the anode catalyst layer 405 may additionally include an anion-conducting polymer. Examples of metal oxide catalyst particles for anode catalyst layer 405 may include those identified for the anode catalyst layer 305 of FIG. 3. Anion-conducting PEM 407 may include any of various anion-conducting polymers such as, for example, those identified for the PEM 307 of FIG. 3.

As illustrated in FIG. 4, CO gas may be provided to cathode catalyst layer 403. In certain embodiments, the CO may be provided via a gas diffusion electrode. At the cathode catalyst layer 403, the CO may react to produce a reduction product indicated generically as $C_xO_yH_z$.

Anions produced at the cathode catalyst layer 403 may include hydroxide ions. These may diffuse, migrate, or otherwise move to the anode catalyst layer 405. At the anode catalyst layer 405, an oxidation reaction may occur such as oxidation of water or hydroxide ion to produce diatomic oxygen and hydrogen ions or water. In some applications, the hydrogen ions may react with hydroxide ions to produce water.

While the general configuration of the MEA 401 is similar to that of MEA 301, there are certain differences in the MEAs. For $CO_2$ reduction, a significant amount of $CO_2$ may be dissolved and then transferred to the anode for an AEM-only MEA such as shown in FIG. 3. For CO reduction, there is less likely to be significant CO gas crossover. In this case, the reaction environment for CO reduction could be more basic than the reaction environment for $CO_2$ reduction. MEA materials, including the catalyst, may be selected to have good stability in high pH environments.

Example of AEM-Only MEA

1. Copper metal (40 nm thick Cu, about 0.05 mg/cm$^2$) was deposited onto a porous carbon sheet (Sigracet 39BC gas diffusion layer) via electron beam deposition. Ir metal nanoparticles were deposited onto a porous titanium sheet at a loading of 3 mg/cm$^2$ via drop casting or ultrasonic spray deposition. An anion-exchange membrane from Ionomr (25-50 μm, 80 mS/cm$^2$ OH— conductivity, 2-3 mS/cm$^2$ $HCO_3^-$ conductivity, 33-37% water uptake) was sandwiched between the porous carbon and titanium sheets with the electrocatalyst layers facing the membrane.

2. Sigma Aldrich 80 nm spherical Cu nanoparticles, mixed with FAA-3 anion exchange solid polymer electrolyte from Fumatech, FAA-3 to catalyst mass ratio of 0.10, setup as described above.

U.S. Patent Application Publication No. US 2017/0321334, published Nov. 9, 2017, and U.S. Patent Application Publication No. 20190226103, published Jul. 25, 2019, which describe various features and examples of MEAs, are incorporated herein by reference in their entireties. All publications referred to herein are incorporated by reference in their entireties as if fully set forth herein.

Multi-Cell $CO_x$ Electrolyzer Stacks

While the above discussion has provided a general overview of various aspects of $CO_x$ MEA construction and characteristics, the following discussion is intended to address aspects of multi-cell $CO_x$ electrolyzer stacks.

Figure 5:
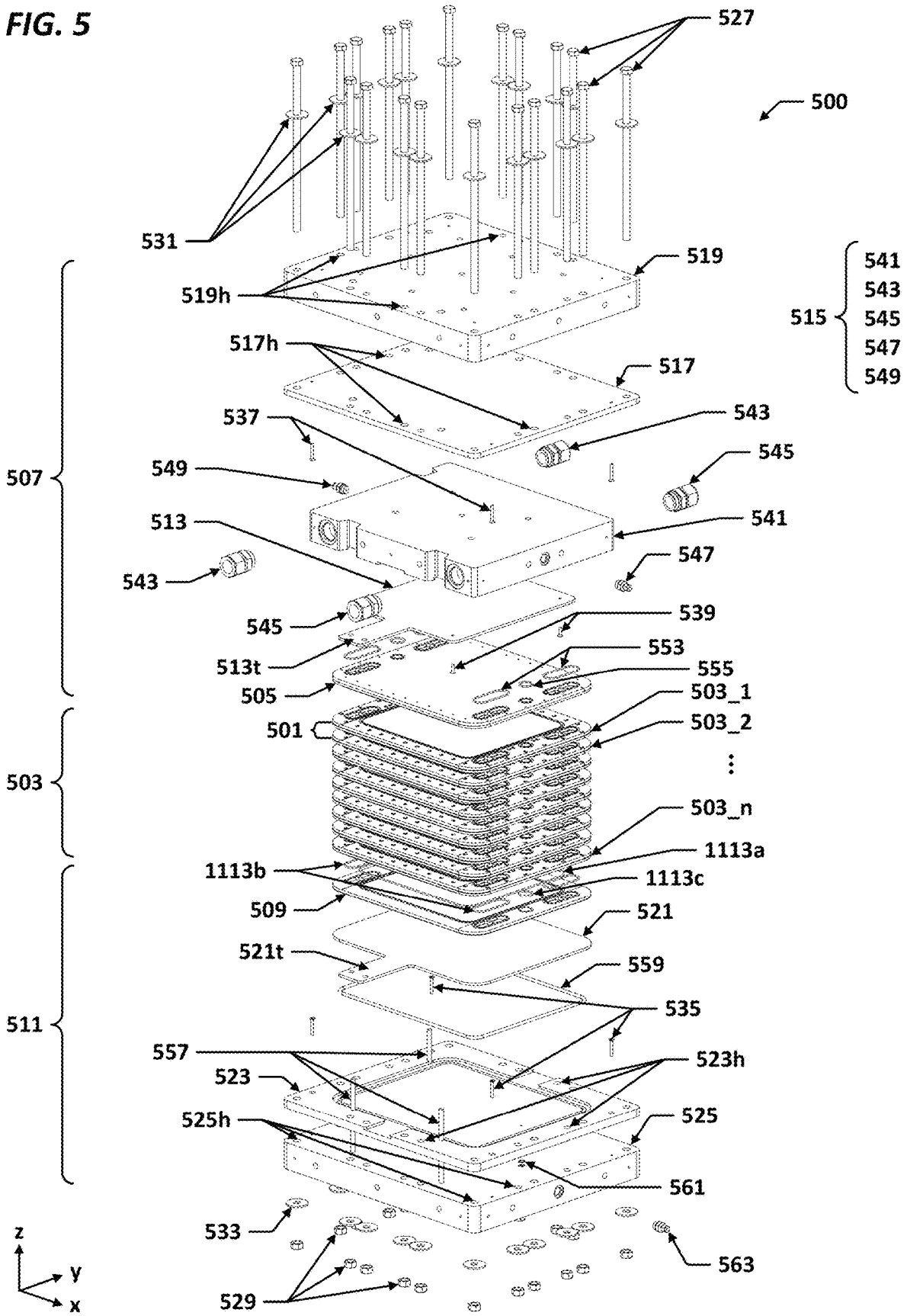
FIG. 5 depicts an exploded view of an example multi-cell $CO_x$ electrolyzer stack.
Figure 6:
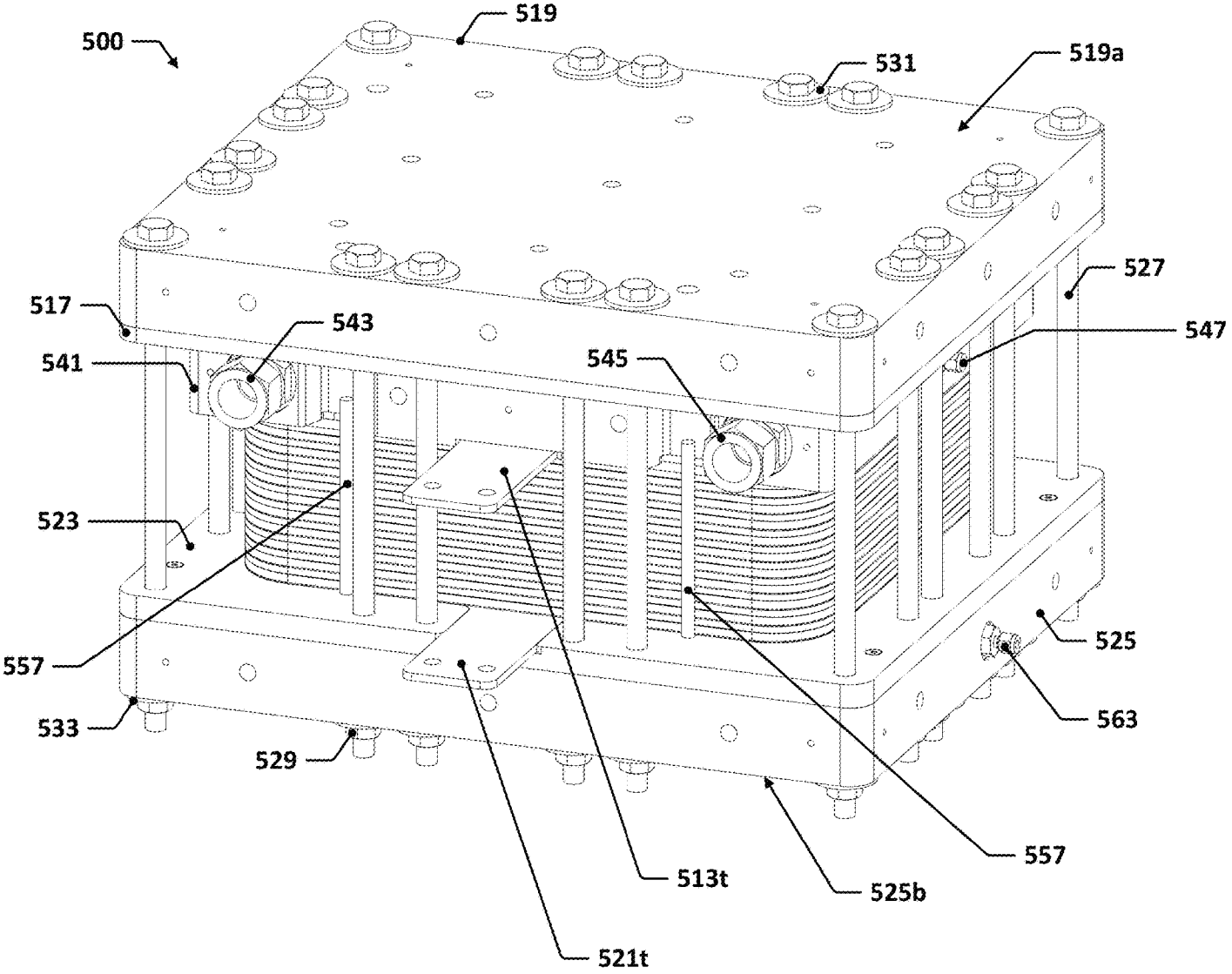
FIG. 6 depicts a perspective view of the example multi-cell $CO_x$ electrolyzer of FIG. 5.
Figure 7:
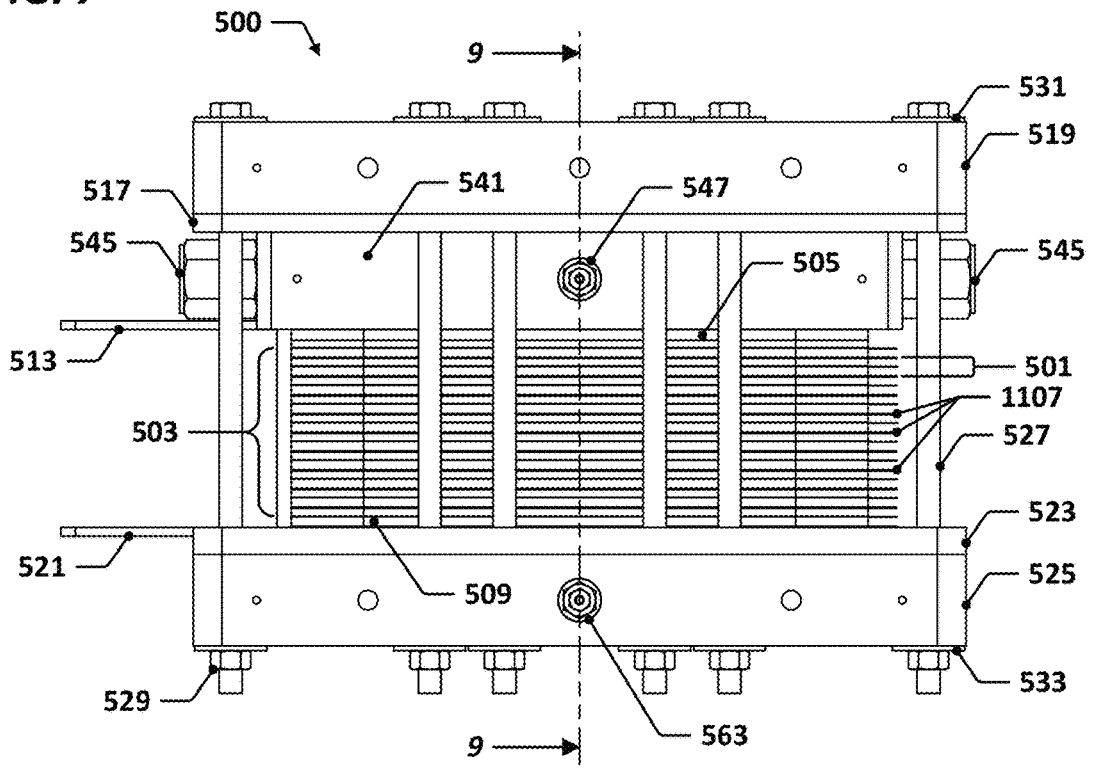
FIGS. 7 and 8 depict side views of the example multi-cell $CO_x$ electrolyzer of FIG. 6.
Figure 8:
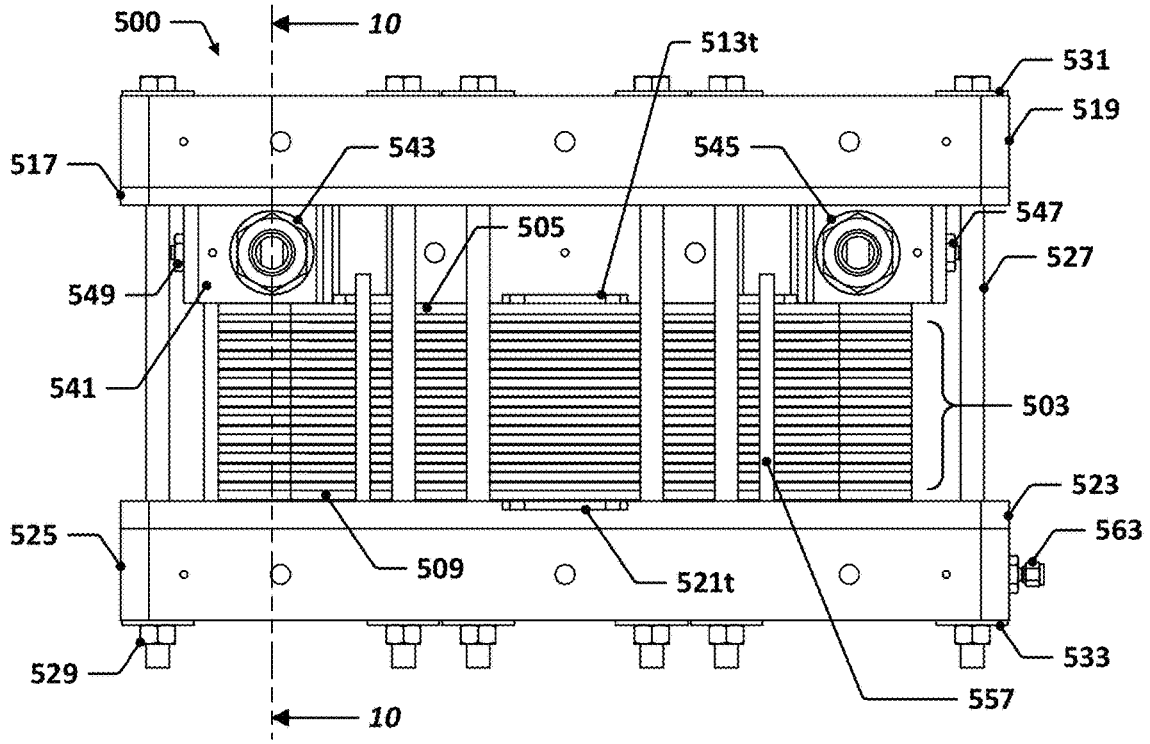
Figure 9:
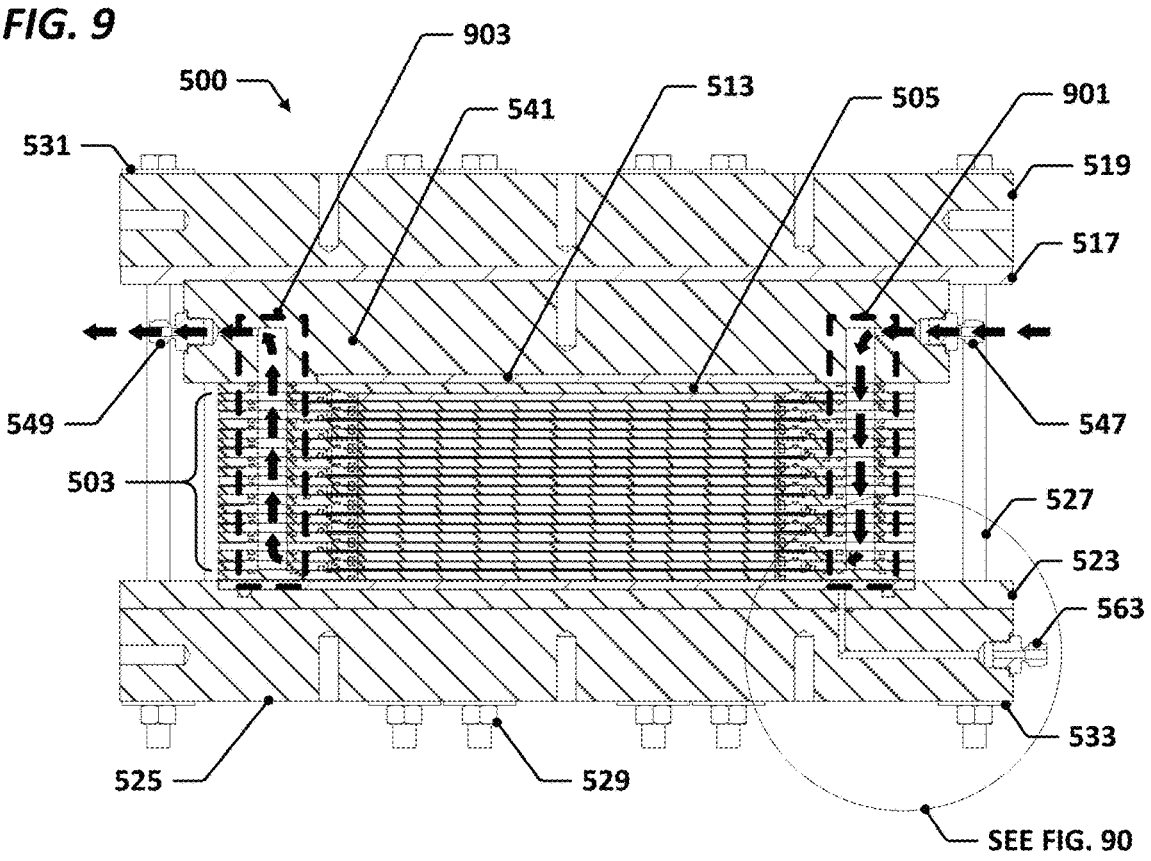
FIG. 9 depicts a cross-sectional view of the example multi-cell $CO_x$ electrolyzer of FIG. 7 taken along sectional line 9-9.
Figure 10:
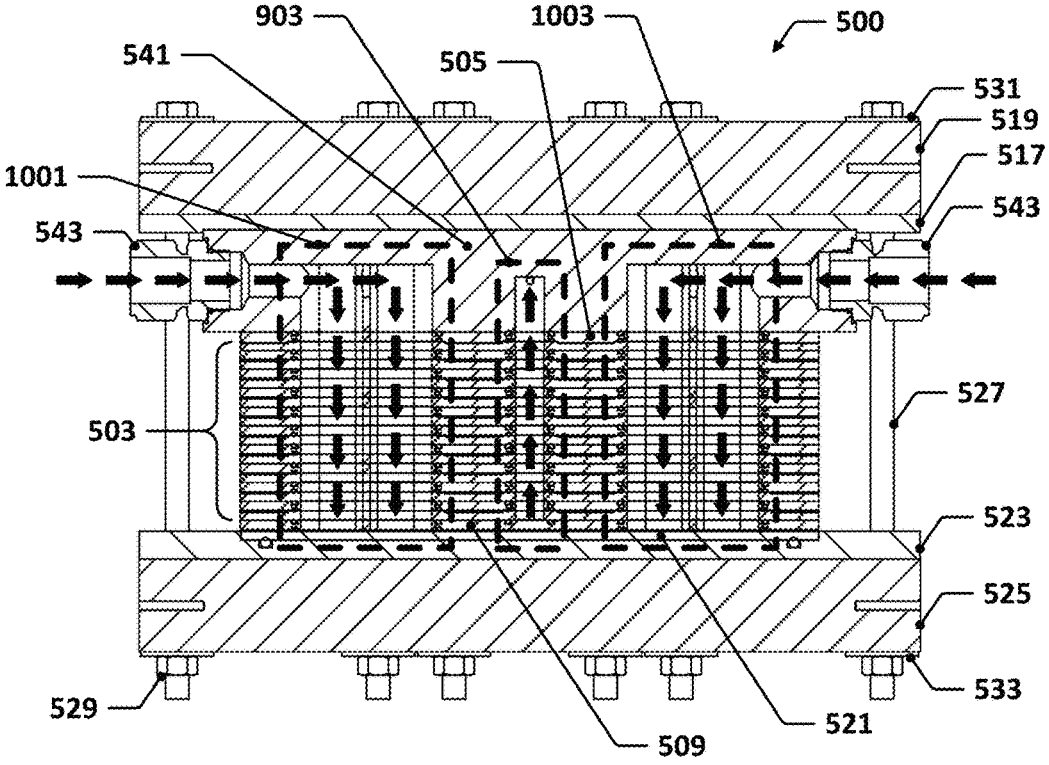
FIG. 10 depicts a cross-sectional view of the example multi-cell $CO_x$ electrolyzer of FIG. 8 taken along sectional line 10-10.
Figure 11A:
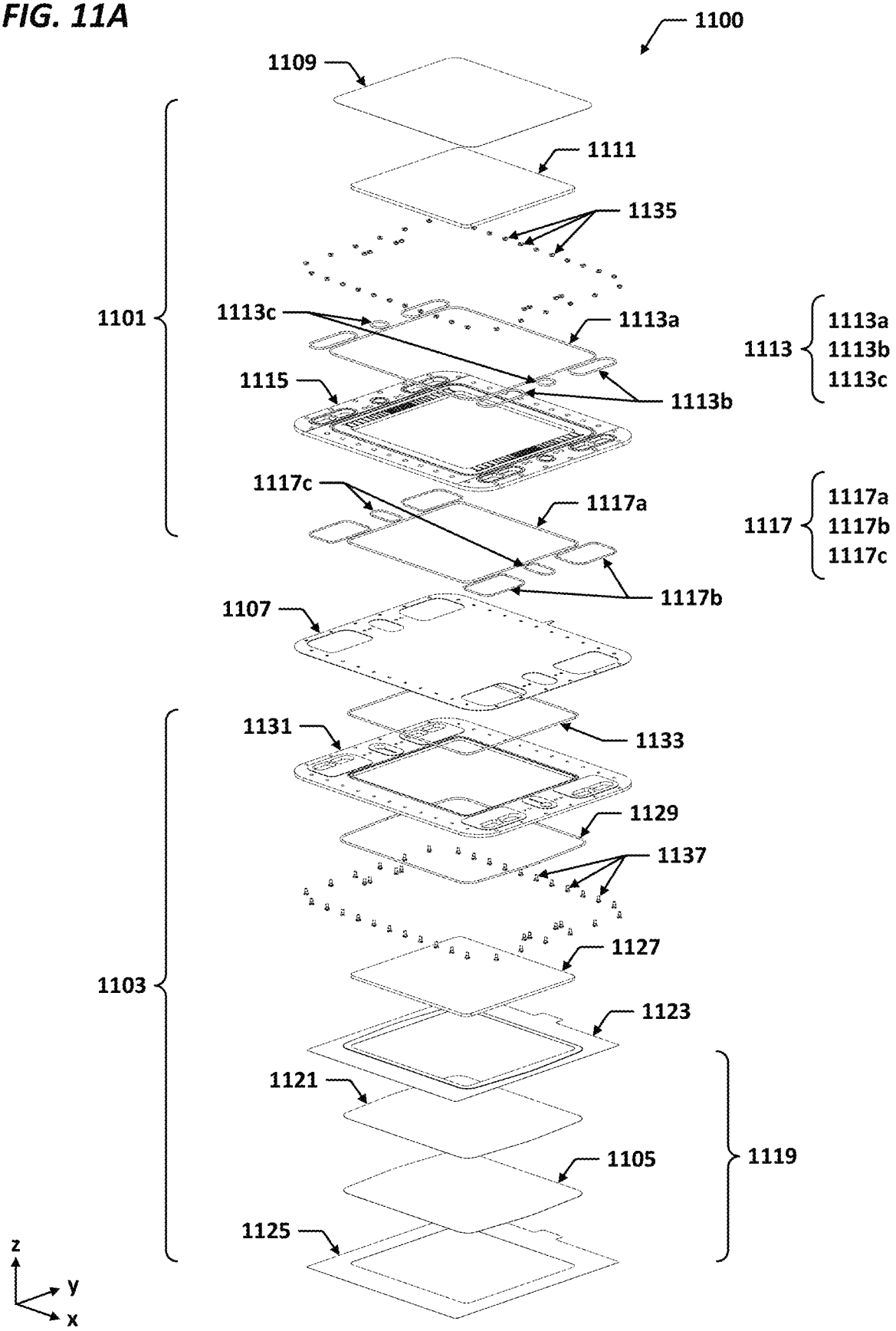
FIG. 11A depicts an exploded view of an example repeat unit of the example multi-cell $CO_x$ electrolyzer stack of FIG. 6.
Figure 17:
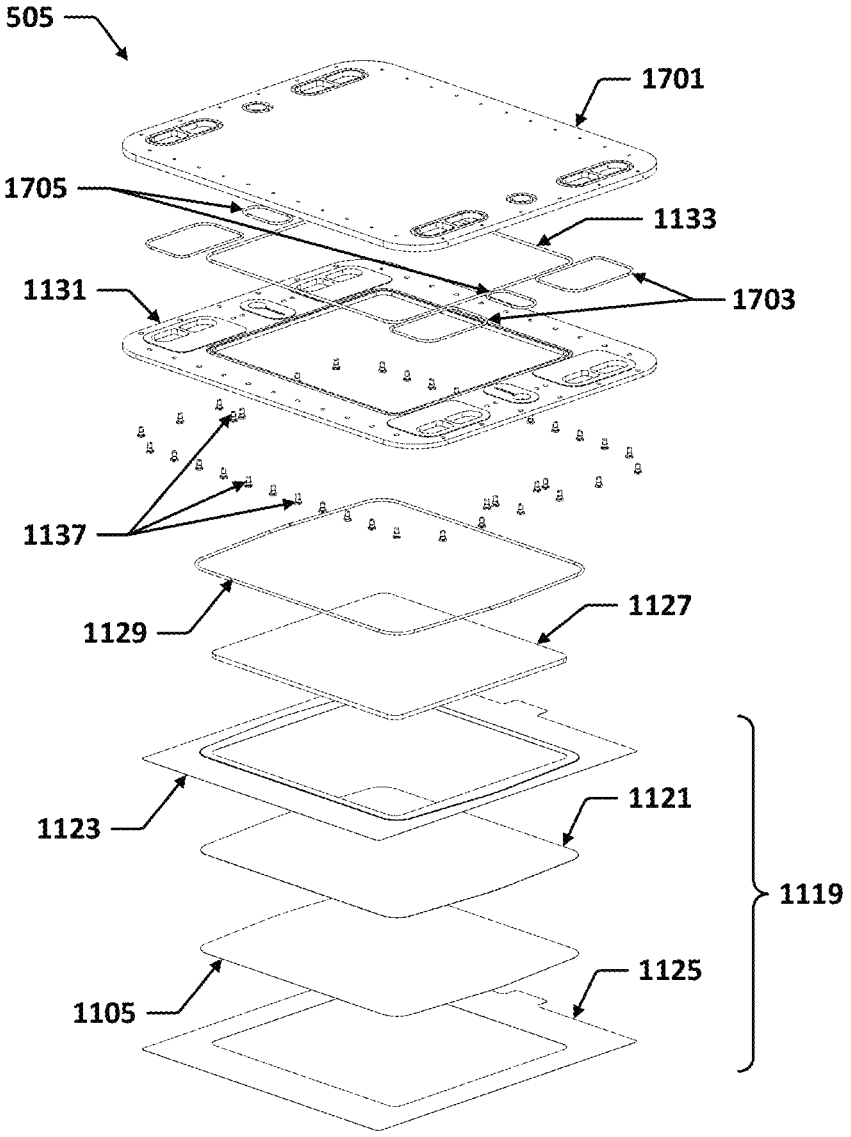
FIG. 17 depicts an exploded view of an example cathode interface assembly of the example multi-cell $CO_x$ electrolyzer stack of FIG. 6.
Figure 19:
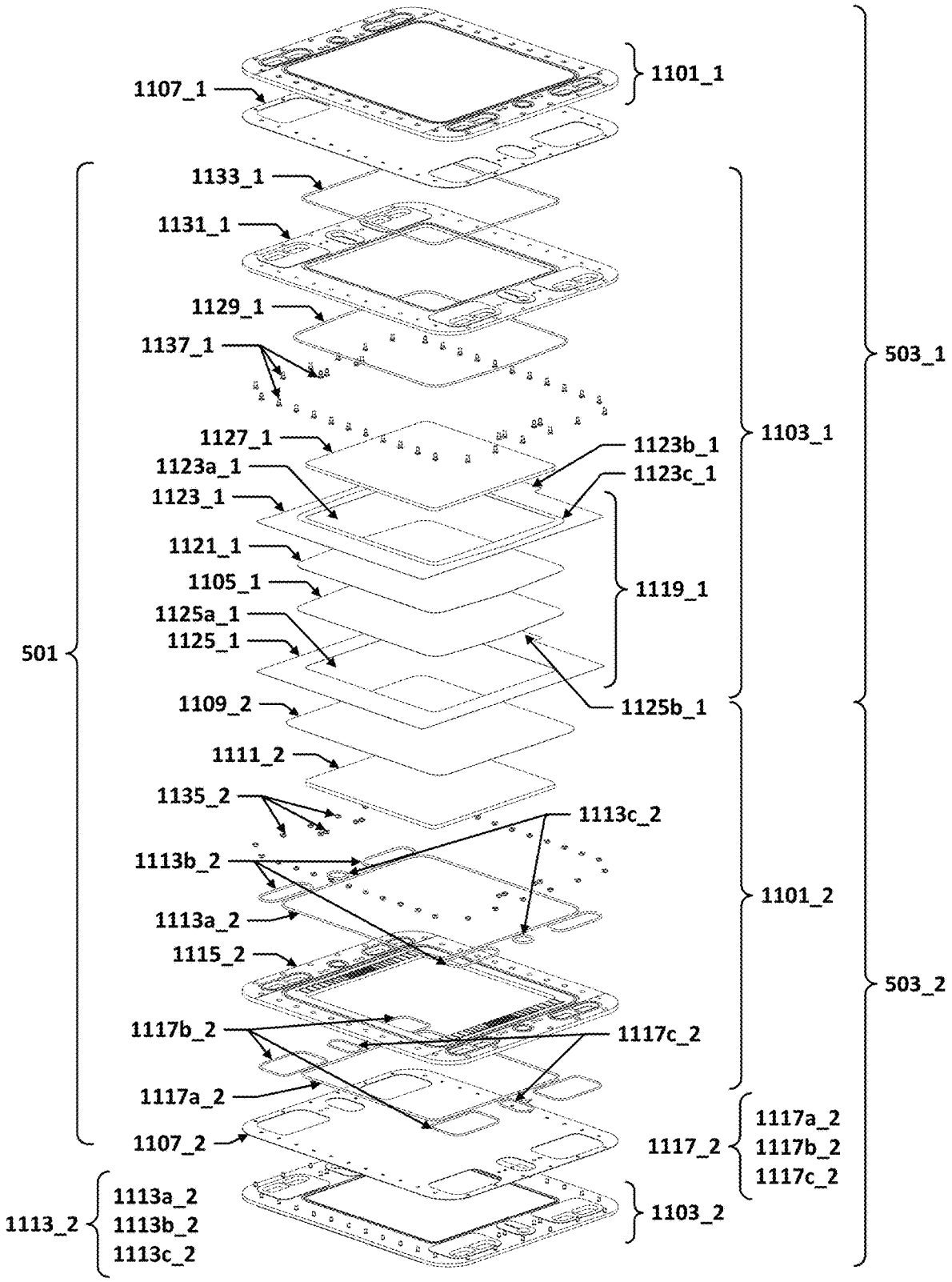
FIG. 19 depicts an exploded view of an illustrative $CO_x$ electrolyzer cell of the example multi-cell $CO_x$ electrolyzer stack of FIG. 6.

FIG. 5 depicts an exploded view of an example multi-cell $CO_x$ electrolyzer stack. FIG. 6 depicts a perspective view of the example multi-cell $CO_x$ electrolyzer of FIG. 5. FIGS. 7 and 8 depict side views of the example multi-cell $CO_x$ electrolyzer of FIG. 6. FIG. 9 depicts a cross-sectional view of the example multi-cell $CO_x$ electrolyzer of FIG. 7 taken along sectional line 9-9. FIG. 10 depicts a cross-sectional view of the example multi-cell $CO_x$ electrolyzer of FIG. 8 taken along sectional line 10-10. FIG. 11A depicts an exploded view of an illustrative repeat unit of the example multi-cell $CO_x$ electrolyzer stack of FIG. 6. FIG. 17 depicts an exploded view of a cathode interface assembly of the example multi-cell $CO_x$ electrolyzer stack of FIG. 6. FIG. 19 depicts an exploded view of an illustrative $CO_x$ electrolyzer cell of the example multi-cell $CO_x$ electrolyzer stack of FIG. 6.

As seen in FIGS. 5-11A, 17, and 19, multi-cell $CO_x$ electrolyzer stack (or stack) 500 includes a plurality of $CO_x$ electrolyzer cells (or cells), such as cell 501, formed by stacking a plurality of repeat units 503 (individually referenced as repeat units 503_1 to **503_*n*, where "n" is an integer greater than or equal to one) between cathode interface assembly 505 of port side assembly 507 and anode interface assembly 509 of bladder side assembly 511. In this manner, any given cell among the plurality of $CO_x$ electrolyzer cells may be formed by the conjunction of 1) cathode interface assembly 505 (which includes MEA 1105) and anode components 1101 of repeat unit 503_1; 2) cathode components 1103 (which include MEA 1105) of a first repeat unit (e.g., repeat unit 503_1) and anode components 1101 of a second repeat unit (e.g., repeat unit 503_2) adjacent to the first repeat unit; or 3) cathode components 1103 of repeat unit 503_*n* and anode interface assembly 509. Accordingly, the MEA of any given cell among the plurality of $CO_x$ electrolyzer cells may be configured to facilitate a $CO_x$ reduction process, such as described in association with one or more of FIGS. 1 to 4**.

Port side assembly 507 may include cathode interface assembly 505, bus (or terminal) plate 513, manifold assembly 515, insulation plate 517, and end plate 519 sequentially stacked from a first side of the plurality of repeat units 503 in a first direction, e.g., an axial direction, which may extend parallel to the z-axis direction. Among other functions, port side assembly 507 may at least be configured to provide one or more reactants to the cells to feed the $CO_x$ reduction process and output one or more byproducts from the cells in association therewith. Bladder side assembly 511 may include anode interface assembly 509, bus (or terminal) plate 521, insulation plate 523, and end plate 525 sequentially stacked from a second side of the plurality of repeat units 503 in a second direction opposite the first direction. Among other functions, bladder side assembly 511 may be at least configured to constrain axial expansion of the cells during the $CO_x$ reduction process in a manner that prevents or reduces the likelihood of the plurality of cells from being overly compressed, but maintains corresponding fluidic seals and electrical conductivity between associated components of stack 500.

Respective end plates 519 and 525 of port side assembly 507 and bladder side assembly 511 may be coupled to one another via a plurality of tensioning members 527 (e.g., anchors, bolts, studs, tie rods, etc.) extending in the axial direction. As such, end plates 519 and 525 may include respectively pluralities of fastener orifices 519*h* and 525*h* through which tensioning members 527 may pass. In some embodiments, fastener orifices 519*h* and 525*h* may be respectively arranged about corresponding peripheral regions of end plates 519 and 525. It is also noted that end plates 519 and 525 may be formed of any suitable material, such as aluminum, magnesium, titanium, and/or the like. Tensioning members 527 may be at least partially threaded to respectively engage with, for instance, threaded fasteners 529 (e.g., nuts, rivets, etc.). In this manner, a clamping force extending in the axial direction may be applied to the plurality of cells via the conjunction of end plates 519 and 525, tensioning members 527, and threaded fasteners 529. As such, end plates 519 and 525 may generally serve to act as load-spreading members that distribute a clamping load relatively evenly over the other elements of stack 500. In some instances, first washers 531 may be respectively disposed between the heads of tensioning members 527 and upper surface 519*a* of end plate 519, and second washers 533 may be respectively disposed between lower surface 525*b* of end plate 525 and threaded fasteners 529. It is contemplated that one or more of first washers 531 may be formed as lock washers and/or respectively integrated with the heads of tensioning members 527 such as in the case of flanged bolts. Similarly, one or more of second washers 533 may be formed as lock washers and/or respectively integrated with threaded fasteners 529 such as in the case of flanged nuts.

Bus plates 513 and 521 are respectively provided with terminal portions 513*t* and 521*t* protruding outwardly from corresponding peripheral surfaces and may be respectively connected to a power supply. In some cases, terminal portions 513*t* and 521*t* may have, for example, lugs, terminal blocks, and/or other electrical connection mechanisms to facilitate electrical connections between bus plates 513 and 521 and a corresponding positive or negative voltage or current source. For example, terminal portion 513*t* on a cathode side of stack 500 may be connected to a negative electrode of the power supply, and terminal portion 521*t* on an anode side of the stack 500 may be connected to a positive electrode of the power supply. In this manner, bus plates 513 and 521 may provide common electrical connections for the plurality of cells of stack 500, such as cell 501, and, thereby, enable an electrical potential or current to be generated across the plurality of cells of stack 500 that may drive the reduction and oxidation reactions within the plurality of cells. For instance, when an electrical potential difference is imposed on the plurality of cells of stack 500 through application of a voltage or current across bus plates 513 and 521, the resulting electrical potential difference may cause an oxidation reaction at the anode sides of the cells (e.g., oxidation of water to molecular oxygen) and a reduction reaction at the cathode sides of the cells, e.g., that converts the $CO_x$ into carbon monoxide, a hydrocarbon, and/or other catalyst-specific byproducts. As will become more apparent below, bus plate 513 may be sized so as not to interfere with various fluidic passages through stack 500.

According to various embodiments, bus plates 513 and 521 may be formed of a first electrically conductive material, e.g., aluminum, iron, nickel, lead, steel, zinc, and/or the like, and may be coated (or plated) with a second, more electrically conductive coating material, e.g., silver plating, gold plating, copper plating, or other material with relatively higher electrical conductivity, to provide a higher level of electrical conductivity between bus plates 513 and 521 and the corresponding flow fields (e.g., anode and cathode flow fields 1111 and 1127) of the respective cells of stack 500.

Bus plate 513 may, for example, be electrically insulated from end plate 519 by insulation plate 517 and/or at least one other layer of electrically insulating material. As shown, insulation plate 517 is disposed between the electrically conductive portion of bus plate 513 and end plate 519, and may include a plurality of fastener orifices 517*h* through which tensioning members 527 may pass. In some cases, electrical insulation between bus plate 513 and end plate 519 may be additionally or alternatively provided by manifold assembly 515 when, for instance, manifold assembly 515 is formed of an electrically non-conductive material. Further, electrical insulation may be additionally or alternatively provided by forming (or bonding) electrically insulating material on (or to) a surface of bus plate 513 facing end plate 519, a surface of end plate 519 facing bus plate 513, or at least one surface of manifold assembly 515 facing end plate 519 or end plate 525. Regardless of how such electrical insulation is provided, bus plate 513 may be electrically insulated from end plate 519. When, however, end plate 519 is made of an electrically non-conductive material, or in which end plate 519 is otherwise electrically isolated from, for example, bus plate 521 and/or end plate 525, insulation plate 517 (or other electrically insulating material) may be omitted.

Similar to bus plate 513, bus plate 521 may be electrically insulated from end plate 525 by insulation plate 523 and/or at least one other layer of electrically insulating material that may act in a similar manner as insulation plate 517 with respect to bus plate 513 and end plate 519, but with respect to end plate 525 and bus plate 521. Similar to insulation plate 517, insulation plate 523 may include a plurality of fastener orifices 523*h* through which tensioning members 527 may pass. In some embodiments, electrical insulation may be additionally or alternatively provided by forming (or bonding) electrically insulating material on (or to) a surface of bus plate 521 facing end plate 525 and/or a surface of end plate 525 facing bus plate 521. In some implementations, insulation plate 523 (or other electrically insulating material) may be omitted if end plate 525 is otherwise electrically isolated from bus plate 521. It is also contemplated that bus plate 521 may be allowed to come into electrically conductive contact with end plate 525 in those instances when the various components of the cells of stack 500 are otherwise configured to maintain electrical insulation between bus plates 513 and 521 other than a conductive path through the various MEAs of the plurality of cells. However, as will become more apparent below, insulation plate 523 may be utilized in association with bus plate 521 to constrain (e.g., actively constrain) axial expansion of the plurality of cells of stack 500. It is noted that an example configuration of insulation plate 523 will be described in more detail in association with FIGS. 86 and 87.

According to some embodiments, insulation plate 523 may be coupled to end plate 525 via a plurality of first fasteners 535. Similarly, insulation plate 517 may be coupled to end plate 519 via a plurality of second fasteners 537. Further, bus plate 513 may be coupled to manifold assembly 515 via a plurality of third fasteners 539. First, second, and third fasteners 535, 537, and 539 may be any suitable fastening mechanism, such as flathead machine screws, rivets, etc., but embodiments are not limited thereto.

Manifold Assembly

Figure 12:
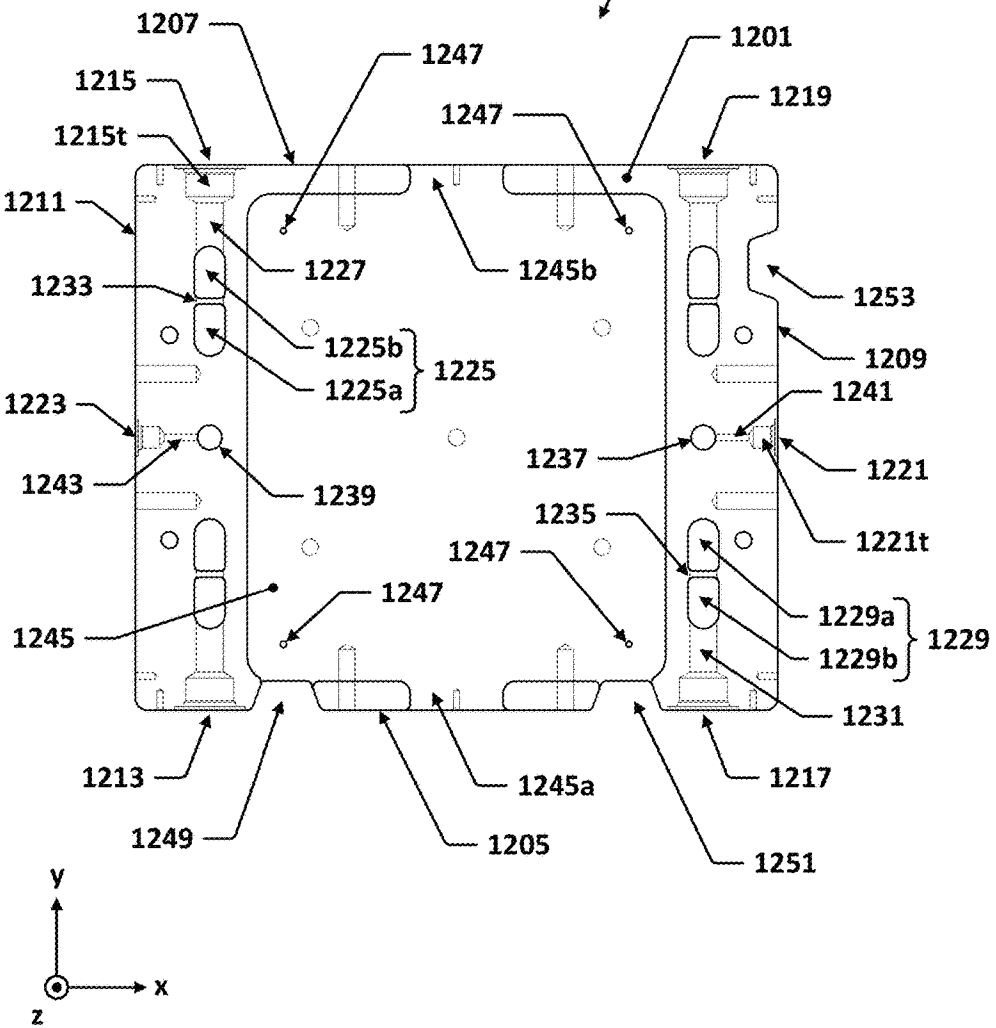
FIG. 12 depicts a plan view of an example manifold block of the example multi-cell $CO_x$ electrolyzer of FIG. 6.

FIG. 12 depicts a bottom plan view of an example manifold block of the example multi-cell $CO_x$ electrolyzer of FIG. 6. FIGS. 13-16 depict side views of the example manifold block of FIG. 12. It is noted that hidden internal features of the manifold block (or main body) 541 that would otherwise not be visible in the view of FIG. 12 are shown in dashed-line format.

In general (and with continued reference to FIGS. 5-10), manifold assembly 515 may be configured to provide one or more reactants to the plurality of cells to feed the $CO_x$ reduction process. For instance, in a $CO_x$ electrolyzer, an anolyte (e.g., liquid water) may be provided to the anode sides of the plurality of cells of stack 500 during operation, while a catholyte (e.g., gaseous $CO_x$, such as CO and/or $CO_2$), may be provided to the cathode sides of the cells. In some implementations, an aqueous solution may be provided in place of water, and references to water herein may be understood to also be inclusive of the use of an aqueous solution as well. The liquid water may, through an electrolysis reaction on the anode sides of the cells, undergo oxidation to create oxygen ($O_2$) gas, H+ protons, and electrons. The H+ protons may be drawn through the MEAs (such as MEA 1105 in FIG. 11A) of the plurality of cells due to an electromagnetic field that is present within the cells due to the electrical potential that is applied across the cells via bus plates 513 and 521 and may react with the bicarbonate and/or hydroxide and/or formate that is produced at the cathode sides of the cells. Manifold assembly 515 may also be configured to allow one or more byproducts of a $CO_x$ reduction process to be expelled from the cells. Thus, as will become more apparent below, manifold assembly 515 may include (or define), for example, at least a portion of one or more fluidic inlet passages and at least a portion of one or more fluidic outlet passages that may be used to convey fluid to and from the anode and cathode sides of the plurality of cells of stack 500.

Referring to FIGS. 5-10 and 12-16, manifold assembly 515 may include main body 541, first fluidic inlet connectors (or couplings) 543, first fluidic outlet connectors 545, second fluidic inlet connector 547, and second fluidic outlet connector 549. Main body 541 may be a generally rectangular plate-shaped body having first surface 1201 opposing second surface 1203 in the axial direction. Although main body 541 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. When assembled as part of stack 500, first surface 1201 may face end plate 525 and interface with bus plate 513 and cathode interface assembly 505, whereas second surface 1203 may face end plate 519 and interface with insulation plate 517. First and second surfaces 1201 and 1203 may be bounded by third, fourth, fifth, and sixth surfaces 1205, 1207, 1209, and 1211. It is noted, however, that embodiments are not limited to the aforementioned configuration, and main body 541 may be formed having any other suitable geometric configuration with corresponding bounding surfaces.

In some embodiments, main body 541 includes first fluidic inlet ports 1213 and 1215 in third and fourth surfaces 1205 and 1207, respectively, that are configured to interface with first fluidic inlet connectors (or inlet connectors) 543, first fluidic outlet ports (or outlet ports) 1217 and 1219 in third and fourth surfaces 1205 and 1207, respectively, that are configured to interface with first fluidic outlet connectors (or outlet connectors) 545, second fluidic inlet port (or inlet port) 1221 in fifth surface 1209 that is configured to interface with second fluidic inlet connector (or inlet connector) 547, and second fluidic outlet port (or outlet port) 1223 in sixth surface 1211 that is configured to interface with second fluidic outlet connector (or outlet connector) 549. As such, first and second inlet and outlet ports 1213-1223 may include corresponding threaded regions, such as threaded region 1215*t* of first fluidic inlet port 1215 and threaded region 1221*t* of second fluidic inlet port 1221, to engage with respective threaded regions of first and second fluidic inlet and outlet connectors 543-549. Alternatively, first and second fluidic inlet and outlet connectors 543-549 may be respectively welded, e.g., sweat welded, to first and second inlet and outlet ports 1213-1223 or otherwise coupled to first and second inlet and outlet ports 1213-1223.

First fluidic inlet ports 1213 and 1215 may be fluidically connected to corresponding third fluidic outlet ports in first surface 1201 via respective connecting passages. For instance, first fluidic inlet port 1215 may be fluidically connected to third fluidic outlet port 1225 via connecting passage 1227. Similarly, first fluidic outlet ports 1217 and 1219 may be fluidically connected to corresponding third fluidic inlet ports in first surface 1201 via respective connecting passages. For instance, first fluidic outlet port 1217 may be fluidically connected to third fluidic inlet port 1229 via connecting passage 1231. Third fluidic outlet and inlet ports 1225 and 1229 respectively include a plurality of orifices fluidically connected to one another via corresponding connecting passages. For example, third fluidic outlet port 1225 may include first and second outlet orifices 1225*a* and 1225*b* fluidically connected to one another via connecting passage 1233, whereas third fluidic inlet port 1229 may include first and second inlet orifices 1229*a* and 1229*b* fluidically connected to one another via connecting passage 1235. Likewise, second fluidic inlet and outlet ports 1221 and 1223 may be fluidically connected to corresponding fourth fluidic outlet and inlet ports 1237 and 1239 in first surface 1201 via respective connecting passages 1241 and 1243. Accordingly, the conjunction of first fluidic inlet ports 1213 and 1215, respective connecting passages (e.g., connecting passage 1227), and corresponding third fluidic outlet ports (e.g., third fluidic outlet port 1225) may be configured to provide water to inlet passages 1001 and 1003 of stack 500. The conjunction of first fluidic outlet ports 1217 and 1219, respective connecting passages (e.g., connecting passage 1235), and corresponding third fluidic inlet ports (e.g., third fluidic inlet port 1229) may be configured to allow water to be expelled from outlet passages of stack 500. It is noted that the outlet passages of stack 500 may be similar to inlet passages 1001 and 1003, but may terminate at first fluidic outlet connectors 545 versus initiate at first fluidic inlet connectors 543. Further, the conjunction of second fluidic inlet port 1221, connecting passage 1241, and fourth fluidic outlet port 1237 may be configured to provide gaseous $CO_x$ to inlet passage 901 of stack 500, whereas the conjunction of second fluidic outlet port 1223, connecting passage 1243, and fourth fluidic inlet port 1239 may be configured to expel one or more byproducts of the $CO_x$ reduction process from outlet passage 903 of stack 500.

In some embodiments, first surface 1201 of main body 541 may include recessed region 1245 configured to receive at least a portion of bus plate 513 therein when manifold assembly 515 is incorporated as part of stack 500. Recessed region 1245 may include one or more portions (e.g., portions 1245*a* and 1245*b*) either of which may receive terminal portion 513*t* of bus plate 513 therein. Additionally, recessed region 1245 may include one or more threaded openings 1247 extending into main body 541 that are configured to threadedly engage with third fasteners (e.g., flatheaded machine screws) 539, which may be utilized to couple bus plate 513 to manifold assembly 515. In some embodiments, threaded openings 1247 may be provided as blind openings including, for instance, swage nuts pressed and/or clinched into main body 541 in a manner that third fasteners 539 engage with the swage nuts. Further, when manifold assembly 515 is incorporated as part of stack 500 and at least a portion of bus plate 513 is received in recessed region 1245, respective fluidic seals may be formed between third fluidic outlet and inlet ports 1225 and 1229 and corresponding ports (or openings) in cathode interface assembly 505 via gaskets 553. Similarly, respective fluidic seals may be formed between fourth fluidic outlet and inlet ports 1237 and 1239 and corresponding ports of cathode interface assembly 505 via gaskets 555.

Main body 541 may further include recesses 1249 and 1251 in third surface 1205 and recess 1253 in fifth surface 1209 to allow datum rods 557 of stack 500 to extend from, for instance, insulation plate 523 in the axial direction and at least partially into corresponding recesses 1249-1253. During assembly of stack 500, datum rods 557 may be utilized to maintain alignment between components of stack 500. In some cases, external surfaces of datum rods 557 may optionally abut against outer surfaces of the plurality of repeat units 503, cathode interface assembly 505, anode interface assembly 509, and/or recesses 1249-1253 of manifold assembly 515.

Repeat Unit

Figure 21:
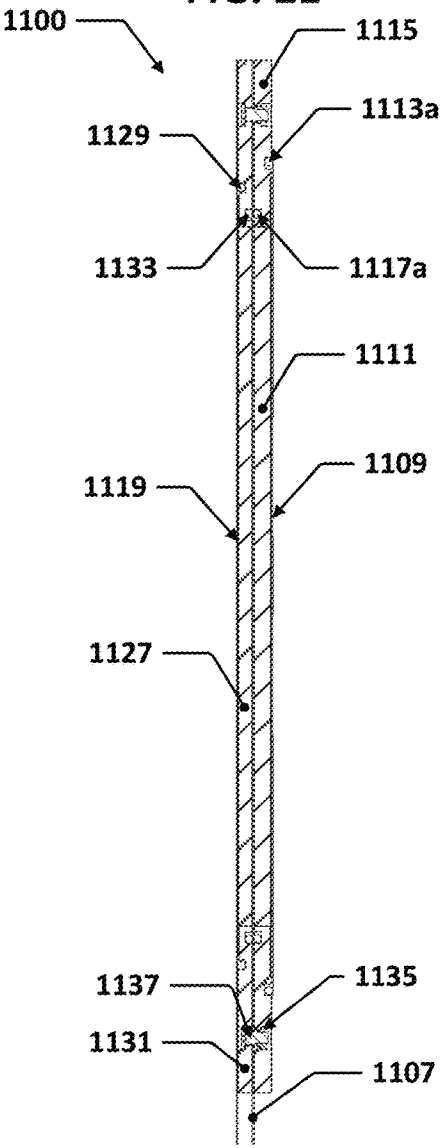
FIG. 21 depicts a cross-sectional view of the representative repeat unit of FIG. 20 taken along sectional line 21-21.
Figure 20:
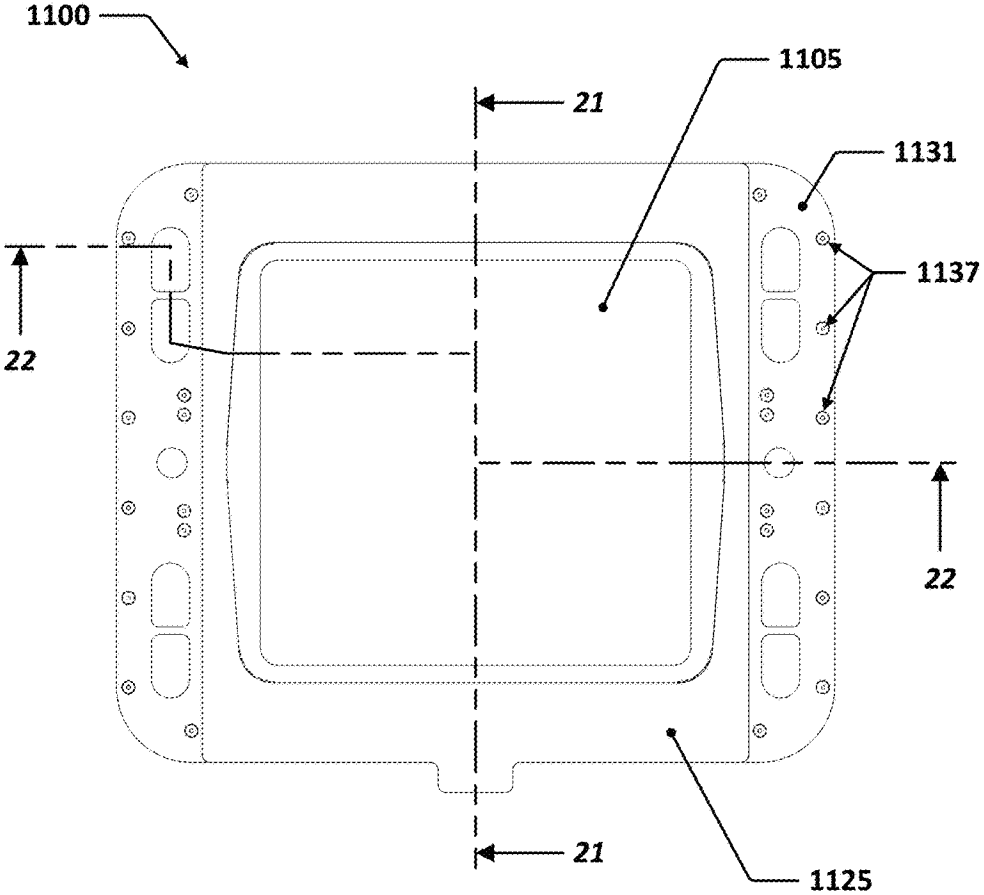
FIG. 20 depicts a bottom view of a representative repeat unit of the example multi-cell $CO_x$ electrolyzer stack of FIG. 6.
Figure 22:
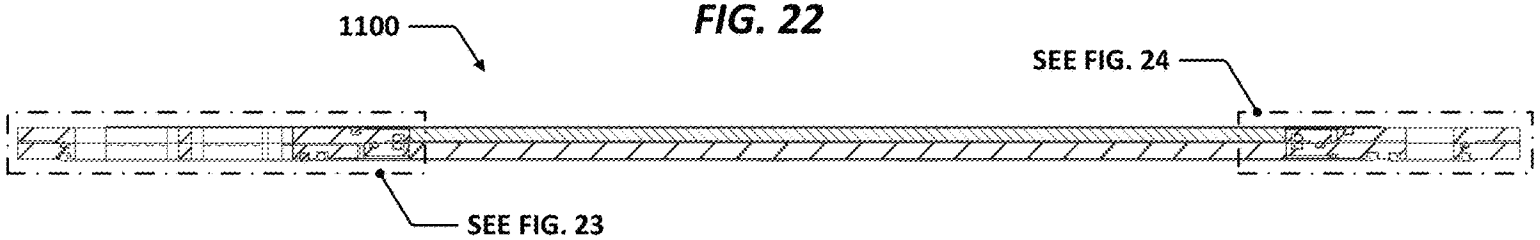
FIG. 22 depicts a cross-sectional view of the representative repeat unit of FIG. 20 taken along sectional line 22-22.
Figure 23:
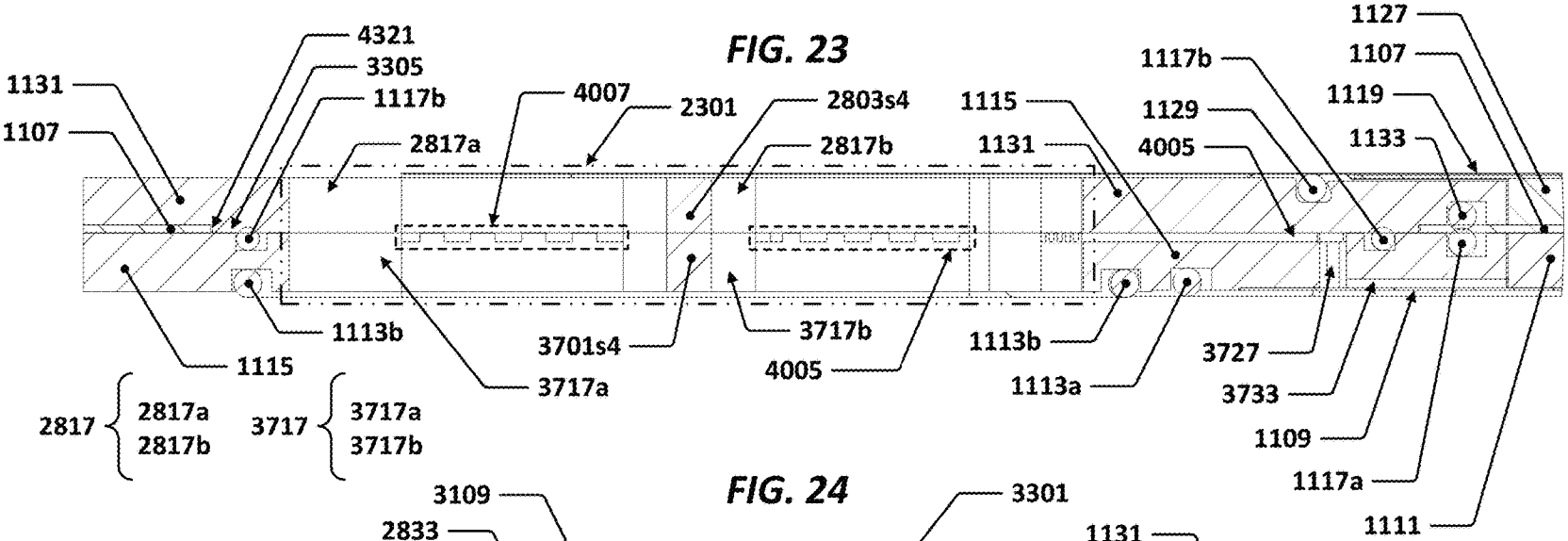
FIGS. 23 and 24 depict enlarged portions of the cross-sectional view of FIG. 22.
Figure 24:
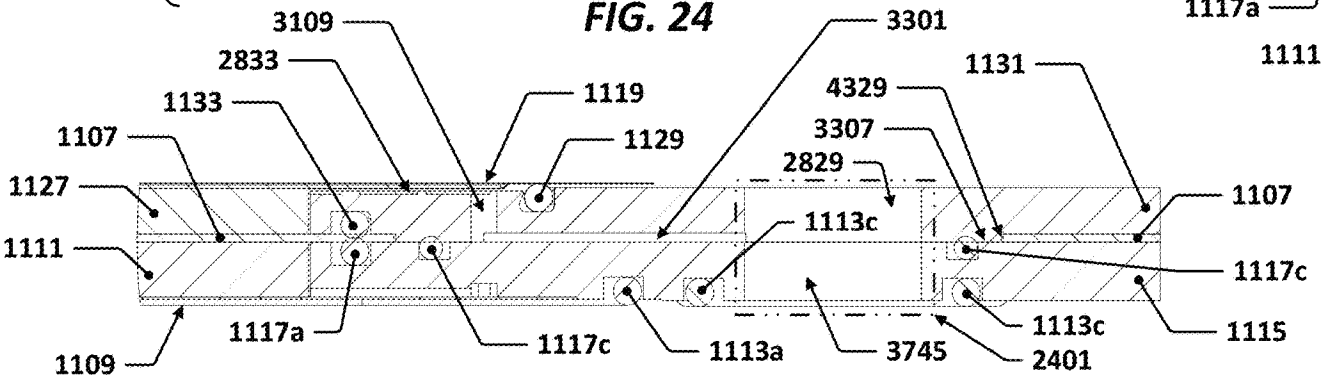

FIG. 20 depicts a bottom view of a representative repeat unit of the example multi-cell $CO_x$ electrolyzer stack of FIG. 6. FIG. 21 depicts a cross-sectional view of the representative repeat unit of FIG. 20 taken along sectional line 21-21. FIG. 22 depicts a cross-sectional view of the representative repeat unit of FIG. 20 taken along sectional line 22-22. FIGS. 23 and 24 depict enlarged portions of the cross-sectional view of FIG. 22.

Referring to FIGS. 11A and 20-24, representative repeat unit (or repeat unit) 1100 may include separator plate 1107 at least partially stacked between anode components 1101 and cathode components 1103. Anode components 1101 may include anode PTL 1109, anode flow field 1111, first anode gasket set 1113, anode frame 1115, and second anode gasket set 1117. In some embodiments, anode components 1101 may further include anode annular insert 1118 (see FIGS. 11B and 11C). It is noted that various anode components, such as first and second anode gasket sets 1113 and 1117 are not shown in FIGS. 11B and 11C for illustrative convenience. Cathode components 1103 may not only include MEA unit 1119 having MEA 1105 and cathode GDL 1121 stacked between first and second support frames 1123 and 1125, but may also include cathode flow field 1127, first cathode gasket 1129, cathode frame 1131, and second cathode gasket 1133. In some embodiments, cathode components 1103 may further include cathode annular insert 1134 (see FIGS. 11D and 11E). It is noted that various cathode components, such as MEA 1105, first and second support frames 1123 and 1125, and first and second cathode gasket sets 1129 and 1133 are not shown in FIGS. 11B and 11C for illustrative convenience.

According to various embodiments, anode frame 1115 may be coupled to cathode frame 1131 via any suitable fastening mechanism(s), e.g., anchors, bolts, nuts, rivets, screws, and/or the like. For instance, anode frame 1115 may be coupled to cathode frame 1131 via swage (or press) nuts 1135 pressed and/or clinched into anode frame 1115 and fasteners 1137 (e.g., shoulder screws), which interface with cathode frame 1131 and extend through separator plate 1107 to engage with swage nuts 1135. In some embodiments, swage nuts 1135 may be pressed and/or clinched into cathode frame 1131 versus anode frame 1115 such that fasteners 1137 interface with anode frame 1115 and extend through separator plate 1107 to engage swage nuts 1135 of cathode frame 1131. It is also contemplated that a first some of swage nuts 1135 may be pressed and/or clinched into anode frame 1115 and a second some of swage nuts 1135 may be pressed and/or clinched into cathode frame 1131 such that a corresponding first some of fasteners 1137 interface with cathode frame 1131 and extend through separator plate 1107 to engage with the first some of swage nuts 1135 and a corresponding second some of fasteners 1137 interface with anode frame 1115 and extend through separator plate 1107 to engage the second some of swage nuts 1135 of cathode frame 1131. Hereinafter, it will be assumed that swage nuts 1135 are incorporated as part of anode frame 1115 and fasteners 1137 interface with cathode frame 1131 and extend through separator plate 1107 to engage swage nuts 1135 of anode frame 1115. In this manner, second anode gasket set 1117 may be interposed between anode frame 1115 and separator plate 1107, whereas second cathode gasket 1133 may be interposed between separator plate 1107 and cathode frame 1131.

Figure 26:
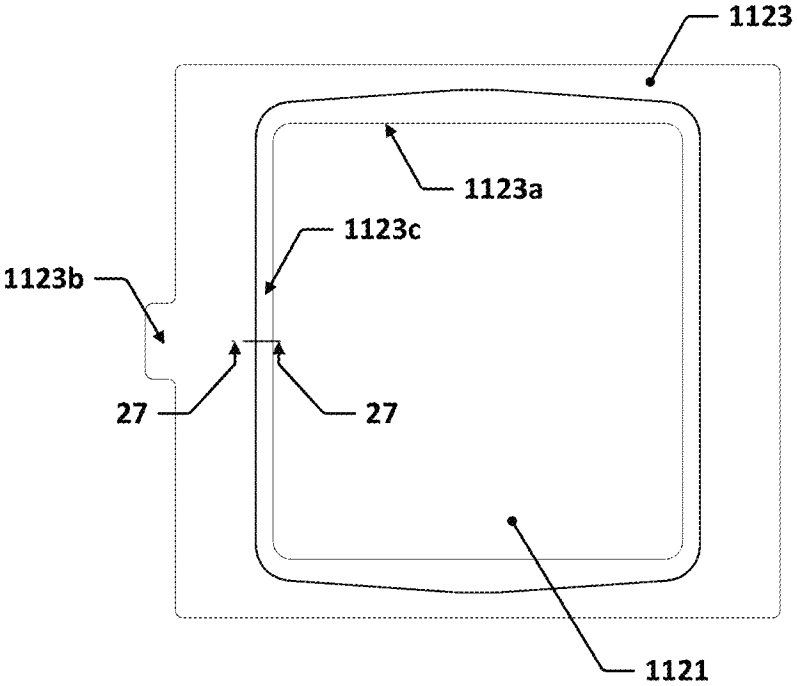
FIG. 26 depicts a top view of the example unitized MEA assembly of FIG. 25.
Figure 25:
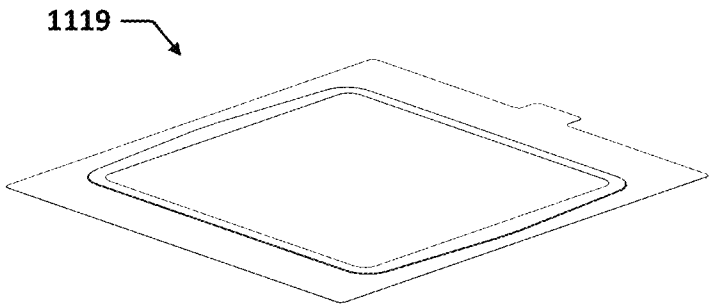
FIG. 25 depicts a perspective view of the example unitized MEA assembly of the example multi-cell $CO_x$ electrolyzer stack of FIG. 6.
Figure 27:
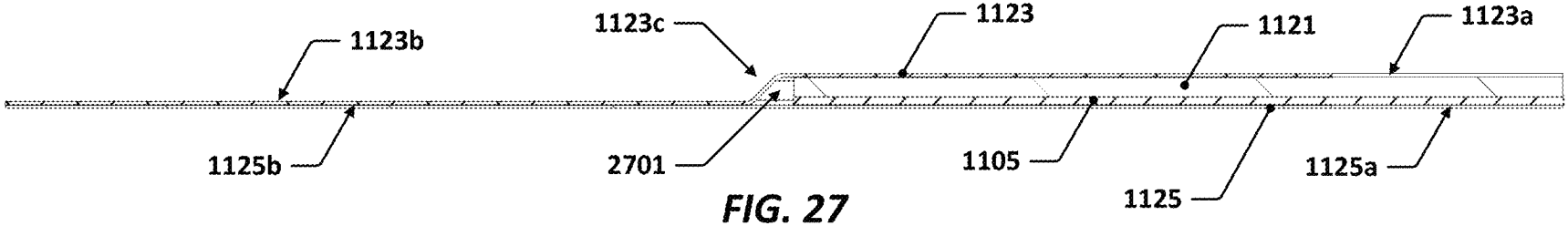
FIG. 27 depicts a cross-sectional view of the example unitized MEA assembly of FIG. 26 taken along sectional line 27-27.

As can be seen in FIGS. 20-24, at least a portion of anode PTL 1109 and anode flow field 1111 may be supported in one or more openings in anode frame 1115, whereas cathode flow field 1127 and at least a portion of unitized MEA assembly 1119 may be supported in one or more openings in cathode frame 1131. In this manner, first cathode gasket 1129 may be interposed between cathode frame 1131 and unitized MEA assembly 1119 to encircle, encompass, circumscribe, surround, and/or the like (hereinafter "encircle") cathode flow field 1127 and bulged portion 1123*c* (see FIGS. 25-27) of support frame 1123. First anode gasket 1113*a* of first anode gasket set 1113 may not only be interposed between anode frame 1115 and anode PTL 1109, but may also encircle anode flow field 1111. Second and third anode gaskets 1113*b* and 1113*c* of first anode gasket set 1113 may interface with anode frame 1115 to form fluidic seals with an adjacent repeat unit or cathode interface assembly 505, as will become more apparent below.

According to various embodiments, when repeat unit 1100 is assembled, anode flow field 1111 may be supported in at least one opening in anode frame 1115 such that a first surface of anode flow field 1111 abuts against a corresponding surface of anode PTL 1109 and a second surface of anode flow field 1111 abuts against a corresponding surface of separator plate 1107. In those instances when repeat unit 1100 includes anode annular insert 1118, anode annular insert 1118 may be at least partially supported in at least one opening in anode frame 1115 and may encircle anode flow field 1111. To this end, at least a portion of first surface 1118*a* (e.g., a top surface) of anode annular insert 1118 may abut against one or more corresponding surfaces of a unitized MEA assembly stacked between two adjacent repeat units or a unitized MEA assembly of cathode interface assembly 505. At least a portion of second surface 1118*b* (e.g., a bottom surface) of anode annular insert 1118 opposing first surface 1118*a* may abut against a corresponding surface of anode frame 1115. Additional features and effects of anode annular insert 1118 will be described later in association with anode frame 1115. Similarly, when repeat unit 1100 is assembled, cathode flow field 1127 may be supported in at least one opening in cathode frame 1131 such that a first surface of cathode flow field 1127 abuts against a corresponding surface of separator plate 1107 and a second surface of cathode flow field 1127 at least abuts against a corresponding surface of cathode GDL 1121, which may be exposed by an opening 1123*a* (see FIGS. 25-27) in support frame 1123 of unitized MEA assembly 1119. In those instances when repeat unit 1100 includes cathode annular insert 1134, cathode annular insert 1134 may be at least partially supported in at least one opening in cathode frame 1131 and may encircle cathode flow field 1127. To this end, at least a portion of first surface 1134*a* (e.g., a top surface) of cathode annular insert 1134 may abut against a corresponding surface of cathode frame 1131, and at least a portion of second surface 1134*b* (e.g., a bottom surface) of cathode annular insert 1134 opposing first surface 1134*a* may abut against one or more corresponding surfaces of a unitized MEA assembly of an associated repeat unit, e.g., repeat unit 1100. Other features and effects of cathode annular insert 1134 will be described later in connection with cathode frame 1131.

Aspects of the various components of repeat unit 1100 will be now described in more detail not only in association with the description of cell 501, but also the text associated with FIGS. 25-43, 49-79, 83, 84A, 84B, and 85A-85C.

$CO_x$ Electrolyzer Cell

Referring to FIG. 19, an exploded view of cell 501 is shown. Cell 501 is formed between cathode components 1103_1 of repeat unit 503_1 and anode components 1103_2 of repeat unit 503_2. Separator plates 1107_1 and 1107_2 of repeat units 503_1 and 503_2 separate cell 501 from adjacent cells of stack 500. With this in mind, anode components 1101_1 of repeat unit 503_1 and cathode components 1103_2 of repeat unit 503_2 are shown in partially assembled states and form portions of such cells adjacent to cell 501. Hereinafter, components of cell 501 will be referenced followed by an underscore and identifier to indicate the repeat unit to which the components are a part without specifying the repeat unit itself.

Cell 501 may include MEA 1105_1 interposed between anode porous transport layer (PTL) 1109_2 and cathode GDL 1121_1. In some cases, MEA 1105_1 and cathode GDL 1121_1 may be part of a unitized MEA assembly, such as unitized MEA assembly 1119_1, which includes MEA 1105_1 and cathode GDL 1121_1 sandwiched between support frames 1123_1 and 1125_1 (see also FIGS. 25-27). Support frames 1123_1 and 1125_1 may not only include respective openings 1123*a*_1 and 1125*a*_1 exposing corresponding surfaces of MEA 1105_1 and cathode GDL 1121_1 to adjacent components, but may also respectively include protruded tab portions 1123*b*_1 and 1125*b*_1 that may facilitate handling of unitized MEA assembly 1119_1 during manufacture and testing. In some embodiments, protruded tab portions 1123*b*_1 and 1125*b*_1 may be silkscreened, inscribed, embossed, or otherwise marked with identifying information, such as identifying information indicating a cell to which unitized MEA assembly 1119_1 belongs. Support frame 1123_1 may also include bulged portion 1123*c*_1 (see also bulged portion 1123*c* in FIG. 27) to accommodate MEA 1105_1 and cathode GDL 1121_1 in a cavity (e.g., cavity 2701 in FIG. 27) formed between support frames 1123_1 and 1125_1. Accordingly, the design of unitized MEA assembly 1119_1 may allow its components to be preassembled and tested before incorporation into, for example, cell 501, which may increase assembly efficiencies and reduce both cell-level and stack-level defects.

With continued reference to FIG. 19, anode PTL 1109_2 may be interposed between MEA 1105_1 and anode flow field 1111_2, whereas cathode GDL 1121_1 may be interposed between MEA 1105_1 and cathode flow field 1127_1. As such, opening 1125*a*_1 in support frame 1125_1 may allow MEA 1105_1 and anode flow field 1111_2 to be fluidically connected via anode PTL 1111_2, and opening 1123*a*_1 in support frame 1123_1 may allow MEA 1105_1 and cathode flow field 1127_1 to be fluidically connected via cathode GDL 1127_1. As will become more apparent below, anode PTL 1109_2 and anode flow field 1111_2 may, for example, be supported in one or more openings in anode frame 1115_2 and encircled by first anode gasket 1113*a*_2 of first anode gasket set 1113_2 at a first side of anode frame 1115_2. Similarly, cathode flow field 1127_1 and at least a portion of unitized MEA assembly 1119_1 (and, thereby, at least cathode GDL 1121_1) may be supported in one or more openings of cathode frame 1131_1 and encircled by first cathode gasket 1129_1 at a first side of cathode frame 1131_1. In turn, anode frame 1115_2 may be stacked between unitized MEA assembly 1119_1 and separator plate 1107_2, and cathode frame 1131_1 may be stacked between separator plate 1107_1 and unitized MEA assembly 1119_1. Second anode gasket set 1117_2 may be disposed between anode frame 1115_2 and separator plate 1107_2, whereas second cathode gasket 1133_1 may be disposed between cathode frame 1131_1 and separator plate 1107_1. In this manner, first anode gasket 1117*a*_2 of second anode gasket set 1117_2 may encircle anode flow field 1111_2 at a second side of anode frame 1111_2, and second cathode gasket 1133_1 may encircle cathode flow field 1127_1 at a second side of cathode frame 1131_1.

Gaskets 1113*a*_2 and 1129_1 may not only provide fluidic seals between unitized MEA assembly 1119_1 and the corresponding flow fields 1111_2 and 1127_1, but may also provide structural support to avoid over-compression of anode PTL 1109_2 and cathode GDL 1121_1. It is also noted that gaskets 1113*a*_2 and 1129_1 may be formed thin enough so that anode PTL 1109_2 and cathode GDL 1121_1 are not under-compressed when assembled as part of stack 500. For example, gaskets 1113*a*_2 and 1129_1 may be sized such that anode PTL 1109_2 and cathode GDL 1121_1 are compressed and sealed against corresponding surfaces of flow fields 1111_2 and 1127_1 to maintain electrical contact while preventing or discouraging fluids from pooling during operation. In a similar manner, gaskets 1117*a*_2 and 1133_1 may provide fluidic seals between separator plates 1107_2 and 1107_1 and corresponding surfaces of flow fields 1111_2 and 1127_1.

Each element within cell 501 may provide particular functionality to cell 501, and various components of stack 500 may provide shared functionality with each of the plurality of cells including cell 501. For instance, end plates 519 and 525 may generally serve to act as load-spreading members that distribute a clamping load relatively evenly over the plurality of cells of stack 500 including cell 501. Manifold assembly 515 may include, for example, main body 541 forming at least a portion of one or more fluidic inlet ports, which may begin at inlet connectors 543, and at least a portion of one or more fluidic outlet ports, which may terminate at outlet connectors 545, that may be used to convey fluid to and from the anode sides of the plurality of cells of stack 500 including cell 501. As will become more apparent below, the fluidic inlet port(s) and fluidic outlet port(s) of manifold assembly 515 may be fluidically connected to corresponding inlet and outlet fluidic passages in not only anode frame 1115_2 and cathode frame 1131_1 of cell 501, but also inlet and outlet fluidic passages of the anode and cathode frames of the other cells of stack 500. In a similar fashion, main body 541 of manifold assembly 515 may form at least a portion of one or more fluidic inlet ports, which may begin at inlet connector 547, and at least a portion of one or more fluidic outlet ports, which may terminate at outlet connector 549, that may be used to convey fluid to and from the cathode sides of the plurality of cells of stack 500 including cell 501. Thus, and as will become more apparent below, the fluidic inlet port(s) and fluidic outlet port(s) of manifold assembly 515 may be fluidically connected to corresponding inlet and outlet fluidic passages in not only anode frame 1115_2 and cathode frame 1131_1 of cell 501, but also inlet and outlet fluidic passages of the anode and cathode frames of the other cells of stack 500.

According to various embodiments, bus plate 521 may be electrically connected to anode flow field 1111_2 (and, in some instances, anode frame 1115_2) via anode interface separator 4703, anode flow field 1111, and anode PTL 1109 of anode interface assembly 509 (see FIGS. 5-10 and 47), as well as the corresponding separator plates 1107, anode flow fields 1111, anode PTLs 1109, MEAs 1105, cathode GDLs 1121, and cathode flow fields 1127 between anode interface assembly 509 and cell 501 (see also FIGS. 5-11); similarly, bus plate 513 may be electrically connected to cathode flow field 1127_1 (and, in some instances, cathode frame 1131_1) via cathode interface separator 1701, cathode flow field 1127, cathode GDL 1121, and MEA 1105 of cathode interface assembly 505 (see FIGS. 5-10 and 17). Anode and cathode flow fields 1111_2 and 1127_1 may be made of any suitable material(s) that is electrically conductive and otherwise capable of withstanding relatively long-term exposure to the fluids flowed within stack 500 during normal operating conditions. For example, flow fields 1111_2 and 1127_1 may be made from titanium or titanium alloy, stainless steel (although stainless steel may have a higher susceptibility to corrosion than other materials), porous graphite, a carbon-fiber reinforced thermoset polymer, etc.

In general, anode and cathode frames 1115_2 and 1131_1 may have inlets that correspond in location to the fluidic inlet passageways that begin at inlet connectors 543 and 547, and outlets that corresponding in location to the fluidic outlet passageways that terminate at outlet connectors 545 and 549. To this end, anode and cathode flow fields 1111_2 and 1127_1 may each have one or more channels that are formed in surfaces of the corresponding flow fields that are in contact with anode PTL 1109_2 and cathode GDL 1121_1, respectively, that are routed so as to allow the fluid that is conducted through the channels to come into contact with the adjacent PTL or GDL in a generally distributed manner.

For example, anode flow field 1111_2 may feature one or more inlet openings (or channels) and one or more outlet openings (or channels) that may, respectively, fluidically connect with corresponding openings in anode frame 1115_2. One or more anode channels, e.g., serpentine channels, may be provided in a surface of anode flow field 1111_2 that is in contact with anode PTL 1109_2. The anode channels may serve to distribute the fluid introduced to the anode side of cell 501 across anode PTL 1109_2 such that the anolyte is able to come into contact with anode PTL 1109_2 in a spatially distributed manner such that the anolyte may be allowed to flow through anode PTL 1109_2 in a relatively uniform manner across the entire area, or most of the entire area, of anode PTL 1109_2. An illustrative anode frame 1115 and some example anode flow fields 1111 will be described in more detail in association with FIGS. 37-42 and 83-85.

Similarly, cathode flow field 1127_1 may feature one or more inlet openings (or channels) and one or more outlet openings (or channels) that may, respectively, fluidically connect with corresponding openings in cathode frame 1131_1. One or more cathode channels may be provided in a surface of cathode flow field 1127_1 that is in contact with cathode GDL 1121_1. The cathode channels may serve to distribute the fluid introduced to the cathode side of cell 501 across cathode GDL 1121_1 such that the cathode fluid is able to come into contact with cathode GDL 1121_1 in a spatially distributed manner such that the cathode fluid may be allowed to flow through cathode GDL 1121_1 in a relatively uniform manner across the entire area, or most of the entire area, of cathode GDL 1121_1. An illustrative cathode frame 1131 and example cathode flow fields 1127 will be described in more detail in association with FIGS. 28-36 and 49-78.

Anode PTL 1109_2 and cathode GDL 514 may both serve to help gases that are generated within or provided via anode flow field 1111_2 and cathode flow field 1127_1, respectively, to diffuse across the active area of MEA 1105_1. A typical GDL suitable for use in a $CO_x$ electrolyzer may include, for example, a fibrous substrate that provides structural support, e.g., to the catalyst layer in MEA 1105_1, and may allow gas to flow from the adjacent flow field towards the MEA (including in directions parallel to the plane of MEA 1105_1, thereby allowing the gas to flow laterally underneath portions of the adjacent flow field that may be in contact with the GDL). Such a GDL may also permit water that is present in MEA 1105_1 or that is trapped within the GDL and/or trapped between that GDL and MEA 1105_1 to escape into the channel(s) of a flow field that is adjacent to the GDL, thereby potentially allowing that water to be expelled from that flow field as a result of fluid flow through that flow field. The GDL may also serve as an electrical conductor that serves to conduct electrical charge through MEA 1105_1. Similarly, a typical PTL suitable for use in a $CO_x$ electrolyzer may include, for example, a porous, metallic matrix that provides structural support, e.g., to the catalyst layer in MEA 1105_1, and may allow water to flow from the adjacent flow field towards the MEA (including in directions parallel to the plane of MEA 1105_1, thereby allowing the water to flow laterally above portions of the adjacent flow field that may be in contact with the PTL). Such a PTL may also permit gas that is present in MEA 1105_1 or that is trapped within the PTL and/or trapped between that PTL and MEA 1105_1 to escape into the channel(s) of a flow field that is adjacent to the PTL, thereby potentially allowing that water to be expelled from that flow field as a result of fluid flow through that flow field. The PTL may also serve as an electrical conductor that serves to conduct electrical charge through MEA 1105_1.

According to some embodiments, MEA 1105_1 for a $CO_x$ electrolyzer may feature a metal nanoparticle catalyst layer that is pressed into contact with cathode GDL 1121_1. In some implementations, the metal nanoparticle catalyst layer may alternatively be formed on cathode GDL 1121_1 and pressed into contact with MEA 1105_1. In yet further cases, there may be metal nanoparticle catalyst layers that may be formed on both MEA 1105_1 and cathode GDL 1121_1 and then pressed into contact with each other. One example of such a catalyst layer is a layer of carbon material supporting a layer of, or incorporating, gold nanoparticles. Various types of MEAs and appropriate catalysts for use in a $CO_x$ electrolyzer are discussed in U.S. patent application Ser. Nos. 15/586,173 and 15/586,182, both filed May 3, 2017, and both titled "REACTOR WITH ADVANCED ARCHITECTURE FOR THE ELECTROCHEMICAL REACTION OF $CO_2$, CO, AND OTHER CHEMICAL COMPOUNDS," and U.S. Patent Application No. 62/939,960, filed Nov. 25, 2019, and titled "MEMBRANE ELECTRODE ASSEMBLY FOR $CO_x$ REDUCTION," each of which is hereby incorporated herein by reference in their entireties. It is noted, however, that these are merely examples and other configurations are contemplated.

Within the context of a multi-cell architecture, such as in the case of stack 500, multiple cells (including cell 501) may be served by common fluidic inlet ports/outlet ports and/or a common electrical potential source. It is noted that the overall multi-cell stack performance may be partially defined by the uniformity of electrical efficiency and product selectivity across the plurality of cells of stack 500, and this uniformity may be driven by the uniformity of gas flow delivery to/across each of the plurality of cells. To this point, the selection of flow field geometry, in that it relates to flow field pressure drop, may have a noticeable effect on overall stack flow uniformity. This may be because the flow uniformity is improved when the pressure drop across/through the plurality of cells is about an order of magnitude more than a pressure difference between discrete locations along a plenum where collective flow is distributed into individual cells within stack 500. Thus, establishing appropriate dimensions may be significant when working with a fixed plenum geometry toward the overall performance of stack 500.

As mentioned earlier, in a $CO_x$ electrolyzer, liquid water may be provided to the anode side of cell 501 during operation, while gaseous $CO_x$ may be provided to the cathode side of cell 501. In some implementations, an aqueous solution may be provided in place of water, and references to water herein may be understood to also be inclusive of the use of an aqueous solution as well. The liquid water may, through an electrolysis reaction on the anode side of cell 501, undergo oxidation to create oxygen ($O_2$) gas, H+ protons, and electrons. The H+ protons may be drawn through MEA 1105_1 due to the electromagnetic field that is present within cell 501 due to the electrical potential that is applied across cell 501 and may react with the bicarbonate and/or hydroxide and/or formate that is produced at the cathode side.

For a variety of other reasons, water may enter the cathode of MEA 1105_1. In some implementations, liquid water is transported by one or more phenomena to the cathode. Thus, water molecules from the anode side of cell 501 may be transported to the cathode side of cell 501, e.g., through electroosmotic drag caused by the movement of the H+ protons from the anode side of cell 501 to the cathode side of cell 501. The rate of water delivery to and/or generation within the cathode side of cell 501 may be relatively high, e.g., for every molecule of CO gas that is produced through reduction of $CO_x$ gas, there may be, for example, between five (5) and nine (9) molecules of water generated in and/or drawn to the cathode side of cell 501. This imbalance presents a significant challenge—for every molecule of $CO_x$ gas that is reduced on the cathode side of cell 501, between five (5) and nine (9) molecules of water may need to be removed from the cathode side of cell 501. In some $CO_x$ gas electrolyzers, such as those that may use a copper catalyst and may be used to generate CH 4, for every molecule of $CO_x$ gas that is reduced on the cathode side of cell 501, between five (5) and 36 molecules of water may need to be removed from the cathode side of cell 501, presenting an even greater water management challenge.

This imbalance between the rate of $CO_x$ gas reduction and rate of water accumulation on the cathode side of cell 501 is further complicated by the relatively low gas flow rate of $CO_x$ gas as compared with the typical gas flow rate on the cathode side in fuel cells, as well as the relatively lower temperatures and higher pressures used in $CO_x$ electrolyzers as compared with fuel cells. For example, fuel cells may dilute the flow of $O_2$ in the cathode of a fuel cell using nitrogen ($N_2$), thereby allowing a higher volumetric flow rate to be used in a fuel cell than may be used in a $CO_x$ electrolyzer. Such higher volumetric flow rates may allow for a faster rate of water molecule evacuation to be provided for in a fuel cell as compared with a $CO_x$ electrolyzer. In contrast, the $CO_x$ gas that is provided to a $CO_x$ electrolyzer may generally be high-purity $CO_x$ gas, which, in combination with the higher working pressures that may be common in $CO_x$ electrolyzers, may allow for much lower volumetric flow rates to be used to provide a similar level of desired reactant gas flow within a $CO_x$ electrolyzer as compared to a comparably sized fuel cell. The generally slower flow rate that is present in a $CO_x$ electrolyzer as opposed to in a fuel cell may, in combination with the higher rate of water creation in and/or migration to the cathode side of cell 501, cause significant issues in a $CO_x$ electrolyzer if not adequately handled that are not as significant a concern in fuel cells.

For example, approximately 90% of the water that is generated in/delivered to the cathode side of the cell during operation of a fuel cell may be in vapor phase, and thus, easily flowed out of the cathode flow field as compared with the water that is generated in/delivered to the cathode side of cell 501 during operation of a $CO_x$ electrolyzer. In a typical $CO_x$ electrolyzer, less than 2% of the gas phase that is generated in/delivered to the cathode side of cell 501 may be water in the vapor phase; the rest is in liquid phase. As a result of this significant liquid/vapor phase imbalance, as well as the significantly higher rate of water condensation in $CO_x$ electrolyzers, $CO_x$ electrolyzers are confronted with unique challenges with liquid water management that are not encountered in fuel cells. Such issues are, of course, also not present in water electrolyzers since the reactant that is delivered to the cathode side of water electrolyzers in the first place is liquid water that migrates from the anode, and the presence of liquid water in the cathode is, thus, not only expected, but desired and by design.

In $CO_x$ electrolyzers, the presence of high concentrations of liquid water on the cathode side of cell 501 presents particular challenges that must be overcome in order for $CO_x$ electrolyzers to be able to operate efficiently. In particular, the presence of liquid water in the cathode side of $CO_x$ electrolyzers may interfere with the flow of gaseous $CO_x$ through cathode GDL 1121_1 to MEA 1105_1 in cell 501. For example, excess liquid water that collects in the cathode channels of cathode flow field 1127_1 and/or cathode GDL 1121_1 may form a physical barrier that occludes portions of the cathode channels of cathode flow field 1127_1 and/or cathode GDL 1121_1 and prevents the gaseous $CO_x$ from coming into contact with some or all of MEA 1105_1. This limits the reduction efficiency of cell 501 and may even, in some cases, cause permanent damage to cell 501 that may decrease the reduction efficiency of cell 501 going forward even if the liquid water is later removed. An additional issue that may occur if there is excess liquid water present in a $CO_x$ electrolyzer is that the water may be reduced instead of the $CO_x$ gas, resulting in the production of hydrogen instead of the desired reaction product.

$CO_x$ electrolyzers may not only experience significantly higher rates of liquid water generation as compared with similarly sized fuel cell reactors, but may also tend to operate under conditions that tend to inhibit, at least in comparison to fuel cells, the ability of $CO_x$ electrolyzers to compensate for such increased liquid water generation in some respects. For example, the input gas, e.g., air, that is provided to the cathode side of fuel cells tends to be provided at a higher flow rate as compared with the input gas that is provided to the cathode side of $CO_x$ electrolyzers. As air is abundantly available, there is little concern with respect to a fuel cell with providing more air than can be utilized in the reduction reaction of a fuel cell. As a result, air may be provided to the cathode flow field in a fuel cell at a much higher flow rate than may be needed in order to support the reduction reaction taking place within the fuel cell, thereby allowing more kinetic energy to be available in fuel cell cathode input gas flows that may be used to assist with forcibly expelling water that has accumulated within the fuel cell cathode flow field. Further, in fuel cells, the oxidant gas may commonly be diluted with other gases, e.g., nitrogen in air, and higher flow rates may, thus, be used to ensure a sufficient rate of delivery of the oxidant gas to the cathode side of the fuel cell. The increased flow velocity in fuel cells may serve to forcibly push any potential droplets of liquid water that are present in the cathode flow field channel(s) through the flow field and to the fluidic outlet port of the cathode flow field, thereby rapidly evacuating what little liquid water is present in the flow field channels from the flow field.

In contrast, the input gas in a $CO_x$ electrolyzer is the $CO_x$ gas, and one of the main reasons for using $CO_x$ electrolyzers is to reduce $CO_x$ emissions that may be harmful to the environment by converting $CO_x$ gas to other, more desirable gases or liquids (e.g., commercially valuable gases or liquids or gases or liquids that are less harmful to the environment, e.g., water and/or oxygen). It may, thus, be desirable to reduce the flow rate of the $CO_x$ gas to a level that still achieves high, and preferably maximal, $CO_x$ reduction for a given electrical current density used with a $CO_x$ electrolyzer, but also reduces or minimizes the amount of extra $CO_x$ gas that is flowed through the $CO_x$ electrolyzer and is not reduced.

Due to such factors, $CO_x$ electrolyzers may operate using a high-purity, undiluted input gas stream or streams, e.g., pure $CO_x$ gas or relatively pure $CO_x$ gas, that is flowed into the cathode side of cell 501 at relatively low speeds, at least as compared with equivalently sized fuel cells having similar construction. For example, some $CO_x$ electrolyzers may be capable of operating at flow speeds comparable to or lower than those found in a typical fuel cell. In some implementations, $CO_x$ electrolyzers are configured to operate at an average $CO_x$ gas flow velocity in the flow field channels of between about 0.02 m/s and about 30 m/s, between about 0.02 m/s and about 15 m/s, between about 15 m/s and about 30 m/s, between about 0.02 m/s and about 7.5 m/s, between about 7.5 m/s and about 15 m/s, between about 15 m/s and about 23 m/s, between about 23 m/s and about 30 m/s, between about 0.02 m/s and about 3.8 m/s, between about 3.8 m/s and about 7.5 m/s, between about 7.5 m/s and about 11 m/s, between about 11 m/s and about 15 m/s, between about 15 m/s and about 19 m/s, between about 19 m/s and about 23 m/s, between about 23 m/s and about 26 m/s, or between about 26 m/s and about 30 m/s. In some implementations, $CO_x$ electrolyzers are configured to operate at a $CO_x$ gas flow velocity of about 2 m/s to 10 m/s, or about 5 m/s to 10 m/s, or about 7.5 m/s to about 10 m/s.

As indicated, in some implementations, relatively low flow rates provide advantages in $CO_x$ electrolyzers, such as relatively high $CO_x$ utilizations (not to be confused with conversion efficiency) due to low molar flow rates, which are often associated with low volumetric or linear flow rates. Another benefit is in maintaining the MEA (e.g., MEA 1105_1 of cell 501) at an acceptable hydration level. High gas flow rates tend to dry out the MEA, which leads to degradation. Further, for a fixed utilization, flow field designs having shorter channels, and hence more channels per cell, allow for lower gas speeds. In some embodiments, $CO_x$ electrolyzers are configured to operate at a $CO_x$ flow speed in flow channels of between about 0.02 m/s and about 5 m/s, between about 0.02 m/s and about 2.5 m/s, between about 2.5 m/s and about 5 m/s, between about 0.02 m/s and about 1.3 m/s, between about 1.3 m/s and about 2.5 m/s, between about 2.5 m/s and about 3.8 m/s, between about 3.8 m/s and about 5 m/s, between about 0.02 m/s and about 0.64 m/s, between about 0.64 m/s and about 1.3 m/s, between about 1.3 m/s and about 1.9 m/s, between about 1.9 m/s and about 2.5 m/s, between about 2.5 m/s and about 3.1 m/s, between about 3.1 m/s and about 3.8 m/s, between about 3.8 m/s and about 4.4 m/s, or between about 4.4 m/s and about 5 m/s.

In contrast, the typically lower flow rates seen in $CO_x$ electrolyzers, coupled with the significantly higher rates of liquid water introduction into the cathode side of cell 501, make water evacuation in $CO_x$ electrolyzers much more challenging as compared with other electrochemical devices, e.g., fuel cells or water electrolyzers.

Accordingly, various features and technologies may be used to help mitigate the detrimental effects of liquid water accumulation in $CO_x$ electrolyzer cathodes, as well as liquid water supply in $CO_x$ electrolyzer anodes. For example, anode frame 1115_2, cathode frame 1131_1, anode flow field 1111_2, and cathode flow field 1127_1 may be constructed so as to have one or more structural features that may allow for more effective liquid water management in cell 501. For example, anode frame 1115_2, cathode frame 1131_1, anode flow field 1111_2, and cathode flow field 1127_1 may have corresponding channels, risers, protrusions, distributors, collectors, etc., that may, for example, be designed to have certain characteristics that may contribute to 1) more effective water and gaseous $CO_x$ delivery to the anode and cathode sides of cell 501, 2) more effective water evacuation in the context of a $CO_x$ electrolyzer, 3) more effective mitigation of the potential performance degradation that may occur in such a $CO_x$ electrolyzer in the event that liquid water collects within, for instance, the cathode side of cell 501, and 4) more effective expulsion from cell 501 of the byproducts of the $CO_x$ reduction process. Accordingly, cathode frame 1131_1, anode frame 1115_2, cathode flow field 1127_1, and anode flow field 1111_2 will now be discussed in more detail in association with FIGS. 28-78, 83, 84A, 84B, and 85A-85C.

Cathode Frame

As previously discussed in association with FIGS. 5-11A, cathode flow field 1127 may be supported in an opening of cathode frame 1131 between separator plate 1107 and unitized MEA assembly 1119, as well as include a plurality of fluidic passages to facilitate fluid flow (or communication) through stack 500, and, in particular, through a cell of stack 500, such as cell 501. Various details of an illustrative cathode frame 1131 will now be discussed in more detail in association with FIGS. 28-36.

Figure 28:
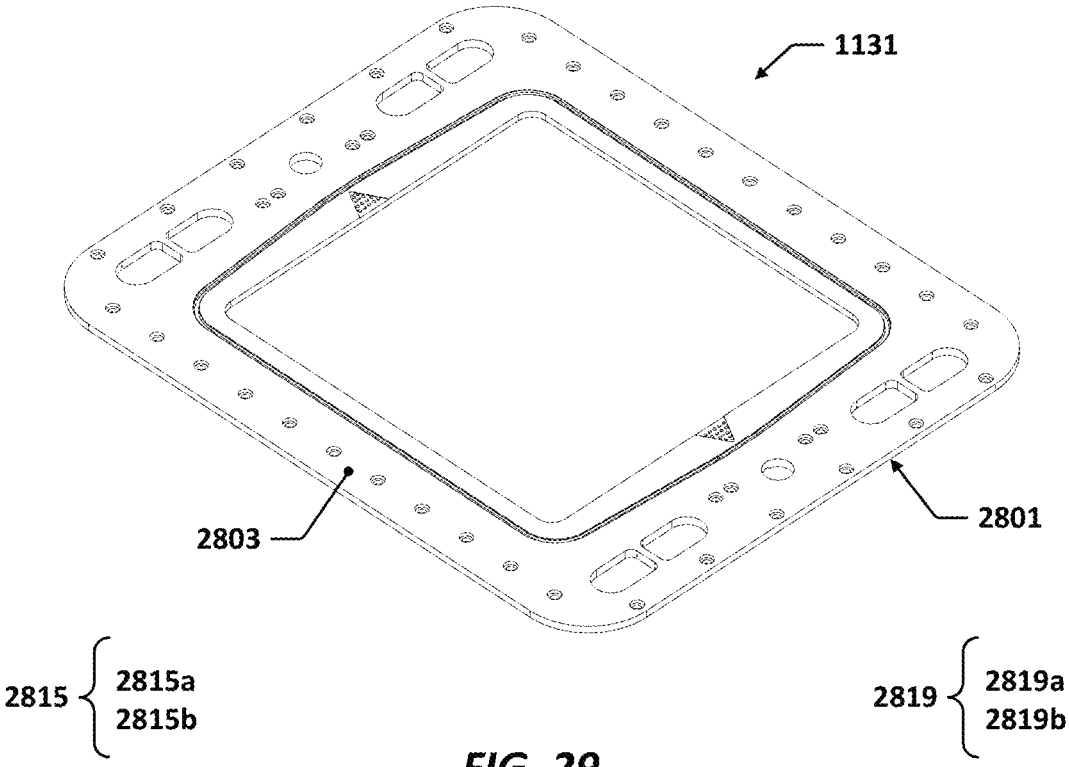
FIG. 28 depicts a first perspective view of an example cathode frame.
Figure 29:
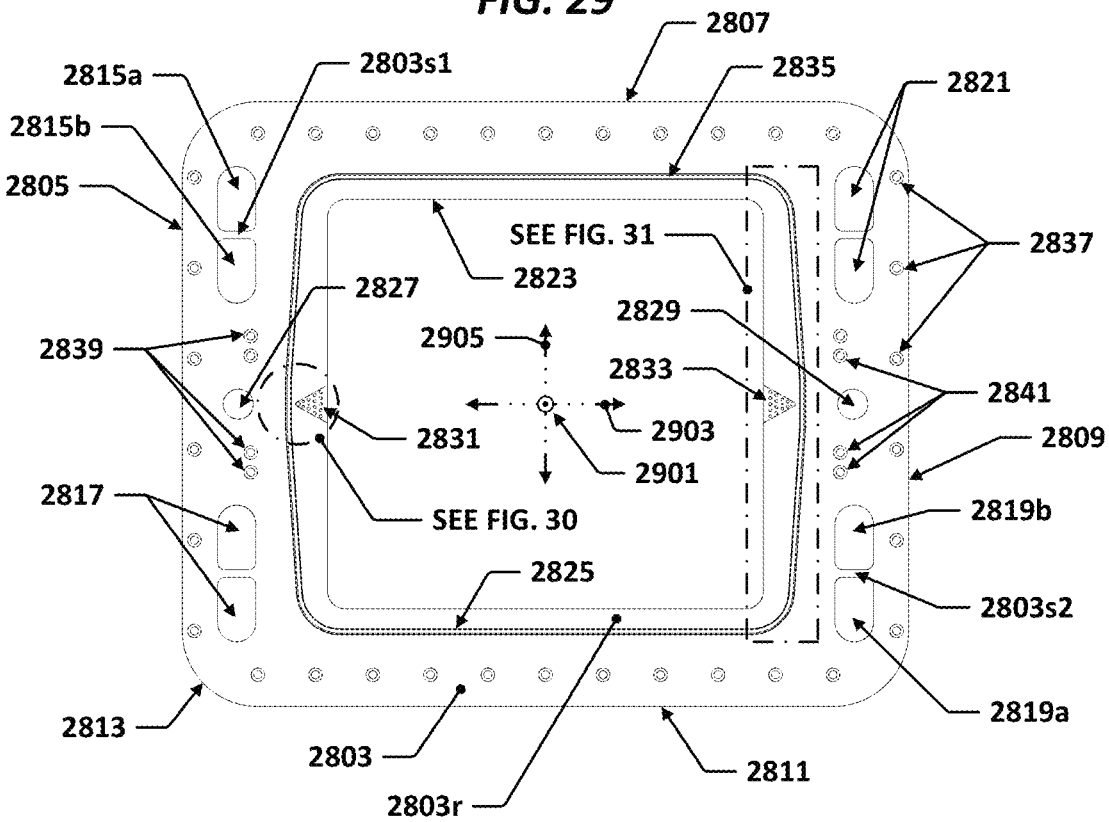
FIG. 29 depicts a bottom view of the example cathode frame of FIG. 28.
Figure 30:
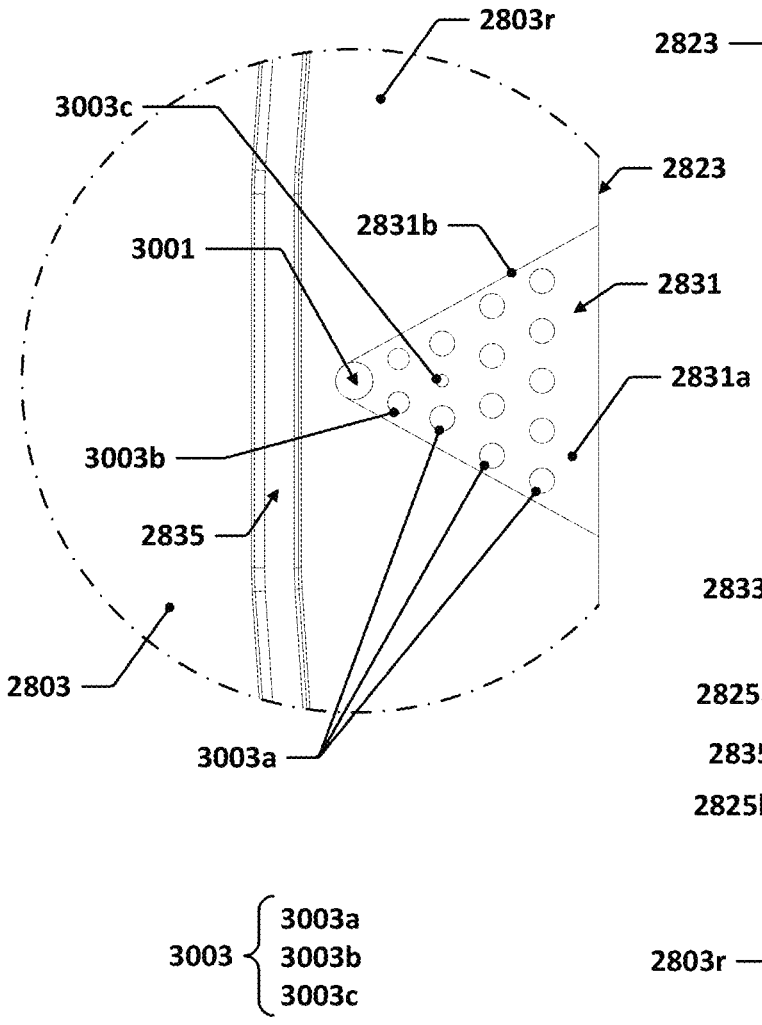
FIGS. 30 and 31 depict enlarged portions of the example cathode frame of FIG. 28.
Figure 31:
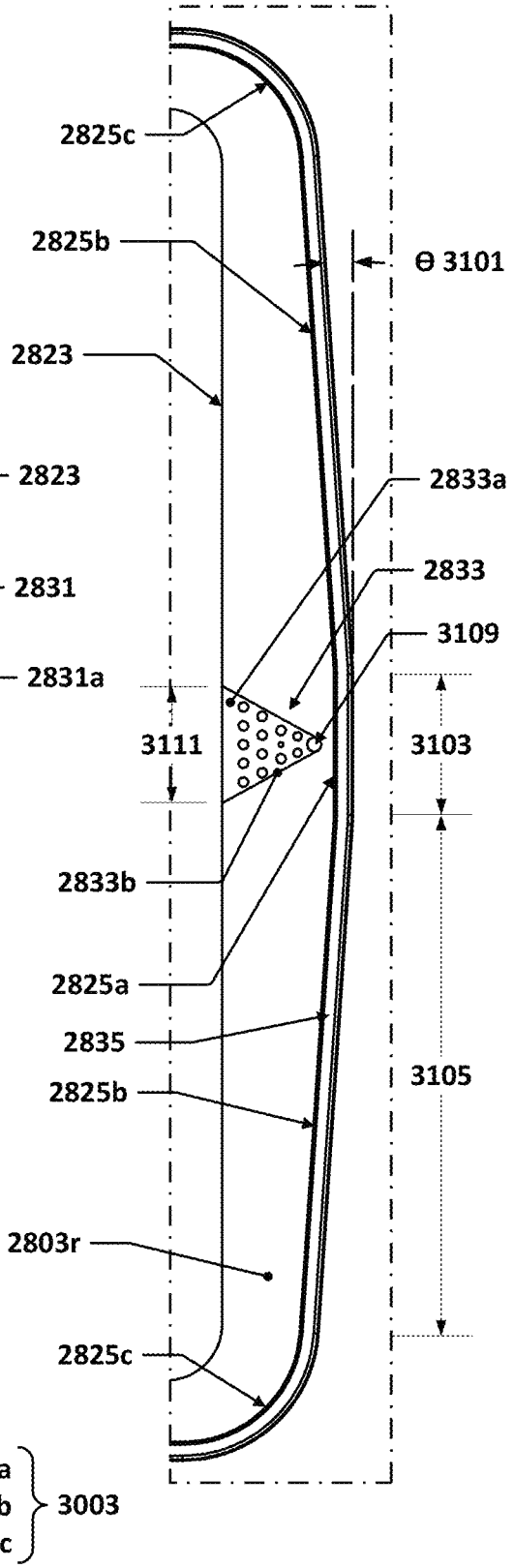
Figure 32:
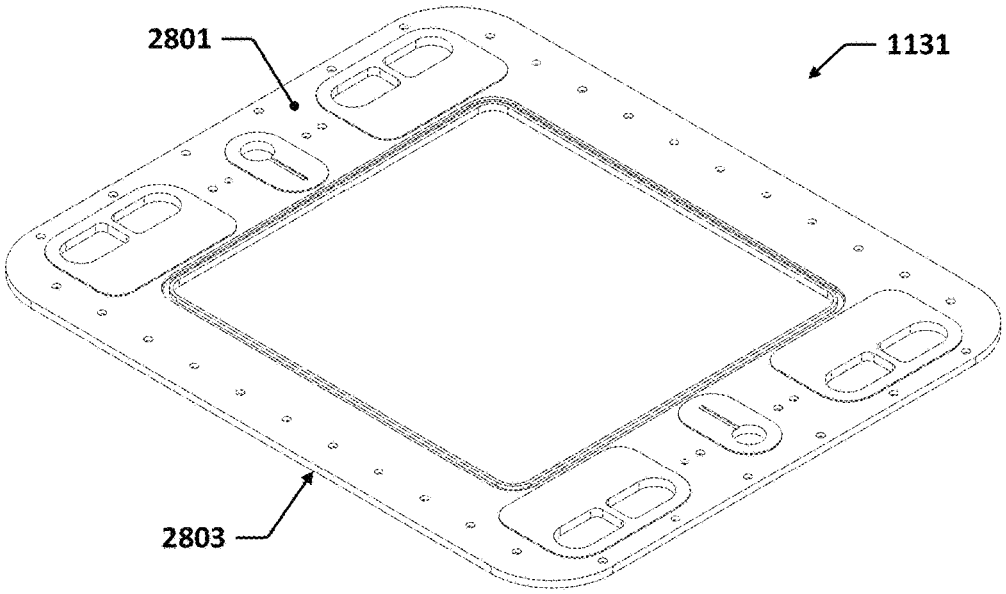
FIG. 32 depicts a second perspective view of the example cathode frame of FIG. 28.
Figure 33:
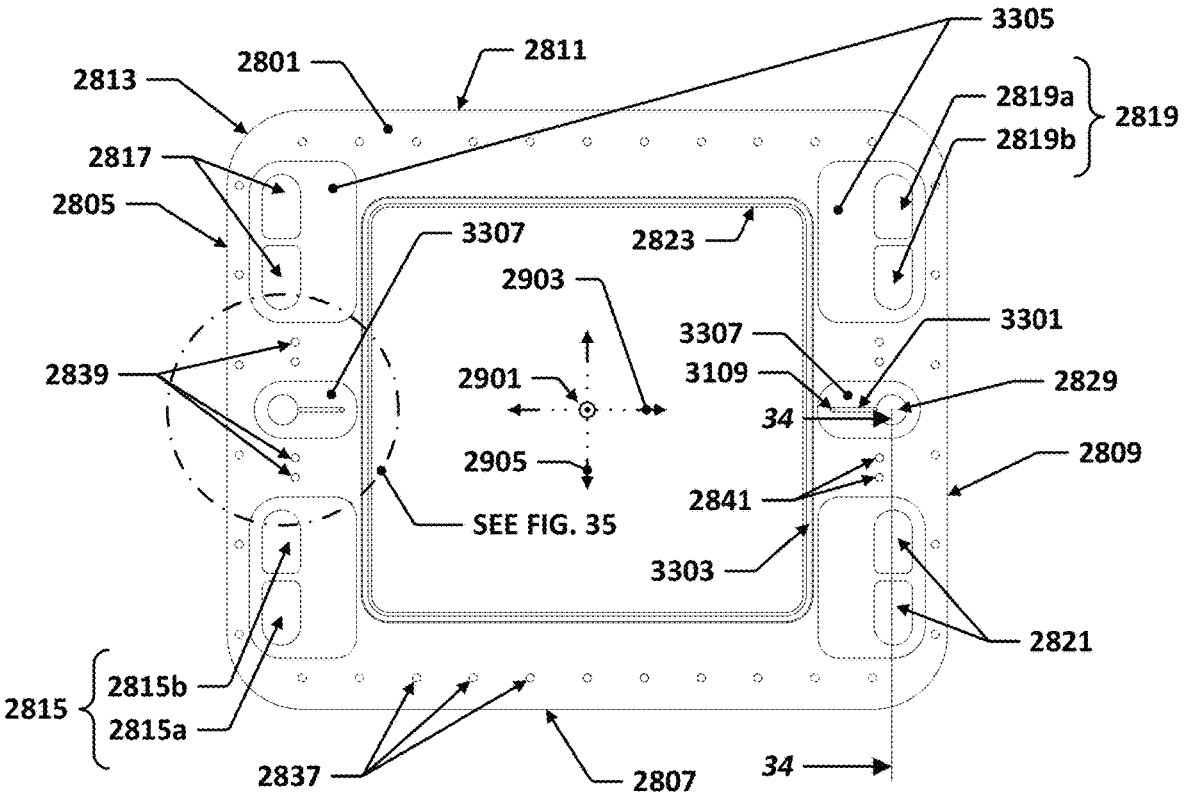
FIG. 33 depicts a top view of the example cathode frame of FIG. 32.
Figure 34:
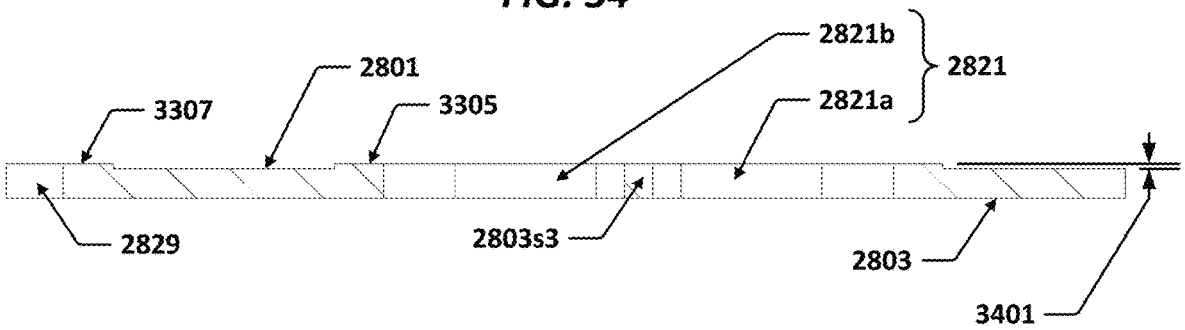
FIG. 34 depicts a cross-sectional view of the example cathode frame of FIG. 33 taken along sectional line 34-34.
Figure 35:
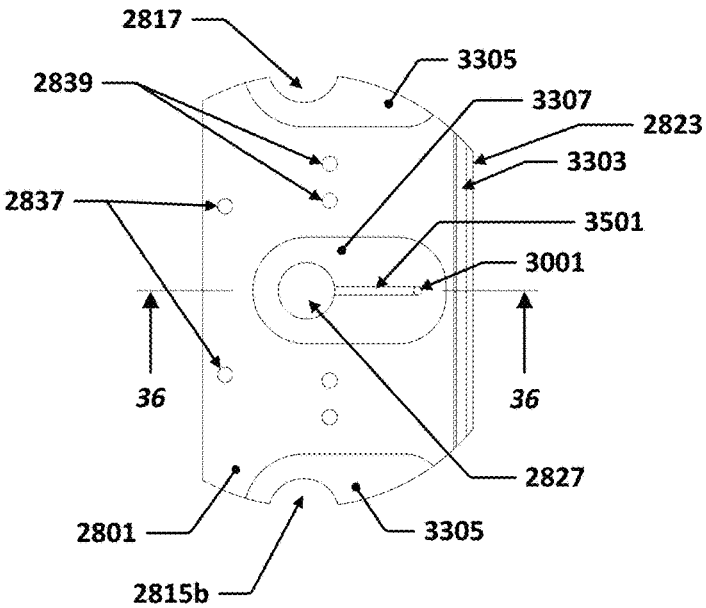
FIG. 35 depicts an enlarged portion of the example cathode frame of FIG. 33.
Figure 36:
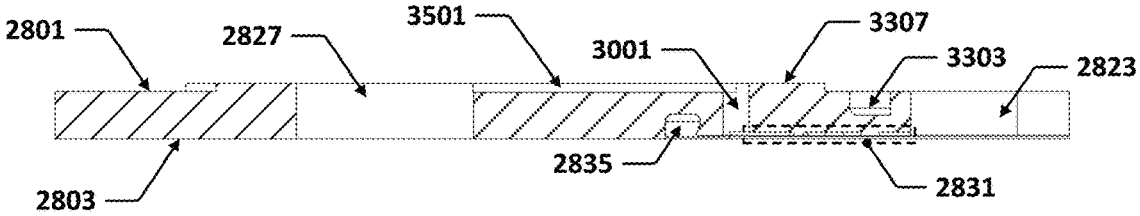
FIG. 36 depicts a cross-sectional view of the example cathode frame of FIG. 35 taken along sectional line 36-36.

FIG. 28 depicts a first perspective view of an example cathode frame. FIG. 29 depicts a bottom view of the example cathode frame of FIG. 28. FIGS. 30 and 31 depict enlarged portions of the example cathode frame of FIG. 28. FIG. 32 depicts a second perspective view of the example cathode frame of FIG. 28. FIG. 33 depicts a top view of the example cathode frame of FIG. 32. FIG. 34 depicts a cross-sectional view of the example cathode frame of FIG. 33 taken along sectional line 34-34. FIG. 35 depicts an enlarged portion of the example cathode frame of FIG. 33. FIG. 36 depicts a cross-sectional view of the example cathode frame of FIG. 35 taken along sectional line 36-36.

Cathode frame (or frame) 1131 may be a generally rectangular plate-shaped body having first surface 2801 (e.g., a top surface) opposing second surface 2803 (e.g., a bottom surface) in axial direction 2901 (see FIG. 29). Although frame 1131 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, frame 1131 will be described in association with a generally rectangular configuration. First and second surfaces 2801 and 2803 may be bounded by one or more peripheral surfaces, such as peripheral surfaces (or surfaces) 2805, 2807, 2809, and 2811 that may be connected to one another via one or more other peripheral surfaces, such as peripheral surface (or surface) 2813. In some embodiments, frame 1131 may have a symmetrical configuration about one or more reference planes perpendicular to axial direction 2901 shown in FIG. 29. For instance, a configuration of frame 1131 may be symmetrical about either or both of reference planes 2903 and 2905 (see FIG. 29), but embodiments are not limited thereto.

According to various embodiments, first fluidic inlet passages 2815 and 2817 may be adjacent to peripheral edge 2805, and first fluidic outlet passages 2819 and 2821 may be adjacent to peripheral edge 2809. First fluidic inlet passages 2815 and 2817 may form portions of inlet passages 1001 and 1003 (see FIG. 10) of stack 500 in association with inlet connectors 543 of manifold assembly 515 (see FIGS. 5-10) that provide input water to the various anode frames (e.g., anode frame 1115 in FIG. 11A) of stack 500, and, thereby, to the corresponding anode flow fields (such as anode flow field 1111 in FIG. 11A) of the plurality of cells, such as cell 501. First fluidic outlet passages 2819 and 2821 may form portions of outlet passages (that are similar to inlet passages 1001 and 1003 (see FIG. 10), but associated with outlet connectors 545 of manifold assembly 515 versus inlet connectors 543 (see FIG. 5)) of stack 500 that output water from the various anode frames of stack 500, such as anode frame 1115 in FIG. 11A, and, thereby, from corresponding anode flow fields (e.g., anode flow field 1111 in FIG. 11) of the plurality of cells. In some cases, first fluidic inlet and outlet passages 2815-2821 may be defined by respective pluralities of orifices separated from one another via corresponding septal walls. For instance, first fluidic inlet passage 2815 may include first and second inlet orifices 2815*a* and 2815*b* separated from one another via septal wall 2803*s*1, whereas first fluidic outlet passage 2819 may include first and second outlet orifices 2819*a* and 2819*b* separated from one another via septal wall 2803*s*2. Illustrative septal walls are also depicted in the cross-sectional views of FIGS. 23 and 34. For example, septal wall 2803*s*3 is shown separating first and second outlet orifices 2821*a* and 2821*b* forming first fluidic outlet passage 2821 in FIG. 34, and septal wall 2803*s*4 is shown separating first and second inlet orifices 2817*a* and 2817*b* forming first fluidic inlet passage 2817 in FIG. 23. The presence of these septal walls, such as septal walls 2803*s*1-2803*s*4, may increase the structural rigidity and, thereby, reliability of frame 1131 in the vicinity of first fluidic inlet and outlet passages 2815-2821.

According to various implementations, frame 1131 includes through opening (or opening) 2823 formed completely through a first central portion of frame 1131 and may be configured to receive at least a portion of cathode flow field 1127 (see, e.g., FIGS. 11A, 23, and 24) therein. In this manner, opening 2823 may be shaped and sized to correspond with the shape and size of cathode flow field 1127. For example, opening 2823 may have a generally rectangular shape with rounded corners, but embodiments are not limited thereto. Frame 1131 may also include blind opening (or opening) 2825 formed in a second central portion of frame 1131 encircling the first central portion of frame 1131. In some cases, opening 2825 may be omitted or may be at least partially filled by cathode annular insert 1134, as will become more apparent below. When included as part of cathode frame 1131, opening 2825 may terminate at surface 2803*r*, which may be recessed from second surface 2803, and may be configured to receive at least a portion of unitized MEA assembly 1119 (see, e.g., FIGS. 11A, 23, and 24) and/or at least a portion of cathode annular insert 1134 therein. As such, opening 2825 may be shaped and sized to correspond with the shape and size of the portion of unitized MEA assembly 1119 and/or cathode annular insert 1134, but embodiments are not limited thereto. For instance, opening 2825 may have a generally rectangular shape with rounded corners, but embodiments are not limited thereto. In some implementations, the sides of opening 2825 extending respectively adjacent to surfaces 2805 and 2809 of frame 1131 may bulge towards surfaces 2805 and 2809, and, thereby, away from opening 2823. For example, as seen in FIGS. 29 and 31, the side of opening 2825 extending adjacent to surface 2809 of frame 1131 may not only have central portion 2825*a* extending in a first direction parallel (or substantially parallel) to surface 2809, but may also have second portions 2825*b* extending from central portion 2825*a* that are angled inwards from first portion 2825*a* towards opening 2823 by, for instance, angle 3101. Central portion 2825*a* may have width 3103 in the first direction, whereas second portions 2825*b* may have corresponding widths 3105, which may be greater than width 3103. Curved (or arcuate) corners 2825*c* of opening 2825 may respectively extend from second portions 2825*b* to connect the side of opening 2825 extending adjacent to surface 2809 to corresponding sides of opening 2825 extending in a second direction transverse to the first direction, e.g., extending parallel (or substantially parallel) to surfaces 2807 and 2811 of frame 1131. Embodiments, however, are not limited thereto.

Figure 11B:
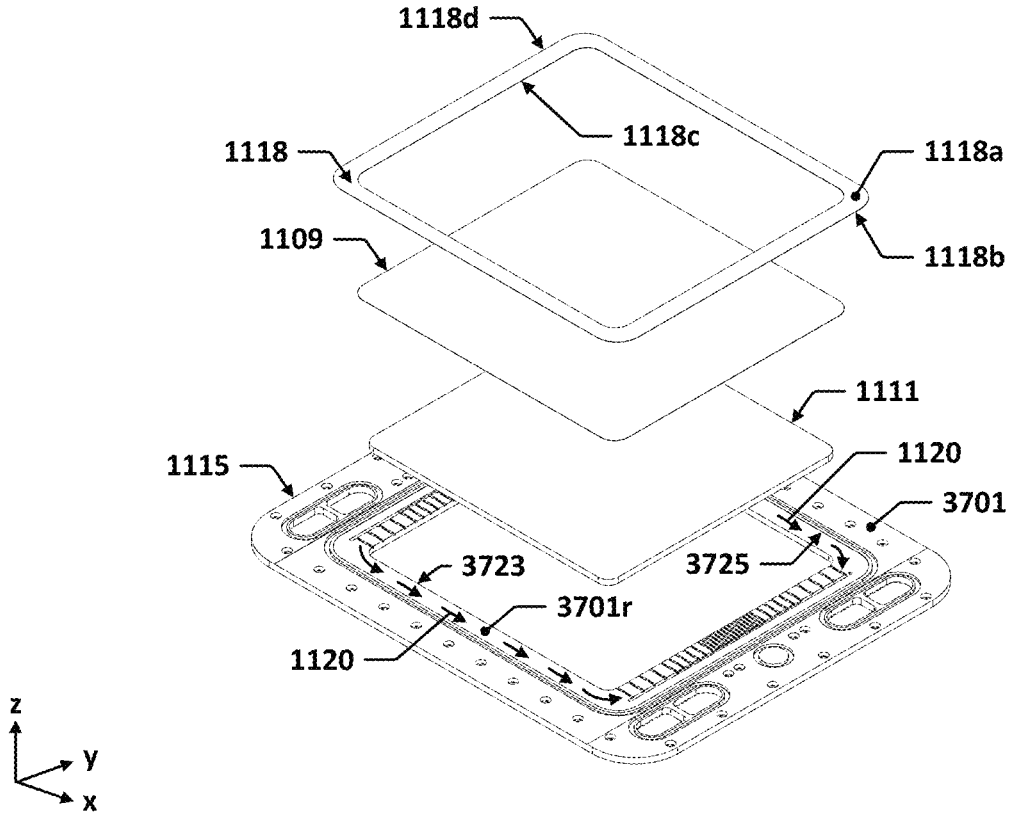
FIG. 11B depicts an exploded view of some cathode components of another example repeat unit of the example multi-cell $CO_x$ electrolyzer stack of FIG. 6.
Figure 11C:
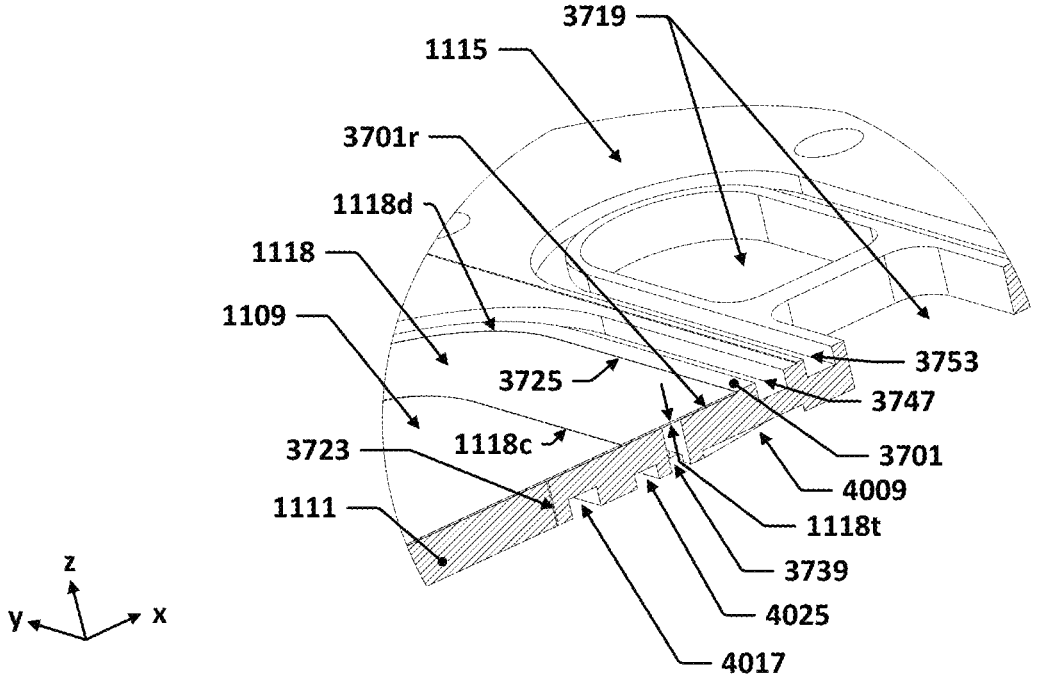
FIG. 11C depicts a cross-sectional view of the cathode components of the example repeat unit of FIG. 11B.
Figure 11D:
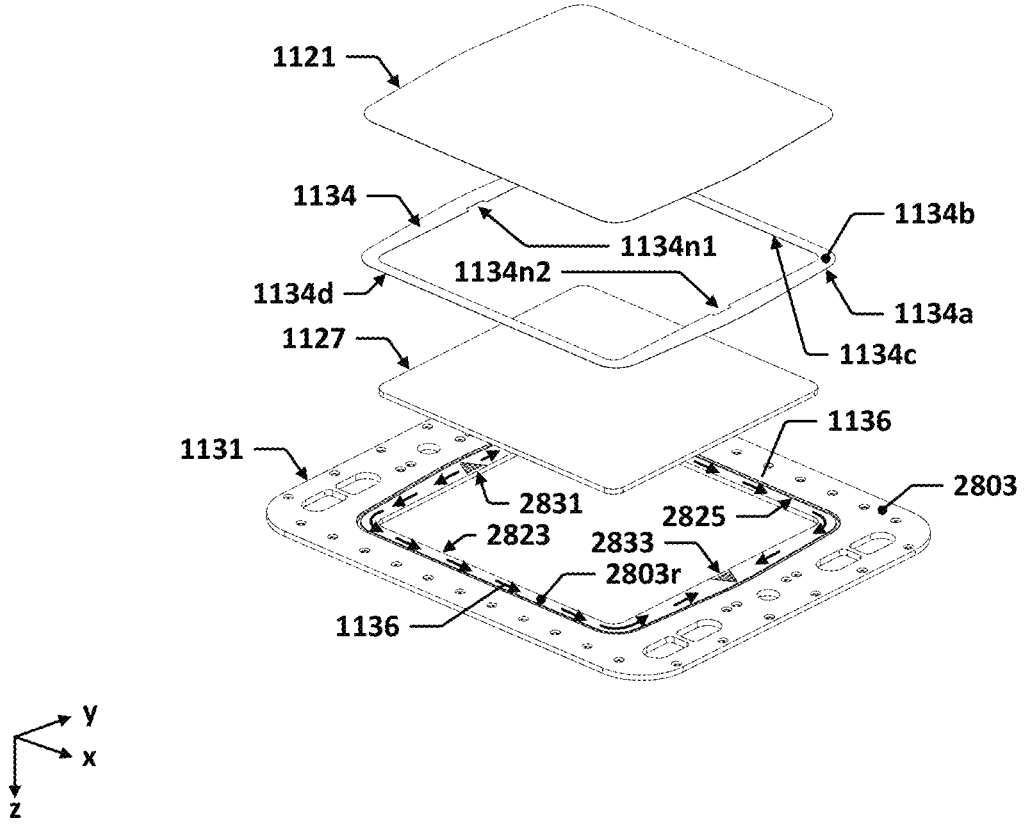
FIG. 11D depicts an exploded view of anode components of the example repeat unit of the example multi-cell $CO_x$ electrolyzer stack of FIG. 6.
Figure 11E:
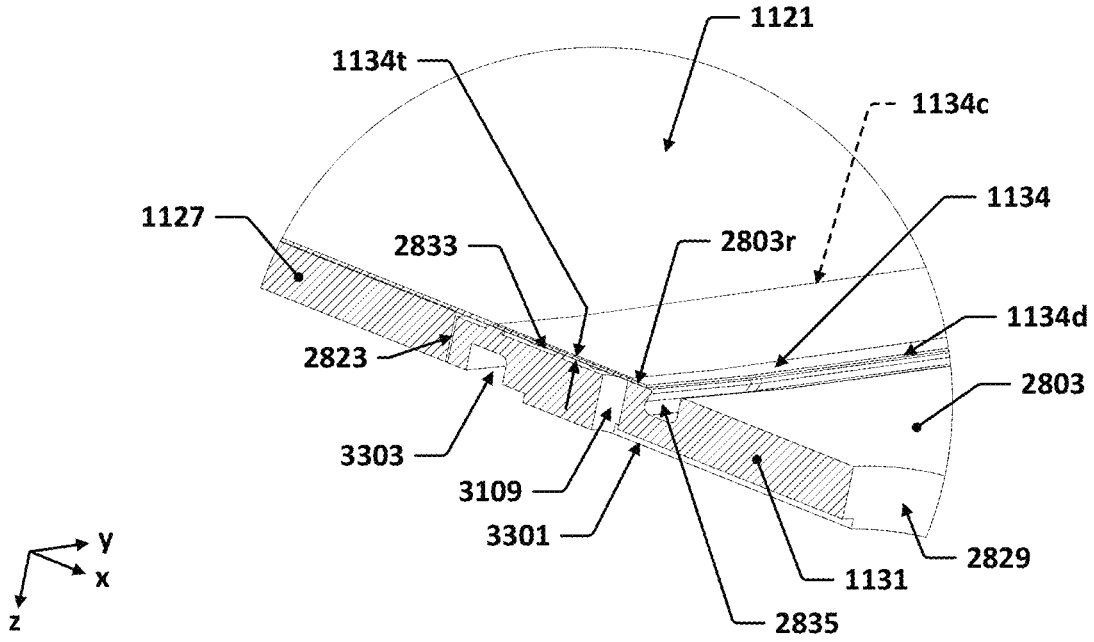
FIG. 11E depicts a cross-sectional view of the anode components of the example repeat unit of FIG. 11D.
Figure 13:
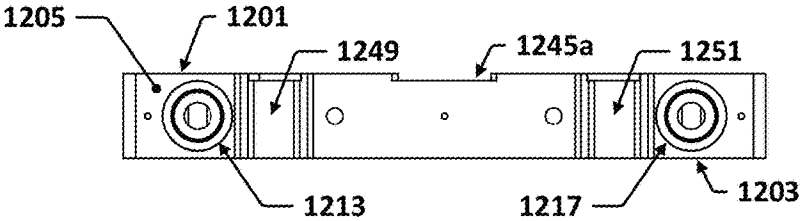
FIGS. 13, 14, 15, and 16 depict side views of the example manifold block of FIG. 12.
Figure 14:
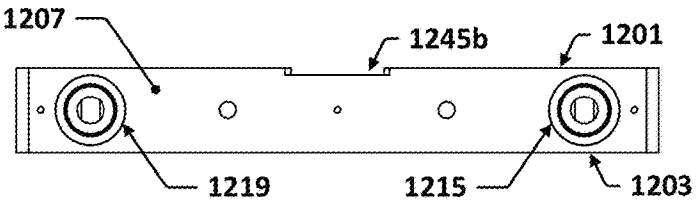
Figure 15:
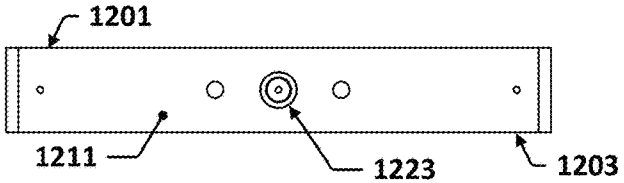
Figure 16:
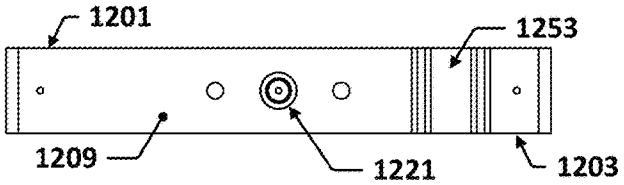

In those implementations including cathode annular insert 1134, cathode annular insert 1134 may be at least partially supported in opening 2825 such that first surface 1134*a* of cathode annular insert 1134 abuts against surface 2803*r* of frame 1131 and inner peripheral surface 1134*c* of cathode annular insert 1134 encircles an outer peripheral boundary of cathode flow field 1127, and thereby, an inner peripheral boundary of opening 2825 (see also FIGS. 11D and 11E). To this end, outer peripheral surface 1134*d* of cathode annular insert 1134 may be shaped and sized to correspond with the shape and size of an inner peripheral boundary of opening 2825. In some cases, thickness 1134*t* of cathode annular insert 1134 may be equivalent (or substantially equivalent) to the depth of opening 2825, but implementations are not limited thereto. When thickness 1134*t* of cathode annular insert 1134 corresponds to the depth of opening 2825, cathode annular insert 1134 may fill the void in cathode frame 1131 corresponding to opening 2825. It is also contemplated that cathode annular insert 1134 may include one or more notched portions 1134*n*1 and 1134*n*2 such that cathode annular insert 1134 does not completely fill the void corresponding to opening 2825. Whatever the case, cathode annular insert 1134 may have a generally ring-like configuration, and as such, may not be truly annular. For instance, cathode annular insert 1134 may have a generally rectangular cross-section when viewed along the z-axis direction shown in FIGS. 11D and 11E, thus giving rise to a cathode annular insert having two-fold symmetry instead of axial symmetry. As such, cathode annular insert 1134 may have, for instance, a circular, an oval, a polygonal, or any other suitable cross-sectional geometry when viewed along the z-axis direction shown in FIGS. 11D and 11E.

As seen in FIG. 29, openings 2823 and 2825 may be arranged between second fluidic inlet and outlet passages 2827 and 2829, which form respective portions of inlet and outlet passages 901 and 903 of stack 500 in association with input and outlet connectors 547 and 549 of manifold assembly 515 (see FIGS. 5 and 9). Referring momentarily to FIGS. 7, 9, 11A, 23, 24, and 29, inlet passage 901 may supply one or more reactants (e.g., gaseous $CO_x$) to frame 1131, and, thereby, to cathode flow field 1127 at least partially supported in opening 2823 when frame 1131 is incorporated as part of a cell, such as cell 501. Outlet passage 903, however, may enable one or more byproducts of the $CO_x$ reduction process to be routed from frame 1131, and, thereby, from the corresponding cathode flow field 1127 at least partially supported in one or more of openings 2823 and 2825. Adverting back to FIGS. 28-36, to enable such exchange of fluids to and from cathode flow field 1127 (see FIG. 11A), second fluidic inlet passage 2827 may be fluidically connected to opening 2823 via channel 3501, connecting riser 3001, and buffering passage 2831, and second fluidic outlet passage 2829 may be fluidically connected to opening 2823 via channel 3301, connecting riser 3109, and buffering passage 2833.

Buffering passages 2831 and 2833 may be corresponding recesses formed in surface 2803*r* that respectively terminate at surfaces 2831*a* and 2833*a*. To facilitate reactant supply to, and byproduct expulsion from, the corresponding cathode flow field 1127 (see, e.g., FIGS. 23 and 24) at least partially supported in opening 2823, buffering passages 2831 and 2833 may have corresponding outer sidewalls 2831*b* and 2833*b* that respectively expand from connecting risers 3001 and 3109 towards opening 2823. For instance, buffering passages 2831 and 2833 may have a generally triangular shape, but embodiments are not limited thereto. In some instances, respective widths 3111 of buffering passages 2831 and 2833 may be smaller than width 3103 of central portion 2825*a* of opening 2825. Buffering passages 2831 and 2833 may also include corresponding pluralities of protrusions 3003 arranged at one or more intervals to accelerate reactant/byproduct flow between adjacent protrusions among the protrusions 3003 and between protrusions 3003 and correspondingly adjacent sidewalls 2831*b* and 2833*b*. In association with buffering passage 2831, protrusions 3003 may not only promote a draw of reactant from connecting riser 3001, but may also facilitate a distributed flow of reactant to an input portion of cathode flow field 1127 (see, e.g., FIGS. 23 and 24) at least partially supported in opening 2823. Protrusions 3003, in association with buffering passage 2833, may promote a draw of byproduct from an output portion of cathode flow field 1127 (see, e.g., FIGS. 23 and 24) at least partially supported in opening 2823 to connecting riser 3109. Although protrusions 3003 are shown as generally cylindrically shaped bosses, embodiments are not limited thereto. For instance, one or more of protrusions 3003 may be generally elliptical bosses, generally rectangular bosses, generally pentagonal bosses, generally hexagonal bosses, etc. When incorporated as part of a cell, such as cell 501, cathode annular insert 1134 may be at least partially supported in opening 2825 to at least partially fill the void corresponding to opening 2825. By filling the void corresponding to opening 2825 (which is formed between opening 2823 in frame 1131 and recess 2835) the likelihood that input reactant(s) (e.g., gaseous $CO_x$) that are to be supplied to cathode flow field 1127 from buffering passage 2831 instead flow around cathode flow field 1127 via opening 2825 (illustrated in FIG. 11D as reactant bypass flow 1136) and become expelled via buffering passage 2833 is reduced or eliminated. It is noted that reactant bypass flow 1136 decreases the amount of input reactant flowing through cathode flow field 1134, and as such, has the potential to decrease the efficiency of the cell. In some cases, both opening 2825 and cathode annular insert 1134 may be omitted, thereby further reducing the possibility of reactant bypass flow 1136. In those instances when opening 2825 is formed in frame 1131 and cathode annular insert 1134 is not utilized, the compression of at least a portion of unitized MEA assembly 1119 therein may also serve to reduce or prevent reactant bypass flow 1136.

According to some embodiments, the inclusion of cathode annular insert 1134 may also aid in providing additional compression of GDL 1121 in the region occupied by cathode annular insert 1134 when the cell (e.g., cell 501) and/or stack 500 is assembled and compressed, whether as part of the assembly process or during use of stack 500. This additional compression may decrease in-plane permeability of GDL 1121 in the region corresponding to cathode annular insert 1134 and may further mitigate the potential for reactant bypass flow 1136. Given, however, that the presence of cathode annular insert 1134 between GDL 1121 and frame 1131 is likely to compress cathode annular insert 1134 in the axial direction, notched portions 1134*n*1 and 1134*n*2 may be formed in cathode annular insert 1134 in areas corresponding to buffering passages 2831 and 2833 to prevent or reduce the likelihood that cathode annular insert 1134 compresses into respective portions of buffering passages 2831 and 2833 that interface with opening 2823 in frame 1131. As such, notched portions 1134*n*1 and 1134*n*2 may be formed such that their leading edges corresponding to portions of inner peripheral surface 1134*c* of cathode annular insert 1134 overlap with corresponding protrusions 3003 respectively formed in buffering passages 2831 and 2833 to support cathode annular insert 1134 in the areas corresponding to buffering passages 2831 and 2833. For example, the leading edges of notched portions 1134*n*1 and 1134*n*2 may be supported by one or more of protrusions 3003. In some examples, the leading edges of notched portions 1134*n*1 and 1134*n*2 may be supported by one or more of protrusions 3003 positioned nearest to connecting riser 3001. Notched portions 1134*n*1 and 1134*n*2, however, may be omitted. In some cases, additional protrusions 3003 may be provided in buffering passages 2831 and 2833 to support cathode annular insert 1134 thereon, and thereby, to similarly prevent or reduce the likelihood that cathode annular insert 1134 compresses into the respective portions of buffering passages 2831 and 2833 that interface with opening 2823 in frame 1131.

In some embodiments, protrusions 3003 may be sized similar (or substantially similar) to one another or at least one protrusion among protrusions 3003 may be sized differently than at least one other protrusion among protrusions 3003. This may be with respect to the lengths, widths, and/or heights of protrusions 3003. For example, protrusions 3003 may include first, second, and third protrusions 3003*a*, 3003*b*, and 3003*c*. With respect to a reference plane perpendicular to the axial direction, a cross-sectional area of first protrusions 3003*a* may be larger than a cross-sectional area of second protrusions 3003*b*, and a cross-sectional area of second protrusions 3003*b* may be larger than a cross-sectional area of third protrusions 3003*c*. In some cases, second protrusions 3003*b* of buffering passages 2831 and 2833 may be disposed respectively closer to connecting risers 3001 and 3109 than first and third protrusions 3003*a* and 3003*c*. Third protrusions 3003*c* may be arranged amongst first protrusions 3003*a* and positioned such that third protrusions 3003*c* are disposed between second protrusions 3003*b* and a majority of first protrusions 3003*a*. Embodiments, however, are not limited to such a configuration and/or arrangement of protrusions 3003.

Frame 1131 may also include recess 2835 in surface 2803 and recess 3303 in surface 2801 that are configured to respectively receive corresponding portions of first and second cathode gaskets 1129 and 1133 (see, e.g., FIGS. 11A, 23, and 24) therein when, for example, frame 1131 is assembled as part of a repeat unit (e.g., repeat unit 503_1 in FIG. 5) or cathode interface assembly 505 (see FIG. 5). Recess 2835 may be formed to encircle the periphery of opening 2825 and recess 3303 may be formed to encircle the periphery of opening 2823. It is noted that the conjunction of second fluidic inlet passage 2827, channel 3501, connecting riser 3001, and buffering passage 2831 enables reactant supply to flow from an area outside of first cathode gasket 1129 (see, e.g., FIGS. 11A, 23, and 24) to an area inside of first cathode gasket 1129 without disturbing the integrity of or seal provided by first cathode gasket 1129. Similarly, the conjunction of buffering passage 2833, connecting riser 3109, channel 3301, and second fluidic outlet passage 2829 enables byproduct flow from an area inside of first cathode gasket 1129 (see, e.g., FIGS. 11A, 23, and 24) to an area outside of first cathode gasket 1129 without disturbing the integrity of or seal provided by first cathode gasket 1129.

According to some embodiments, frame 1131 may include first protruded portions 3305 extending from surface 2801 and encircling corresponding first fluidic inlet and outlet passages 2815, 2817, 2819, and 2821. Second protruded portions 3307 may also extend from surface 2801, but encircle respective second fluidic inlet and outlet passages 2827 and 2829. In some implementations, the second protruded portion 3307 encircling second fluidic inlet passage 2827 may also encircle channel 3501 and connecting riser 3001, and the second protruded portion 3307 encircling second fluidic outlet passage 2829 may also encircle channel 3301 and connecting riser 3109. In some embodiments, first and second protruded portions 3305 and 3307 may protrude from surface 2801 by height 3401, but embodiments are not limited thereto. For instance, one or more of first and second protruded portions 3305 and 3307 may have a different height than at least another one or more of first and second protruded portions 3305 and 3307. When assembled as part of a repeat unit (e.g., repeat unit 1100 in FIG. 11A), first and second protruded portions 3305 and 3307 of frame 1131 may be received in and through corresponding openings in a separator plate (such as separator plate 1107 in FIG. 11A; see also FIGS. 23 and 24) or corresponding recesses 4607-4617 (see FIG. 46) in cathode interface separator 1701 (see FIG. 17) of cathode interface assembly 505 (see, e.g., FIGS. 5-10 and 17). As such, one or more of first and second protruded portions 3305 and 3307 may be sized to form respective clearance or interference fits with the corresponding openings in the separator plate (such as separator plate 1107 in FIG. 11A) or corresponding recesses 4607-4617 (see FIG. 46) in cathode interface separator 1701 (see FIGS. 17 and 46) when frame 1131 is assembled as part of a repeat unit (e.g., repeat unit 503_1 in FIG. 5 or as part of cathode interface assembly 505, see, e.g., FIGS. 5-10, 17, and 18).

In some embodiments, one or more of first and second protruded portions 3305 and 3307 may be sized to form respective clearance fits with corresponding features in (or of) the separator plate to which frame 1131 interfaces when incorporated as part of stack 500 (such as separator plate 1107 in FIG. 11A) or cathode interface separator 1701 (see, e.g., FIG. 17) depending on the location of frame 1131 within stack 500). In addition, one or more of first and second protruded portions 3305 and 3307 may be sized to form respective interference fits with the corresponding features in the separator plate to which frame 1131 interfaces when incorporated as part of stack 500 (such as separator plate 1107 in FIG. 11A) or cathode interface separator 1701 (see, e.g., FIG. 17) depending on the location of frame 1131 within stack 500). For example, respective outer boundaries of first and second protruded portions 3305 and 3307 may be about 0.01% to about 5% larger (in the case of an interference fit) or about 0.01% to about 10% smaller (in the case of a clearance fit) than corresponding boundaries of the corresponding features in the separator plate (such as separator plate 1107 in FIG. 11A) or cathode interface separator 1701 (see, e.g., FIG. 17) depending on the location of frame 1131 within stack 500). The clearance and/or interference fits may be utilized to constrain in-plane expansion (e.g., expansion in, for instance, a plane parallel to an x-y plane (see FIG. 11A)) of frame 1131 (and, in some embodiments, anode frame 1115) during operation of stack 500 without unduly stressing frame 1131 and/or anode frame 1115. In some embodiments, first and second protruded portions 3305 and 3307 may be sized to form respective clearance fits with corresponding features in (or of) the separator plate (such as separator plate 1107 in FIG. 11A) or cathode interface separator 1701 (see, e.g., FIG. 17) depending on the location of frame 1131 within stack 500) in a cooled, non-operational state of stack 500 (see FIGS. 5 and 6), but expand to form corresponding interference fits in a steady-state operational condition of stack 500. This may prevent (or at least reduce the likelihood of) misalignments, bunching, etc., of cathode GDLs 1121 and anode PTLs 1109 of the various cells of stack 500, as well as prevent (or reduce the likelihood of) misalignments between adjacent frames of adjacent cells of stack 500. Such a configuration may also allow frame 1131 and/or anode frame 1115 (see FIG. 11A) to be formed of more compliant materials that, in some cases, may be less expensive and/or easier to manufacture (and, in some cases, not electrically conductive). It is noted, however, that the separator plate (e.g., separator plate 1107 in FIG. 11A) or cathode interface separator 1701 (see, e.g., FIG. 17) depending on the location of frame 1131 within stack 500) may be formed of a stronger and/or more rigid material(s) to increase the strength and/or rigidity of the various repeat units (e.g., repeat unit 1100 of FIG. 11A; see also repeat units 503 in FIGS. 5-10) and/or cathode interface assembly 505 (see, e.g., FIGS. 5-10, 17, and 18).

According to various embodiments, first protruded portions 3305 may be sized and shaped to interface with second anode gaskets 1117*b* of second anode gasket set 1117 and second protruded portions 3307 may be sized and shaped to interface with third anode gaskets 1117*c* of second anode gasket set 1117. As such, cross-flow between first and second fluidic inlet and outlet passages 2815, 2817, 2819, 2821, 2827, and 2829 may be prevented.

Frame 1131 may also include first fastener orifices 2837 arranged about a peripheral area of frame 1131 at one or more intervals. In some embodiments, a pitch between adjacent first fastener orifices 2837 may be constant (or substantially constant), but embodiments are not limited thereto. Second and third fastener orifices 2839 and 2841 may be inset from first fastener orifices 2837 in central portions of frame 1131 respectively near second fluidic inlet and outlet passages 2827 and 2829. A pitch between adjacent second fastener orifices 2839 and a pitch between adjacent third fastener orifices 2841 may be smaller than the pitch(es) between adjacent first fastener orifices 2837. In various embodiments, first, second, and third fastener orifices 2837, 2839, and 2841 may extend completely through frame 1131 and may be counterbored with respect to, for example, surface 2803. When assembled as part of a repeat unit (e.g., repeat unit 1100 in FIG. 11A), first, second, and third fastener orifices 2837, 2839, and 2841 may be configured to respectively receive corresponding fasteners 1137 (see FIG. 11A), which may engage with, for instance, swage nuts 1135 (see FIG. 11A) incorporated into (or as part of) anode frame 1115 (see, e.g., FIGS. 11A and 21), as will become more apparent below. In those instances when frame 1131 is incorporated as part of cathode interface assembly 505 (see, e.g., FIGS. 5-10, 17, and 18)), first, second, and third fastener orifices 2837, 2839, and 2841 may be configured to respectively receive corresponding fasteners 1137 (see FIG. 17), which may engage with, for instance, first, second, and third threaded fastener orifices 4539, 4541, and 4543 of cathode interface separator 1701 (see, e.g., FIGS. 17, 18, and 45), as will become more apparent below.

According to various embodiments, one or more of the counterbored portions of first, second, and third fastener orifices 2837, 2839, and 2841 may be sized to form respective clearance or interference fits with corresponding fasteners 1137 (see FIG. 11A) or corresponding portions (e.g., head or shoulder portions) of fasteners 1137 (see, e.g., FIG. 21) when frame 1131 is assembled as part of a repeat unit (e.g., repeat unit 1100 in FIG. 11A) or as part of cathode interface assembly 505 in, for instance, FIGS. 5-10, 17, and 18. In some embodiments, one or more of the counterbored portions of first, second, and third fastener orifices 2837, 2839, and 2841 may be sized to form respective clearance fits with corresponding fasteners 1137 (see, e.g., FIGS. 11A, 17, and 21) and one or more of the counterbored portions of first, second, and third fastener orifices 2837, 2839, and 2841 may be sized to form respective interference fits with corresponding fasteners 1137. For example, respective widths (e.g., diameters) of the counterbored portions of first, second, and third fastener orifices 2837, 2839, and 2841 may be about 0.01% to about 10% larger (in the case of a clearance fit) or about 0.01% to about 5% smaller (in the case of an interference fit) than corresponding widths (e.g., diameters) of respective portions (e.g., head or shoulder portions) of fasteners 1137 (see, e.g., FIGS. 11A, 17, and 21). In some embodiments, one or more of the counterbored portions of first, second, and third fastener orifices 2837, 2839, and 2841 may be sized to form respective clearance fits with corresponding fasteners 1137 (see, e.g., FIGS. 11A, 17, and 21) or corresponding portions (e.g., head or shoulder portions) of fasteners 1137 (see, e.g., FIG. 21) when frame 1131 is assembled as part of a repeat unit (e.g., repeat unit 1100 in FIG. 11A) or as part of cathode interface assembly 505 in, for instance, FIGS. 5-10, 17, and 18, and stack 500 (see, e.g., FIG. 5) is in a cooled, non-operational state, but expand to form corresponding interference fits in a steady-state operational condition of stack 500. These clearance and/or interference fits may be utilized to constrain in-plane expansion (e.g., expansion in, for instance, a plane parallel to an x-y plane (see FIG. 11A)) of frame 1131 (and, in some embodiments, anode frame 1115 in FIG. 11A) during operation of stack 500 without unduly stressing frame 1131 and/or anode frame 1115. This may prevent (or at least reduce the likelihood of) misalignments, bunching, etc., of anode PTLs 1109 and cathode GDLs 1121 of the various cells/repeat units of stack 500 (see, e.g., FIGS. 5-10), as well as prevent (or reduce the likelihood of) misalignments between adjacent frames of adjacent cells/repeat units of stack 500. Such a configuration may also allow frame 1131 and/or anode frame 1115 to be formed of more compliant materials that, in some cases, may be less expensive and/or easier to manufacture (and, in some cases, not electrically conductive).

According to some embodiments, frame 1131 and/or cathode annular insert 1134 may be formed of any suitable thermoplastic and/or thermosetting material, such as, for instance, polyethylene terephthalate (PET), polycarbonate (PC), polyimide (PI), polyamide (PA), poly(methylmethacrylate) (PMMA), polyethylene naphthalate (PEN), polyetherketone (PEK), polyetheretherketone (PEEK), polystyrene (PS), polyetherimide (PEI), polyphenylene sulfide (PPS), polyarylate (PAR), polyether sulfone (PES), cyclic olefin copolymer (COC), polyvinyl alcohol (PVA), ethylene chlorotrifluoroethylene (ECTFE), polytetrafluoroethylene (PTFE), polybutylene terephthalate (PBT), polychlorotrifluoroethylene (PCTFE), polyethylene terephthalate glycol (PETG), and/or the like. In some cases, frame 1131 and/or cathode annular insert 1134 may be formed of one or more metals or metal alloys, such as aluminum, aluminum alloy, copper, copper alloy, tin, tin alloy, titanium, titanium alloy, tungsten, tungsten alloy, zinc, zinc alloy, steel, stainless steel, etc. It is noted, however, that when formed of a metal or metal alloy, frame 1131 may, in some embodiments, include a coating or other feature to, for instance, electrically insulate frame 1131 from a corresponding cathode GDL (e.g., cathode GDL 1121 in FIG. 11A) and/or cathode flow field (e.g., cathode flow field 1127 in FIG. 11A) associated therewith. It is also contemplated that a base material of frame 1131 may be coated with, for example, one or more other materials, e.g., one or more corrosion-resistant materials. Whatever the case, frame 1131 and/or cathode annular insert 1134 may be formed in any suitable manner, such as additively manufactured, stamped, injection molded, compression molded, casted, machined, and/or the like.

Anode Frame

Similar to cathode flow field 1127 (see, e.g., FIGS. 11A, 23, and 24), anode flow field 1111 may be at least partially supported in an opening of anode frame 1115 (see, e.g., FIGS. 11A, 23, and 24), which also includes a plurality of fluidic passages to facilitate fluid communication (or flow) through stack 500 (see, e.g., FIGS. 5-10), and, in particular, through a $CO_x$ electrolyzer cell of stack 500, such as cell 501. Various details of an illustrative anode frame 1115 will now be discussed in more detail in association with FIGS. 37-42.

Figure 37:
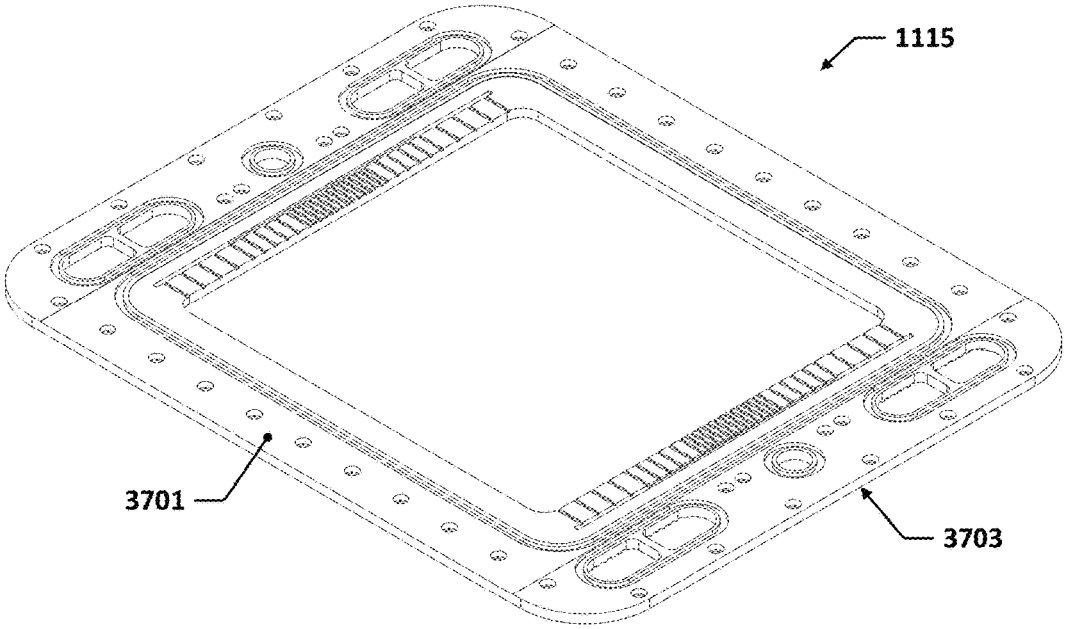
FIG. 37 depicts a first perspective view of an example anode frame.
Figure 38:
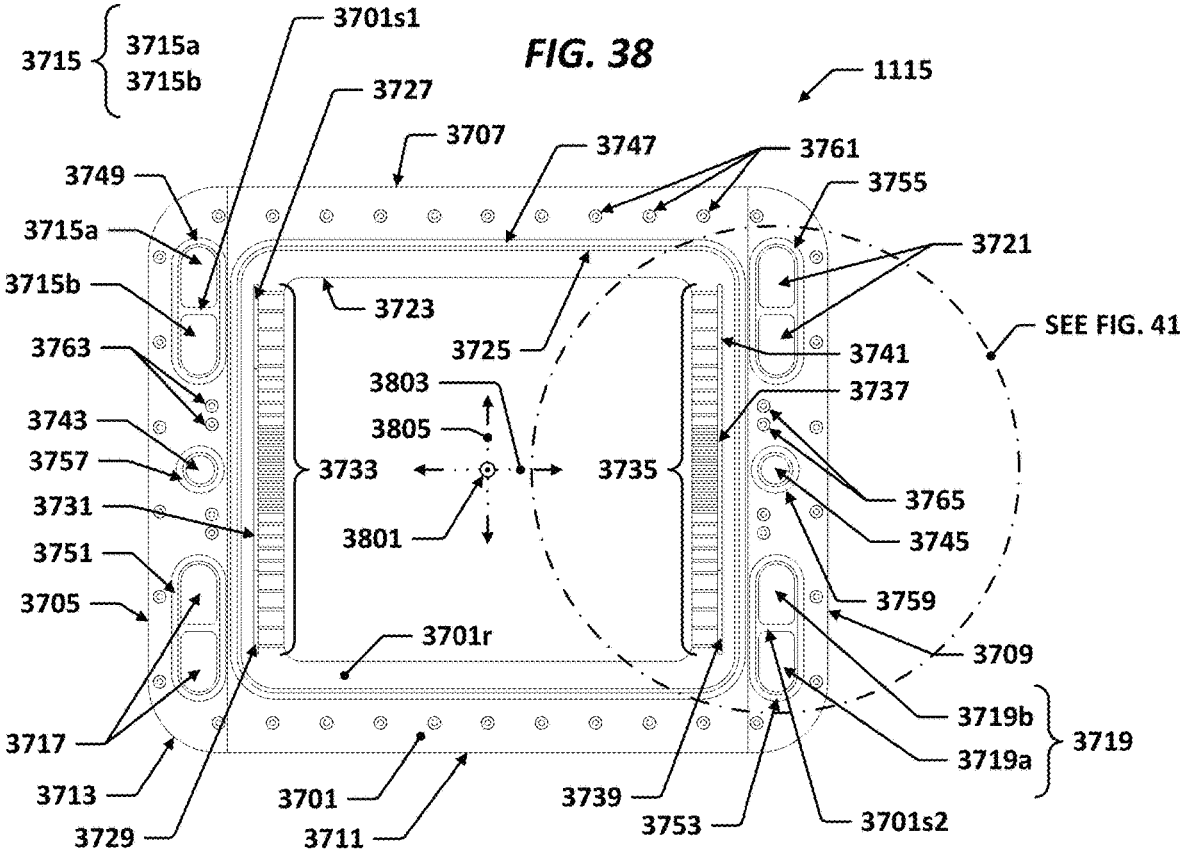
FIG. 38 depicts a top view of the example cathode frame of FIG. 37.
Figure 39:
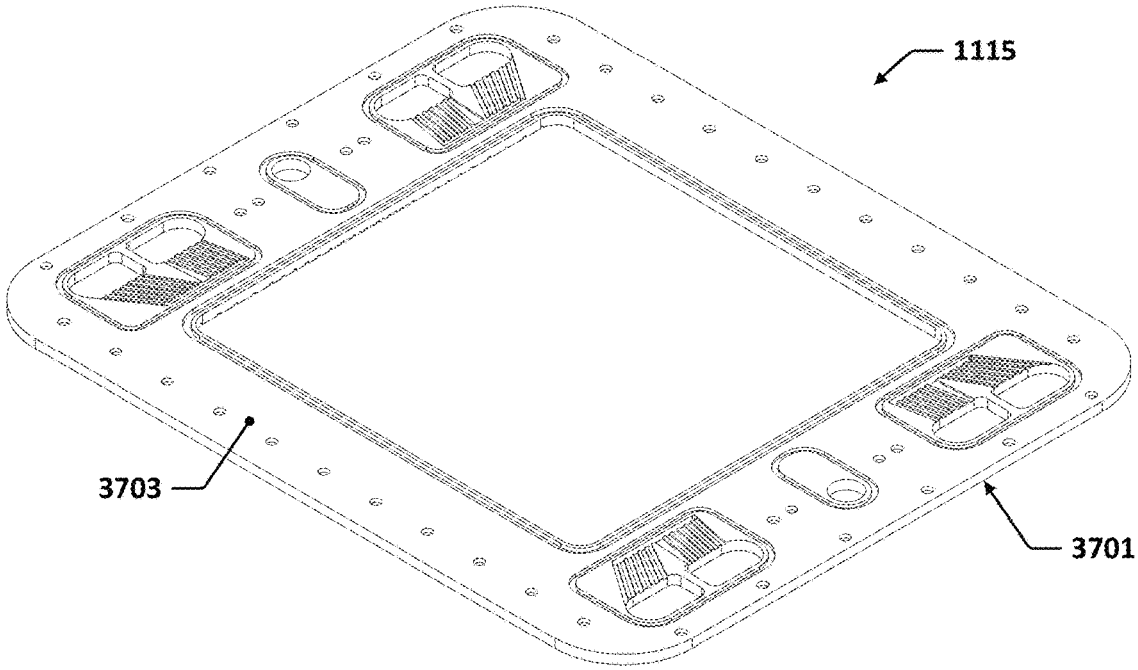
FIG. 39 depicts a second perspective view of the example anode frame of FIG. 37.
Figure 40:
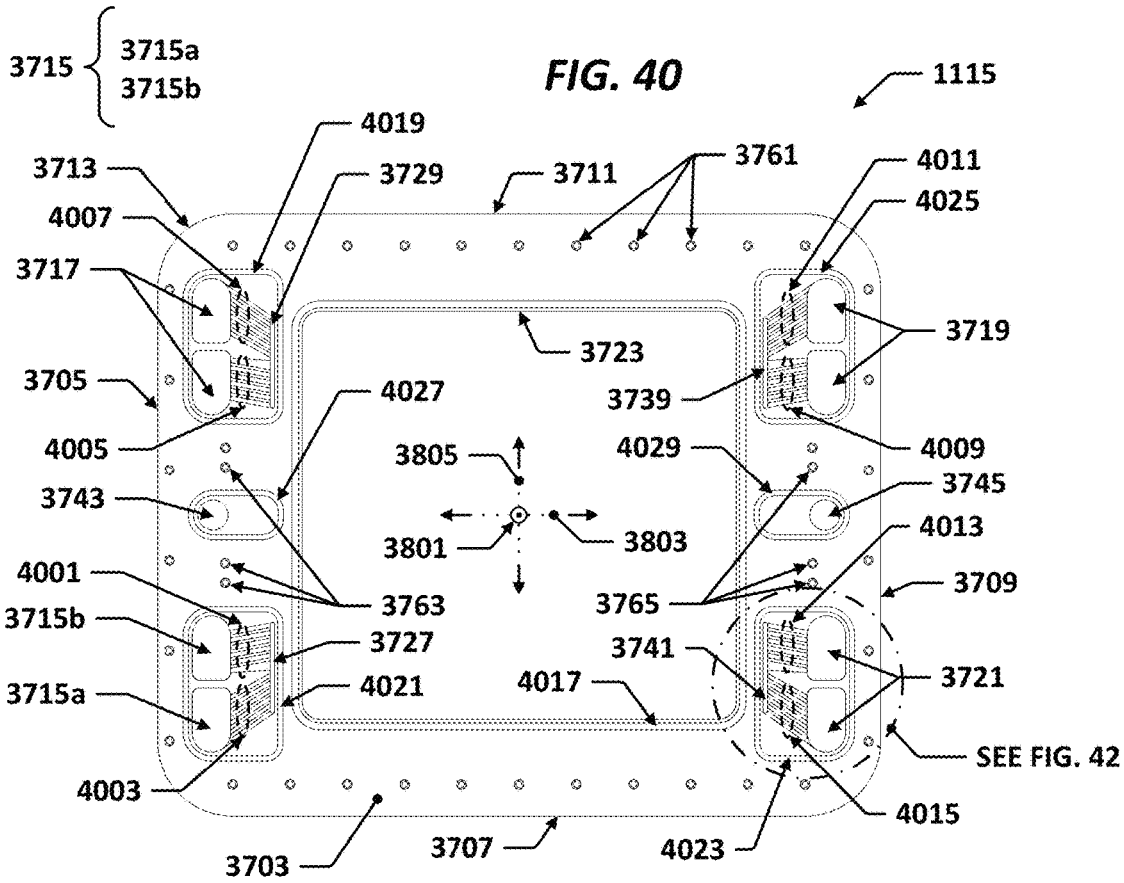
FIG. 40 depicts a bottom view of the example anode frame of FIG. 39.
Figure 41:
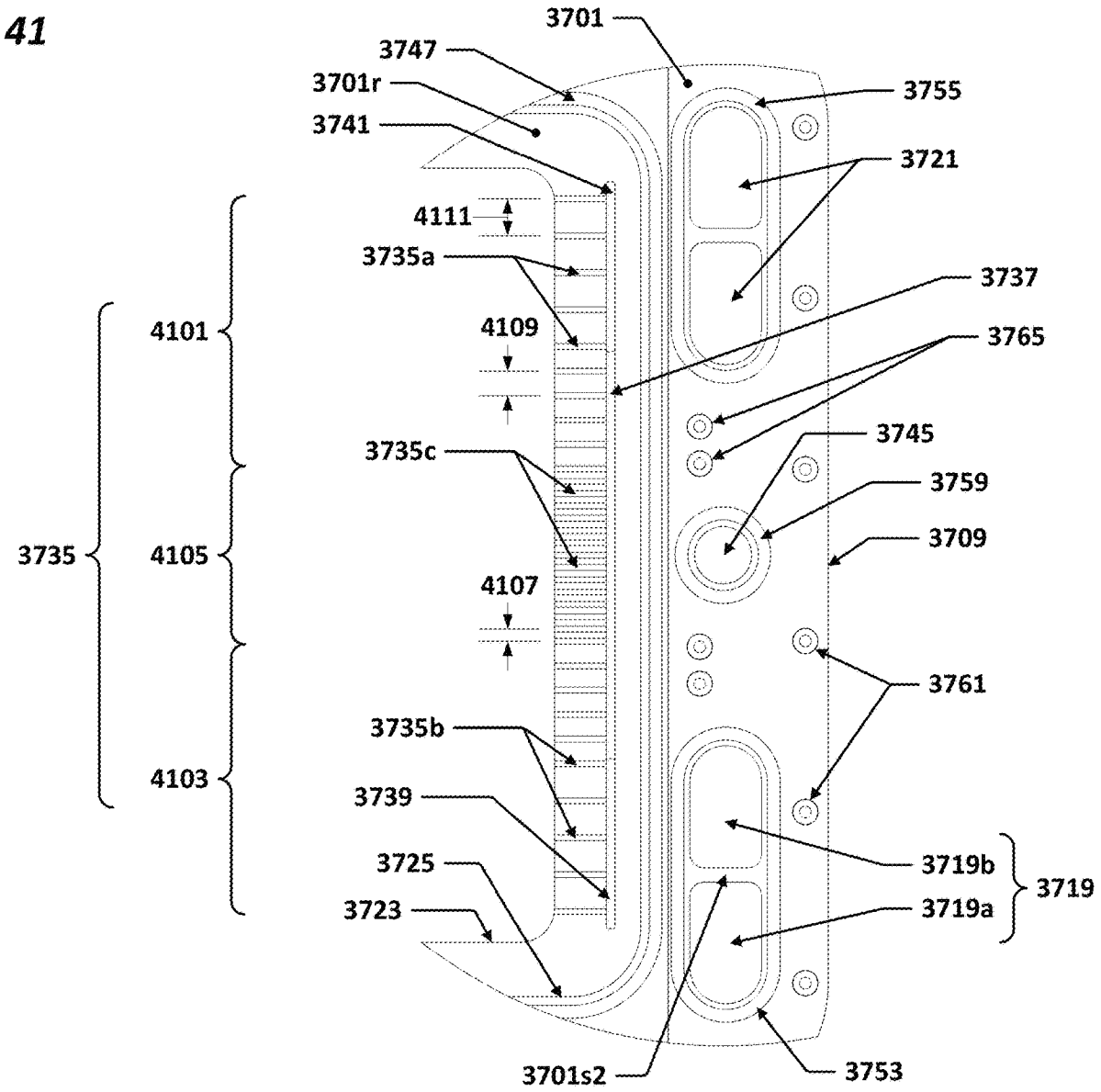
FIG. 41 depicts an enlarged portion of the example anode frame of FIG. 38.
Figure 42:
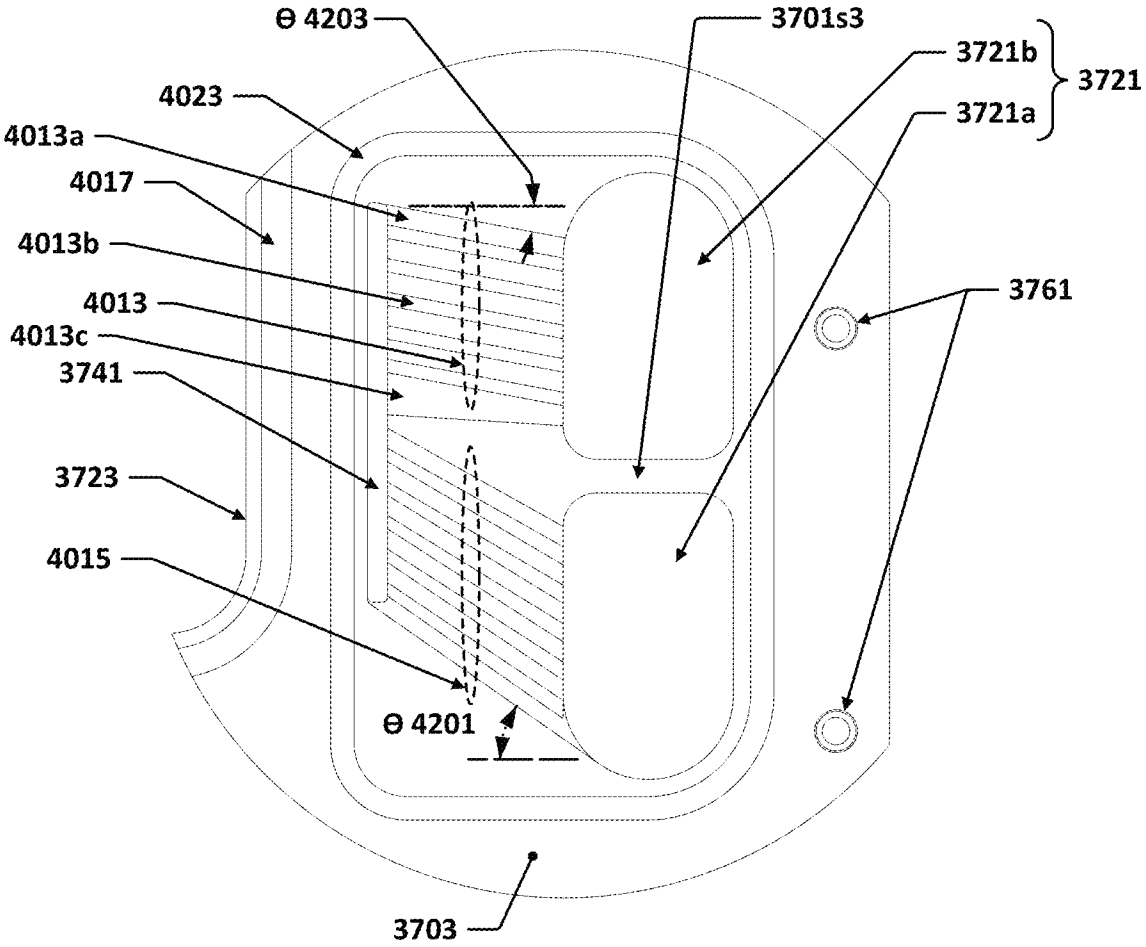
FIG. 42 depicts an enlarged portion of the example anode frame of FIG. 40

FIG. 37 depicts a first perspective view of an example anode frame. FIG. 38 depicts a top view of the example anode frame of FIG. 37. FIG. 39 depicts a second perspective view of the example anode frame of FIG. 37. FIG. 40 depicts a bottom view of the example anode frame of FIG. 39. FIG. 41 depicts an enlarged portion of the example anode frame of FIG. 38. FIG. 42 depicts an enlarged portion of the example anode frame of FIG. 40.

Anode frame (or frame) 1115 may be a generally rectangular plate-shaped body having first surface 3701 (e.g., a top surface) opposing second surface 3703 (e.g., a bottom surface) in axial direction 3801. Although frame 1115 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, frame 1115 will be described in association with a generally rectangular configuration. First and second surfaces 3701 and 3703 may be bounded by one or more peripheral surfaces, such as peripheral surfaces (or surfaces) 3705, 3707, 3709, and 3711 that may be connected to one another via one or more other peripheral surfaces, such as peripheral surface (or surface) 3713. In some embodiments, frame 1115 may have a symmetrical configuration about one or more reference planes perpendicular to axial direction 3801 (see FIGS. 38 and 40). For instance, a configuration of frame 1115 may be symmetrical about either or both of reference planes 3803 and 3805 depicted in FIGS. 38 and 40, but embodiments are not limited thereto.

According to various embodiments, first fluidic inlet passages 3715 and 3717 may be adjacent to peripheral edge 3705, and first fluidic outlet passages 3719 and 3721 may be adjacent to peripheral edge 3709. First fluidic inlet passages 3715 and 3717 may form portions of inlet passages 1001 and 1003 (see FIG. 10) of stack 500 in association with inlet connectors 543 of manifold assembly 515 (see FIGS. 5-10) that provide input water to frame 1115, and, thereby, to a corresponding anode flow field 1111 (see, e.g., FIGS. 11A, 23, and 24) associated with frame 1115. First fluidic outlet passages 3719 and 3721 may form portions of outlet passages (that are similar to inlet passages 1001 and 1003 (see FIG. 10), but associated with outlet connectors 545 of manifold assembly 515 versus inlet connectors 543 (see, e.g., FIGS. 5-10)) of stack 500 that output water from frame 1115, and, thereby, from the corresponding anode flow field 1111 (see, e.g., FIGS. 11A, 23, and 24) associated with frame 1115. In some implementations, first fluidic inlet and outlet passages 3715-3721 may be defined by respective pluralities of orifices separated from one another via corresponding septal walls. For instance, first fluidic inlet passage 3715 may include first and second inlet orifices 3715*a* and 3715*b* separated from one another via septal wall 3701*s*1, whereas first fluidic outlet passage 3719 may include first and second outlet orifices 3719*a* and 3719*b* separated from one another via septal wall 3701*s*2. An illustrative septal wall is also depicted in the enlarged view of FIG. 42 and the cross-sectional view of FIG. 23. That is, septal wall 3701*s*3 is shown separating first and second outlet orifices 3721*a* and 3721*b* forming first fluidic outlet passage 3721 in FIG. 42, and septal wall 3701*s*4 is shown separating first and second inlet orifices 3717*a* and 3717*b* forming first fluidic inlet passage 3717 in FIG. 23. As with cathode frame 1131 (see, e.g., FIG. 11A), the presence of the septal walls in frame 1115, such as septal walls 3701*s*1-3701*s*3, may increase the structural rigidity and, thereby, reliability of frame 1115 in the vicinity of first fluidic inlet and outlet passages 3715-3721.

According to various embodiments, frame 1115 also includes through opening (or opening) 3723 formed completely through a first central portion of frame 1115 and may be configured to receive at least a portion of anode flow field 1111 therein (see, e.g., FIGS. 11A, 23, and 24). As such, opening 3723 may be sized and shaped to correspond with the size and shape of anode flow field 1111. For example, opening 3723 may have a generally rectangular shape with rounded corners, but embodiments are not limited thereto. Frame 1115 may also include blind opening (or opening) 3725 formed in a second central portion of frame 1115 encircling the first central portion of frame 1115. In some cases, opening 3725 may be omitted or may be at least partially filled by anode annular insert 1118, as will become more apparent below. When included as part of frame 1115, opening 3725 may terminate at surface 3701*r*, which may be recessed from first surface 3701, and may be configured to receive at least a portion of anode PTL 1109 (see, e.g., FIGS. 11A, 23, and 24) and/or at least a portion of anode frame insert 1118 therein. As such, opening 3725 may be sized and shaped to correspond with the size and shape of anode PTL 1109 (see, e.g., FIGS. 11A, 23, and 24) and/or anode frame insert 1118. For instance, opening 3725 may have a generally rectangular shape with rounded corners, but embodiments are not limited thereto. To enable fluid flow to and from anode flow field 1111 (see, e.g., FIGS. 11A, 23, and 24) at least partially supported in opening 3723, first fluidic inlet passages 3715 and 3717 may be fluidically connected to opening 3723 via corresponding channels 4001, 4003, 4005, and 4007, respective connecting risers 3727 and 3729, distribution channel 3731, and supply (or inlet) channels 3733. First fluidic outlet passages 3719 and 3721 may be fluidically connected to opening 3723 via outlet channels 3735, collection channel 3737, respective connecting risers 3739 and 3741, and corresponding channels 4009, 4011, 4013, and 4015.

In those implementations including anode annular insert 1118, anode annular insert 1118 may be at least partially supported in opening 3725 such that second surface 1118*b* of anode annular insert 1118 abuts against surface 3701*r* of frame 1115 and inner peripheral surface 1118*c* of anode annular insert 1118 encircles an outer peripheral boundary of anode flow field 1111, and thereby, an inner peripheral boundary of opening 3723 (see also FIGS. 11B and 11C). To this end, outer peripheral surface 1118*d* of anode annular insert 1118 may be shaped and sized to correspond with the shape and size of an inner peripheral boundary of opening 3725. In some cases, thickness 1118*t* of anode annular insert 1118 may be equivalent (or substantially equivalent) to the depth of opening 3725, but implementations are not limited thereto. When thickness 1118*t* of anode annular insert 1118 corresponds to the depth of opening 3725, anode annular insert 1118 may fill the void in frame 1115 corresponding to opening 3725. It is also contemplated that anode annular insert 1118 may not completely fill the void corresponding to opening 3725, such as can be appreciated in FIGS. 11B and 11C. In such instances, inner peripheral surface 1118*c* of anode annular insert 1118 may be offset from the inner peripheral boundary of opening 3723 and PTL 1109 may fill a remaining amount of space not filled by anode annular insert 1118. Whatever the case, anode annular insert 1118 may have a generally ring-like configuration, and as such, may not be truly annular. For instance, anode annular insert 1118 may have a generally rectangular cross-section when viewed along the z-axis direction shown in FIGS. 11B and 11C, thus giving rise to an anode annular insert having two-fold symmetry instead of axial symmetry. As such, anode annular insert 1118 may have, for instance, a circular, an oval, a polygonal, or any other suitable cross-sectional geometry when viewed along the z-axis direction shown in FIGS. 11B and 11C.

Inlet and outlet channels 3733 and 3735 may be blind recesses formed in surface 3701*r* that extend from opening 3723 and terminate at distribution channel 3731 and connecting risers 3727 and 3729 in the case of inlet channels 3733 and distribution channel 3737 and connecting risers 3739 and 3741 in the case of outlet channels 3735, such as illustrated in FIGS. 37, 38, and 41. In some cases, inlet and outlet channels 3733 and 3735 may not only extend parallel (or substantially parallel) to one another, but may also extend parallel (or substantially parallel) to reference plane 3803. When incorporated as part of a cell, such as cell 501, anode annular insert 1118 may be at least partially supported in opening 3725 to at least partially fill the void corresponding to opening 3725. As previously noted, a remaining area of the void may be filled by PTL 1109, and as such, anode annular insert 1118 may serve to extend the outer boundary of PTL 1109 further outwards towards recess 3747 in frame 1115. By filling the void corresponding to opening 3725 (which is formed between opening 3723 and recess 3747) the likelihood that input water that is to be supplied to anode flow field 1111 from inlet channels 3733 instead flows around anode flow field 1111 via opening 3725 (illustrated in FIG. 11B as bypass flow 1120) and becomes expelled via outlet channels 3735 is reduced or eliminated. It is noted that bypass flow 1120 decreases the amount of input water flowing through anode flow field 1111, and as such, has the potential to decrease the efficiency of the cell. In some cases, both opening 3725 and anode annular insert 1118 may be omitted, thereby further reducing the possibility of bypass flow 1120. In those instances when opening 3725 is formed in frame 1115 and anode annular insert 1118 is not utilized, PTL 1109 may be formed to completely (or substantially completely) fill opening 3725 to reduce or prevent the likelihood of bypass flow 1120.

According to some embodiments, the presence of anode annular insert 1118 may not only prevent or reduce the likelihood of bypass flow 1120 during operation of stack 500, but may also prevent or reduce the likelihood that bypass flow 1120 or compression forces within the system (e.g., stack 500) cause the anode side of MEA 1105 to push against the outer periphery of PTL 1109 and become mechanically deteriorated via abrasion, cutting, etc. Anode annular insert 1118 may also prevent or reduce the likelihood that, for instance, first anode gasket 1113*a* intrudes into one or more of inlet and/or outlet channels 3733 and 3735.

To facilitate distributed supply and collection of water to and from anode flow field 1111 (see, e.g., FIGS. 11A, 23, and 24), inlet and outlet channels may have respective outer channels flanking corresponding central channels. For example, as seen in FIG. 41, outlet channels 3735 may be divided into first outer outlet channels 3735*a* arranged in first outer portion 4101, second outer outlet channels 3735*b* arranged in second outer portion 4103, and central outlet channels 3735*c* arranged in central portion 4105. Central outlet channels 3735*c* may be spaced apart from one another at constant interval 4107, whereas first and second outer outlet channels 3735*a* and 3735*b* may be spaced apart from one another with variable intervals that may increase in size with increasing distance from central portion 4105. For instance, adjacent first outer outlet channels 3735*a* near central portion 4105 may be spaced apart from one another by interval 4109 and adjacent first outer outlet channels 4135*a* further away from central portion 4105 may be spaced apart from one another by interval 4111, which may be greater than interval 4109. Inlet channels 3733 may be similarly arranged and configured as outlet channels 3735, but with respect to an inlet side of opening 3723 versus the outlet side of opening 3723 associated with outlet channels 3735.

The central inlet and outlet channels (e.g., central outlet channels 3735*c*) of inlet and outlet channels 3733 and 3735 may respectively terminate at and be fluidically connected to distribution channels 3731 and 3737. Some of the first outer inlet and outlet channels of inlet and outlet channels 3733 and 3735 may respectively terminate at and be fluidically connected to distribution channels 3731 and 3737, whereas other ones of the first outer inlet and outlet channels (e.g., the identified first outer outlet channels 3735*a* in FIG. 41) of inlet and outlet channels 3733 and 3735 may respectively terminate at and be fluidically connected to connecting risers 3727 and 3741. Similarly, some of the second outer inlet and outlet channels of inlet and outlet channels 3733 and 3735 may respectively terminate at and be fluidically connected to distribution channels 3731 and 3737, whereas other ones of the second outer inlet and outlet channels (e.g., the identified second outer outlet channels 3735*b* in FIG. 41) of inlet and outlet channels 3733 and 3735 may respectively terminate at and be fluidically connected to connecting risers 3729 and 3739.

Distribution channels 3731 and 3737 may be formed as blind recesses in surface 3701*r* and may extend in a direction transverse to the direction of extension of inlet and outlet channels 3735, such as depicted in FIGS. 37, 38, and 41. In some embodiments, distribution channels 3731 and 3737 may extend parallel (or substantially parallel) to reference plane 3805. Distribution channel 3731 may be flanked on either side by and fluidically connected to connecting risers 3727 and 3729, which may be formed as orifices extending through frame 1115 from surface 3701*r* to surface 3703 in axial direction 3801, such as can be appreciated from FIGS. 37-42. Similarly, distribution channel 3737 may be flanked on either side by and fluidically connected to connecting risers 3739 and 3741, which may be formed as orifices extending through frame 1115 from surface 3701*r* to surface 3703 in axial direction 3801.

As seen in FIGS. 39 and 40, connecting risers 3727, 3729, 3739, and 3749 may be fluidically connected to first fluidic inlet and outlet passages 3715-3721, respectively, via corresponding groups of channels 4001-4015. For instance, connecting riser 3727 may be fluidically connected to first fluidic inlet passages 3715 via channels 4001 and 4003, whereas connecting riser 3729 may be fluidically connected to first fluidic inlet passages 3717 via channels 4005 and 4007. Further, connecting riser 3739 may be fluidically connected to first fluidic outlet passages 3719 via channels 4009 and 4011, whereas connecting riser 3741 may be fluidically connected to first fluidic outlet passages 3721 via channels 4013 and 4015.

Channels 4001-4015 may be formed as blind recesses in surface 3703 and may extend in oblique directions with respect to, for instance, a direction of extension of reference plane 3803, as can be appreciated in FIGS. 39, 40, and 42. For instance, as seen in FIG. 42, channels 4015 may not only extend parallel (or substantially parallel) to one another, but may extend from first outlet orifice 3721*a* of first fluidic outlet passage 3721 to connecting riser 3741 at oblique angle 4201. Similarly, channels 4013 may not only extend parallel (or substantially parallel) to one another, but may extend from second outlet orifice 3721*b* of first fluidic outlet passage 3721 to connecting riser 3741 at oblique angle 4203, which may be smaller than oblique angle 4201. In some embodiments, channels 4013 and 4015 may be formed as respective groups of six channels, but embodiments are not limited thereto. For example, any number of channels may be utilized, such as less or more than six. Additionally, channels 4013 and 4015 may have the same number of individual channels or a different number of individual channels. To this end, the individual channels among channels 4013 and 4015 may have equivalent (or substantially equivalent) cross-sectional areas in a plane perpendicular to their respective directions of longitudinal extension. In some embodiments, some of the individual channels may have equivalent (or substantially equivalent) cross-sectional areas (such as channels 4013*a* and 4013*b*) and at least one of the individual channels may have a different cross-sectional area (such as channel 4013*c*). In the case of individual channel 4013*c*, its cross-sectional area may vary in size, such as increase in cross-sectional area with increasing distance from second outlet orifice 3721*b* of first fluidic outlet passage 3721. Channels 4001-4011 may be similarly configured as described in association with channels 4013 and 4015, but with respect to the corresponding connecting risers and first fluidic inlet and outlet passages associated therewith.

According to various embodiments, openings 3723 and 3725 may be arranged between second fluidic inlet and outlet passages 3743 and 3745, which form respective portions of inlet and outlet passages 901 and 903 (see FIG. 9) of stack 500 in association with input and outlet connectors 547 and 549 of manifold assembly 515 (see, e.g., FIGS. 5-10). Inlet passage 901 (see FIG. 9) may supply one or more reactants (e.g., gaseous $CO_x$) to the various cathode frames 1131 of stack 500 (see, e.g., FIG. 5), and, as such, to the corresponding cathode flow fields 1127 (see, e.g., FIGS. 5-11A) supported in association therewith when frame 1115 is incorporated as part of a cell, such as cell 501. Outlet passage 903 (see FIG. 9), however, may enable one or more byproducts of the CON reduction process to be expelled from the various cathode frames 1131 of stack 500 (see, e.g., FIGS. 5-11A), and, thereby, from the corresponding cathode flow fields 1127 supported in association therewith.

Frame 1115 may also include recesses 3747-3759 in surface 3701 that may be configured to respectively receive corresponding portions of gaskets among first anode gasket set 1113 (see, e.g., FIGS. 11A, 23, and 24) therein when, for example, frame 1115 is assembled as part of a repeat unit (e.g., repeat unit 503_1 in FIG. 5) or anode interface assembly 509 (see, e.g., FIGS. 5-10, 47, and 48). For instance, and with momentary reference to FIGS. 11A, 23, and 24 in addition to FIGS. 37-42, recess 3747 may be formed to encircle the periphery of opening 3725 and interface with first anode gasket 1113*a* of first anode gasket set 1113, whereas recesses 3749-3755 may be formed to respectively encircle the peripheries of first fluidic inlet and outlet passages 3715-3721 and respectively interface with second anode gaskets 1113*b* of first anode gasket set 1113. It is noted that the conjunction of first fluidic inlet passages 3715 and 3717, channels 4001, 4003, 4005, and 4007, connecting risers 3727 and 3729, distribution channel 3731, and supply channels 3733 enables, for example, water to flow from an area outside of first anode gasket 1113*a* of first anode gasket set 1113 (see, e.g., FIGS. 11A, 23, and 24) to an area inside of first anode gasket 1113*a* of first anode gasket set 1113 without disturbing the integrity of or seal provided by first anode gasket 1113*a* of first anode gasket set 1113. The same is true with respect to the integrity of and seals provided by those second anode gaskets 1113*b* of first anode gasket set 1113 that interface with recesses 3749 and 3751, see, e.g., FIGS. 11A, 23, and 24). In a similar fashion, the conjunction of first fluidic outlet passages 3719 and 3721, outlet channels 3735, collection channel 3737, connecting risers 3739 and 3741, and channels 4009, 4011, 4013, and 4015 enables, for example, water to flow from an area inside of first anode gasket 1113*a* of first anode gasket set 1113 (see, e.g., FIGS. 11A, 23, and 24) to an area outside of first anode gasket 1113*a* of first anode gasket set 1113 without disturbing the integrity of or seal provided by first anode gasket 1113*a* of first anode gasket set 1113. The same is true with respect to the integrity of and seals provided by those second anode gaskets 1113*b* of first anode gasket set 1113 (see, e.g., FIGS. 11A, 23, and 24) that interface with recesses 3753 and 3755. In addition, recesses 3757 and 3759 may be formed to encircle the respective peripheries of second fluidic inlet and outlet passages 3743 and 3745 and interface with third anode gaskets 1113*c* of first anode gasket set 1113 (see, e.g., FIGS. 11A, 23, and 24).

Similar to recesses 3747-3759 formed in surface 3701, frame 1115 may include recesses 4017-4029 in surface 3703 that may be configured to respectively receive corresponding portions of gaskets among second anode gasket set 1117 (see, e.g., FIGS. 11A, 23, and 24) therein when, for example, frame 1115 is assembled as part of a repeat unit (e.g., repeat unit 503_1 in FIG. 5) or anode interface assembly 509 (see, e.g., FIGS. 5-10, 47, and 48). For instance, recess 3717 may be formed to encircle the periphery of opening 3723 and interface with first anode gasket 1117*a* of second anode gasket set 1117 (see, e.g., FIGS. 11A, 23, and 24). Recesses 4019-4025 may be formed to respectively encircle combined peripheries of associated first fluidic inlet and outlet passages 3715-3721, corresponding channels 4001-4015, and respective connecting risers 3727, 3729, 3739, and 3741 and respectively interface with second anode gaskets 1117*b* of second anode gasket set 1117 (see, e.g., FIGS. 11A, 23, and 24). For example, recess 4019 may be formed to encircle a combined periphery of first fluidic inlet passages 3717, channels 4005 and 4007, and connecting riser 3729 and to interface with one of second anode gaskets 1117*b* of second anode gasket set 1117 (see, e.g., FIGS. 11A, 23, and 24), whereas recess 4021 may be formed to encircle a combined periphery of first fluidic inlet passages 3715, channels 4001 and 4003, and connecting riser 3727 to interface with another one of second anode gaskets 1117*b* of second anode gasket set 1117 (see, e.g., FIGS. 11A, 23, and 24). Similarly, recess 4023 may be formed to encircle a combined periphery of first fluidic outlet passages 3721, channels 4013 and 4015, and connecting riser 3741 to interface with still another one of second anode gaskets 1117*b* of second anode gasket set 1117 (see, e.g., FIGS. 11A, 23, and 24), whereas recess 4025 may be formed to encircle a combined periphery of first fluidic outlet passages 3719, channels 4009 and 4011, and connecting riser 3739 to interface with yet another one of second anode gaskets 1117*b* of second anode gasket set 1117 (see, e.g., FIGS. 11A, 23, and 24). It is noted that the conjunction of first fluidic inlet passages 3715 and 3717, channels 4001, 4003, 4005, and 4007, connecting risers 3727 and 3729, distribution channel 3731, and supply channels 3733 enables, for example, water to flow from an area outside of first anode gasket 1113*a* of first anode gasket set 1113 (see, e.g., FIGS. 11A, 23, and 24) to an area inside of first anode gasket 1113*a* of first anode gasket set 1113 without also disturbing the integrity of or seal provided by second anode gaskets 1117*b* of second anode gasket set 1117 (see, e.g., FIGS. 11A, 23, and 24). In addition, recesses 4027 and 4029 may be formed to at least encircle the respective peripheries of second fluidic inlet and outlet passages 3743 and 3745 and interface with third anode gaskets 1117*c* of second anode gasket set 1117 (see, e.g., FIGS. 11A, 23, and 24). It is noted that the size, shape, and location of recesses 4019-4029 may correspond with the size, shape, and location of protrusions 3305 and 3307 (see FIGS. 32-36) of cathode frame 1131 to enable second and third anode gaskets 1117*b* and 1117*c* (see, e.g., FIGS. 11A, 23, and 24) to form corresponding seals between anode and cathode frames 1115 and 1131 when anode and cathode frames 1115 and 1131 are stacked in relation with other anode and cathode frames 1115 and 1131 of stack 500 (see, e.g., FIGS. 5-11A, 23, and 24). Accordingly, cross-flow between first and second fluidic inlet and outlet passages 3715-3721, 3743, and 3745 may be prevented.

Frame 1115 may also include first fastener orifices 3761 arranged about a peripheral area of frame 1115 at one or more intervals. In some embodiments, a pitch between adjacent first fastener orifices 3761 may be constant (or substantially constant), but embodiments are not limited thereto. Second and third fastener orifices 3763 and 3765 may be inset from first fastener orifices 3761 in central portions of frame 1115 near second fluidic inlet and outlet passages 3743 and 3745. A pitch between adjacent second fastener orifices 3763 and a pitch between adjacent third fastener orifices 3765 may be smaller than the pitch(es) between adjacent first fastener orifices 3761. In various embodiments, first, second, and third fastener orifices 3761, 3763, and 3765 may extend completely through frame 1115 and may be counterbored with respect to surface 3701. According to various embodiments, swage nuts 1135 (see, e.g., FIGS. 11A and 21) may be pressed into, for example, the counterbored portions of first, second, and third fastener orifices 3761, 3763, and 3765 such that, when frame 1115 is assembled as part of a repeat unit (e.g., repeat unit 503_1 in FIG. 5) or as part of anode interface assembly 509 (see, e.g., FIGS. 5-10, 47, and 48), first, second, and third fastener orifices 3761, 3763, and 3765 may be configured to respectively engage with corresponding fasteners 1137 (see, e.g., FIGS. 11A and 21), which may be received in corresponding first, second, and third fastener orifices 2837, 2839, and 2841 of cathode frame 1131 (see, e.g., FIGS. 11A, 21, 28, 29, 32, 33, and 35).

According to some embodiments, frame 1115 and/or anode annular insert 1118 may be formed of any suitable thermoplastic and/or thermosetting material, such as, for instance, PET, PC, PI, PA, PMMA, PEN, PEK, PEEK, PEI, PPS, PAR, PES, COC, PVA, PS, ECTFE, PTFE, PBT, PCTFE, PETG, and/or the like. In some cases, frame 1115 and/or anode annular insert 1118 may be formed of one or more metals or metal alloys, such as, for example, aluminum, aluminum alloy, copper, copper alloy, tin, tin alloy, titanium, titanium alloy, tungsten, tungsten alloy, zinc, zinc alloy, steel, stainless steel, etc. It is noted, however, that when formed of a metal or metal alloy, frame 1115 and/or anode annular insert 1118 may, in some embodiments, include a coating or other feature to, for instance, electrically insulate frame 1115 or anode annular insert 1118 from a corresponding anode PTL (e.g., anode PTL 1109 in FIG. 11A) and/or anode flow field (e.g., anode flow field 1111 in FIG. 11A) associated therewith. It is also contemplated that a base material of frame 1131 and/or anode annular insert 1118 may be coated with, for instance, one or more other materials, e.g., one or more corrosion-resistant materials. That being said, in some cases, anode annular insert 1118 may be formed of one or more materials with equivalent, substantially equivalent, or at least similar chemical inertness as PTL 1109. To this end, anode annular insert 1118 may have a porous or non-porous configuration. Whatever the case, frame 1115 and/or anode annular insert 1118 may be formed in any suitable manner, such as additively manufactured, injection molded, compression molded, stamped, casted, machined, and/or the like.

Separator Plate

Figure 43:
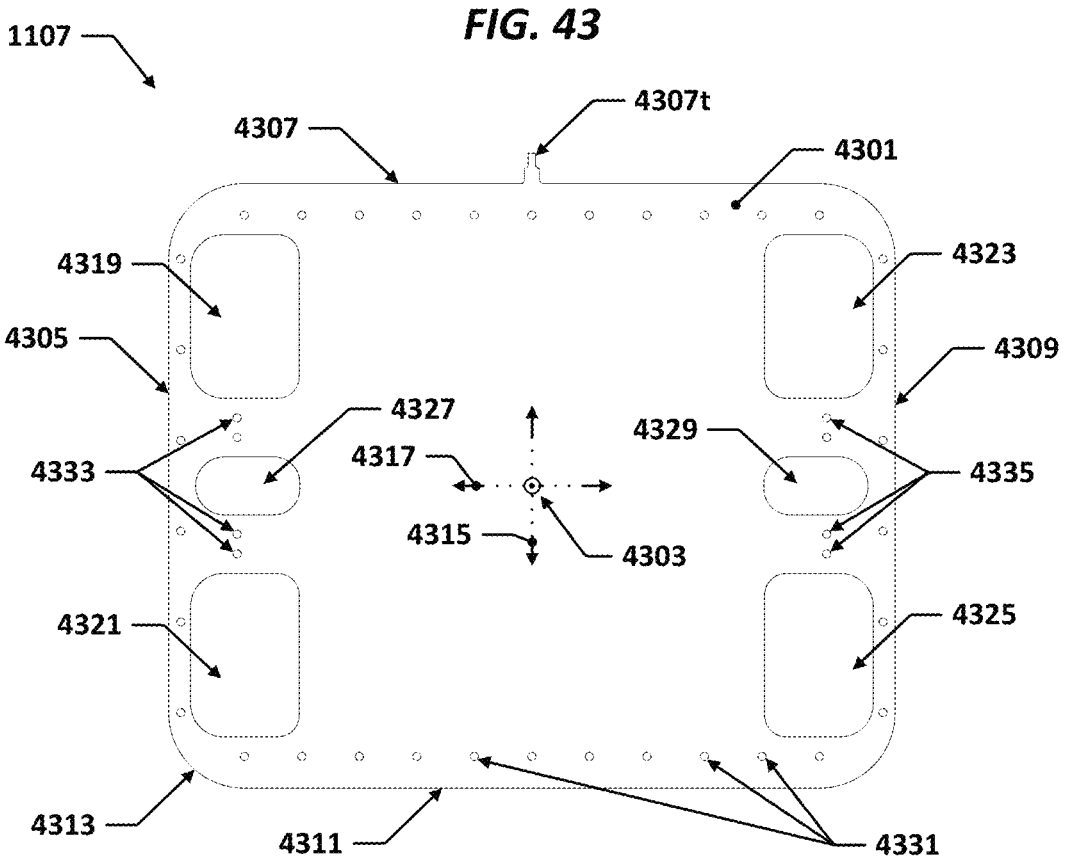
FIG. 43 depicts a plan view of an example separator plate of the representative repeat unit of FIG. 11A.

FIG. 43 depicts a plan view of an example separator plate of the representative repeat unit of FIG. 11A.

Separator plate 1107 may be a generally rectangular plate-shaped body having first surface 4301 (e.g., a top surface) opposing a second surface in axial direction 4303. Although separator plate 1107 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, separator plate 11070 will be described in association with a generally rectangular configuration. First surface 4301 and the second surface may be bounded by one or more peripheral surfaces, such as peripheral surfaces (or surfaces) 4305, 4307, 4309, and 4311 that may be connected to one another via one or more other peripheral surfaces, such as peripheral surface (or surface) 4313. Separator plate 1107 may also have terminal 4307*t* protruding from peripheral surface 4307. It is noted that when corresponding separator plates (such as separator plate 1107) are interposed between adjacent cells among stack 500 (see FIGS. 5-10), corresponding voltage drops between adjacent separator plates (and, thereby, associated with respective cells correspondingly between the adjacent separator plates) may be probed via respective terminals (such as terminal 4307*t*) of the corresponding separator plates, such as separator plate 1107 (see also FIG. 7). In some embodiments, separator plate 1107 may have a symmetrical configuration about one or more reference planes perpendicular to axial direction 4303. For instance, a configuration of separator plate 1107 may be symmetrical about either or both of reference planes 4315 and 4317 (apart from the presence of terminal 4307*t*), but embodiments are not limited thereto.

According to various implementations, separator plate 1107 includes first openings 4319 and 4321 adjacent to peripheral surface 4305, second openings 4323 and 4325 adjacent to peripheral surface 4309, third opening 4327 adjacent to peripheral surface 4305, and fourth opening 4329 adjacent to peripheral surface 4309. Openings 4319 and 4321 may be sized, shaped, and located in correspondence with the size, shape, and location of protrusions 3305 (see, e.g., FIGS. 32 and 33) adjacent to peripheral surface 2805 of cathode frame 1131 such that, when separator plate 1107 is incorporated as part of a repeat unit (e.g., repeat unit 1100 in FIG. 11A), protrusions 3305 adjacent to peripheral surface 2805 of cathode frame 1131 may be received in openings 4319 and 4321 (see also FIG. 23). Similarly, openings 4323 and 4325 may be sized, shaped, and located in correspondence with the size, shape, and location of protrusions 3305 adjacent to peripheral surface 2809 of cathode frame 1131 (see, e.g., FIGS. 32 and 33) such that, when separator plate 1107 is incorporated as part of a repeat unit (e.g., repeat unit 1100 in FIG. 11A), protrusions 3305 adjacent to peripheral surface 2809 of cathode frame 1131 may be received in openings 4323 and 4325. Further, openings 4327 and 4329 may be sized, shaped, and located in correspondence with the size, shape, and location of protrusions 3307 adjacent to peripheral surfaces 2805 and 2809 of cathode frame 1131 (see, e.g., FIGS. 24, 32, and 33) such that, when separator plate 1107 is incorporated as part of a repeat unit (e.g., repeat unit 1100 in FIG. 11A), protrusions 3307 adjacent to peripheral surfaces 2805 and 2809 of cathode frame 1131 may be respectively received in openings 4327 and 4329 (see also FIG. 24). Relative dimensioning between openings 4319-4329 and first and second protrusions 3305 and 3307 has already been described in association with cathode frame 1131, and, therefore, duplicative descriptions will be omitted to avoid obscuring embodiments described herein. In this manner, first surface 4301 of separator plate 1107 may abut against surface 3701 of anode frame 1115 (see, e.g., FIGS. 23, 24, 37, and 38) and the second surface of separator plate 1107 may abut against surface 2801 of cathode frame 1131 (see, e.g., FIGS. 23, 24, 32, and 33) when the repeat unit (e.g., repeat unit 1100 in FIG. 11A) is assembled, such as assembled in a compressed state (see also FIGS. 20-24).

Separator plate 1107 may also include first fastener orifices 4331 arranged about a peripheral area of separator plate 1107 at one or more intervals. In some embodiments, a pitch between adjacent first fastener orifices 4331 may be constant (or substantially constant), but embodiments are not limited thereto. Second and third fastener orifices 4333 and 4335 may be inset from first fastener orifices 4331 in central portions of separator plate 1107 near third and fourth openings 4327 and 4329. A pitch between adjacent second fastener orifices 4333 and a pitch between adjacent third fastener orifices 4335 may be smaller than the pitch(es) between adjacent first fastener orifices 4331. In various embodiments, first, second, and third fastener orifices 4331, 4333, and 4335 may extend completely through separator plate 1107 such that, when separator plate 1107 is assembled as part of a repeat unit (e.g., repeat unit 1100 in FIG. 11A), fasteners 1137 extending from cathode frame 1131 may extend through separator plate 1107 and may be threadedly engaged with corresponding swage nuts 1135 pressed and/or clinched into first, second, and third fastener orifices 3761, 3763, and 3765 of anode frame 1115 (see also FIGS. 11A and 21).

According to various embodiments, one or more of first, second, and third fastener orifices 4331, 4333, and 4335 may be sized to form respective clearance or interference fits with corresponding fasteners 1137 (see FIG. 11A) or corresponding portions (e.g., shoulder portions) of fasteners 1137 (see, e.g., FIG. 21) when separator plate 1107 is assembled as part of a repeat unit (e.g., repeat unit 1100 in FIG. 11A). In some cases, one or more of first, second, and third fastener orifices 4331, 4333, and 4335 may be sized to form respective clearance fits with corresponding fasteners 1137 (see FIG. 11A) or corresponding portions (e.g., shoulder portions) of fasteners 1137 (see, e.g., FIG. 21) and one or more of first, second, and third fastener orifices 4331, 4333, and 4335 may be sized to form respective interference fits with corresponding fasteners 1137 (see FIG. 11A) or corresponding portions (e.g., shoulder portions) of fasteners 1137 (see, e.g., FIG. 21). For example, respective sizes (e.g., diameters) of first, second, and third fastener orifices 4331, 4333, and 4335 may be about 0.01% to about 10% larger (in the case of a clearance fit) or about 0.01% to about 5% smaller (in the case of an interference fit) than corresponding widths (e.g., diameters) of respective portions (e.g., shoulder portions) of fasteners 1137 (see, e.g., FIGS. 11A, 17, and 21). In some embodiments, one or more of first, second, and third fastener orifices 4331, 4333, and 4335 may be sized to form respective clearance fits with corresponding fasteners 1137 (see, e.g., FIGS. 11A, 17, and 21) or corresponding portions (e.g., shoulder portions) of fasteners 1137 (see, e.g., FIG. 21) when separator plate 1107 is assembled as part of a repeat unit (e.g., repeat unit 1100 in FIG. 11A) and stack 500 (see, e.g., FIG. 5) is in a cooled, non-operational state, but when stack 500 is in a steady-state operational condition, fasteners 1137 may expand to form corresponding interference fits with the one or more of first, second, and third fastener orifices 4331, 4333, and 4335. These clearance and/or interference fits may be utilized to constrain in-plane expansion (e.g., expansion in, for instance, a plane parallel to an x-y plane (see FIG. 11A)) of anode and cathode frames 1115 and 1131 during operation of stack 500 (see, e.g., FIG. 5) without unduly stressing anode and cathode frames 1115 and 1131.

It is also noted that, when separator plate 1107 is assembled as part of a repeat unit (e.g., repeat unit 1100 in FIG. 11A) with cathode frame 1131 coupled to anode frame 1115 via fasteners 1137 and swage nuts 1135 (see also FIGS. 11A and 21-24), some of the various gaskets of second anode gasket set 1117 may not only be interposed between surface 4301 of separator plate 1107 and some of the various recesses in surface 3703 of anode frame 1115 (see, e.g., FIGS. 39 and 40), but may also encircle the various protrusions extending from surface 2801 of cathode frame 1131 (see, e.g., FIGS. 32 and 33). For example, second gaskets 1117*b* of second anode gasket set 1117 (see, e.g., FIGS. 11A and 23) may not only be interposed between surface 4301 of separator plate 1107 and corresponding recesses 4019-4025 in surface 3703 of anode frame 1115 (see also FIGS. 39 and 40), but may also encircle protrusions 3305 extending from surface 2801 of cathode frame 1131 (see also FIGS. 32 and 33) to fluidically seal corresponding first fluidic inlet and outlet passageways between cathode frame 1131 and anode frame 1115 (see, e.g., second anode gasket 1117*b* fluidically sealing first fluidic inlet passageway 2301 that is outlined in FIG. 23 in a dash-dot-dot line format). In a similar fashion, third gaskets 1117*c* of second anode gasket set 1117 (see, e.g., FIGS. 11A and 24) may not only be interposed between surface 4301 of separator plate 1107 and corresponding recesses 4027-4029 in surface 3703 of anode frame 1115 (see also FIGS. 39 and 40), but may also encircle protrusions 3307 extending from surface 2801 of cathode frame 1131 (see also FIGS. 32 and 33) to fluidically seal corresponding second fluidic inlet and outlet passageways between cathode frame 1131 and anode frame 1115 (see, e.g., third anode gasket 1117*c* fluidically sealing second fluidic outlet passageway 2401 that is outlined in FIG. 24 in a dash-dot-dot line format).

According to various embodiments, separator plate 1107 may be formed of any suitable thermoplastic and/or thermosetting material, such as, for instance, PET, PC, PI, PA, PMMA, PEN, PEK, PEEK, PEI, PPS, PAR, PES, COC, PVA, PS, ECTFE, PTFE, PBT, PCTFE, PETG, and/or the like. In some cases, separator plate 1107 may be formed of one or more metals or metal alloys, such as, for example, aluminum, aluminum alloy, copper, copper alloy, tin, tin alloy, titanium, titanium alloy, tungsten, tungsten alloy, zinc, zinc alloy, steel, stainless steel, etc. For instance, in one embodiment, separator plate 1107 may be formed of titanium, which may increase the strength and rigidity of a repeat unit, such as repeat unit 1100 in FIG. 11A, as well as enable electrical conductivity between adjacent cells of stack 500 (see, e.g., FIGS. 5 and 7). In some embodiments, a material(s) and/or configuration of separator plate 1107 may be stronger and/or more rigid than a material(s) and/or configuration of anode and cathode frames 1115 and 1131 (see also FIG. 11A). In some instances, an electrical conductivity of separator plate 1107 may be greater than corresponding electrical conductivities of anode and cathode frames 1115 and 1131 (see also FIG. 11A). It is also contemplated that a base material of separator plate 1107 may be coated with, for instance, one or more other materials, e.g., one or more corrosion-resistant materials. Whatever the case, separator plate 1107 may be formed in any suitable manner, such as additively manufactured, injection molded, compression molded, stamped, casted, machined, and/or the like.

Cathode Interface Assembly

Figure 18:
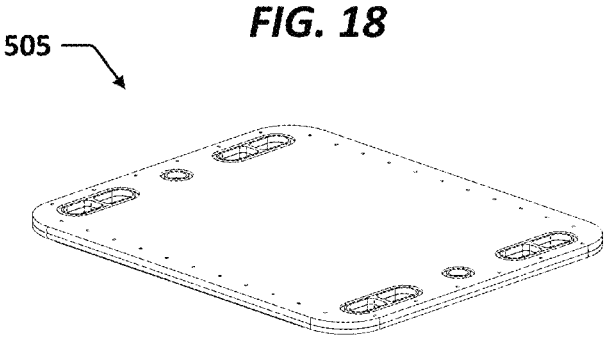
FIG. 18 depicts the example cathode interface assembly of FIG. 17 in a non-exploded state.
Figure 45:
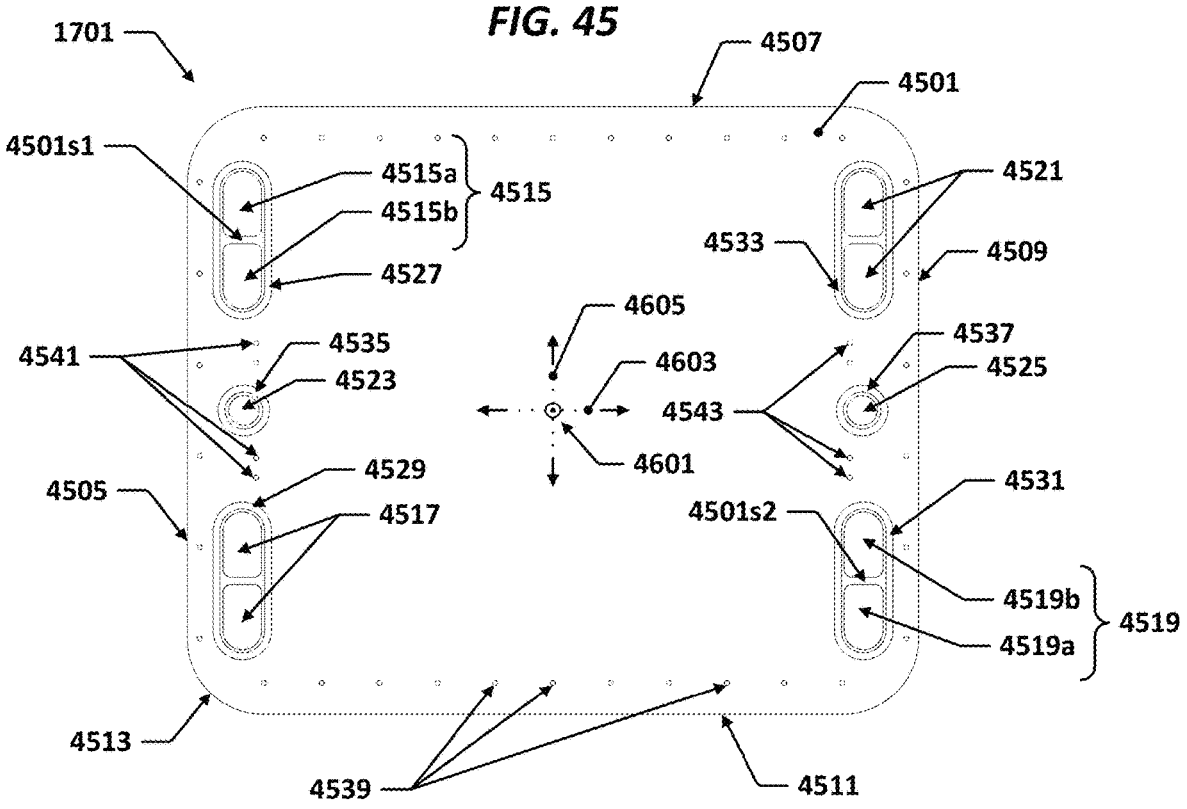
FIGS. 45 and 46 depict top and bottom plan views of an example cathode interface separator of the example cathode interface assembly of FIG. 18.
Figure 46:
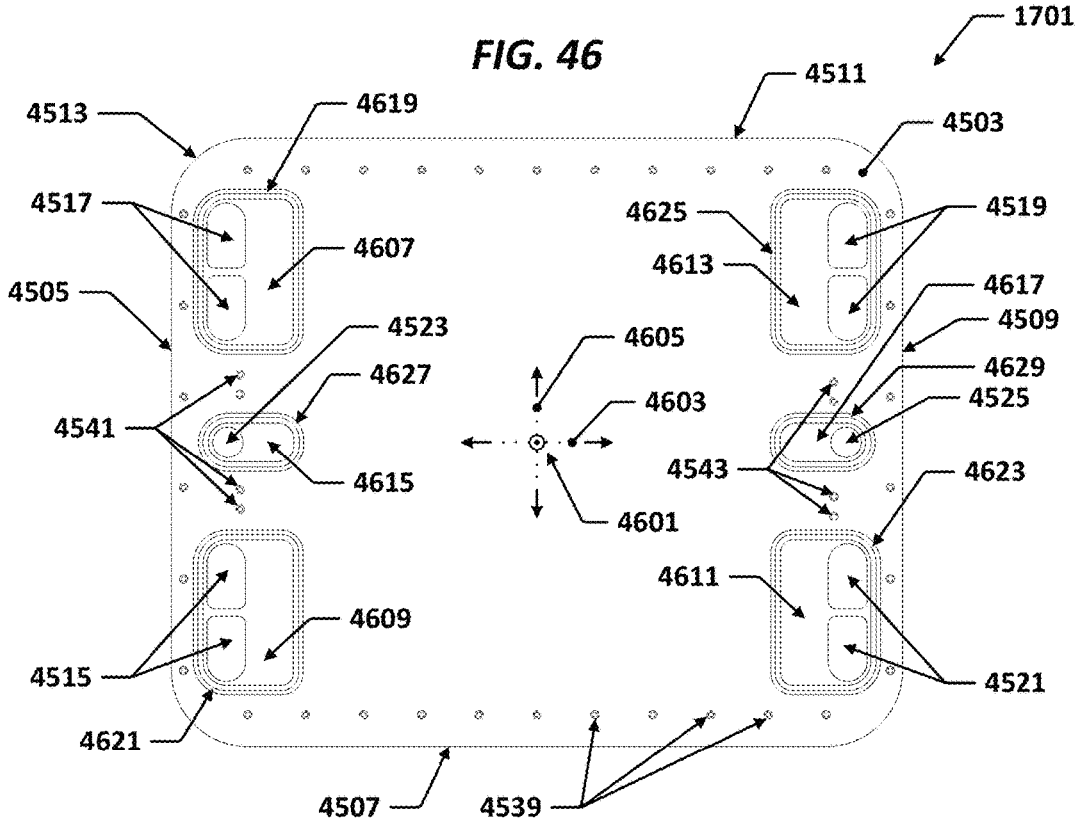

FIG. 17 depicts an exploded view of an example cathode interface assembly of the example multi-cell $CO_x$ electrolyzer stack of FIG. 6. FIG. 18 depicts the example cathode interface assembly of FIG. 17 in a non-exploded state. FIGS. 45 and 46 depict top and bottom plan views of an example cathode interface separator of the example cathode interface assembly of FIG. 18.

As seen in FIGS. 5-10, 17, and 18, cathode interface assembly 505 may include equivalent components as cathode components 1103 of repeat unit 1100 described in association with FIG. 11A, except cathode interface assembly 505 may also include cathode interface separator 1701, third cathode gaskets 1703, and fourth cathode gaskets 1705. As such, duplicative descriptions of equivalent components will be omitted to avoid obscuring embodiments disclosed herein. It is noted, however, that instead of cathode frame 1131 being coupled to anode frame 1115 as in repeat unit 1100 (see FIG. 11A), cathode frame 1131 may be coupled to cathode interface separator 1701, which will now be described in more detail in association with FIGS. 45 and 46.

Referring to FIGS. 45 and 46, cathode interface separator 1701 may be a generally rectangular plate-shaped body having first surface 4501 (e.g., a top surface) opposing second surface 4503 (e.g., a bottom surface) in axial direction 4601. Although cathode interface separator 1701 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, cathode interface separator 1701 will be described in association with a generally rectangular configuration. First and second surfaces 4501 and 4503 may be bounded by one or more peripheral surfaces, such as peripheral surfaces (or surfaces) 4505, 4507, 4509, and 4511 that may be connected to one another via one or more other peripheral surfaces, such as peripheral surface (or surface) 4513. In some embodiments, cathode interface separator 1701 may have a symmetrical configuration about one or more reference planes perpendicular to axial direction 4601. For instance, a configuration of cathode interface separator 1701 may be symmetrical about either or both of reference planes 4603 and 4605, but embodiments are not limited thereto.

According to various embodiments, cathode interface separator 1701 may include first fluidic inlet passages 4515 and 4517 adjacent to peripheral edge 4505, and first fluidic outlet passages 4519 and 4521 adjacent to peripheral edge 4509. With additional reference to FIGS. 5-11A, first fluidic inlet passages 4515 and 4517 may form portions of inlet passages 1001 and 1003 of stack 500 in association with inlet connectors 543 of manifold assembly 515 that provide, for example, input water to anode frames 1115 of stack 500, and, thereby, to the corresponding anode flow fields 1111 of the plurality of cells, such as cell 501. First fluidic outlet passages 4519 and 4521 may form portions of outlet passages (that are similar to inlet passages 1001 and 1003, but associated with outlet connectors 545 of manifold assembly 515 versus inlet connectors 543) of stack 500 that output water from anode frames 1115, and, thereby, from corresponding anode flow fields 1111 of the plurality of cells, such as cell 501 (see also FIGS. 5-11A). In some implementations, first fluidic inlet and outlet passages 4515-4521 may be defined by respective pluralities of orifices separated from one another via corresponding septal walls. For instance, first fluidic inlet passage 4515 may include first and second inlet orifices 4515*a* and 4515*b* separated from one another via septal wall 4501*s*1, whereas first fluidic outlet passage 4519 may include first and second outlet orifices 4519*a* and 4519*b* separated from one another via septal wall 4501*s*2. As with anode and cathode frames 1115 and 1131 (see, e.g., FIG. 11A), the presence of these septal walls, such as septal walls 4501*s*1 and 4501*s*2, may increase the structural rigidity and, thereby, reliability of cathode interface separator 1701 in the vicinity of first fluidic inlet and outlet passages 4515-4521.

Cathode interface separator 1701 may further include second inlet and outlet passages 4523 and 4525, which form respective portions of inlet and outlet passages 901 and 903 of stack 500 (see FIG. 9) in association with input and outlet connectors 547 and 549 of manifold assembly 515 (see, e.g., FIGS. 5 and 9). Inlet passage 901 (see FIG. 9) may supply one or more reactants (e.g., gaseous $CO_x$) to the various cathode frames 1131 of stack 500 (see, e.g., FIGS. 5 and 9), and, as such, to the corresponding cathode flow fields 1127 supported in association therewith when cathode interface separator 1701 is incorporated as part of a cell, such as a cell formed between cathode interface assembly 505 and repeat unit 503_1 (see, e.g., FIGS. 5-11A and 19). Outlet passage 903, however, may enable one or more byproducts of the $CO_x$ reduction process to be expelled from the various cathode frames 1131 of stack 500, and, thereby, from the corresponding cathode flow fields 1127 supported in association therewith (see, e.g., FIGS. 5-11A and 19).

Similar to anode frame 1115 (see, e.g., FIGS. 11A, 37, and 38), cathode interface separator 1701 may also include recesses 4527-4537 in surface 4501 that may be configured to respectively receive corresponding portions of gaskets 553 and 555 when, for example, cathode interface assembly 505 is assembled as part of stack 500, e.g., when cathode interface assembly 505 is stacked in relation to manifold assembly 515 with bus plate 513 interposed therebetween (see, e.g., FIGS. 5-10, 17, and 18). For instance, recesses 4527-4533 may be formed to respectively encircle the peripheries of first fluidic inlet and outlet passages 4515-4521 and respectively interface with corresponding gaskets 553 (which may respectively encircle third fluidic outlet and inlet ports 1225 and 1229 of manifold assembly 515 (see, e.g., FIG. 12)), whereas recesses 4535 and 4537 may be formed to respectively encircle the peripheries of second fluidic inlet and outlet passages 4535 and 4537 and respectively interface with corresponding gaskets 555 (which may respectively encircle fourth fluidic outlet and inlet ports 1239 and 1237 of manifold assembly 515 (see, e.g., FIG. 12)). As such, corresponding fluidic seals may be formed with respective outlet and inlet ports of manifold assembly 515 when cathode interface assembly 505 is assembled as part of stack 500 (see, e.g., FIGS. 5-10).

Referring to FIG. 46, second surface 4503 may include first recesses 4607-4613 respectively encircling first fluidic inlet and outlet passages 4515-4521, as well as second recesses 4615 and 4617 respectively encircling second fluidic inlet and outlet passages 4535 and 4537. In some embodiments, first and second recesses 4607-4617 may be recessed into surface 4503 by a depth equivalent (or substantially equivalent) to height 3401 (see FIG. 34) of first and second protrusions 3305 and 3307 of cathode frame 1131, but embodiments are not limited thereto. For instance, the depth at which first and second recessed 4607-4617 extend into surface 4503 may be greater than or smaller than height 3401 (see FIG. 34) provided sufficient fluidic seals may be formed between cathode interface separator 1701 and cathode frame 1131 when a cell is formed between cathode interface assembly 505 and repeat unit 503_1 (see also FIGS. 5-10 and 17). In other words, the depth of first and second recesses 4607-4617 may at least permit a portion of first and second protrusions 3305 and 3307 of cathode frame 1131 to be received therein when a cell is formed between cathode interface assembly 505 and repeat unit 503_1 (see also FIGS. 5-10). With this in mind, first and second recesses 4607-4613 may be sized and shaped to interface with corresponding protrusions among first and second protrusions 3305 and 3307 of cathode frame 1131 (see FIGS. 32-33).

Cathode interface separator 1701 may further include third recesses 4619-4625 in surface 4503 respectively encircling first fluidic inlet and outlet passages 4515-4521 and associated recesses 4607-4613, as well as include fourth recesses 4627 and 4629 respectively encircling second fluidic inlet and outlet passages 4523 and 4525 and associated recesses 4615-4617. It is also noted that third and fourth recesses 4619-4629 may be respectively sized, shaped, and located to further correspond with the size, shape, and location of protrusions 3305 and 3307 of cathode frame 1131 (see FIGS. 32-33) to enable third and fourth cathode gaskets 1703 and 1705 to form corresponding seals between cathode interface separator 1701 and first and second protrusions 3305 and 3307 of cathode frame 1131 when a cell is formed between cathode interface assembly 505 and repeat unit 503_1 (see also FIGS. 5-10, 32, and 33). Accordingly, the conjunction of first and second recesses 4607-4617 of cathode interface separator 1701, third and fourth recesses 4619-4629 of cathode interface separator 1701, first and second protrusions 3305 and 3307 of cathode frame 1131 (see FIGS. 32-33), and third and fourth cathode gaskets 1703 and 1705 may prevent cross-flow between first and second fluidic inlet and outlet passages 4515-4525. It is also noted that, when a cell is formed between cathode interface assembly 505 and repeat unit 503_1 (see, e.g., FIGS. 5-10), second cathode gasket 1133 may be interposed between a central portion of surface 4503 and recess 3303 in cathode frame 1131 (see FIGS. 17, 32, and 33) to form a fluidic seal around cathode flow field 1127 at least partially supported in an opening of cathode frame 1131. In this manner, corresponding surfaces of cathode flow field 1127 may abut against surface 4503 of cathode interface separator 1701 and a surface of cathode GDL 1121 facing cathode flow field 1127 similar to how corresponding surfaces of cathode flow field 1127 may abut against a surface of cathode GDL 1121 of unitized MEA assembly 1119 and a surface of separator plate 1107 described in association with, for instance, FIGS. 5-11A, 23, and 24.

Cathode interface separator 1701 may also include first threaded fastener orifices 4539 arranged about a peripheral area of cathode interface separator 1701 at one or more intervals. In some embodiments, a pitch between adjacent first threaded fastener orifices 4539 may be constant (or substantially constant), but embodiments are not limited thereto. Cathode interface separator 1701 may optionally include second and third threaded fastener orifices 4541 and 4543 inset from first threaded fastener orifices 4539 in central portions of cathode interface separator 1701 near second fluidic inlet and outlet passages 4523 and 4525. A pitch between adjacent second threaded fastener orifices 4541 and a pitch between adjacent third threaded fastener orifices 4543 may be smaller than the pitch(es) between adjacent first threaded fastener orifices 4539. In some embodiments, one or more of first, second, and third threaded fastener orifices 4539-4543 may be formed similar to first, second, and third fastener orifices 3761-3765 of anode frame 1115 (see, e.g., FIGS. 11A and 37-42), and, thereby, include swage nuts 1135 versus being threaded. Regardless, when cathode interface separator 1701 is assembled as part of cathode interface assembly 505 (see also FIGS. 5-10), first, second, and third threaded fastener orifices 4539, 4541, and 4543 may be configured to respectively engage with corresponding fasteners 1137 respectively received in and extending from corresponding first, second, and third fastener orifices 2837, 2839, and 2841 of cathode frame 1131 (see FIGS. 28, 29, 32, 33, and 35). Further, as can be appreciated from at least FIG. 17, cathode frame 1131 of cathode interface assembly 505 may be coupled to cathode interface separator 1701 with second, third, and fourth cathode gaskets 1133, 1703, and 1705 interposed therebetween.

According to various embodiments, cathode interface separator 1701 may be formed of any suitable thermoplastic and/or thermosetting material, such as, for instance, PET, PC, PI, PA, PMMA, PEN, PEK, PEEK, PEI, PPS, PAR, PES, COC, PVA, PS, ECTFE, PTFE, PBT, PCTFE, PETG, and/or the like. In some cases, cathode interface separator 1701 may be formed of one or more metals or metal alloys, such as, for example, aluminum, aluminum alloy, copper, copper alloy, tin, tin alloy, titanium, titanium alloy, tungsten, tungsten alloy, zinc, zinc alloy, steel, stainless steel, etc. For instance, in one embodiment, cathode interface separator 1701 may be formed of titanium, which may increase the strength and rigidity of cathode interface assembly 505 (see, e.g., FIGS. 5-10, 17, and 18). In some cases, a material(s) and/or configuration of cathode interface separator 1701 may be stronger and/or more rigid than a material(s) and/or configuration of anode and cathode frames 1115 and 1131 (see also FIG. 11A). Also, an electrical conductivity of cathode interface separator 1701 may, in some embodiments, be greater than corresponding electrical conductivities of anode and cathode frames 1115 and 1131 (see also FIG. 11A). It is also contemplated that a base material of cathode interface separator 1701 may be coated with, for instance, one or more other materials, e.g., one or more corrosion-resistant materials. Whatever the case, cathode interface separator 1701 may be formed in any suitable manner, such as additively manufactured, injection molded, compression molded, stamped, casted, machined, and/or the like.

Anode Interface Assembly

Figure 44:
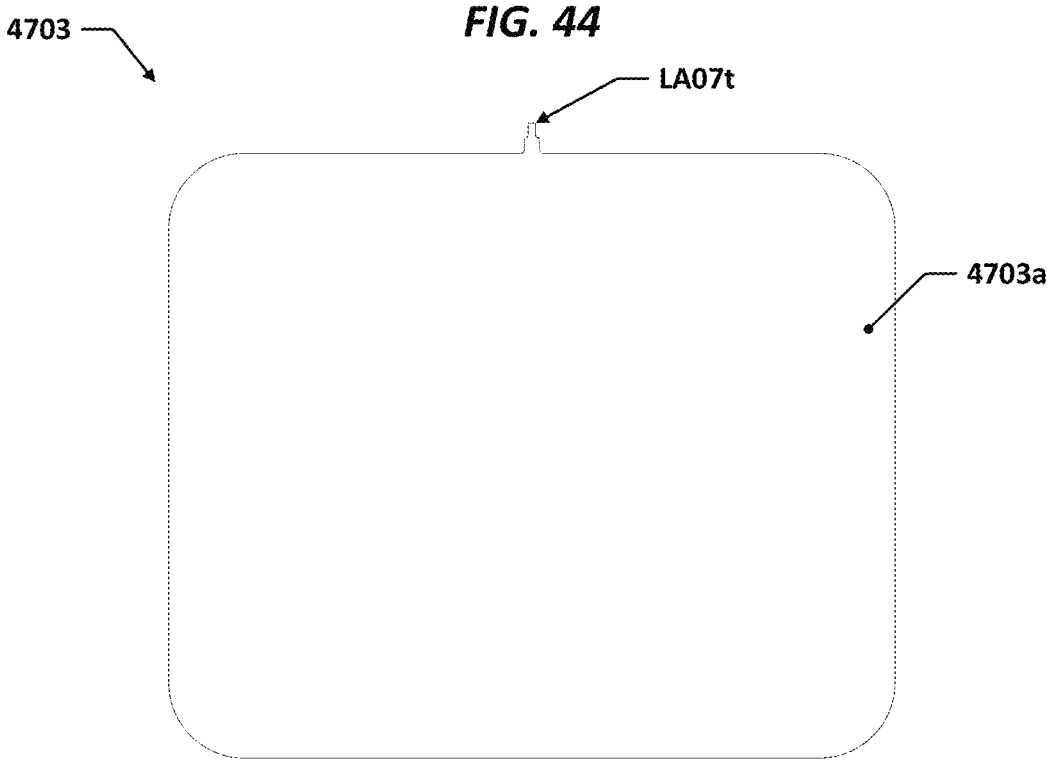
FIG. 44 depicts an example anode interface separator of FIG. 47.
Figure 47:
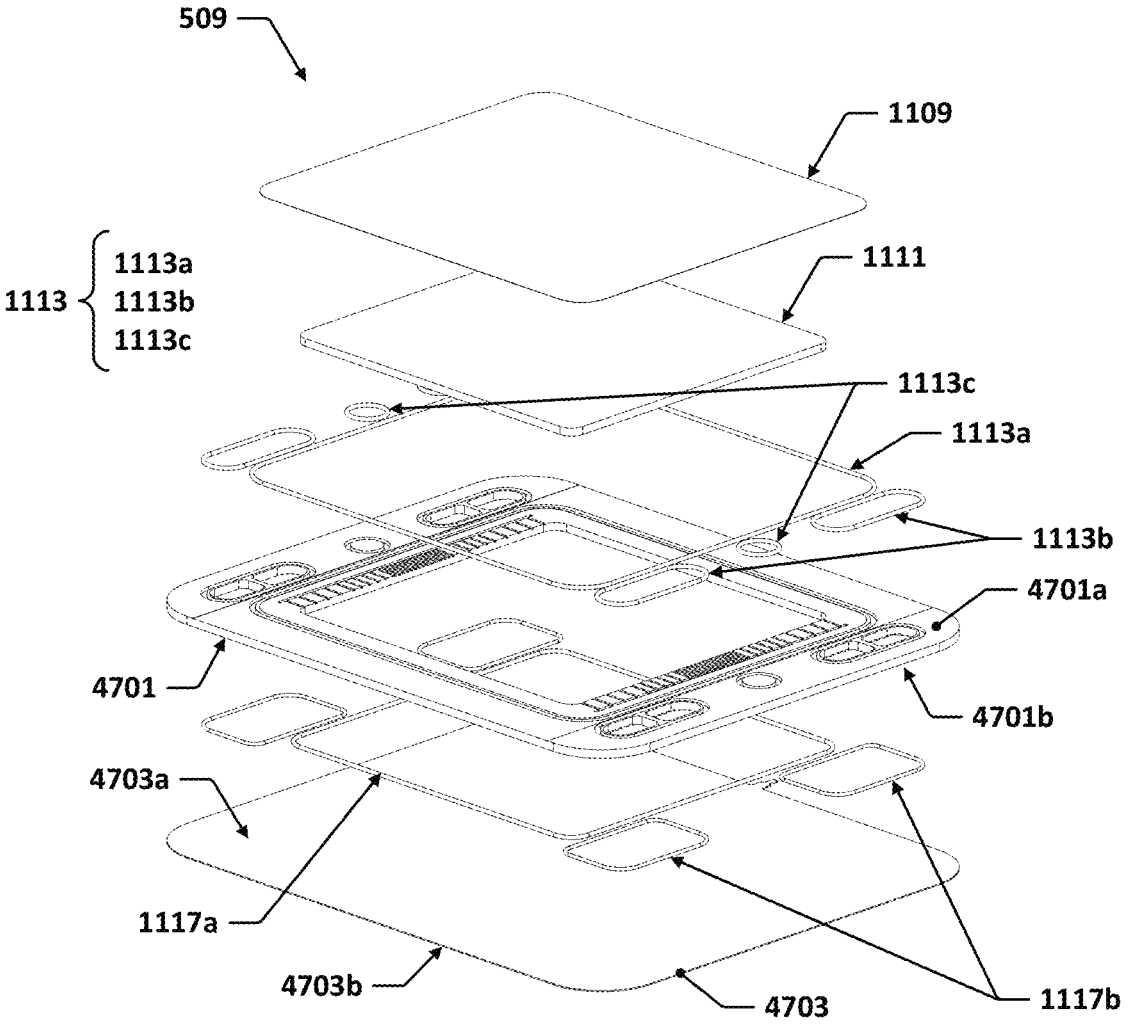
FIG. 47 depicts an exploded view of an example anode interface assembly of the example multi-cell $CO_x$ electrolyzer stack of FIG. 6.
Figure 48:
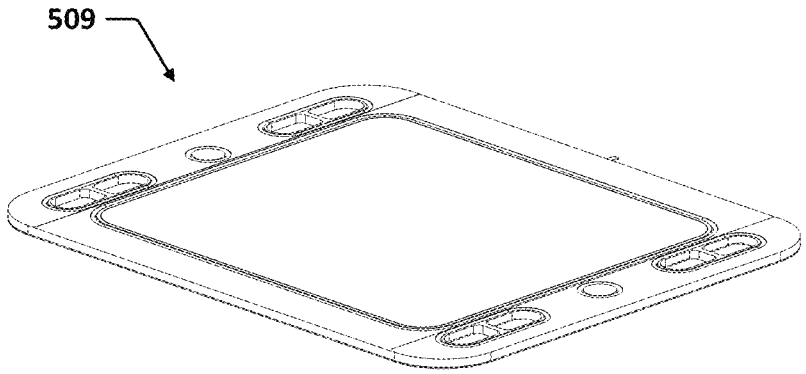
FIG. 48 depicts the example anode interface assembly of FIG. 47 in an assembled state.

FIG. 47 depicts an exploded view of an example anode interface assembly of the example multi-cell $CO_x$ electrolyzer stack of FIG. 6. FIG. 48 depicts the example anode interface assembly of FIG. 47 in an assembled state. FIG. 44 depicts an example anode interface separator of FIG. 47.

As seen in at least FIGS. 5, 6, 11A, 44, 47, and 48, anode interface assembly 509 may include equivalent components as anode components 1101 of repeat unit 1100, except anode interface assembly 509 may omit third anode gaskets 1117*c* of second anode gasket set 1117 and include anode frame 4701 instead of anode frame 1115. As such, duplicative descriptions of equivalent components will be omitted to avoid obscuring embodiments disclosed herein. In addition, anode interface assembly 509 may include anode interface separator 4703, which may be configured substantially equivalent to separator plate 1107 of repeat unit 1100, except anode interface separator 4703 may exclude openings/orifices 4319-4335 (see FIG. 43). It is also noted that anode frame 4701 may be substantially equivalent to anode frame 1115 (see also FIGS. 37-42), except that anode frame 4701 may omit second fluidic inlet and outlet passages 3743 and 3745, recesses 4027 and 4029 in surface 3703, and first, second, and third fastener orifices 3761, 3763, and 3765, as well as swage nuts 1135. Thus, instead of anode frame 4701 being coupled to an adjacent cathode frame, such as cathode frame 1115, as in repeat unit 1100 described at least in association with FIG. 11A, anode frame 4701 may simply be interposed between unitized MEA assembly 1119_*n* of repeat unit 503_*n* and anode interface separator 4703 when anode interface assembly 509 is incorporated as part of stack 500 (see also FIGS. 5-10). As such, second and third anode gaskets 1113*b* and 1113*c* of first anode gasket set 1113 may interface with recesses in surface 4701*a* of anode frame 4701 similar to recesses 3749-3759 in surface 3701 of anode frame 1115 and abut against surface 2803 of cathode frame 1131 of repeat unit 503_*n* around first and second fluidic inlet and outlet passages 2815-2821 (see also FIGS. 28-36). Further, first anode gasket 1113*a* of first anode gasket set 1113 may interface with a recess in surface 4701*a* of anode frame 4701 similar to recess 3747 in surface 3701 of anode frame 1115, abut against a corresponding surface of support frame 1125 of unitized MEA assembly 1119 (see also FIGS. 25-27), and encircle opening 1125*a* in support frame 1125 (see also FIGS. 25-27). In a similar fashion, first and second anode gaskets 1117*a* and 1117*b* of second anode gasket set 1117 may simply interface with recesses in surface 4701*b* of anode frame 4701 similar to recesses 4017-4025 in surface 3703 of anode frame 1115 (see also FIGS. 39, 40, and 42) and may abut against first surface 4703*a* of anode interface separator 4703.

Bladder

As previously discussed, bladder side assembly 511 (see, e.g., FIG. 5) may be at least configured to constrain axial expansion of the plurality of cells, such as cell 501, of stack 500 during the $CO_x$ reduction process(es) in a manner that prevents or reduces the likelihood of the plurality of cells from being overly or insufficiently compressed, but maintain corresponding fluidic seals and electrical conductivity between associated components of stack 500. These features may be provided by the conjunction of bladder bus plate 521, insulation plate 523, end plate 525, gaskets 559 and 561, and fluidic inlet connector 563 (see, e.g., FIGS. 5-10).

Figure 86:
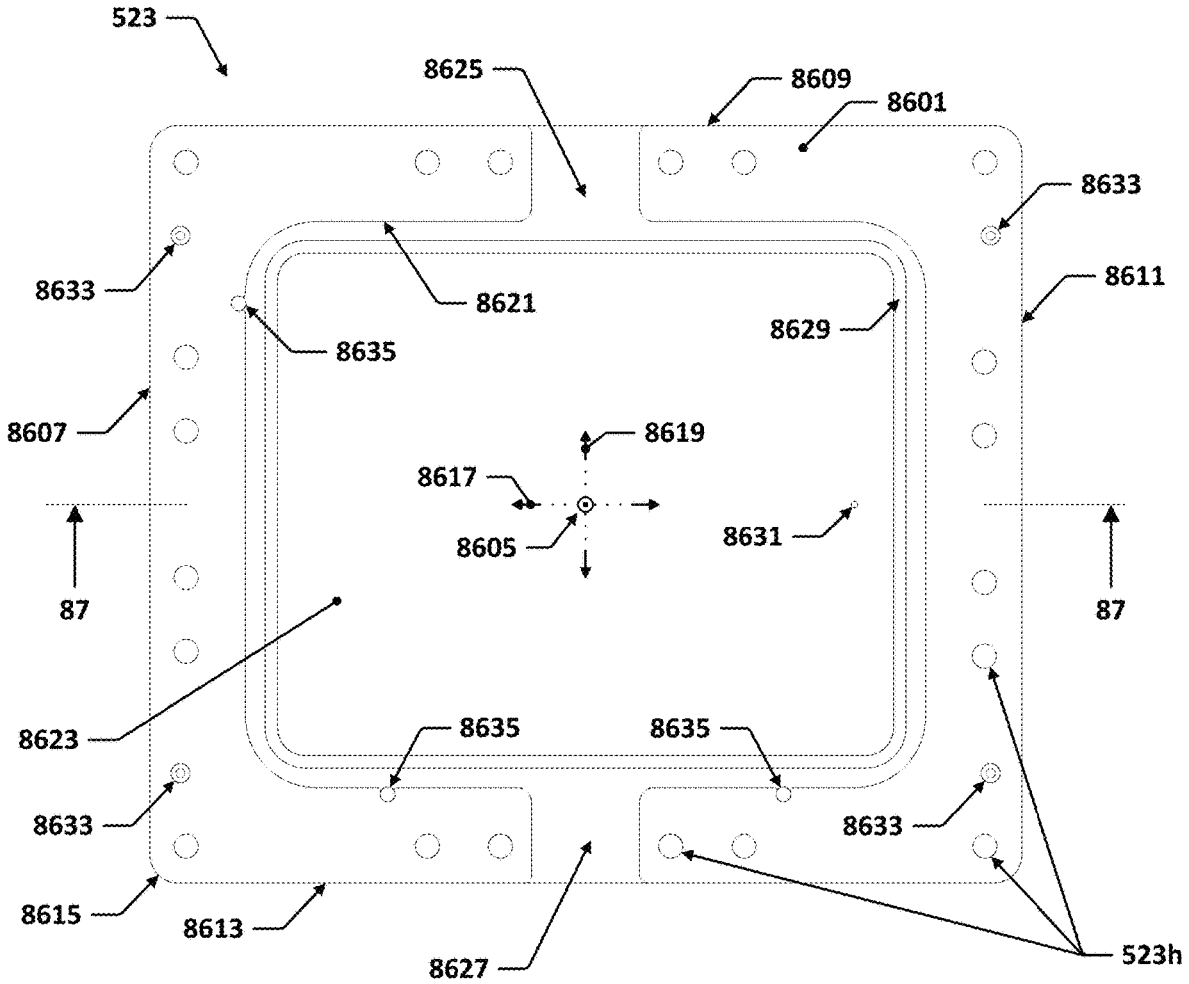
FIG. 86 depicts a plan view of an illustrative insulation plate of the example multi-cell $CO_x$ electrolyzer of FIG. 6.
Figure 87:
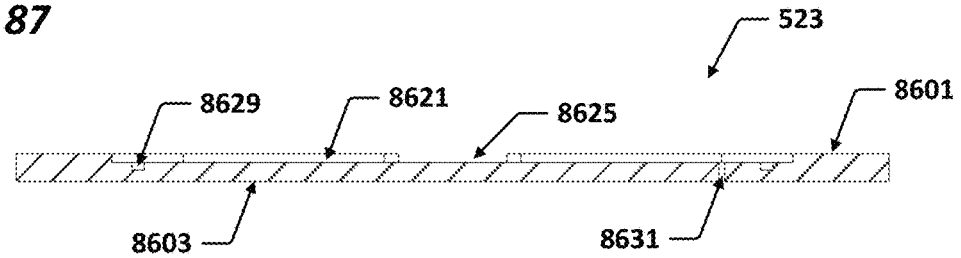
FIG. 87 depicts a cross-sectional view of the illustrative insulation plate of FIG. 86 taken along sectional line 87-87.
Figure 88:
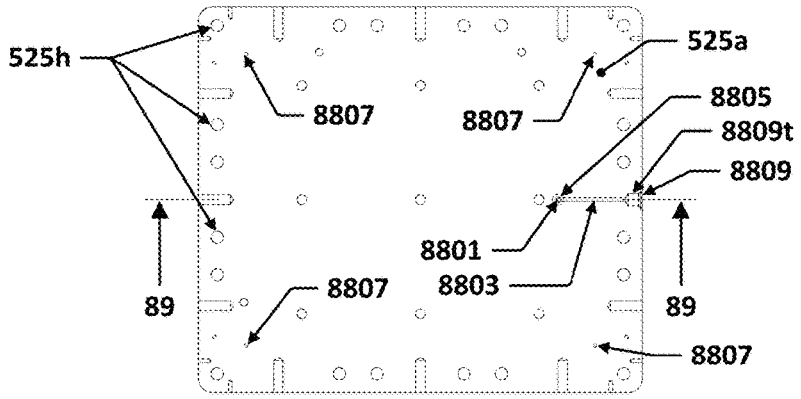
FIG. 88 depicts a plan view of an illustrative end plate of the example multi-cell $CO_x$ electrolyzer of FIG. 6.
Figure 89:
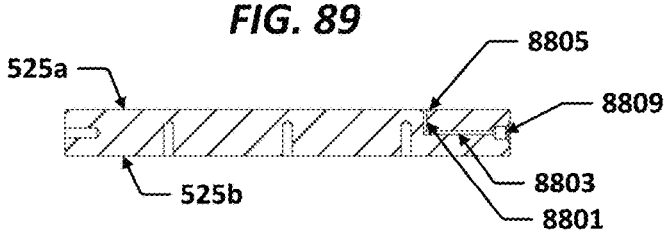
FIG. 89 depicts a cross-sectional view of the illustrative end plate of FIG. 88 taken along sectional line 89-89.
Figure 90:
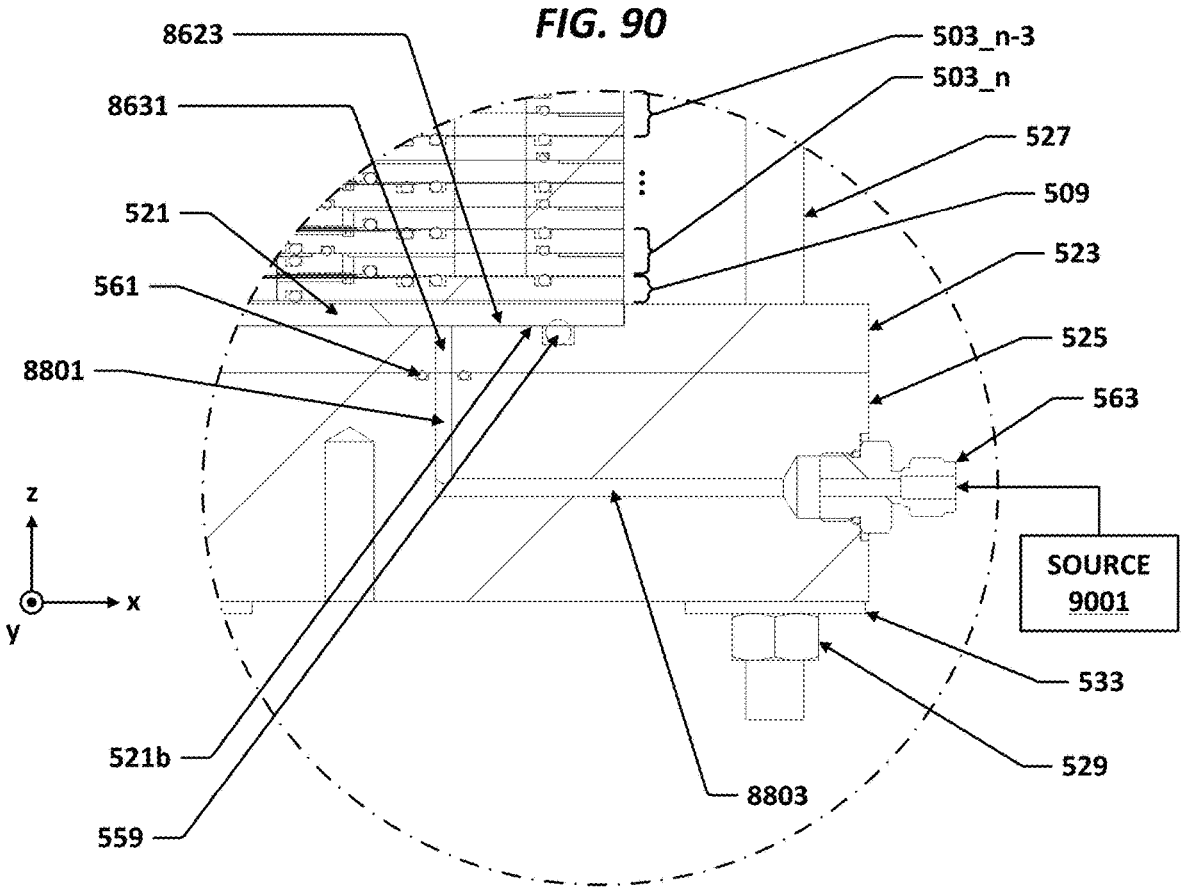
FIG. 90 depicts an enlarged portion of the cross-sectional view of FIG. 9

FIG. 86 depicts a plan view of an illustrative insulation plate of the example multi-cell $CO_x$ electrolyzer of FIG. 6. FIG. 87 depicts a cross-sectional view of the illustrative insulation plate of FIG. 86 taken along sectional line 87-87. FIG. 88 depicts a plan view of an illustrative end plate of the example multi-cell $CO_x$ electrolyzer of FIG. 6. FIG. 89 depicts a cross-sectional view of the illustrative end plate of FIG. 88 taken along sectional line 89-89. FIG. 90 depicts an enlarged portion of the cross-sectional view of FIG. 9.

Referring to FIGS. 86 and 87, insulation plate 523 may be a generally rectangular plate-shaped body having first surface 8601 (e.g., a top surface) opposing second surface 8603 (e.g., a bottom surface) in axial direction 8605. Although insulation plate 523 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, insulation plate 523 will be described in association with a generally rectangular configuration. First and second surfaces 8601 and 8603 may be bounded by one or more peripheral surfaces, such as peripheral surfaces (or surfaces) 8607, 8609, 8611, and 8613 that may be connected to one another via one or more other peripheral surfaces, such as peripheral surface (or surface) 8615. In some embodiments, insulation plate 523 may have a symmetrical configuration about one or more reference planes perpendicular to axial direction 8605. For instance, a configuration of insulation plate 523 may be symmetrical about either or both of reference planes 8617 and 8619, but embodiments are not limited thereto.

According to various implementations, insulation plate 523 includes first recess 8621 in a central portion of surface 8601. First recess 8621 may not only terminate at surface 8623, but may also include extended portions 8625 and 8627 extending from a central area of first recess 8621 respectively towards peripheral surfaces 8609 and 8613. A size, shape, and location of first recess 8621 may be configured to enable at least a portion of bus plate 521 (see, e.g., FIGS. 5-10) to be received therein when stack 500 is assembled. As such, a corresponding portion of terminal portion 521*t* of bus plate 521 (see, e.g., FIGS. 5-10) may be received in one of extended portions 8625 and 8627. The central area of first recess 8621 may include second recess 8629 in a peripheral region thereof. Second recess 8629 may be configured to interface with gasket 559 (see, e.g., FIGS. 5 and 90) in a manner that, when bus plate 521 and insulation plate 523 are assembled as part of stack 500, lower surface 521*b* (see FIG. 90) of bus plate 521 may at least abut against gasket 559, and, depending on an extent of compression of the various components of stack 500, may either abut against surface 8623 of insulation plate 523 (such as shown in FIG. 90) or may be spaced apart from surface 8623 in an axial direction, which may extend parallel (or substantially parallel) to the z-axis direction shown in FIGS. 5 and 90 and may be the same as axial direction 8605. As will become more apparent below, a distance in axial direction 8605 between lower surface 521*b* of bus plate 521 and surface 8623 of insulation plate 523 may be controlled to constrain axial expansion of the plurality of cells, such as cell 501, of stack 500 (see, e.g., FIGS. 5-10) during the $CO_x$ reduction process(es) to maintain corresponding fluidic seals and electrical conductivity between associated components of stack 500, but in a manner that prevents or reduces the likelihood that the plurality of cells (and the associated components of the cells) are overly compressed.

For example, one or more control fluids (e.g., gaseous $CO_x$) may be introduced between bus plate 521 and insulation plate 523 to regulate a distance between lower surface 521*b* of bus plate 521 and surface 8623 of insulation plate 523. In some embodiments, the one or more control fluids may be provided via orifice 8631 in surface 8623 that extends through insulation plate 523 to surface 8603. A size, shape, and location of orifice 8631 may correspond with a size, shape, and location of blind orifice 8801 in surface 525*a* of end plate 525 (see FIGS. 88-90). Blind orifice 8801 of end plate 525 may be fluidically connected to fluidic inlet connector 563 via fluidic passageway 8803 as seen in FIGS. 88-90. As such, the one or more control fluids may be caused to flow between bus plate 521 and insulation plate 523 via the conjunction of fluidic inlet connector 563, fluidic passageway 8803, blind orifice 8801, and orifice 8631, as well as source 9001 (see FIG. 90) of the one or more control fluids. In some embodiments, source 9001 of the one or more control fluids may be the same as the source of input providing, for instance, gaseous $CO_x$, to second fluidic inlet connector 547 (see FIG. 5). Regardless of the source, the distance between lower surface 521*b* of bus plate 521 and surface 8623 of insulation plate 523 may be controlled based on an accumulated pressure of the one or more control fluids in the area between lower surface 521*b* of bus plate 521 and surface 8623 of insulation plate 523, the area being peripherally bounded by gasket 559 (see also FIGS. 5 and 90). In this manner, regulating the distance between lower surface 521*b* of bus plate 521 and surface 8623 of insulation plate 523 may be utilized to constrain axial expansion of the plurality of cells, such as cell 501, during operation. This may help maintain corresponding fluidic seals and electrical conductivity between associated components of stack 500 (see, e.g., FIG. 5).

According to some embodiments, when the accumulated pressure in the area between lower surface 521*b* of bus plate 521 and surface 8623 of insulation plate 523 builds beyond a determined threshold, the distance between lower surface 521*b* of bus plate 521 and surface 8623 of insulation plate 523 may increase to point at which a fluidic seal formed between gasket 559 and lower surface 521*b* of bus plate 521 may become compromised. If and when the fluidic seal formed between gasket 559 and lower surface 521*b* of bus plate 521 becomes compromised, at least some of the one or more control fluids may escape (or bleed) from the area between lower surface 521*b* of bus plate 521 and surface 8623 of insulation plate 523 that may cause the accumulated pressure to decrease along with the distance between lower surface 521*b* of bus plate 521 and surface 8623 of insulation plate 523. In some embodiments, insulation plate 523 and/or end plate 525 may be configured with one or more fluidic passages interfacing with a relief valve configured to evacuate excess pressure built in the area between lower surface 521*b* of bus plate 521 and surface 8623 of insulation plate 523 to prevent over compression of the various components of stack 500 (see, e.g., FIG. 5).

In some embodiments, surface 525*a* (see FIG. 88) of end plate 525 may include recess 8805 encircling blind orifice 8801. Recess 8805 may be configured to interface with gasket 561 (see, e.g., FIGS. 5 and 90) such that, when insulation plate 523, end plate 525, gasket 565, and gasket 561 are incorporated as part of stack 500 (see, e.g., FIGS. 5 and 90), gasket 561 may not only be interposed between insulation plate 523 and end plate 525, but also form a fluidic seal between orifice 8631 in insulation plate 523 and blind orifice 8801 in end plate 525. The fluidic seal between orifice 8631 in insulation plate 523 and blind orifice 8801 in end plate 525 may be enhanced through the coupling of insulation plate 523 and end plate 525. As such, insulation plate 523 may include a plurality of fastener orifices 8633 (which may be countersunk with respect to surface 8601) to enable first fasteners 535 (see FIG. 5) to extend through insulation plate 523 and engage with corresponding fastener orifices 8807 (see FIG. 88) in end plate 525. Although only one set of mating orifices configured to enable the one or more control fluids to be flowed into the area between lower surface 521*b* of bus plate 521 and surface 8623 of insulation plate 523 are shown in FIGS. 86-90, insulation plate 523 and end plate 525 may be configured with more than one set of mating orifices. In some cases, a plurality of mating orifices may be provided and arranged about the central area of recess 8621 in insulation plate 523, such as arranged at regular (or substantially regular) rotation angles about, for instance, a reference axis coincident with axial direction 8605. Such a configuration may allow for a more uniform axial force to be exerted on bus plate 521 as pressure builds in the area between lower surface 521*b* of bus plate 521 and surface 8623 of insulation plate 523.

According to various embodiments, source 9001 may be configured to supply the gaseous $CO_x$ to second fluidic inlet connector 547 (see, e.g., FIGS. 5-9) at a first pressure and to supply the one or more control fluids (e.g., gaseous $CO_x$) to fluidic inlet connector 563 (see, e.g., FIGS. 5-9 and 90) at a second pressure. In some embodiments, the first and second pressures may be equivalent or substantially equivalent. In some cases, source 9001 may be configured to control (e.g., adjust) one or more of the first and second pressures based on conditions of stack 500, e.g., based on an extent of expansion of the cells of stack 500 in the axial direction, based on an accumulated pressure in the area between lower surface 521*b* of bus plate 521 and surface 8623 of insulation plate 523, based on the temperature of one or more components of stack 500, and/or the like (see also FIGS. 5-10). As such, the first and second pressures may reach equilibrium, such as, in response to steady state conditions, e.g., steady state operational conditions of stack 500. It is also noted that source 9001 may be configured to supply the gaseous $CO_x$ to second fluidic inlet connector 547 (see, e.g., FIGS. 5-9) at a first time and to supply the one or more control fluids (e.g., gaseous $CO_x$) to fluidic inlet connector 563 (see, e.g., FIGS. 5-9 and 90) at a second time. In some embodiments, the first and second times may occur simultaneously or substantially simultaneously. In some cases, source 9001 may be configured to delay the supply of the one or more control fluids to fluidic inlet connector 563 (see, e.g., FIGS. 5-9 and 90) with respect to the provisioning of the gaseous $CO_x$ to second fluidic inlet connector 547 (see, e.g., FIGS. 5-9). For example, and with reference to FIGS. 5-9 and 90, source 9001 may be configured to delay the supply of the one or more control fluids to fluidic inlet connector 563 until one or more conditions are satisfied, e.g., an extent of expansion of one or more of the cells of stack 500 in the axial direction reaches one or more defined thresholds, a temperature of one or more components of stack 500 reaches one or more defined thresholds, flow of the gaseous $CO_x$ to second fluidic inlet connector 547 reaches steady state condition(s), and/or the like.

With continued reference to FIGS. 86, 88, and 90, insulation plate 523 may include a plurality of datum openings 8635 configured to receive and support respective portions of datum rods 557 therein, and end plate 525 may further include fluidic inlet port 8809 configured to interface with fluidic inlet connector 563. Fluidic inlet port 8809 may include threaded region 8809*t*, which may be configured to engage with a respective threaded region of fluidic inlet connector 563. Alternatively, fluidic inlet connector 563 may be welded, e.g., sweat welded, to fluidic inlet port 8809 and threaded portion 8809*t* may be omitted.

Anode Flow Fields

Figure 83:
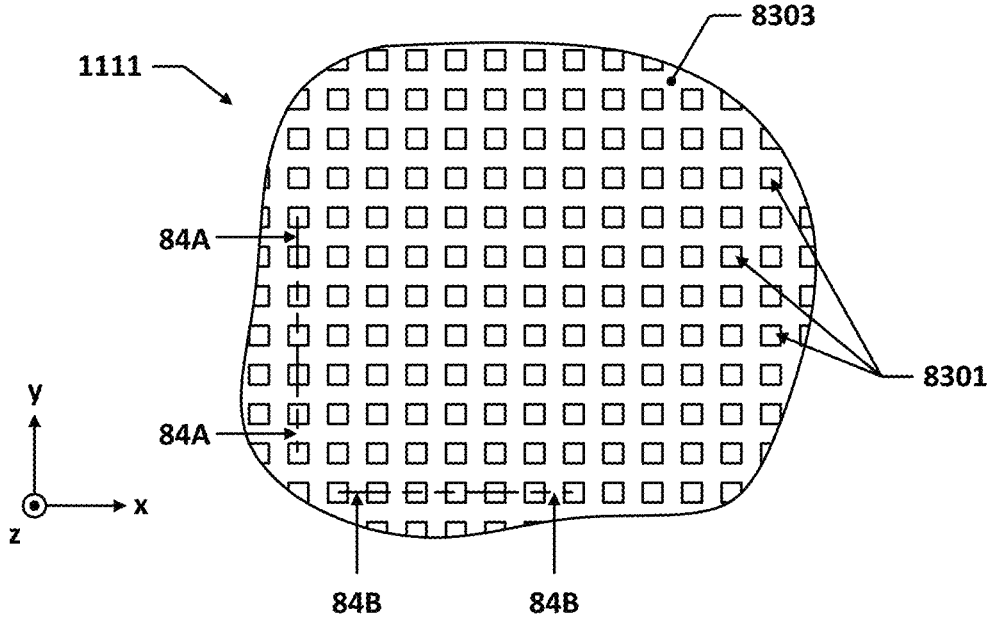
FIG. 83 depicts a plan view of a portion of an illustrative anode flow field of the example multi-cell $CO_x$ electrolyzer of FIG. 6.
Figure 84A:
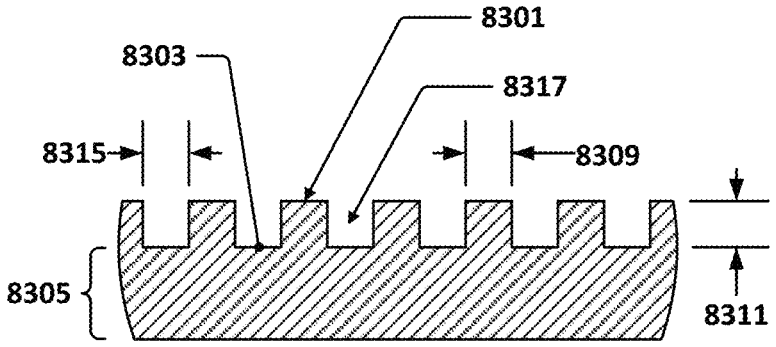
FIGS. 84A and 84B depict respective cross-sectional views of the illustrative anode flow field of FIG. 83 taken along sectional lines 84A-84A and 84B-84B according to some embodiments.
Figure 84B:
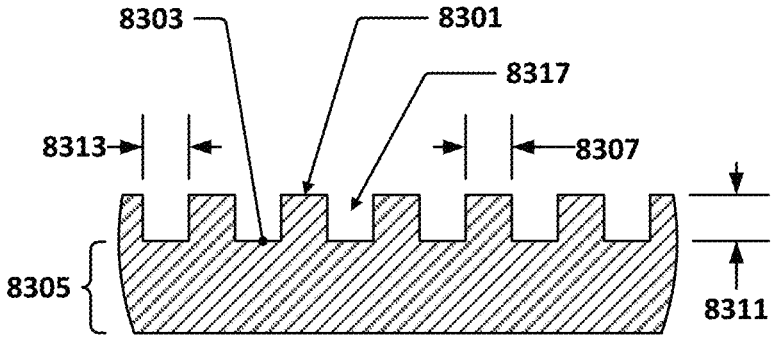

FIG. 83 depicts a plan view of a portion of an illustrative anode flow field of the example multi-cell $CO_x$ electrolyzer of FIG. 6. FIGS. 84A and 84B depict respective cross-sectional views of the illustrative anode flow field of FIG. 83 taken along sectional lines 84A-84A and 84B-84B according to some embodiments.

Figure 85A:
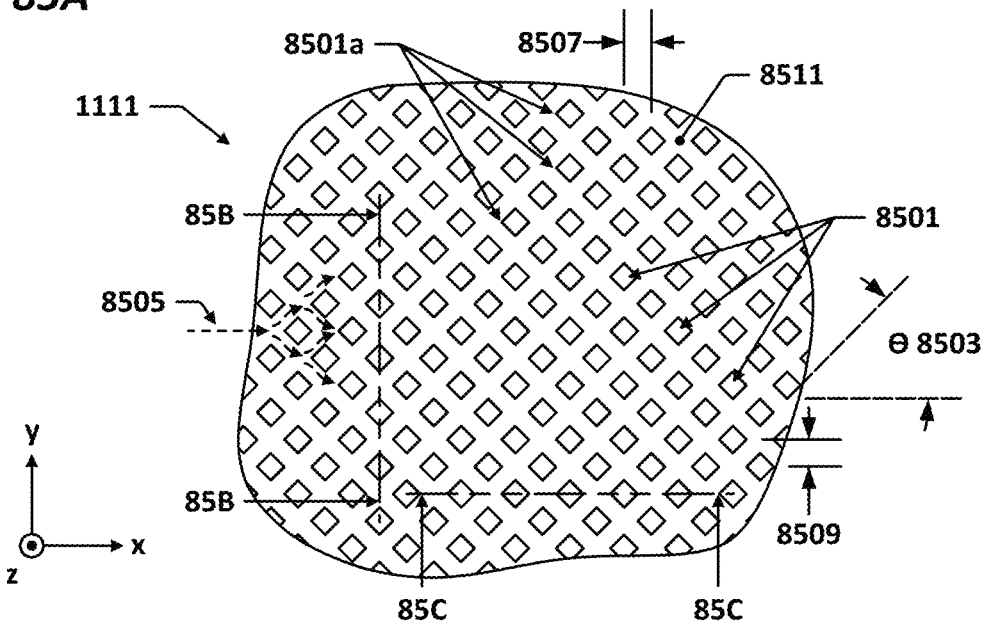
FIG. 85A depicts a plan view of a portion of an illustrative anode flow field of the example multi-cell $CO_x$ electrolyzer of FIG. 6.

With reference to FIGS. 11A, 83, 84A, and 84B, anode flow field 1111 may be a generally rectangular plate-shaped body including a plurality of projections 8301 protruding from surface 8303 of main body portion 8305 in the axial direction, which may extend parallel to the z-axis direction. In some embodiments, projections 8301 may be rectangular prisms having length 8307 in a first direction (e.g., the x-axis direction) transverse to the axial direction, width 8309 in a second direction (e.g., the y-axis direction) transverse to the axial direction and the first direction, and height 8311 in the axial direction, but embodiments are not limited thereto. For instance, one or more of projections 8301 may be alternatively formed as cylindrical prisms, triangular prisms, pentagonal prisms, and/or the like. Projections 8301 may be spaced apart from one another by pitch 8313 in the first direction and pitch 8315 in the second direction. Although projections 8301 are shown as being arranged in a plurality of parallel rows and parallel columns, embodiments are not limited thereto. For instance, adjacent rows and/or columns of projections 8301 may be offset from one another such as shown in FIG. 85A with respect to projections 8501. In some cases, pitches 8313 and 8315 may be equivalent (or substantially equivalent) to one another, but embodiments are not limited thereto. In this manner, fluidic passages 8317 may be formed between adjacent projections among projections 8301, and, thereby, form flow paths through which water (or other anolyte) may flow in a distributed manner generally from supply channels 3733 of anode frame 1115 to collection channels 3735 of anode frame 1115 (see FIG. 37-42) to provide water to anode PTL 1109, and, thereby, to the anode side of MEA 1105 (see FIG. 11A).

Although anode flow field 1111 has been described as having a generally rectangular plate-shaped body, any suitable geometric configuration may be utilized. For instance, anode flow field 1111 may have a generally circular, generally elliptical, generally triangular, generally pentagonal, generally hexagonal, etc., configuration. Whatever configuration is utilized, anode flow field 1111 should be able to be at least partially supported in opening 3723 (see, e.g., FIGS. 23, 24, and 37-42) in anode frame 1115. Further, although anode flow field 1111 has been described in association with a pin-type implementation, embodiments are not limited thereto. For instance, any other suitable anode flow field design may be utilized, such as parallel, serpentine, interdigitated, spiral, radial, etc. An example of a rotated pin-type embodiment will be described in more detail in association with FIGS. 85A-85C.

Figure 85B:
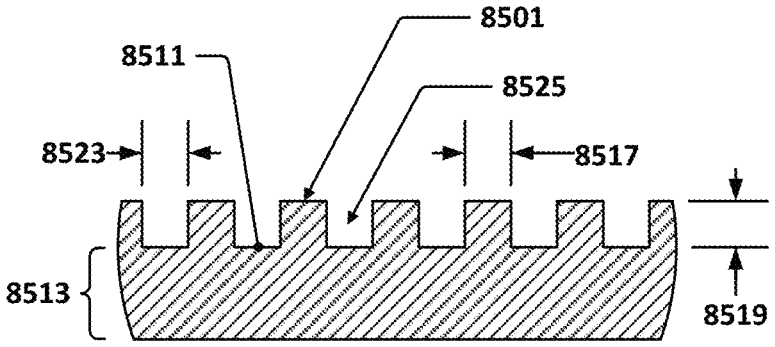
FIGS. 85B and 85C depict respective cross-sectional views of the illustrative anode flow field of FIG. 85A taken along sectional lines 85B-85B and 85C-85C according to some embodiments.
Figure 85C:
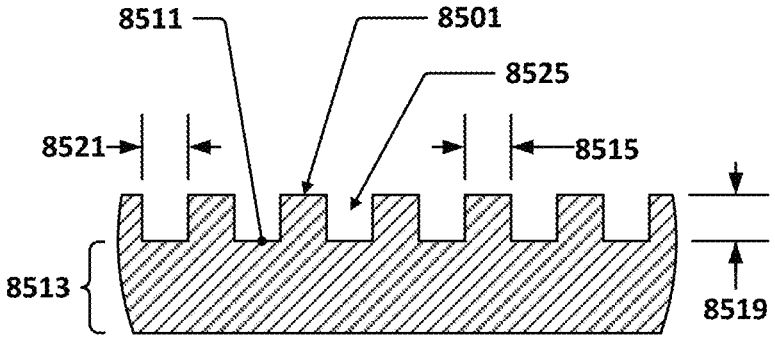

FIG. 85A depicts a plan view of a portion of an illustrative anode flow field of the example multi-cell $CO_x$ electrolyzer of FIG. 6. FIGS. 85B and 85C depict respective cross-sectional views of the illustrative anode flow field of FIG. 85A taken along sectional lines 85B-85B and 85C-85C according to some embodiments.

With reference to FIGS. 11A and 85A-85C, anode flow field 1111 may be formed in a similar manner as described in association with FIGS. 83, 84A, and 84B, but the plurality of projections 8501 in FIGS. 85A-85C may be rotated by angle 8503 with respect to a first direction (e.g., the x-axis direction) to enable leading vertices 8501*a* of projections 8501 to split and distribute input anolyte flow 8505. In addition, adjacent rows and columns of projections 8501 may be offset from one another. For example, adjacent rows may be offset from one another by offset amount 8507 in the first direction transverse to the axial direction (e.g., the z-axis direction), and adjacent columns may be offset from one another by offset amount 8509 in a second direction (e.g., the y-axis direction) transverse to the axial direction and the first direction. In some cases, offset amounts 8507 and 8509 may be equivalent (or substantially equivalent) to one another, but embodiments are not limited thereto.

Similar to projections 8301 described in association with FIGS. 83, 84A, and 84B, projections 8501 may protrude from surface 8511 of main body portion 8513 in the axial direction, which may extend parallel (or substantially parallel) to the z-axis direction. As shown in FIGS. 85A-85C, projections 8501 may be diamond-shaped prisms having respective lengths 8515 in the first direction, corresponding widths 8517 in the second direction, and respective heights 8519 in the axial direction, but embodiments are not limited thereto. For instance, one or more of projections 8501 may be alternatively formed as elliptical prisms, oblong prisms, lenticular prisms, sinus prisms, and/or the like. Projections 8501 may be spaced apart from one another by pitch 8521 in the first direction and pitch 8523 in the second direction. In some cases, pitches 8521 and 8523 may be equivalent (or substantially equivalent) to one another, but embodiments are not limited thereto. In this manner, fluidic passages 8525 may be formed between adjacent projections among projections 8501, and, thereby, form flow paths through which water (or other anolyte) may flow in a distributed manner generally from supply channels 3733 of anode frame 1115 (see FIGS. 37-42) to collection channels 3735 of anode frame 1115 to provide water to anode PTL 1109 (see FIG. 11A), and, thereby, to the anode side of MEA 1105.

Cathode Flow Fields

Various features and technologies may be used to help mitigate the detrimental effects of liquid water accumulation in $CO_x$ electrolyzer cathodes. For example, the cathode flow field 1127 may be constructed so as to have one or more structural features that may allow for more effective liquid water management within the cell 501.

For example, both the anode flow field 1111 and the cathode flow field 1127 may have a corresponding anode channel(s) and cathode channel(s), respectively. The cathode channel(s) may, for example, be designed to have certain characteristics that may contribute to more effective water evacuation in the context of a $CO_x$ electrolyzer and/or that may mitigate the potential performance degradation that may occur in such a $CO_x$ electrolyzer in the event that liquid water collects within the cathode side of the cell 501.

Serpentine Channel Flow Fields

While various geometries of flow field channels may be used in $CO_x$ electrolyzers, multiple serpentine channels generally offer superior performance in terms of providing for reliable, even distribution of $CO_x$ gas to the cathode GDL 1121, and thus the MEA 1105, while also facilitating reliable removal of liquid water that may otherwise accumulate within the cathode flow field 1127 and the cathode GDL 1121 (see FIG. 11A). A serpentine channel typically has repeated longer segments that extend in generally parallel directions and are fluidically connected together by shorter segments that are fluidically interposed between them in alternating fashion, much like a switchback.

For the purposes of this disclosure, the term "fluidically connected" is used with respect to volumes, plenums, holes, etc., that may be structurally connected with one another in some way in order to form a fluidic connection, similar to how the term "electrically connected" is used with respect to components that are connected together to form an electric connection. The term "fluidically interposed," if used, may be used to refer to a component, volume, plenum, or hole that is fluidically connected with at least two other components, volumes, plenums, or holes such that fluid flowing from one of those other components, volumes, plenums, or holes to the other or another of those components, volumes, plenums, or holes would first flow through the "fluidically interposed" component before reaching that other or another of those components, volumes, plenums, or holes. For example, if a pump is fluidically interposed between a reservoir and an outlet, fluid that flowed from the reservoir to the outlet would first flow through the pump before reaching the outlet.

Figure 49:
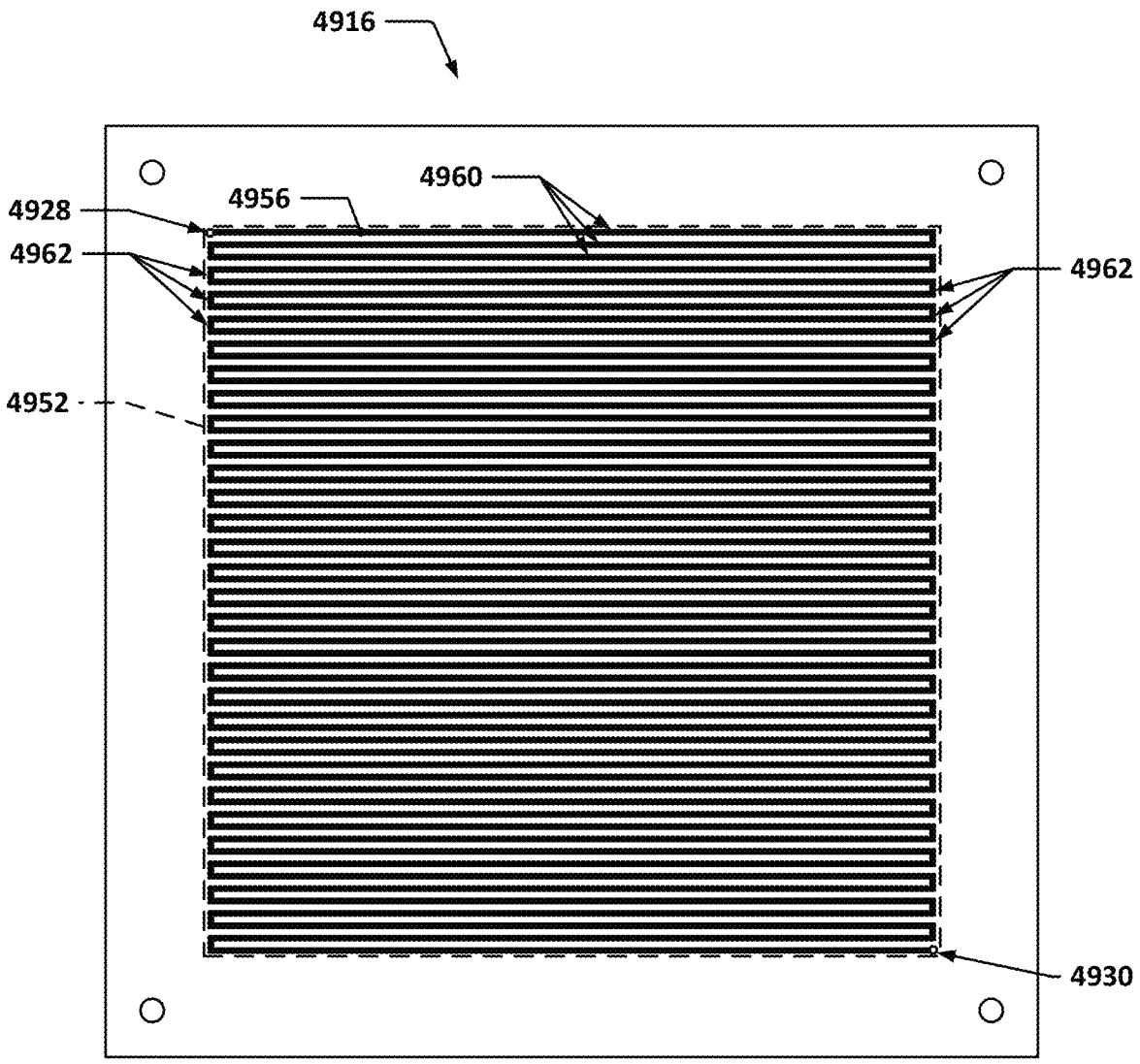
FIG. 49 depicts an example of a cathode flow field with a single serpentine channel.

Single serpentine channel arrangements may have limited water evacuation performance in the context of $CO_x$ electrolyzers for larger-area cells (e.g., larger than 100 $cm^2$). Nevertheless, their performance may be adequate for some applications. In a single serpentine channel arrangement, e.g., such as is shown in FIG. 49, a single, continuous serpentine channel 4956 switchbacks across an area 4952 of a cathode flow field 4916 bounded by shorter segments 4962 and first and last longer segments 4960. The serpentine channel 4956 is thus the only conduit for $CO_x$ gas to enter a corresponding cathode GDL and MEA and is also the only conduit for liquid water that comes into the cathode flow field 4916 from the cathode GDL via that area. Thus, the rate at which liquid water is added to the serpentine channel 4956 is equal to the rate at which liquid water flows out of the area 4952 and into the cathode flow field 4916. The high rate of liquid water introduction into such a serpentine channel 4956, coupled with the long average distance that such water must travel in order to be pushed through the serpentine channel 4956 before reaching a fluidic outlet port, such as fluidic outlet port 4930, generally makes it very challenging to properly manage the liquid water levels within the cathode flow field 4916, rendering $CO_x$ electrolyzers that use such single-channel serpentine cathode flow fields 4916 with significantly compromised performance compared to $CO_x$ electrolyzers using, for example, multiple serpentine channel arrangements. In some implementations, a single serpentine channel has an overall channel length (distance from inlet to outlet) of about 12 m or less, or about 6 m or less, or about 2 m or less.

Figure 50:
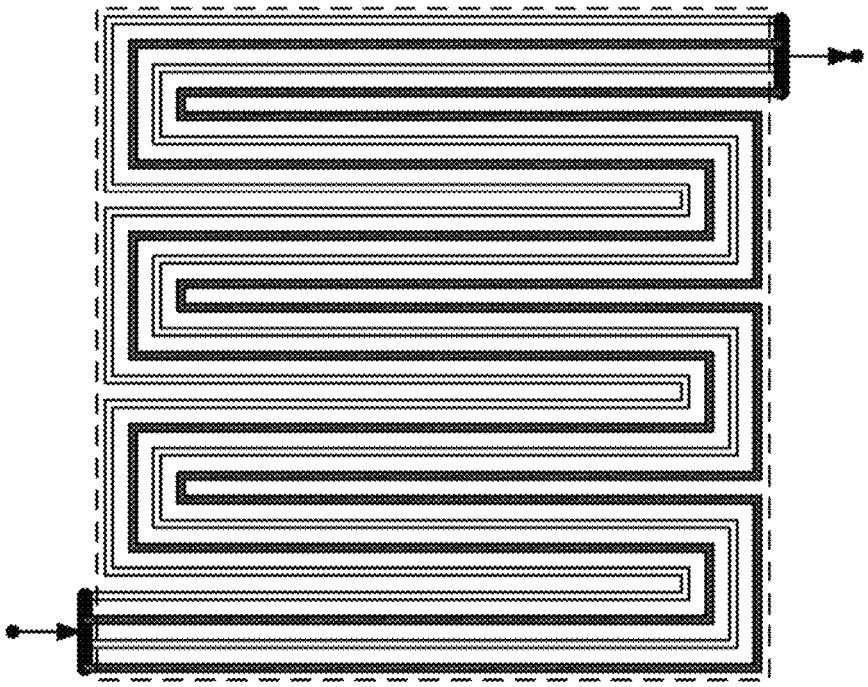
FIG. 50 depicts a diagram of an example multiple serpentine channel arrangement.
Figure 51:
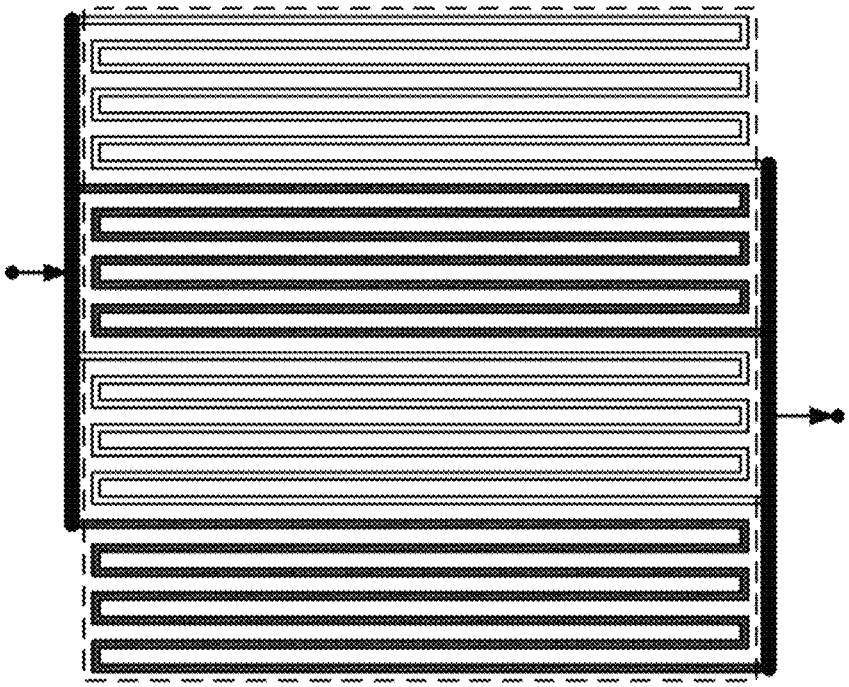
FIG. 51 depicts a diagram of another example multiple serpentine channel arrangement.

Multiple serpentine channels can refer to multiple separate serpentine channels that generally follow a common serpentine path, thereby resulting in an interleaved or nested arrangement of the separate serpentine channels, or can refer to multiple instances of the same serpentine channel (or nearly the same serpentine channel) that are arranged side-by-side or otherwise arranged so as to flow in parallel. FIG. 50 depicts the former arrangement, which may also be referred to herein as nested or interleaved multiple serpentine channel arrangements. In FIG. 50, four serpentine channels that generally follow the same serpentine path are shown (two are shown with interiors with white fill and two with interiors with shaded fill to make it easier to differentiate between them; a broken-line rectangle representing the combined open channel area and wall footprint area of a flow field having such an arrangement is also shown). The open channel area refers to the total area through which gas may exit the flow field and travel into the GDL; in a flow field with constant- and equal-width paths, the open channel area would generally be equal to the total path length of the channel(s) times the channel width. The wall footprint area of a flow field refers to the area of the portion of the flow field that defines walls between adjacent portions of a channel or channels of the flow field and that is pressed into contact with the GDL. Thus, both areas are evaluated within the plane of the flow field that is pressed into contact with the GDL. Fluid may be introduced into/removed from the serpentine channels through the inlet and outlet ports (the short segments terminating in small solid black circles). In FIG. 51, a similar arrangement is shown for a side-by-side arrangement of four multiple serpentine channels, which may also be referred to herein as side-by-side multiple serpentine channels. A similar convention with regard to the inlet/outlet, combined open channel area and wall footprint area, and use of shaded/unshaded fill to illustrate the different channels is used in FIG. 51 as in FIG. 50.

In such arrangements, the total length of each individual serpentine channel may generally be equal to the total lengths of the other individual serpentine channels in the multiple serpentine channels (although in the nested or interleaved multiple serpentine channel arrangements, some small variation in length may be present depending on how the channels are arranged, e.g., whether or not there is an odd or even number of longer segments in each channel), resulting in generally equal flow resistance, pressure drop, and transit time between the channels (assuming that each such channel is fluidically connected with the same fluidic environments on both ends).

Figure 52:
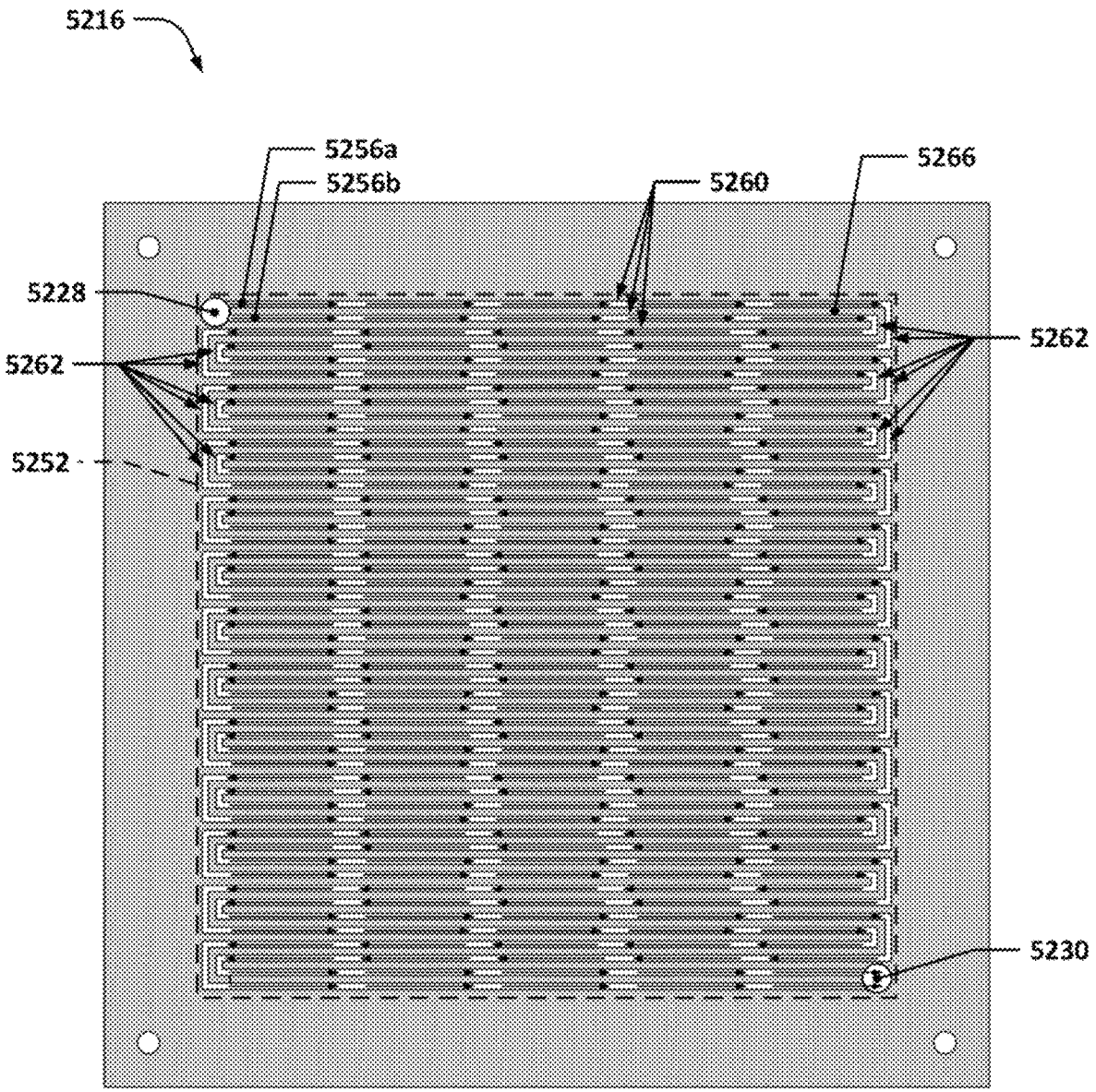
FIG. 52 depicts an example of a cathode flow field that includes a two-channel multiple serpentine channel arrangement.

FIG. 52 depicts an example of a cathode flow field 5216 that includes a two-channel multiple serpentine channel arrangement. As can be seen, the cathode flow field 5216 has a fluidic inlet port 5228 and a fluidic outlet port 5230. Two serpentine channels 5256*a* and 5256*b* are shown which follow a common serpentine path (not shown, but would generally be represented by the path followed by partition wall 5266, which separates the two serpentine channels 5256*a* and 5256*b*). The serpentine channels 5256*a* and 5256*b* switchback across an area 5252 in a generally tandem fashion. As a result, fluid that is flowed through either of the serpentine channels 5256*a* and 5256*b*, e.g., $CO_x$ gas, may generally be evenly delivered to an adjoining cathode GDL within a region corresponding to the area 5252. At the same time, any liquid water that is flowed into the cathode flow field 5216 from the adjoining cathode GDL may correspondingly tend to be evenly delivered to both serpentine channels 5256*a* and 5256*b*. Thus, each serpentine channel 5256 would receive, assuming that the cathode flow field 5216 is substituted for the cathode flow field 4916 of FIG. 49, approximately half the water that was delivered to the single serpentine channel 4956 of FIG. 49. Generally speaking, the amount of water delivered to each serpentine channel in a cathode flow field having a multiple serpentine channel arrangement will be equivalent to the total amount of water received by the multiple serpentine channel arrangement divided by the number of separate channels in the multiple serpentine channel arrangement. This has the effect of reducing the amount of water that must be evacuated from each serpentine channel per unit time, which may make it more feasible to properly manage the liquid water conditions within a $CO_x$ electrolyzer if the gas flow velocity is maintained or at least not proportionately decreased. For example, the lower per channel quantities of water will have less mass and require less energy in order to be pushed through the channels to the fluidic outlet port 5230 of the cathode flow field 5216. As a result, lower pressure differentials between the fluidic inlet port 5228 and fluidic outlet port 5230 of the cathode flow field 5216 may be used while still providing for efficient evacuation of liquid water from the cathode flow field 5216.

Multiple serpentine channels may also allow for relatively even distribution of the fluid that flows within them across the cathode GDL 1121 but with decreased total flow path length for each such serpentine channel as compared with multiple serpentine channel or single serpentine channel implementations having the same or similar channel depth and width and total open channel area in contact with the cathode GDL 1121 but with fewer numbers of such channels. For example, for a given multiple serpentine channel arrangement, it may be desirable to maintain the distance between adjacent portions of at least the longer portions of the serpentine channel(s) to be within a minimum distance of each other. For each additional serpentine channel that is included in a multiple serpentine channel arrangement, meeting such inter-channel spacing restrictions may be attained using serpentine channels of increasingly shorter overall lengths. For clarity, the overall length of a serpentine channel refers to the total of the average path lengths for all of the longer segments of the serpentine channel plus the total average path length of shorter segments that fluidically connect those longer segments with one another, plus the total average path length of any other segments that are fluidically interposed between the inlet and outlet of the serpentine channel.

Moreover, as serpentine channels decrease in length, the average potential distance that liquid water must travel in order to be expelled from such a serpentine channel will also decrease, as does generally the maximum amount of water that would potentially need to be removed. As a result, less energy is required to evacuate water from such serpentine channels in the event that water collects within such a serpentine channel; this is because the maximum amount of water that may need to be removed from such a channel will be less than in longer-length channels (of the same general cross-sectional area)—there is thus less mass to move. Moreover, the distance that such a water mass must be displaced by in order to push it through such a channel to the fluidic outlet port will generally be less than the distance that a similar water mass must be displaced by in order to be pushed through a longer-length channel to the fluidic outlet port. Of course, the distance that the water mass must be displaced by in order to be pushed through the channel to the fluidic outlet port is dependent on where the water mass is located within the channel. However, on average, water masses that collect in shorter-length channels will generally need to be displaced by a lesser amount than water masses that collect in longer-length channels in order to move such water masses to the fluidic outlet port of the flow field having such channels. Since less energy is needed to move such water masses (droplets) in flow fields with shorter-length passages, lower gas flow velocities, and lower pressure drops, may be used. In some embodiments, a cathode flow field has a serpentine channel with a length of about 12 m or less, or about 10 m or less, or about 6 m or less. For example, serpentine channels that have overall lengths on the order of less than about 6 meters, e.g., less than about 6 meters, less than about 5.5 meters, less than about 5 meters, less than about 4.5 meters, less than about 4 meters, less 3.5 meters, less than about 3 meters, less than about 2.5 meters, or less than about 2 meters may, in some implementations, provide a fluid flow path in the cathode flow field 1127 that allows for the flow of $CO_x$ gas to be distributed across a wide area of the cathode GDL 1121 while, at the same time, avoiding being so long that evacuating liquid water from within such serpentine channels becomes too difficult. At the same time, serpentine channels that are too short may make it challenging to maintain a desired pressure drop (see later discussion below) across the cathode flow field 1127. To that end, some cathode flow field serpentine channels may be configured to also have overall lengths greater than or equal to 1.5 meters.

In some implementations, the length of an individual serpentine channel for a cathode flow field may be between about 1.5 m and about 12 m, between about 1.5 m and about 6 m, between about 1.5 m and about 3.8 m, between about 3.8 m and about 6 m, between about 1.5 m and about 2.6 m, between about 2.6 m and about 3.8 m, between about 3.8 m and about 4.9 m, between about 4.9 m and about 6 m, between about 1.5 m and about 2.1 m, between about 2.1 m and about 2.6 m, between about 2.6 m and about 3.2 m, between about 3.2 m and about 3.8 m, between about 3.8 m and about 4.3 m, between about 4.3 m and about 4.9 m, between about 4.9 m and about 5.4 m, between about 5.4 m and about 6 m, between about 1.5 m and about 1.8 m, between about 1.8 m and about 2.1 m, between about 2.1 m and about 2.3 m, between about 2.3 m and about 2.6 m, between about 2.6 m and about 2.9 m, between about 2.9 m and about 3.2 m, between about 3.2 m and about 3.5 m, between about 3.5 m and about 3.8 m, between about 3.8 m and about 4 m, between about 4 m and about 4.3 m, between about 4.3 m and about 4.6 m, between about 4.6 m and about 4.9 m, or between about 4.9 m and about 5.2 m. It will be understood that reference herein, both above and below, to a value being "between" two other values, unless the context indicates otherwise, is inclusive of the values in between the two other values as well as the values themselves.

In cathode flow fields with serpentine channels, it may be beneficial to configure the serpentine channels to have particular structural characteristics that may provide for enhanced liquid water removal while at the same time providing for effective $CO_x$ delivery to the cathode GDL. For example, serpentine channels within the length ranges discussed above may be further constrained to have particular widths (the dimension of a serpentine channel in a direction parallel to the plane of the cathode GDL 1121 and transverse to the path that the channel follows (or, generally, transverse to the nominal flow direction of fluid flow through the channel)) and depths (the dimension of a serpentine channel in a direction perpendicular to the plane of the cathode GDL 1121) to further enhance their water-removal performance in the context of a $CO_x$ electrolyzer. For clarity, the cathode GDL 1121 is generally in the form of a thin sheet that, when stacked with the MEA 1105 (see, e.g., FIG. 11A) and the anode PTL 1109 (see, e.g., FIG. 11A), is compressed between the cathode flow field 1127 and the anode flow field 1111 into a nominally planar geometry; reference to "the plane of the cathode GDL" is thus to be understood to refer to a plane that is generally parallel to, and coincident with, the cathode GDL 1121 in such a state. For example, such serpentine channels may have widths that are between about 0.3 mm and about 2 mm, between about 0.3 mm and about 1.2 mm, between about 1.2 mm and about 2 mm, between about 0.3 mm and about 0.72 mm, between about 0.72 mm and about 1.2 mm, between about 1.2 mm and about 1.6 mm, between about 1.6 mm and about 2 mm, between about 0.3 mm and about 0.51 mm, between about 0.51 mm and about 0.72 mm, between about 0.72 mm and about 0.94 mm, between about 0.94 mm and about 1.2 mm, between about 1.2 mm and about 1.4 mm, between about 1.4 mm and about 1.6 mm, between about 1.6 mm and about 1.8 mm, or between about 1.8 mm and about 2 mm.

Such serpentine channels may also have depths that are between about 0.3 mm and about 3 mm, between about 0.3 mm and about 1.6 mm, between about 1.6 mm and about 3 mm, between about 0.3 mm and about 0.98 mm, between about 0.98 mm and about 1.6 mm, between about 1.6 mm and about 2.3 mm, between about 2.3 mm and about 3 mm, between about 0.3 mm and about 0.64 mm, between about 0.64 mm and about 0.98 mm, between about 0.98 mm and about 1.3 mm, between about 1.3 mm and about 1.6 mm, between about 1.6 mm and about 2 mm, between about 2 mm and about 2.3 mm, between about 2.3 mm and about 2.7 mm, or between about 2.7 mm and about 3 mm.

In particular, in some cathode flow field implementations with serpentine channels, the channels may be dimensioned such that the open surface area per channel, i.e., the area that is bounded by the edges of the channel that contact the cathode GDL, is between about 750 $mm^2$ and about 200,000 $mm^2$, between about 750 $mm^2$ and about 100,000 $mm^2$, between about 100,000 $mm^2$ and about 200,000 $mm^2$, between about 750 $mm^2$ and about 51,000 $mm^2$, between about 51,000 $mm^2$ and about 100,000 $mm^2$, between about 100,000 $mm^2$ and about 150,000 $mm^2$, between about 150,000 $mm^2$ and about 200,000 $mm^2$, between about 750 $mm^2$ and about 26,000 $mm^2$, between about 26,000 $mm^2$ and about 51,000 $mm^2$, between about 51,000 $mm^2$ and about 75,000 $mm^2$, between about 75,000 $mm^2$ and about 100,000 $mm^2$, between about 100,000 $mm^2$ and about 130,000 $mm^2$, between about 130,000 $mm^2$ and about 150,000 $mm^2$, between about 150,000 $mm^2$ and about 180,000 $mm^2$, or between about 180,000 $mm^2$ and about 200,000 $mm^2$.

In some such implementations, such channels may be further dimensioned such that the cross-sectional area (or areas, if the channel has a varying cross-sectional area along its length) of each such channel, i.e., the area of the channel in a plane that is perpendicular to the direction of flow of fluid through the channel under normal operating conditions or to the path that the channel follows across the cathode flow field, is between about 0.15 $mm^2$ and about 6 $mm^2$, between about 0.15 $mm^2$ and about 3.1 $mm^2$, between about 3.1 $mm^2$ and about 6 $mm^2$, between about 0.15 $mm^2$ and about 1.6 $mm^2$, between about 1.6 $mm^2$ and about 3.1 $mm^2$, between about 3.1 $mm^2$ and about 4.5 $mm^2$, between about 4.5 $mm^2$ and about 6 $mm^2$, between about 0.15 $mm^2$ and about 0.88 $mm^2$, between about 0.88 $mm^2$ and about 1.6 $mm^2$, between about 1.6 $mm^2$ and about 2.3 $mm^2$, between about 2.3 $mm^2$ and about 3.1 $mm^2$, between about 3.1 $mm^2$ and about 3.8 $mm^2$, between about 3.8 $mm^2$ and about 4.5 $mm^2$, between about 4.5 $mm^2$ and about 5.3 $mm^2$, or between about 5.3 $mm^2$ and about 6 $mm^2$.

In yet further implementations, the total channel volume of each such channel may be between about 200 μl and about 36,000 μl, between about 200 μl and about 18,000 μl, between about 18,000 μl and about 36,000 μl, between about 200 μl and about 9,200 μl, between about 9,200 μl and about 18,000 μl, between about 18,000 μl and about 27,000 μl, between about 27,000 μl and about 36,000 μl, between about 200 μl and about 4,700 μl, between about 4,700 μl and about 9,200 μl, between about 9,200 μl and about 14,000 μl, between about 14,000 μl and about 18,000 μl, between about 18,000 μl and about 23,000 μl, between about 23,000 μl and about 27,000 μl, between about 27,000 μl and about 32,000 μl, or between about 32,000 μl and about 36,000 μl.

In some such implementations, cathode flow fields with serpentine channels may also have structural characteristics relating to the thickness of the walls that are interposed between adjacent longer segments of one or more of the serpentine channels. For example, the wall thickness in between adjacent longer segments of one or more of the serpentine channels (and thus the distance between surfaces of that channel or those channels that are closest to one another) may be selected to be between about between about 0.00005 and about 0.0013333, between about 0.00005 and about 0.00069, between about 0.00069 and about 0.0013333, between about 0.00005 and about 0.00037, between about 0.00037 and about 0.00069, between about 0.00069 and about 0.001, between about 0.001 and about 0.0013333, between about 0.00005 and about 0.00021, between about 0.00021 and about 0.00037, between about 0.00037 and about 0.00053, between about 0.00053 and about 0.00069, between about 0.00069 and about 0.00085, between about 0.00085 and about 0.001, between about 0.001 and about 0.0012, or between about 0.0012 and about 0.0013333 times the average overall length of that serpentine channel or those serpentine channels (the latter case applying if the wall separates the longer portions of two different serpentine channels from each other—for clarity, in this instance the "average" overall length is half the sum of the overall lengths of both serpentine channels). In some such serpentine channel implementations having dimensional characteristics like those discussed above, the wall thickness may be, for example, between about 0.3 mm and about 2 mm, between about 0.3 mm and about 1.2 mm, between about 1.2 mm and about 2 mm, between about 0.3 mm and about 0.72 mm, between about 0.72 mm and about 1.2 mm, between about 1.2 mm and about 1.6 mm, between about 1.6 mm and about 2 mm, between about 0.3 mm and about 0.51 mm, between about 0.51 mm and about 0.72 mm, between about 0.72 mm and about 0.94 mm, between about 0.94 mm and about 1.2 mm, between about 1.2 mm and about 1.4 mm, between about 1.4 mm and about 1.6 mm, between about 1.6 mm and about 1.8 mm, or between about 1.8 mm and about 2 mm.

Serpentine channel cathode flow fields having characteristics such as those discussed above may offer superior liquid water evacuation performance in the context of $CO_x$ electrolyzers, e.g., under operating conditions typically seen in $CO_x$ electrolyzers (such as are discussed earlier herein) as compared with serpentine channel cathode flow fields having other such characteristics, such as may be designed for use with fuel cells.

While including increasingly higher numbers of multiple serpentine channels in a cathode flow field would generally seem desirable, unfettered increases in the number of flow field channels of the cathode flow field 1127 may be counterproductive. Each additional parallel flow field channel that exists in the cathode flow field 1127 may represent another path that fluid flowing through the multiple serpentine channels may take if blocked from flowing through one or more other serpentine channels in the arrangement of multiple serpentine channels. When such a rerouting of fluid occurs, it may cause an increase in the pressure differential along the channel, e.g., from channel start to channel end, that may cause the fluid that is pressing against the blockage to apply greater pressure on the blockage, thereby increasing the likelihood that the blockage (liquid water) will be dislodged, propelled through the serpentine channel that is being blocked, and eventually evacuated from the cathode flow field 1127 via flow field outlet such as flow field outlet 5930. However, if there are a sufficiently high enough number of channels present, the blockage of any one of them (or a small number of them) may result in a much smaller increase in the pressure differential in any single channel that may occur when an equivalent number of channels is blocked in a flow field with a lesser number of channels. In short, the gas flow that is blocked and reroutes through the other unblocked channels may be divided among a larger number of alternate channels, thereby resulting in a smaller amount of extra gas that must flow through each unblocked channel than might be the case with a lower number of channels in a similar blockage situation. The smaller the amount of extra gas that must flow through each channel during a blockage situation, the smaller the change in pressure drop that is needed to accommodate such a change. As a result, the increase in pressure drop that may occur in unblocked channels when gas flows re-route therethrough due to a blocked channel or channels decreases as the number of channels that are present increases.

At the same time, if the total lengths of the serpentine passages are sufficiently long, e.g., 0.3 m to 6 m, the pressure drop that occurs across each such channel may be high enough that it may act to help dislodge any obstructions, e.g., water, that may exist within any individual serpentine channel regardless of the number of channels present. For example, serpentine channels for $CO_x$ electrolyzers may have dimensions and operational conditions, e.g., fluidic inlet port pressures, that are selected so as to produce a 0.001 psi to 4 psi pressure drop during normal operational flows for such serpentine channels, which may be high enough to dislodge potential water blockages that may be present within the serpentine channels; while higher pressure drops may be used as well, they may be unnecessary with respect to water evacuation and simply result in wasted energy that is needed to move the fluids through the serpentine channels under such pressure drop conditions. In some implementations, serpentine channels for $CO_x$ electrolyzers may have dimensions and operational conditions, e.g., fluidic inlet port pressures, that are selected so as to produce, during normal operational flow conditions for a $CO_x$ electrolyzer, a pressure drop of between about 0.001 psi and about 4 psi, between about 0.001 psi and about 2 psi, between about 2 psi and about 4 psi, between about 0.001 psi and about 1 psi, between about 1 psi and about 2 psi, between about 2 psi and about 3 psi, between about 3 psi and about 4 psi, between about 0.001 psi and about 0.5 psi, between about 0.5 psi and about 1 psi, between about 1 psi and about 1.5 psi, between about 1.5 psi and about 2 psi, between about 2 psi and about 2.5 psi, between about 2.5 psi and about 3 psi, between about 3 psi and about 3.5 psi, between about 3.5 psi and about 4 psi, between about 0.001 psi and about 0.25 psi, between about 0.25 psi and about 0.5 psi, between about 0.5 psi and about 0.75 psi, between about 0.75 psi and about 1 psi, between about 1 psi and about 1.3 psi, between about 1.3 psi and about 1.5 psi, between about 1.5 psi and about 1.8 psi, between about 1.8 psi and about 2 psi, between about 2 psi and about 2.3 psi, between about 2.3 psi and about 2.5 psi, between about 2.5 psi and about 2.8 psi, between about 2.8 psi and about 3 psi, between about 3 psi and about 3.3 psi, between about 3.3 psi and about 3.5 psi, between about 3.5 psi and about 3.8 psi, between about 3.8 psi and about 4 psi, between about 0.001 psi and about 0.13 psi, between about 0.13 psi and about 0.25 psi, between about 0.25 psi and about 0.38 psi, between about 0.38 psi and about 0.5 psi, between about 0.5 psi and about 0.63 psi, between about 0.63 psi and about 0.75 psi, between about 0.75 psi and about 0.88 psi, between about 0.88 psi and about 1 psi, between about 1 psi and about 1.1 psi, between about 1.1 psi and about 1.3 psi, between about 1.3 psi and about 1.4 psi, between about 1.4 psi and about 1.5 psi, between about 1.5 psi and about 1.6 psi, between about 1.6 psi and about 1.8 psi, between about 1.8 psi and about 1.9 psi, between about 1.9 psi and about 2 psi, between about 2 psi and about 2.1 psi, between about 2.1 psi and about 2.3 psi, between about 2.3 psi and about 2.4 psi, between about 2.4 psi and about 2.5 psi, between about 2.5 psi and about 2.6 psi, between about 2.6 psi and about 2.8 psi, between about 2.8 psi and about 2.9 psi, between about 2.9 psi and about 3 psi, between about 3 psi and about 3.1 psi, between about 3.1 psi and about 3.3 psi, between about 3.3 psi and about 3.4 psi, between about 3.4 psi and about 3.5 psi, between about 3.5 psi and about 3.6 psi, between about 3.6 psi and about 3.8 psi, between about 3.8 psi and about 3.9 psi, or between about 3.9 psi and about 4 psi. In some other implementations, serpentine channels for $CO_x$ electrolyzers may have dimensions and operational conditions, e.g., fluidic inlet port pressures, that are selected so as to produce, during normal operational flow conditions for a $CO_x$ electrolyzer, a pressure drop of between about 4 psi and about 50 psi, between about 4 psi and about 27 psi, between about 27 psi and about 50 psi, between about 4 psi and about 16 psi, between about 16 psi and about 27 psi, between about 27 psi and about 38 psi, between about 38 psi and about 50 psi, between about 4 psi and about 9.8 psi, between about 9.8 psi and about 16 psi, between about 16 psi and about 21 psi, between about 21 psi and about 27 psi, between about 27 psi and about 33 psi, between about 33 psi and about 38 psi, between about 38 psi and about 44 psi, between about 44 psi and about 50 psi, between about 4 psi and about 6.9 psi, between about 6.9 psi and about 9.8 psi, between about 9.8 psi and about 13 psi, between about 13 psi and about 16 psi, between about 16 psi and about 18 psi, between about 18 psi and about 21 psi, between about 21 psi and about 24 psi, between about 24 psi and about 27 psi, between about 27 psi and about 30 psi, between about 30 psi and about 33 psi, between about 33 psi and about 36 psi, between about 36 psi and about 38 psi, between about 38 psi and about 41 psi, between about 41 psi and about 44 psi, between about 44 psi and about 47 psi, or between about 47 psi and about 50 psi. In some other implementations, serpentine channels for $CO_x$ electrolyzers may have dimensions and operational conditions, e.g., fluidic inlet port pressures, that are selected so as to produce, during normal operational flow conditions for a $CO_x$ electrolyzer, a pressure drop of between about 0.001 psi and about 50 psi, between about 0.001 psi and about 25 psi, between about 25 psi and about 50 psi, between about 0.001 psi and about 13 psi, between about 13 psi and about 25 psi, between about 25 psi and about 38 psi, between about 38 psi and about 50 psi, between about 0.001 psi and about 6.3 psi, between about 6.3 psi and about 13 psi, between about 13 psi and about 19 psi, between about 19 psi and about 25 psi, between about 25 psi and about 31 psi, between about 31 psi and about 38 psi, between about 38 psi and about 44 psi, or between about 44 psi and about 50 psi. Pressure drops in the ranges listed above may be high enough to dislodge potential water blockages that may be present within such serpentine channels, particularly in the context of the higher water generation rates that $CO_x$ electrolyzers tend to exhibit.

Figure 53:
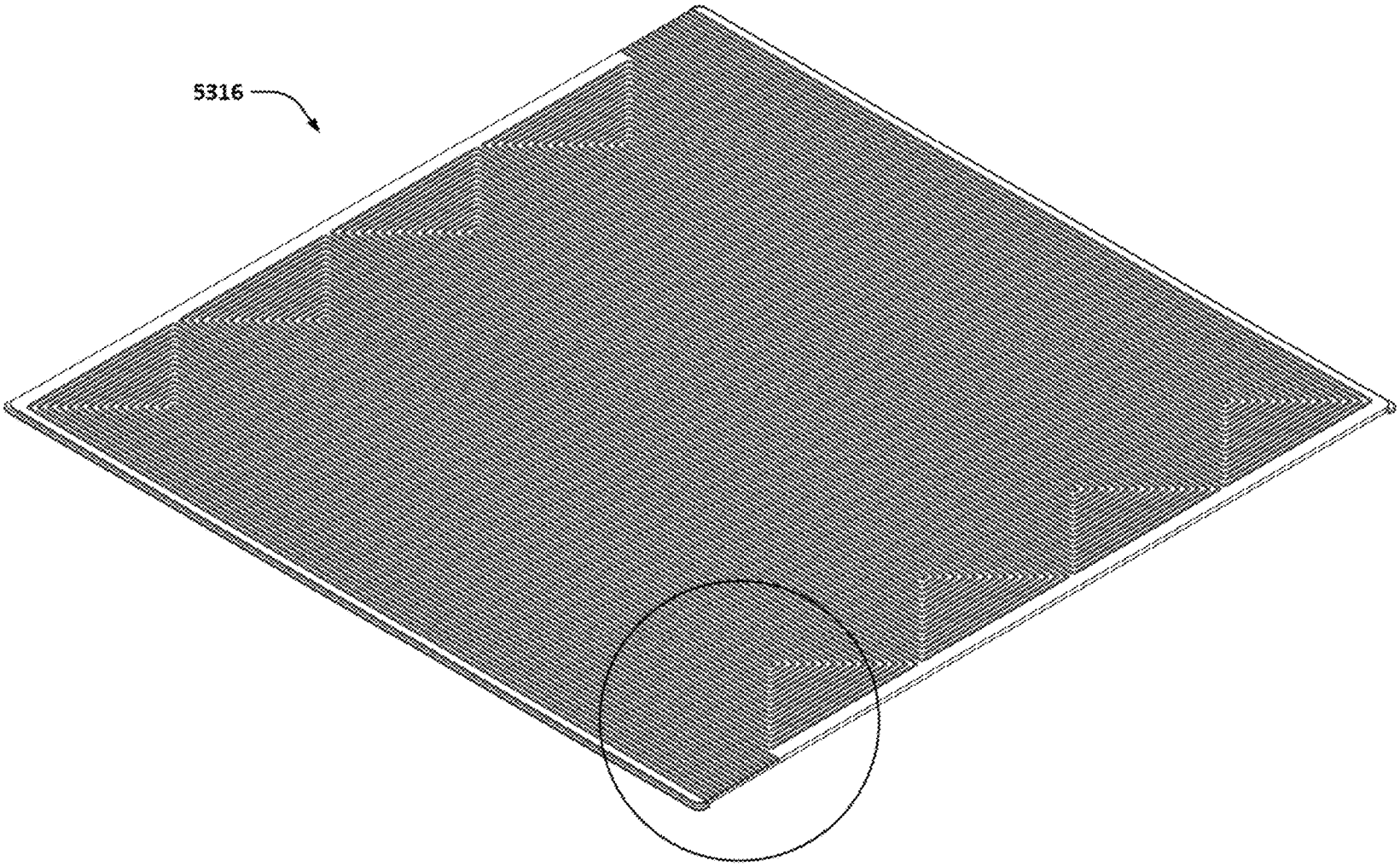
FIGS. 53, 54, and 55 depict an example cathode flow field that may be used in some implementations.
Figure 54:
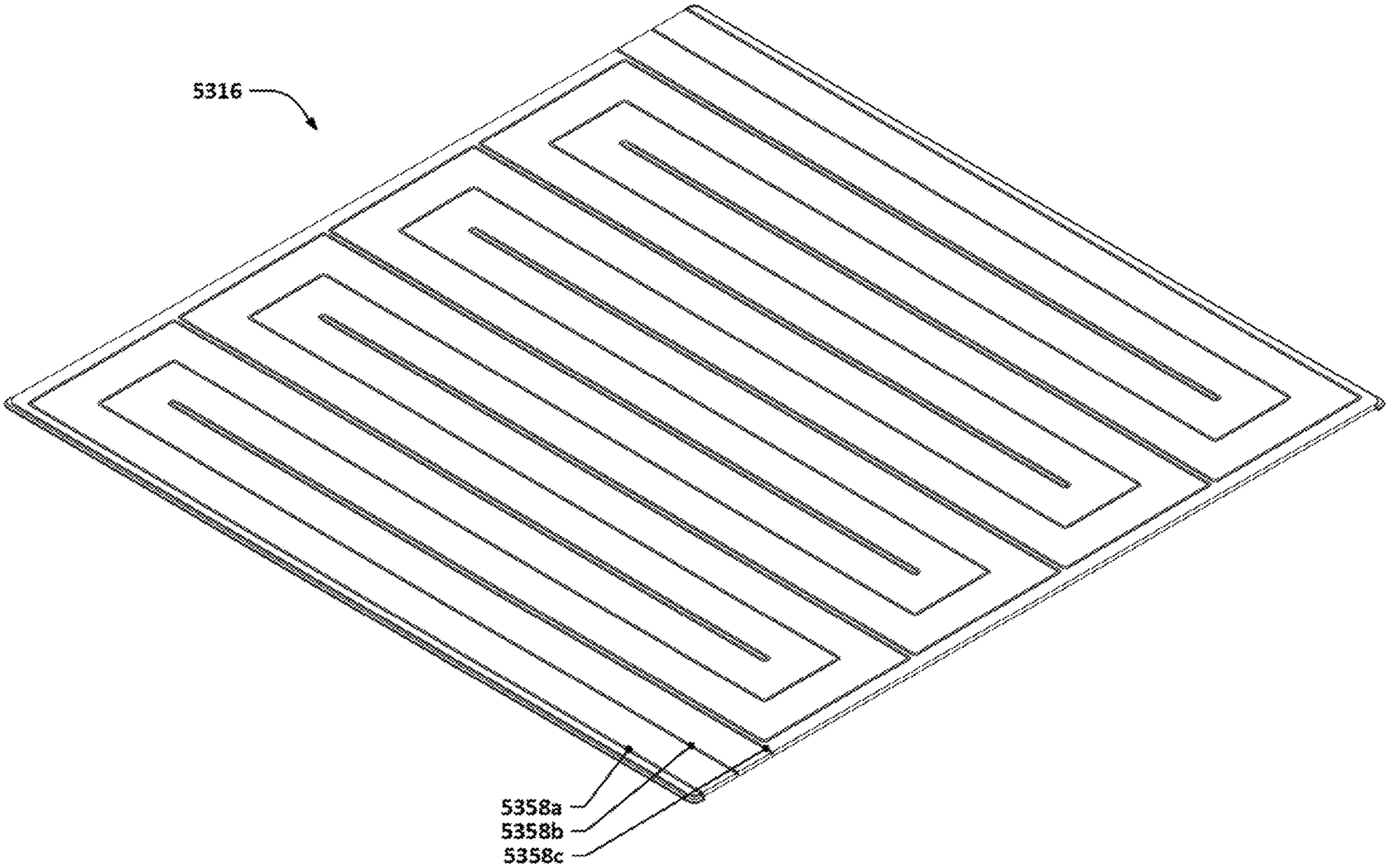
Figure 55:
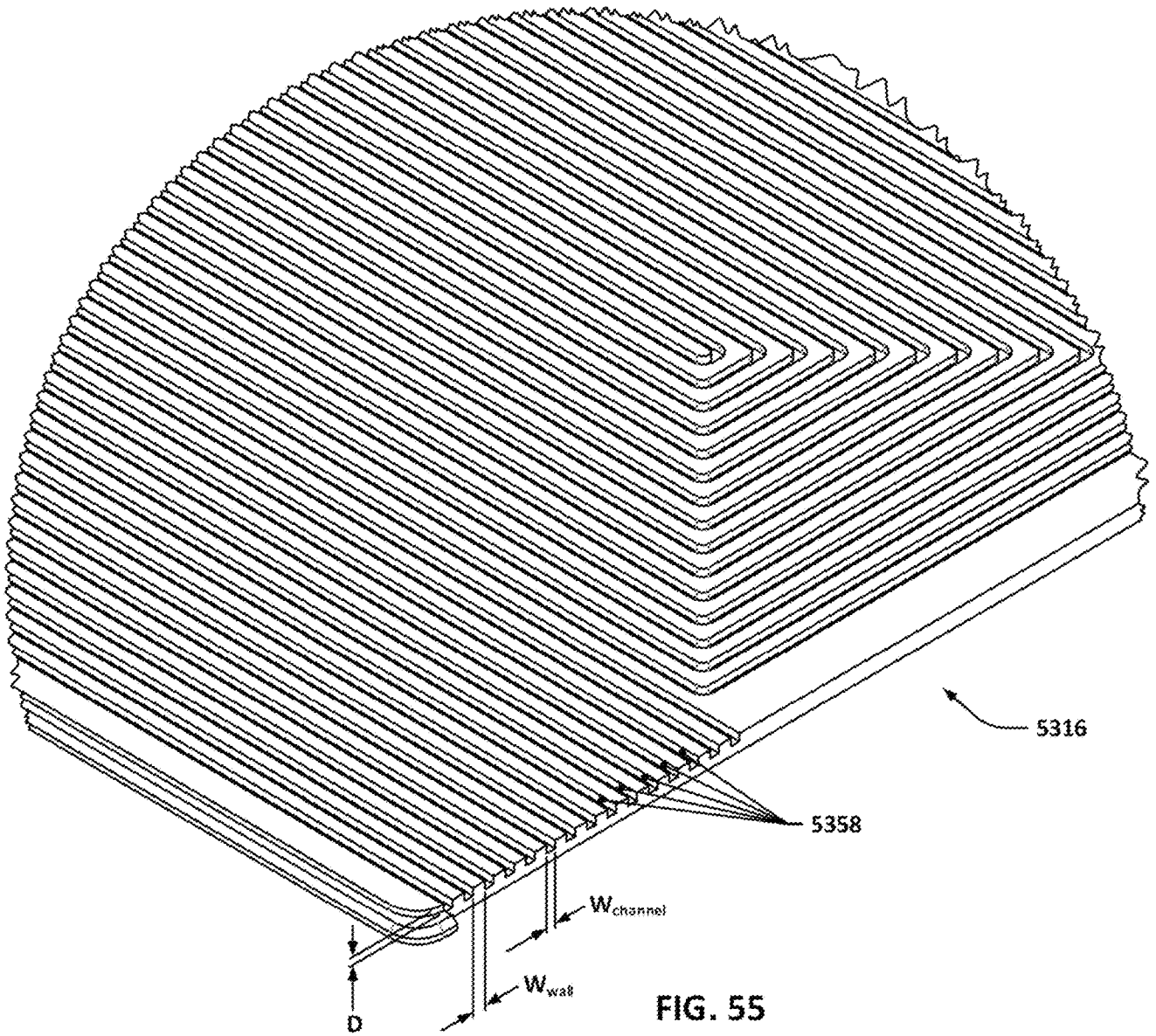

FIGS. 53 through 55 depict an example cathode flow field 5316 that may be used in some implementations. The depicted flow field has 15 channels and 9 passes. In one implementation, the depicted flow field has a planar surface area (facing a GDL) of 700 $cm^2$. FIG. 53 depicts an isometric view of the cathode flow field 5316. FIG. 55 depicts a detail view of the portion of FIG. 53 enclosed by a circle. FIG. 54 depicts the isometric view of FIG. 53, but with most of the channels of the flow field omitted, leaving only three channels 5358*a*, 5358*b*, and 5358*c* visible; this view is intended to make it easier to see the representative serpentine paths followed by the various channels. The cathode flow field 5316 actually includes 15 channels 5358. The channels in the example cathode flow field 5316 are each 0.66 mm deep by 0.81 mm wide, and each have a length of about 2,310 mm, a channel open area of about 1,880 $mm^2$, and a volume of about 1,240 $mm^3$. The total open channel area of the cathode flow field 5316 is, in this example, 28,200 $mm^2$. With each of the 15 channels being separated from any adjacent channels by walls of 1.12 mm in width and the cathode flow field having dimensions of about 265 mm by 265 mm, about 40% of the cathode flow field 5316 surface area is taken up by the channels 5358. The depicted cathode flow field 5316 is designed to receive (and deliver) fluids from external manifolds that may be mounted against the external edges of the cathode flow field 5316 so as to flow fluid into or out of the channels 5358 from the side.

Figure 56:
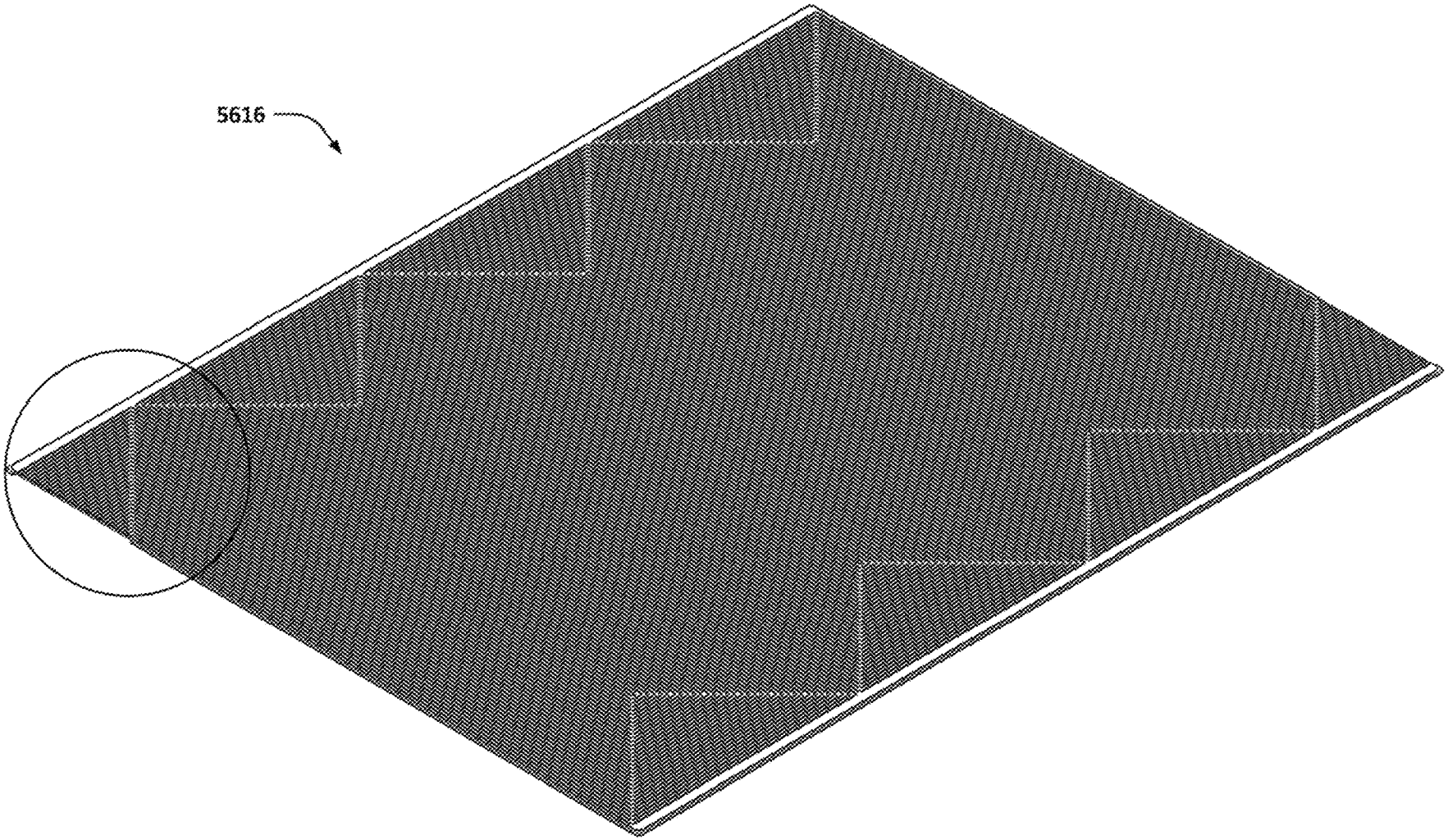
FIGS. 56, 57, and 58 depict an example cathode flow field that may be used in some implementations.
Figure 57:
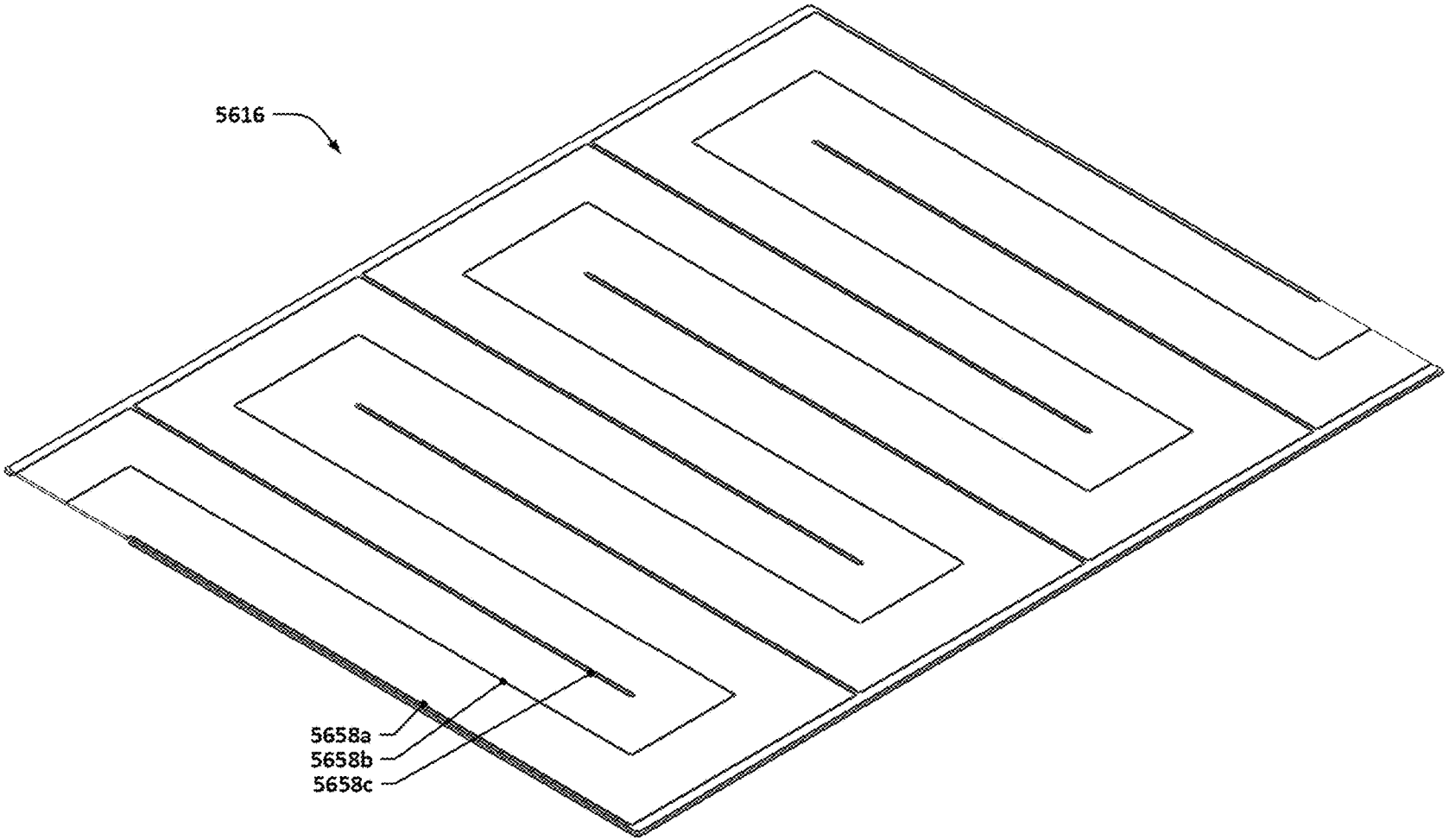
Figure 58:
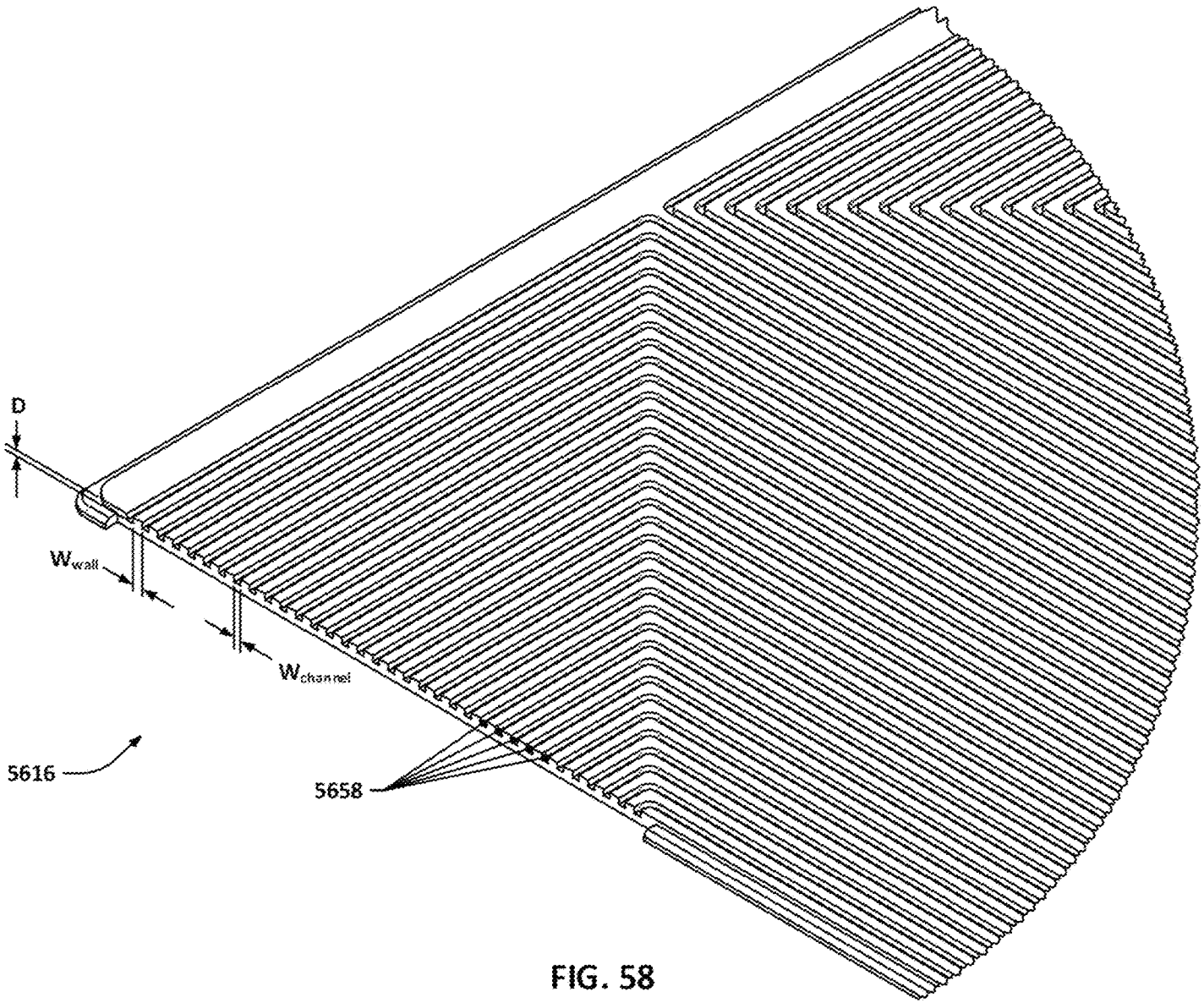

FIGS. 56 through 58 depict another example cathode flow field 5616 that may be used in some implementations. The depicted flow field has 34 channels and 7 passes. In one implementation, the depicted flow field has a planar surface area (facing a GDL) of 1,600 $cm^2$. As with FIGS. 53 through 55, FIG. 56 depicts an isometric view of the cathode flow field 5616 and FIG. 58 depicts a detail view of the portion of FIG. 56 enclosed by a circle. FIG. 57 depicts the isometric view of FIG. 56, but with most of the channels of the flow field omitted, leaving only three channels 5658*a*, 5658*b*, and 5658*c* visible; as with FIG. 55, this view is intended to make it easier to see the representative serpentine paths followed by the various channels. The cathode flow field 5616 actually includes 34 channels 5658. The channels in the example cathode flow field 5616 are each 0.66 mm deep by 0.76 mm wide, and each have a length of about 2,440 mm, a channel open area of about 1,880 $mm^2$, and a volume of about 1,230 $mm^3$. The total open channel area of the cathode flow field 5616 is, in this example, 63,230 $mm^2$. With each of the 34 channels being separated from any adjacent channels by walls of 1.14 mm in width and the cathode flow field 5616 having dimensions of about 360 mm by 450 mm, about 39% of the cathode flow field 5616 surface area is taken up by the channels 5658. As with the cathode flow field 5316, the depicted cathode flow field 5616 is designed to receive (and deliver) fluids from external manifolds that may be mounted against the external edges of the cathode flow field so as to flow fluid into or out of the channels 5658 from the side.

In certain embodiments, a serpentine flow field as in FIGS. 53-58, the channel depth is about 0.5 mm to 1.5 mm. In certain embodiments, the nominal length of each flow channel in a flow field of FIGS. 53-58 is about 300 mm to 3,000 mm. In certain embodiments, the nominal channel width in a flow field of FIGS. 53-58 is about 0.5 mm to 1 mm. In certain embodiments, the nominal channel separation distance in a flow field of FIGS. 53-58 is about 1 mm to 1.5 mm.

Figure 59:
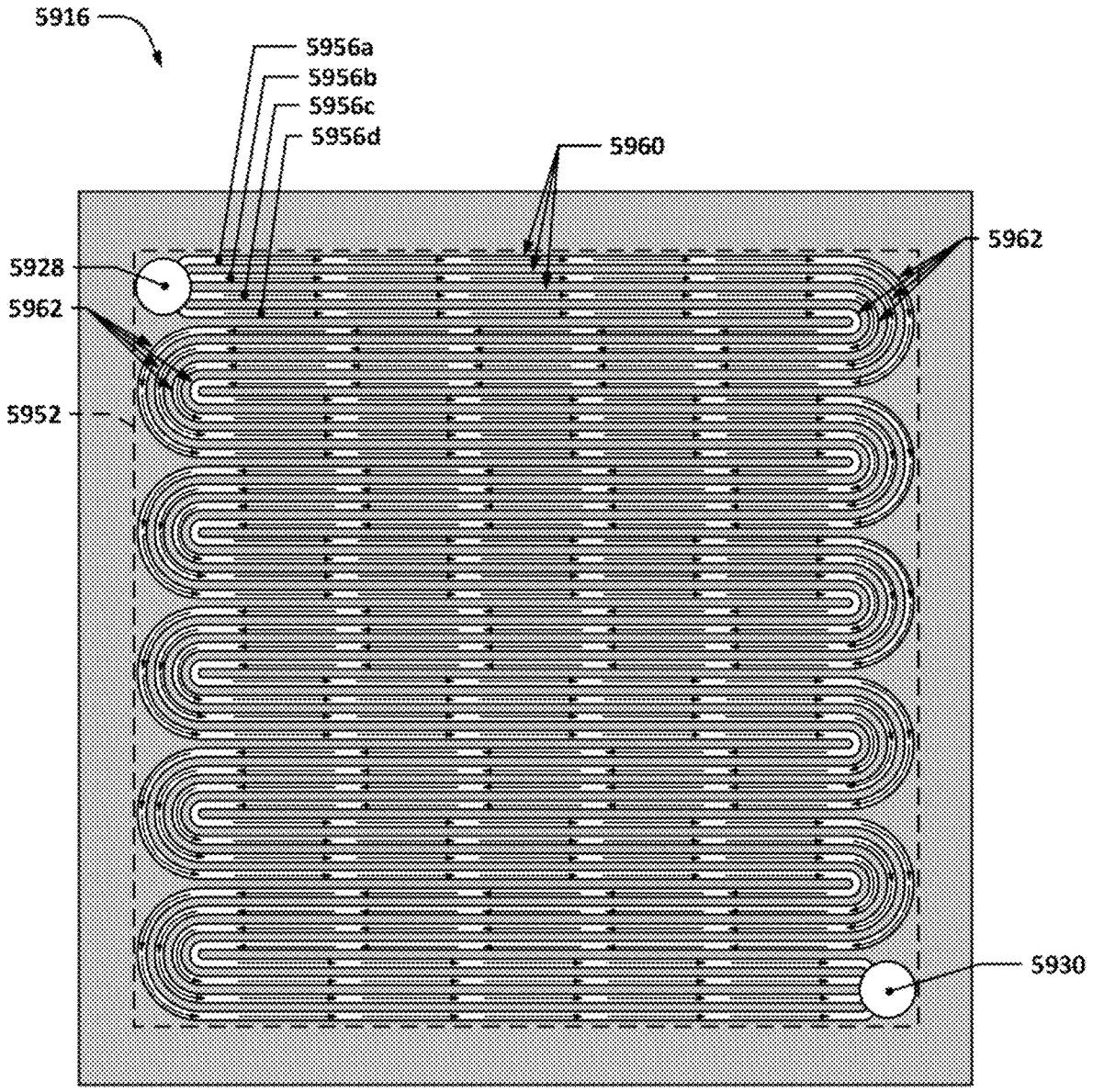
FIG. 59 depicts an example of a cathode flow field that has four cathode serpentine channels arranged in a multiple serpentine channel arrangement

In some implementations, serpentine channel cathode flow fields may feature serpentine channels that have rounded or smooth transitions between the longer and shorter segments as opposed to sharp transitions between such segments. For example, FIG. 59 depicts an example of a cathode flow field 5916 that has four cathode serpentine channels 5956 arranged in a multiple serpentine channel arrangement. It will be noted that unlike the single-channel and two-channel serpentine arrangements depicted in FIGS. 49 and 52, the transitions between the longer segments are provided by arcuate shorter segments instead of straight shorter segments. In other implementations, the shorter segments may still include a straight portion but may be joined to fluidically adjacent longer segments by smaller arcuate segments. Such cathode flow fields may further enhance the water evacuation performance of a $CO_x$ electrolyzer since the absence of sharp interior corners in the serpentine channels may eliminate a potential dead zone or stagnation location for fluid flow that could otherwise serve as a location where liquid water could collect and reside indefinitely during use of the cathode flow field.

Figure 60:
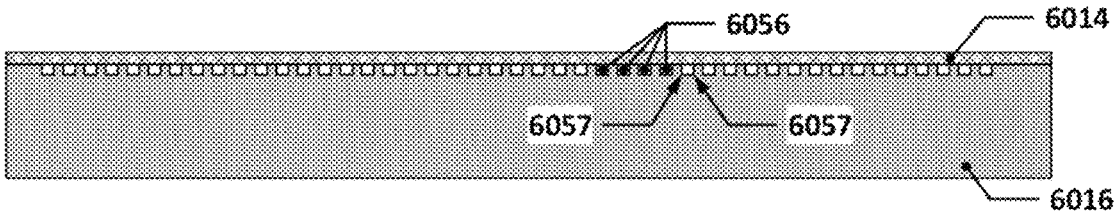
FIG. 60 depicts a cross-sectional view of a cathode flow field with square- or rectangular-cross-section serpentine channels.

Other aspects of flow field channels may be alternatively or additionally modified as well in order to promote more effective liquid water evacuation. FIG. 60, for example, depicts a cross-sectional view of a cathode flow field 6016 that is pressed against a cathode GDL 6014. A plurality of square- or rectangular-cross-section serpentine channels 6056 are formed in the face of the cathode flow field 6016 that is pressed against the cathode GDL 6014. These serpentine channels 6056 have sharp corners at their interior bottom edges 6057, which may act to create small fluid flow stagnation areas that may prevent liquid water from being readily evacuated during normal $CO_x$ electrolyzer operating conditions.

Figure 61:
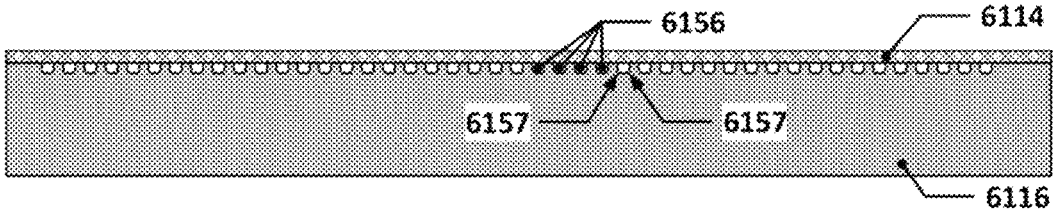
FIG. 61 shows a cross-sectional view of a cathode flow field with a plurality of square- or rectangular-cross-section serpentine channels with rounded interior bottom edges.

FIG. 61, by contrast, shows a cross-sectional view of a similar structure with a cathode flow field 6116 that is pressed against a cathode GDL 6114. A plurality of square- or rectangular-cross-section serpentine channels 6156 are formed in the face of the cathode flow field 6116 that is pressed against the cathode GDL 6114. Unlike the serpentine channels 6056, the serpentine channels 6156 have rounded corners at their interior bottom edges 6157, which may act to reduce flow stagnation in the bottom interior edge regions of such channels, thereby promoting liquid water evacuation during normal $CO_x$ electrolyzer operating conditions.

Figure 62:
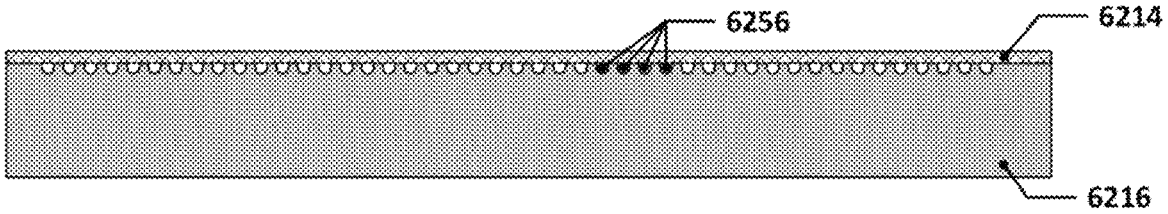
FIG. 62 shows a cross-sectional view of a cathode flow field with a plurality of U-shaped cross-section serpentine channels.

FIG. 62 is a further example of a cathode flow field that may more readily evacuate liquid water during normal $CO_x$ electrolyzer operating conditions. As can be seen, a cathode flow field 6216 is pressed against a cathode GDL 6214. A plurality of U-shaped cross-section serpentine channels 6256 are formed in the face of the cathode flow field 6216 that is pressed against the cathode GDL 6214. In this case, there effectively are no interior bottom edges of the serpentine channels 6256 since the bottom surface of such serpentine channels 6256 is semicircular, which may act to further reduce flow stagnation in such channels, thereby further promoting liquid water evacuation during normal $CO_x$ electrolyzer operating conditions.

Figure 63:
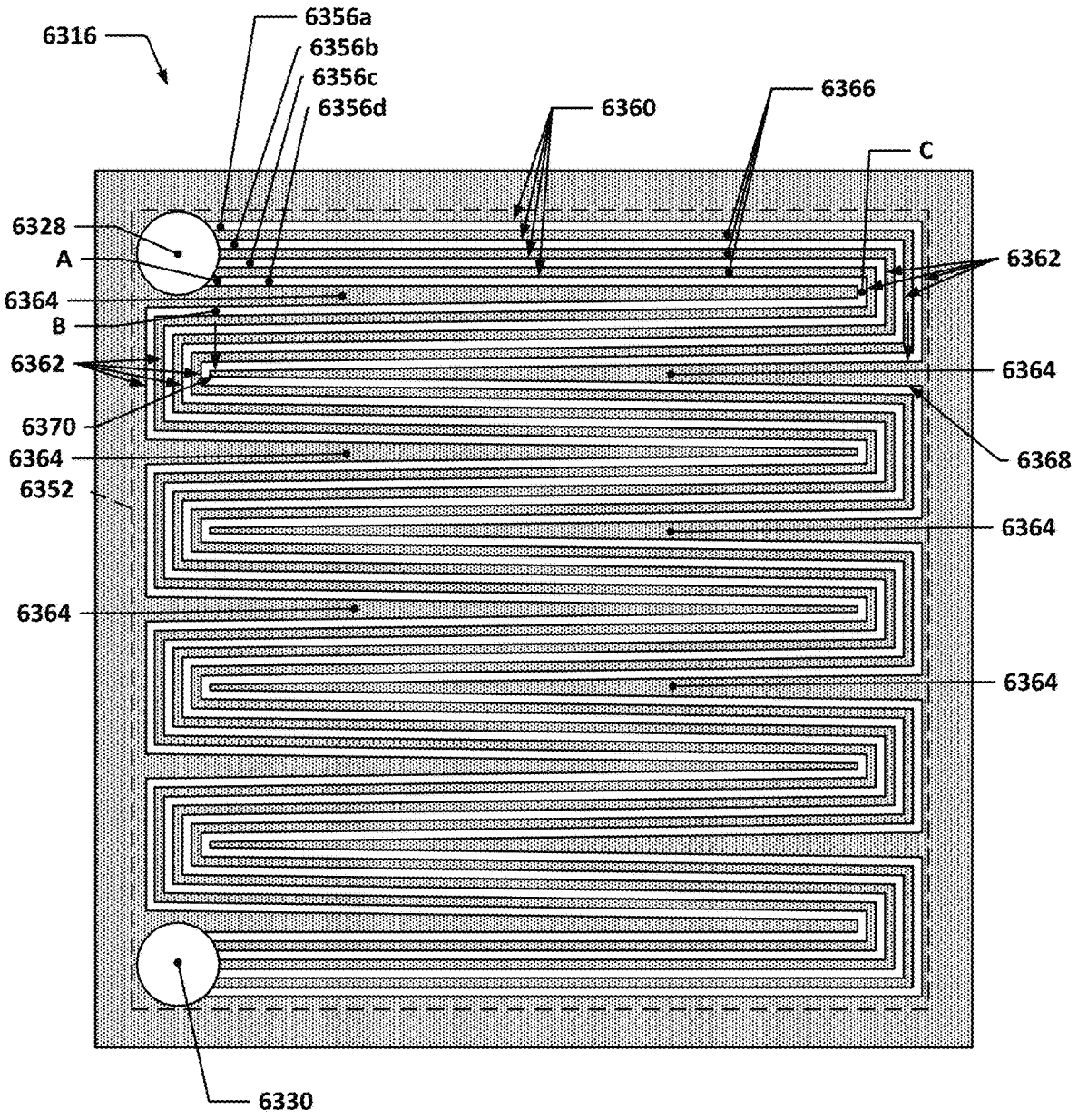
FIG. 63 depicts an example of a cathode flow field with peninsular walls having variable wall thickness.

In some other or additional implementations, serpentine channel cathode flow fields may have variable-width walls in between some or all of the longer segments of one or more serpentine channels. FIG. 63 depicts an example of such a cathode flow field. In FIG. 63, a cathode flow field 6316 is shown which has a four-channel serpentine arrangement with each serpentine channel 6356 having longer segments 6360 and shorter segments 6362. It will be noted that the multiple serpentine channel arrangement has "peninsular" walls 6364 that are interposed between neighboring longer segments 6360 of a common serpentine channel 6356*a* (or 6356*b*) that have opposing fluid flow directions when fluid is flowing through the serpentine channels 6356 (generally all nested or interleaved multiple serpentine channel arrangements will have peninsular walls; they are only specifically called out here due to the particulars of this example implementation).

As can be seen in FIG. 63, the peninsular walls 6364 may have a varying wall thickness. For example, the peninsular walls 6364 have a root width 6368 where the peninsular walls 6364 "connect" with the outer perimeter region of the cathode flow field 6316 (which may be thought of as the "root" of the peninsular wall) and a tip width 6370 at their opposite ends. The increased width at the root as compared with the tip of the peninsular walls 6364 may reduce the chance of gas flow through the cathode GDL that might bypass some or all of the longer segments 6360 that are separated by the peninsular walls 6364 by passing under the wall, i.e., through the GDL that is sandwiched between the cathode flow field 6316 and the MEA (not shown, but see FIG. 11A) and which, in effect, caps the cathode serpentine channels 6356.

For example, in a serpentine channel of a cathode flow field that has portions thereof that are adjacent to one another, e.g., the outermost or innermost serpentine channel on a multi-channel, interleaved serpentine channel arrangement, gas that is flowed through such a channel, e.g., from point A to point B may experience a pressure drop/flow resistance if travelling from point A to point B via flow through point C that may, under some circumstances, exceed the pressure drop/flow resistance that may be experienced by that gas if it simply flowed from point A to point B more directly, e.g., by passing under the peninsular wall 6364 in between points A and B by way of the porous GDL that spans between points A and B and under the peninsular wall 6364. For example, if water accumulates in the channel between points A and C and/or between points C and B, the resulting blockage may increase the pressure drop/flow resistance for gas that flows along this path that it exceeds the pressure drop/flow resistance that the gas would experience if traveling from point A to point B more directly, e.g., under the peninsular wall 6364. As the flow path between points A and B under the peninsular wall 6364 may offer less flow resistance than the flow path between A and B via point C, the gas may then preferentially flow from point A under the peninsular wall 6364 to point B rather than via point C, thus depriving the GDL and MEA of exposure to gas that would normally flow through point C, thereby decreasing the efficiency of the $CO_x$ cell in which the cathode flow field 6316 is used. To prevent this from happening, or to at least reduce the chances of this occurring, in some implementations, the peninsular walls 6364 may simply have a constant thickness along their lengths but may be thicker than partition walls 6366 that may separate other neighboring longer segments 6360 that have fluid flows in the same directions, thereby increasing the flow resistance experienced by gas that attempts to flow under the peninsular walls 6364. In other implementations, such as that shown in FIG. 63, the peninsular walls 6364 may taper towards their tips such that the tip width 6370 is less than the root width 6368, thereby causing the flow resistance under the peninsular walls 6364 to decrease from what it was near the root of a peninsular wall 6364 as the flow nears the tip of the peninsular wall 6364. This may assist with discouraging the flow of gas under the peninsular walls 6364 near the roots of those walls, but this effect may also decrease as the gas flow moves along the peninsular wall 6364 towards the tip thereof—however, the flow resistance along the desired flow path (via point C, for example) may also decrease, and there may thus not be as much of an incentive for gas to flow under the peninsular walls near the tips of the peninsular walls 6364. By tapering the thickness of the peninsular walls, the area of the cathode GDL that is compressed under the peninsular walls 6364 may be reduced as compared with non-tapering peninsular walls 6364, thereby increasing the area of the cathode GDL which has direct exposure to gas flow through the channels and increasing the opportunity for a reduction reaction to occur with such gas.

Mirror Serpentine Channel Flow Fields

In the serpentine channel flow fields discussed above, the serpentine channels discussed generally do not exhibit any mirroring or bilateral symmetry. A further class of serpentine channel flow fields may, however, feature serpentine channels that are arranged in a generally bilaterally symmetric manner. In such flow fields, the flow field may generally be partitioned into two zones. The two zones may be generally equally sized and shaped, and may each contain a similar number of serpentine channels. The serpentine channel or channels in each zone may be arranged so as to generally be mirror images of one another with respect to the boundary between the two zones, e.g., the serpentine channels may exhibit bilateral symmetry about the boundary between the two zones.

Figure 64:
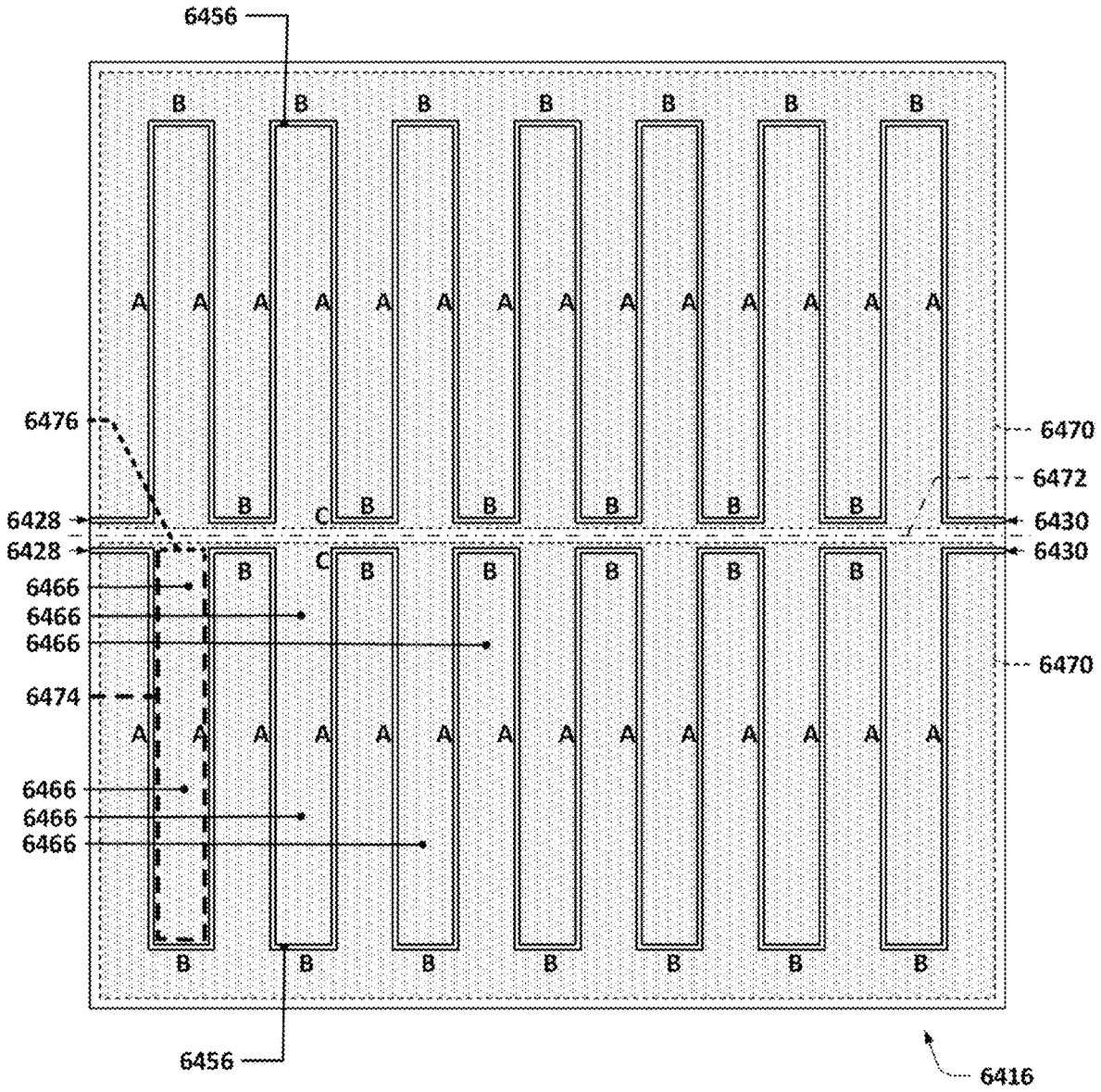
FIG. 64 depicts a plan view of a simplified representation of an example cathode flow field.

FIG. 64 depicts a plan view of a simplified representation of an example mirror image cathode flow field. In FIG. 64, a cathode flow field 6416 is shown that is partitioned into two zones 6470 that are generally the same shape and size. A boundary 6472 is defined in between the two zones 6470; the zones 6470 are generally symmetrically arranged on either side of the boundary 6472. Each zone 6470 in this example includes a single cathode serpentine channel 6456, although it will be understood that each zone may include a larger number of cathode serpentine channels 6456 that follow a common path in a nested or interleaved manner, as with examples discussed earlier. The cathode serpentine channels 6456 each extend between a corresponding fluidic inlet port 6428 and a corresponding fluidic outlet port 6430 (it will be understood that these fluidic inlet ports 6428 may, for example, terminate in the same location, e.g., a common flow passage or manifold, and that the fluidic outlet ports 6430 may be similarly configured).

As is discussed further below, the symmetric arrangement of the cathode serpentine channels 6456 may provide various advantages over non-symmetric arrangements of cathode serpentine channels with respect to maintaining flow uniformity across the cathode flow field 6416. For example, the two zones 6470 may, together, generally represent an active area of the cathode flow field 6416. That active area could, for example, be traversed by a cathode serpentine channel or channels that travel back and forth between opposite sides of the active area, as shown in FIG. 65.

Figure 65:
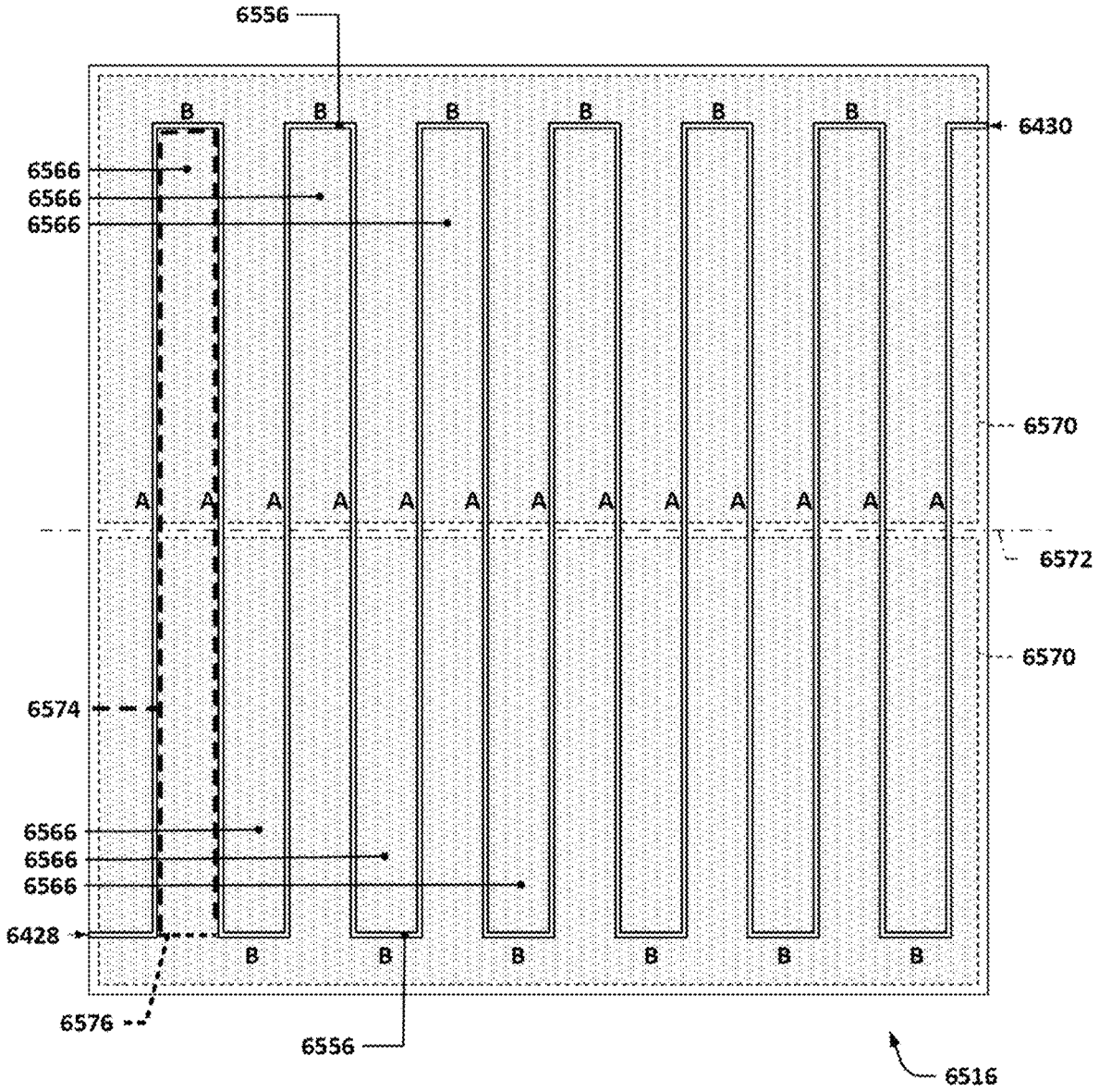
FIG. 65 depicts a cathode flow field with two zones and a boundary.

FIG. 65 depicts a cathode flow field 6516, two zones 6570, and a boundary 6572 that are similar to the zones 6470 and the boundary 6472 are shown as well. The cathode flow field 6516 has a serpentine channel 6556 that includes longer segments A extending in directions nominally perpendicular to a first set of opposing edges of the active area and shorter segments B extending in directions nominally parallel to a second set of opposing edges. The longer-length segments generally have lengths that are of the same order of magnitude as the distance between the first set of opposing edges of the active area (although potentially shortened somewhat to allow additional cathode serpentine channels to be routed in a nested or interleaved fashion). The longer segments A of the cathode serpentine channel 6556 can be seen to cross over the boundary 6572 and extend into both zones 6570. In such an arrangement, fluid that flows down a longer segment A, through a shorter segment B, and into another longer segment A that neighbors the original longer segment A, e.g., along the heavy dashed line 6574 shown in association with the leftmost two longer segments A in FIG. 65, will experience a pressure drop that is generally proportional to the sum of the lengths of the two longer segments A and the shorter segment B that joins them.

The gas flow through the cathode serpentine channel 6556, however, is not limited to staying within the cathode serpentine channel 6556. For example, as discussed earlier, the side of the cathode flow field 6516 in which the cathode serpentine channel 6556 is provided may be compressed against a porous or fibrous GDL (not shown) that provides an alternate flow path that allows gas to also or alternatively flow under partition walls 6566 that lie in between each pair of adjacent longer segments A, e.g., through the GDL that is sandwiched between the cathode flow field 6516 and an adjacent structure, e.g., an MEA. For example, the gas flow may also flow between the two longer segments A at the left of FIG. 65 via a flow path along dotted line 6576.

Generally speaking, the ratio of gas that flows along the flow path 6574 and the flow path 6576 may be biased towards gas flow along the channel flow path 6574 due to the fact that the cathode serpentine channel 6556 has a relatively large, open cross-section compared to the GDL flow path 6576. For example, the cathode serpentine channel 6556 may have a cross-section that is entirely open and that has relatively large dimensions (e.g., on the order of a millimeter or so in height and width), while the flow path offered by the GDL may only be on the order of a few hundred microns in height and be filled with the fibrous or porous material of the GDL. Put another way, the per-unit-length flow resistance of the GDL may be much higher than the per-unit-length flow resistance of the cathode serpentine channel 6556.

However, the overall flow resistance of the flow path 6574 will increase with increasing length of the longer segments A of the cathode serpentine channel 6556. Thus, the longer that the longer segments A of the cathode serpentine channel 6556 are, the higher the flow resistance along the flow path 6574, which causes the ratio of gas that flows through the flow path 6574 to the gas that flows through the flow path 6576 to decrease. In other words, shorter lengths of the longer segments A will result in less gas flow along the flow paths 6576 than longer lengths of the longer segments A.

Moreover, the flow resistance of the flow path 6574 may also increase during operation due to the potential of blockages, e.g., by liquid water or, for example, mineral deposits, within the cathode serpentine channel 6556. If such blockages occur, this will increase the flow resistance along the cathode serpentine channel, thereby causing the ratio of gas that flows through the flow path 6574 to the gas that flows through the flow path 6576 to decrease.

It will be understood that while only one flow path 6574 and one flow path 6576 are shown in FIG. 65, such flow paths may generally be replicated for similar geometrical features across the cathode flow field 6516 and such additional flow paths may have similar characteristics and behavior.

Returning to FIG. 64, it can be seen that by filling the same two zones 6470 with separate cathode serpentine channels 6456, the longer segments A of those serpentine channels 6456 may be decreased as compared with the longer segments A of the cathode serpentine channel 6556. In FIG. 64, the longer segments A of the cathode serpentine channels 6456 are approximately half the length of the longer segments A of the cathode serpentine channels 6556. Assuming that the cathode serpentine channels 6456 and 6556 are generally otherwise similar, e.g., similar cross-sectional areas, the flow resistance along the flow path 6474 will be significantly less, e.g., about 50% or so, of the flow resistance along the flow path 6574. This, in turn, increases the ratio of gas that flows through the cathode serpentine channels 6456 as opposed to leaking, for example, under peninsular walls 6466 (e.g., via flow path 6476). As the cathode serpentine channels 6456 traverse across the zones 6470 in a generally evenly distributed manner, this results in a more uniform distribution of gas across the zones 6470 than may occur in cathode flow fields such as the cathode flow field 6516.

Another aspect of the geometry shown in FIG. 64 is that the depicted cathode serpentine channels 6456 are arranged in a generally symmetric manner such that, at locations where the cathode serpentine channels in the two zones come into close proximity to each other, e.g., the shorter segments B that are adjacent to the boundary 6472, the total flow resistance along the serpentine channel from their respective inlets to those segments is generally equal, thereby resulting in a generally equal pressure drop from the inlet to each set of locations. This avoids a scenario in which two segments from different cathode serpentine channels are adjacent to one another but may have nominally different pressures that result in a pressure differential between them that may act to cause gas to cross from one such cathode serpentine channel to another.

For example, if one considers the flow resistance along the portions of the cathode serpentine channels 6456 that lie between the locations C in FIG. 64 and the fluidic inlet ports 6428, it can be seen that gas that flows through each cathode serpentine channel 6456 from the corresponding fluidic inlet port 6428 to the corresponding location C will flow along four longer segments A and three shorter segments B (and, arguably, a fourth shorter segment B that is not labeled but which leads from the fluidic inlet port 6428 to the leftmost longer segment A). Thus, the lengths of the portions of the cathode serpentine channels 6456 that are traversed by the gas flowing through the cathode serpentine channels 6456 may be generally the same and, accordingly (assuming that the cathode serpentine channels 6456 are otherwise the same, e.g., same cross-sectional dimensions), the total flow resistances between the fluidic inlet ports 6428 and the locations C may be the same. This results in the pressure drop experienced between the fluidic inlet ports 6428 and the locations C being generally the same, resulting in little or no pressure differential between the two locations C. As a result, there is little or no pressure differential present in the vicinity of the locations C that would act to cause gas from one cathode serpentine channel 6456 to flow from that cathode serpentine channel 6456 into the other cathode serpentine channel 6456. This avoids or reduces the risk or severity of a scenario where gas flowed into one zone 6470 migrates into the other zone 6470, resulting in a gas distribution across the cathode flow field 6416 that is skewed.

The symmetric arrangement of cathode serpentine channels depicted in FIG. 64 may thus, for example, be characterized as having, for each set of locations along the cathode serpentine channels where there is the least separation between them, identical or nominally identical path lengths along the serpentine paths followed by the cathode serpentine channels between their fluidic inlet ports and those locations.

A further benefit to the bilaterally symmetric arrangement of cathode serpentine channels that is evident from the above-discussed Figures is that such an arrangement allows the fluidic inlet ports and the fluidic outlet ports to be located near the centers of edges of the cathode flow fields (as opposed to at a corner). In implementations in which similar serpentine channel geometries may be used in both cathode flow fields and anode flow fields, locating the fluidic inlet ports and the fluidic outlet ports in the middle of opposing edges of the flow fields may allow the same flow field component to be used as either a cathode flow field or an anode flow field, thereby potentially reducing the number of unique parts that may be needed to assemble a particular $CO_x$ electrolyzer cell.

Figure 66:
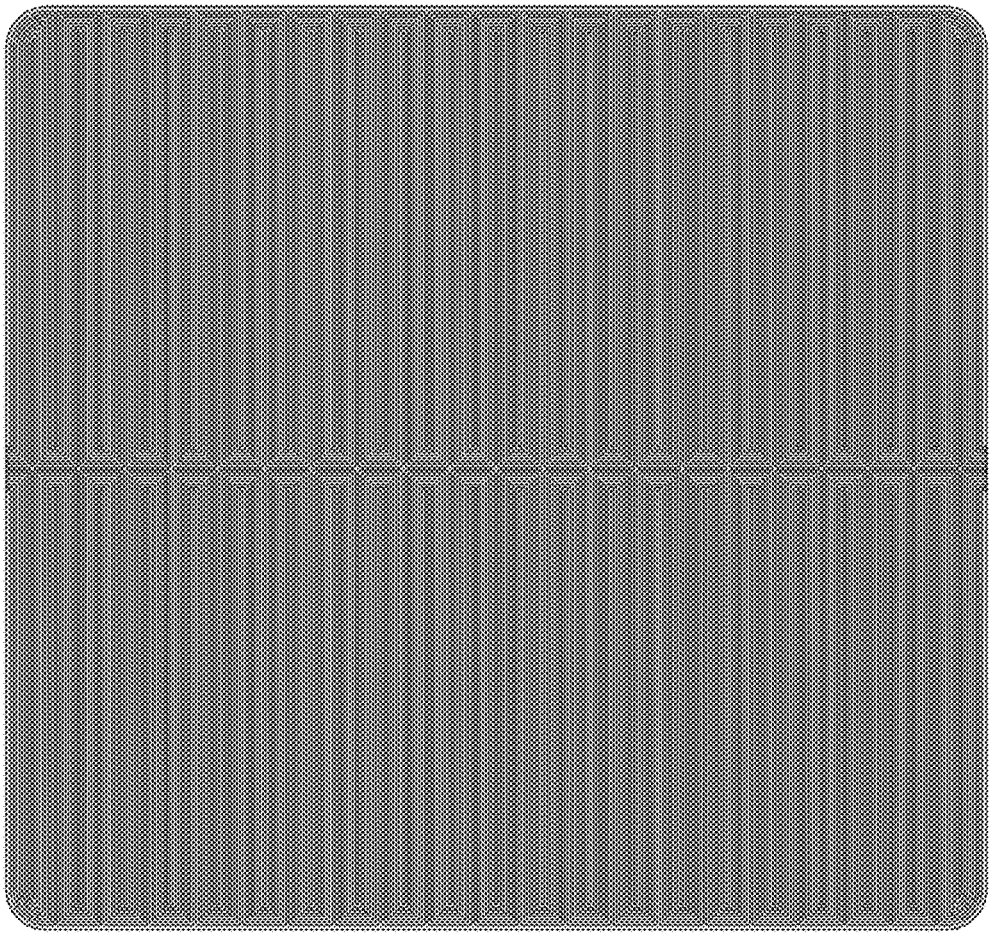
FIG. 66 depicts a cathode flow field with serpentine channels arranged in a bilaterally symmetric manner.
Figure 67:
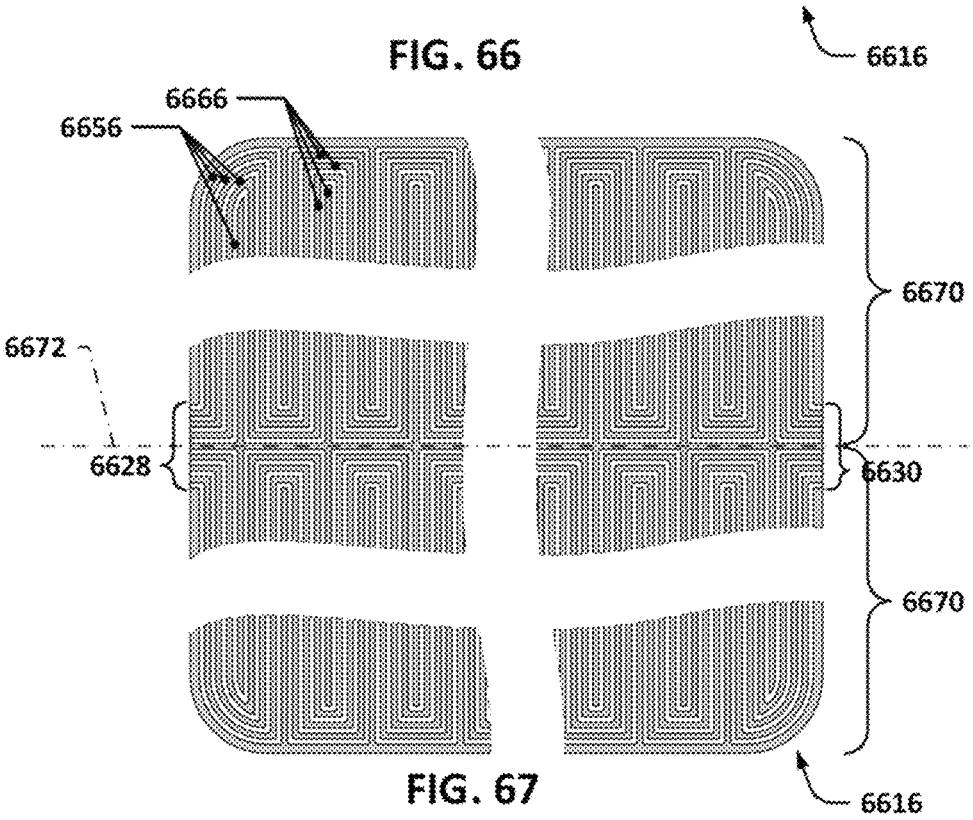
FIG. 67 depicts the same cathode flow field as in FIG. 66 in a scaled-up, broken view manner to allow various features to be more easily labeled and seen.

FIG. 66 depicts a cathode flow field 6616 with serpentine channels arranged in a bilaterally symmetric manner. FIG. 67 depicts the same cathode flow field in a scaled-up, broken view manner to allow various features to be more easily labeled and seen. Large sections of the cathode flow field 6616 have been cut out and removed in FIG. 67, with the remaining portions moved so as to be adjacent to one another. In the implementation of FIGS. 66 and 67, the cathode flow field 6616 is divided into two zones 6670 that are separated by a boundary 6672. Each zone 6670 has a set of four cathode serpentine channels 6656 that switchback in a nested or interleaved manner between the boundary 6672 and the edge of the relevant zone 6670 that is farthest from the boundary 6672. The cathode serpentine channels 6656 each extend between a corresponding fluidic inlet port 6628 and a corresponding fluidic outlet port 6630 (it will be understood that such fluidic inlet ports 6628 and fluidic outlet ports 6630 may, in some implementations, fluidically connect with a common plenum or manifold in a stack of cells where the plenum or manifold delivers gas to all of the fluidic inlet ports simultaneously (or that receives gas from all of the fluidic outlet ports simultaneously, as appropriate).

The cathode flow field of FIGS. 66 and 67 may, for example, have an active area (generally corresponding to the area within the bounds of the depicted component in FIG. 66) on the order of 750-800 $cm^2$, e.g., 760-790 $cm^2$ or 770-780 $cm^2$, while the cathode serpentine channels 6656 themselves may, for example, each have a length of approximately 5000 to 6000 mm, e.g., 5200 to 5800 mm, 5400 to 5600 mm, 5400 to 5800 mm, or 5200 to 5600 mm. The cathode serpentine channels may each be generally rectangular or square in cross-section, e.g., having a transverse width (generally perpendicular to the direction of gas flow within the cathode serpentine channels) and/or depth that ranges from 0.5 mm to 2 mm, e.g., 0.5 mm, 0.6 mm, 0.7 mm, 0.8 mm, 0.9 mm, 1 mm, 1.1 mm, 1.2 mm, etc. In the depicted example, cathode serpentine channels 6656 are each separated from adjacent cathode serpentine channels by peninsular walls 6666 that are, for example, 0.5 mm to 2 mm in transverse width, e.g., 0.5 mm to 2 mm, e.g., 0.5 mm, 0.6 mm, 0.7 mm, 0.8 mm, 0.9 mm, 1 mm, 1.1 mm, 1.2 mm, etc. For example, the cathode serpentine channels 6656 may be approximately 0.8 mm in width and depth, separated from each other by peninsular walls of approximately 0.9 mm width, and each be approximately 5600 mm in length (thus having open channel areas of approximately 5400 $mm^2$ for each channel for zones covering an active area of 77650 $mm^2$).

Figure 68:
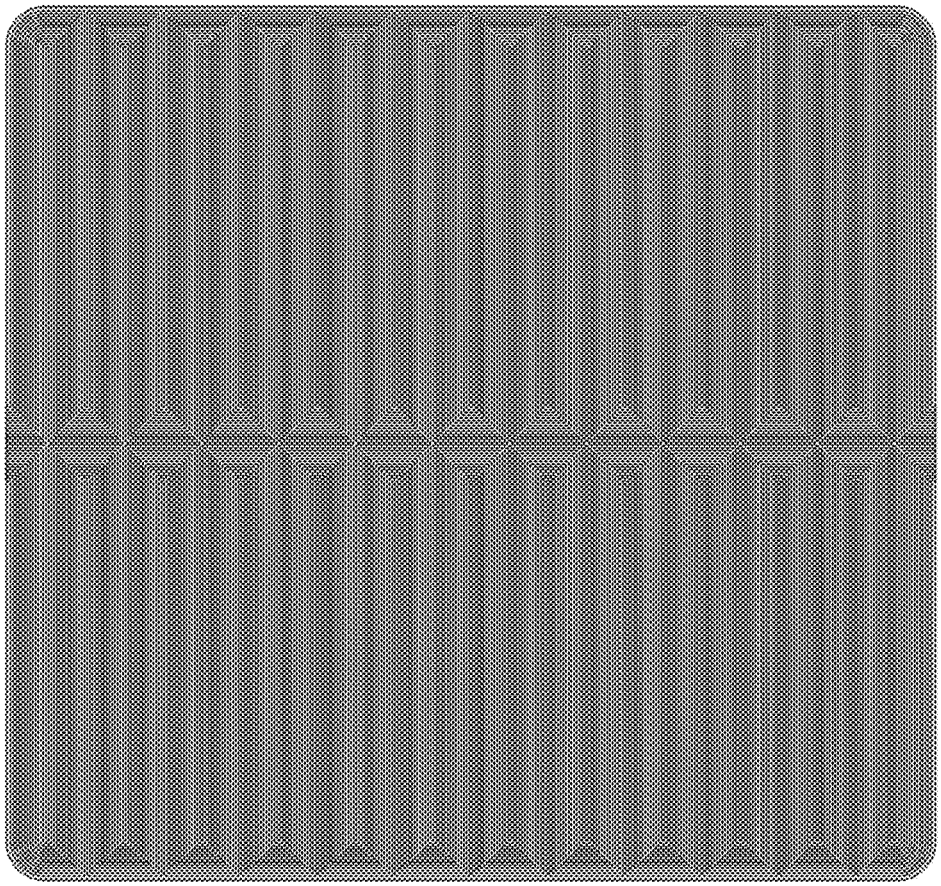
FIG. 68 depicts another cathode flow field with serpentine channels arranged in a bilaterally symmetric manner.
Figure 69:
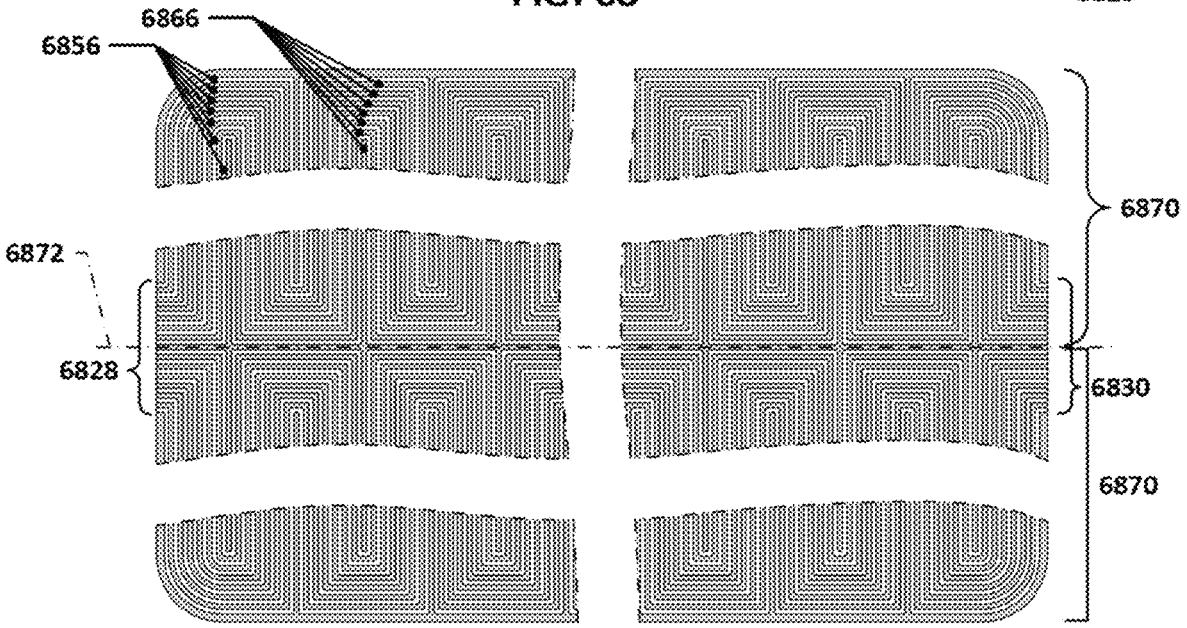
FIG. 69 depicts the same cathode flow field as in FIG. 68 in a scaled-up, broken view manner to allow various features to be more easily labeled and seen.

FIG. 68 depicts another cathode flow field 6816 with serpentine channels arranged in a bilaterally symmetric manner. FIG. 69 depicts the same cathode flow field 6816 in a scaled-up, broken view manner to allow various features to be more easily labeled and seen. Large sections of the cathode flow field 6816 have been cut out and removed in FIG. 69, with the remaining portions moved so as to be adjacent to one another. The implementation of FIGS. 68 and 69 is generally similar to that of FIGS. 66 and 67, with corresponding elements labeled with figure callouts sharing the last two digits in common with their counterparts in the implementation of FIGS. 66 and 67. The discussion above regarding such elements in the context of FIGS. 66 and 67 is equally applicable to those same elements in FIGS. 68 and 69 unless otherwise indicated below.

The implementation of FIGS. 68 and 69, for example, features a larger number of cathode serpentine channels 6856 in each zone 6870, e.g., seven cathode serpentine channels 6856 in each zone 6870. The cathode serpentine channels 6856 may each be on the order of 3000 mm to 3500 mm long. In the implementation shown, the cathode serpentine channels 6856 may be approximately 0.8 mm in width and depth, separated from each other by peninsular walls of approximately 0.9 mm width, and each be approximately 3200 mm in length (thus having open channel areas of approximately 2570 $mm^2$ for each channel for zones covering an active area of 77650 $mm^2$).

Parallel Channel Flow Fields

Figure 70:
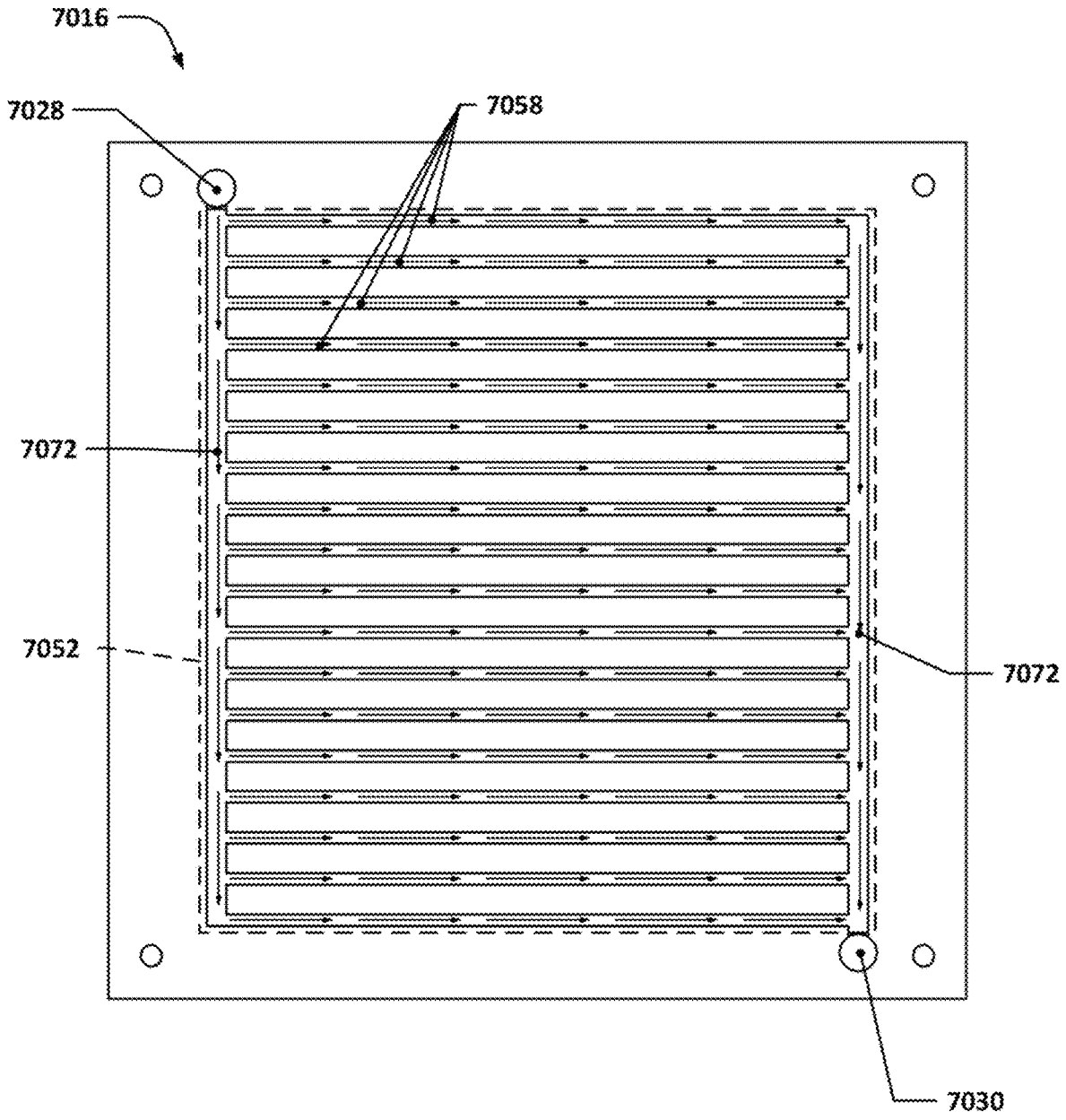
FIG. 70 depicts an example of a cathode flow field with a parallel channel arrangement.

Another type of channel arrangement that may be used in some cathode flow fields is a parallel channel arrangement. Flow fields having a parallel channel arrangement have at least some channels that have a straight or substantially straight path between an inlet port and an outlet port. In some embodiments, all channels in a flow field having a parallel channel arrangement have a straight or substantially straight path between an inlet port and an outlet port. In some embodiments, Flow fields having a parallel channel arrangement have at least one dimension that is at least as long as the channel length of the parallel channels in the flow field. FIG. 70 depicts an example parallel channel cathode flow field. As can be seen, a cathode flow field 7016 is depicted that has a fluidic inlet port 7028 and a fluidic outlet port 7030. The fluidic inlet port 7028 and the fluidic outlet port 7030 may each be fluidically connected with corresponding plenum passages 7072, which may generally extend in directions parallel to one another. A series of parallel channels 7058 may be arranged in a linear array, with each parallel channel 7058 fluidically connected with and fluidically interposed between the two plenum passages 7072. The parallel channels 7058 may be designed to have similar flow resistances, e.g., similar or identical cross-sections and similar or identical lengths. The fluidic inlet port 7028 and the fluidic outlet port 7030 may be positioned at opposing corners of the parallel channel arrangement such that the flow paths from the fluidic inlet port 7028 to the fluidic outlet port 7030 via the parallel channels 7058 and the plenum passages 7072 are of generally equal length regardless of which parallel channel 7058 any given flow path flows through.

Cathode flow fields with parallel channel arrangements offer more direct fluid flow paths than serpentine channel arrangements for equivalent coverage areas provided. Additionally, the average distances that accumulated liquid water must be moved through in order to evacuate it from a parallel channel in such arrangements are significantly shorter in a parallel channel than in a serpentine channel for a similarly sized $CO_x$ electrolyzer. While this is advantageous in that less energy is needed in order to evacuate liquid water from the channels, parallel channel arrangements will typically also include a larger number of potential alternate flow paths, e.g., tens or hundreds of flow paths, as compared with serpentine channel arrangements, which tend to include fewer numbers of flow paths, e.g., 2, 3, 4, or other relatively low numbers of flow paths. As discussed earlier, as the number of flow paths through a cathode flow field increases, it may be more likely that fluid flow that would normally flow through a blocked parallel channel will simply re-route itself and travel through one or more other unobstructed parallel channels within the cathode flow field rather than act to eject the liquid water that is obstructing fluid flow.

The larger numbers of parallel channels that may need to be used in parallel channel cathode flow fields may make it difficult to maintain the higher pressures and flow speeds needed within such cathode flow fields in the context of a $CO_x$ electrolyzer without also reducing the cross-sectional area of the parallel channels in order to allow for higher pressure differentials between the two plenum passages 7072. Achieving such cross-sectional areas may prove challenging from a machining perspective and may make manufacturing of such cathode flow fields more challenging on the smaller scale. However, larger-sized cathode flow fields, e.g., ones that are sufficiently large enough to be able to support parallel, straight-channel flow fields, may allow the use of channel dimensions that are easily machinable to achieve a desired pressure drop. For example, parallel, straight-channel flow fields each having a length on the order of 1.5 meters in length and 0.2 $mm^2$ in cross-sectional area, e.g., 0.5 mm in width and 0.4 mm in depth, may allow for a pressure drop of 1.9 psi during normal operating conditions in some cathode flow fields, which may be sufficient to evacuate any accumulated water resulting from $CO_x$ electrolyzer operation.

By way of example, some parallel channel cathode flow fields may have parallel channels that each have overall lengths of about 12 m or less or about 6 m or less. Some parallel channel cathode flow fields have parallel channels that each have an overall length of about 0.3 m or greater. In some embodiments, parallel channel cathode flow fields have channels that each have overall lengths on the order of between about 0.1 m and about 1.5 m, between about 0.1 m and about 0.8 m, between about 0.3 and about 2 m, between about 0.8 m and about 1.5 m, between about 0.1 m and about 0.45 m, between about 0.45 m and about 0.8 m, between about 0.8 m and about 1.15 m, between about 1.15 m and about 1.5 m, between about 0.1 m and about 0.275 m, between about 0.275 m and about 0.45 m, between about 0.45 m and about 0.625 m, between about 0.625 m and about 0.8 m, between about 0.8 m and about 0.975 m, between about 0.975 m and about 1.15 m, between about 1.15 m and about 1.32 m, or between about 1.32 m and about 1.5 m.

For example, such parallel channels may have widths that are between about 0.5 mm and about 2 mm, between about 0.5 mm and about 1.2 mm, between about 1.2 mm and about 2 mm, between about 0.5 mm and about 0.88 mm, between about 0.88 mm and about 1.2 mm, between about 1.2 mm and about 1.6 mm, between about 1.6 mm and about 2 mm, between about 0.5 mm and about 0.69 mm, between about 0.69 mm and about 0.88 mm, between about 0.88 mm and about 1.1 mm, between about 1.1 mm and about 1.2 mm, between about 1.2 mm and about 1.4 mm, between about 1.4 mm and about 1.6 mm, between about 1.6 mm and about 1.8 mm, or between about 1.8 mm and about 2 mm.

Such parallel channels may also have depths that are between about 0.3 mm and about 3 mm, between about 0.3 mm and about 1.6 mm, between about 1.6 mm and about 3 mm, between about 0.3 mm and about 0.98 mm, between about 0.98 mm and about 1.6 mm, between about 1.6 mm and about 2.3 mm, between about 2.3 mm and about 3 mm, between about 0.3 mm and about 0.64 mm, between about 0.64 mm and about 0.98 mm, between about 0.98 mm and about 1.3 mm, between about 1.3 mm and about 1.6 mm, between about 1.6 mm and about 2 mm, between about 2 mm and about 2.3 mm, between about 2.3 mm and about 2.7 mm, or between about 2.7 mm and about 3 mm.

Parallel channels with widths and depths such as those discussed above may result in each such parallel channel having an open surface area per channel of between about 150 $mm^2$ and about 3000 $mm^2$, between about 150 $mm^2$ and about 1600 $mm^2$, between about 1600 $mm^2$ and about 3000 $mm^2$, between about 150 $mm^2$ and about 860 $mm^2$, between about 860 $mm^2$ and about 1600 $mm^2$, between about 1600 $mm^2$ and about 2300 $mm^2$, between about 2300 $mm^2$ and about 3000 $mm^2$, between about 150 $mm^2$ and about 510 $mm^2$, between about 510 $mm^2$ and about 860 $mm^2$, between about 860 $mm^2$ and about 1200 $mm^2$, between about 1200 $mm^2$ and about 1600 $mm^2$, between about 1600 $mm^2$ and about 1900 $mm^2$, between about 1900 $mm^2$ and about 2300 $mm^2$, between about 2300 $mm^2$ and about 2600 $mm^2$, or between about 2600 $mm^2$ and about 3000 $mm^2$.

Such parallel channels may also have per-channel cross-sectional areas of between about 0.15 $mm^2$ and about 6 $mm^2$, between about 0.15 $mm^2$ and about 3.1 $mm^2$, between about 3.1 $mm^2$ and about 6 $mm^2$, between about 0.15 $mm^2$ and about 1.6 $mm^2$, between about 1.6 $mm^2$ and about 3.1 $mm^2$, between about 3.1 $mm^2$ and about 4.5 $mm^2$, between about 4.5 $mm^2$ and about 6 $mm^2$, between about 0.15 $mm^2$ and about 0.88 $mm^2$, between about 0.88 $mm^2$ and about 1.6 $mm^2$, between about 1.6 $mm^2$ and about 2.3 $mm^2$, between about 2.3 $mm^2$ and about 3.1 $mm^2$, between about 3.1 $mm^2$ and about 3.8 $mm^2$, between about 3.8 $mm^2$ and about 4.5 $mm^2$, between about 4.5 $mm^2$ and about 5.3 $mm^2$, or between about 5.3 $mm^2$ and about 6 $mm^2$ Such parallel channels may also have total channel volumes (per channel) of between about 100 μl and about 9000 μl, between about 100 μl and about 4600 μl, between about 4600 μl and about 9000 μl, between about 100 μl and about 2300 μl, between about 2300 μl and about 4600 μl, between about 4600 μl and about 6800 μl, between about 6800 μl and about 9000 μl, between about 100 μl and about 1200 μl, between about 1200 μl and about 2300 μl, between about 2300 μl and about 3400 μl, between about 3400 μl and about 4600 μl, between about 4600 μl and about 5700 μl, between about 5700 μl and about 6800 μl, between about 6800 μl and about 7900 μl, or between about 7900 μl and about 9000 μl.

In some such implementations, cathode flow fields with parallel channels may also have structural characteristics relating to the thickness of the walls that are interposed between adjacent parallel channels. For example, the wall thickness in between adjacent parallel channels (and thus the distance between surfaces of those channels that are closest to one another) may be selected to be between about 0.0002 and about 0.0067, between about 0.0002 and about 0.0034, between about 0.0034 and about 0.0067, between about 0.0002 and about 0.0018, between about 0.0018 and about 0.0034, between about 0.0034 and about 0.005, between about 0.005 and about 0.0067, between about 0.0002 and about 0.001, between about 0.001 and about 0.0018, between about 0.0018 and about 0.0026, between about 0.0026 and about 0.0034, between about 0.0034 and about 0.0042, between about 0.0042 and about 0.005, between about 0.005 and about 0.0059, between about 0.0059 and about 0.0067 times the average overall length of the two adjacent parallel channels.

In some such parallel channel implementations having dimensional characteristics like those discussed above, the wall thickness between adjacent channels may be, for example, between about 0.15 mm and 5 mm, between about 0.15 mm and about 2.6 mm, between about 2.6 mm and about 5 mm, between about 0.15 mm and about 1.4 mm, between about 1.4 mm and about 2.6 mm, between about 2.6 mm and about 3.8 mm, between about 3.8 mm and about 5 mm, between about 0.15 mm and about 0.76 mm, between about 0.76 mm and about 1.4 mm, between about 1.4 mm and about 2 mm, between about 2 mm and about 2.6 mm, between about 2.6 mm and about 3.2 mm, between about 3.2 mm and about 3.8 mm, between about 3.8 mm and about 4.4 mm, or between about 4.4 mm and about 5 mm.

Branching Parallel Channel Flow Fields

In some parallel channel implementations having dimensional characteristics like those discussed above, the parallel channels may be divided into separate clusters of adjacent channels that are each provided gas by a corresponding common inlet flow path (and that have similar exit flow path arrangements). Such parallel channel implementations may help ensure a more even distribution of gas within a cathode flow field. In effect, each cluster of parallel channels may represent a separate fluid flow "branch" that originates from the same starting point, such as a plenum or manifold that feeds the fluidic inlet ports that supply gas to each cluster of parallel channels).

Figure 71:
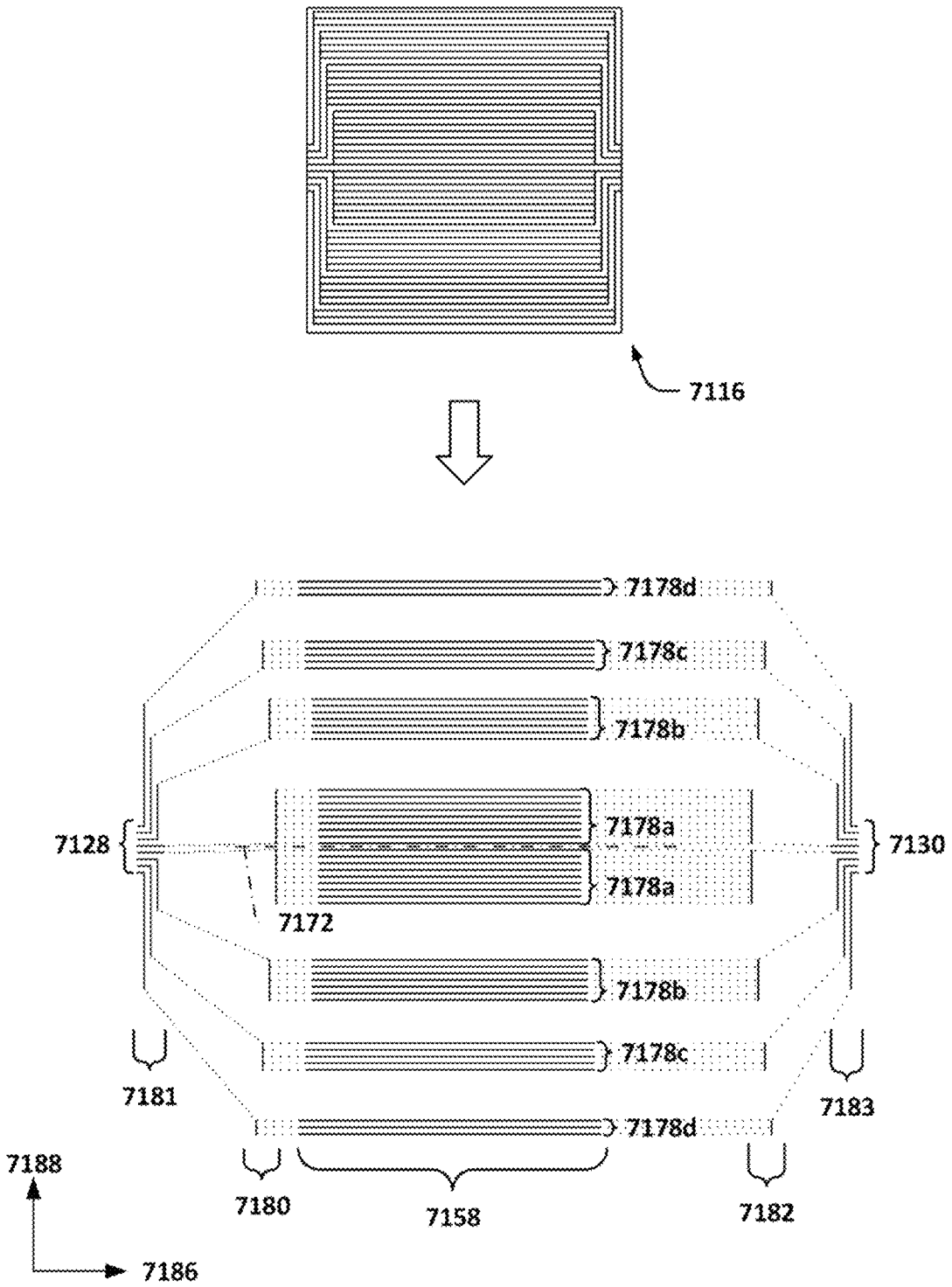
FIG. 71 depicts a schematic of an example parallel channel flow field.

FIG. 71 depicts a schematic of an example such parallel channel flow field. In FIG. 71, a schematic of a cathode flow field 7116 is shown. In the top half of FIG. 71, the cathode flow field 7116 is shown in a single piece, while in the bottom half, the flow paths through the cathode flow field 7116 are shown deconstructed into various sub-portions (dotted lines show the fluidic connections between these sub-portions). As can be seen, there are clusters 7178*a/b/c/d* of parallel channels 7158 that extend along a first direction 7186 in a parallel manner, similar to the parallel channels discussed earlier. In the depicted arrangement, the clusters 7178*a/b/c/d* are arranged in a bilaterally symmetric manner, e.g., with two clusters 7178*a* located at equidistant locations from, and on either side of, a symmetry axis 7172. The other clusters 7178*b/c/d* are also provided in pairs in which the clusters in each pair are each similarly equally spaced apart from the symmetry axis 7172.

The parallel channels 7158 in each cluster 7178*a/b/c/d* are each fluidically connected at one end with a corresponding inlet branch passage 7180 that extends in a second direction 7188 that is nominally orthogonal to the first direction 7186 and at the other end with a corresponding outlet branch passage 7182 that also extends in the second direction 7188. Each of the inlet branch passages 7180 connects with a corresponding inlet passage 7181 that leads to a corresponding fluidic inlet port 7128, while each of the outlet branch passages 7182 on the other side connects with an outlet passage 7183 that leads to a corresponding fluidic outlet port 7130. The inlet passages 7181 and outlet passages 7183 may generally extend along directions parallel to the second direction 7188 but may also include segments that extend in the first direction 7186 in order to connect with the fluidic inlet ports 7128 or the fluidic outlet ports 7130 (as appropriate), and the fluidic inlet ports 7128 and the fluidic outlet ports 7130 may each be located at locations near, and centered on (as a group), the symmetry axis 7172. While not depicted here, the fluidic inlet ports 7128 and the fluidic outlet ports 7130 may each connect with a corresponding common inlet or common outlet, as appropriate and as shown in other example flow fields herein.

When gas is flowed into the fluidic inlet ports 7128, the gas flows into the cathode flow field 7116 as separate gas flows to each of the inlet branch passages 7180 via a corresponding inlet passage 7181, at which point each gas flow may subdivide into the separate parallel channels 7158 that are in the respective cluster 7178*a/b/c/d* of parallel channels 7158 that fluidically connect with the inlet branch passage 7180 that those parallel channels 7158 connect with. Similarly, when the gas that flows down the parallel channels 7158 in a particular cluster 7178*a/b/c/d*, it exits those parallel channels 7158, where such gas flows will recombine in the outlet branch passage 7182 that connects with those parallel channels 7158 before exiting the cathode flow field 7116 via the corresponding outlet passages 7183 and fluidic outlet ports 7130.

It will be noted that the number of parallel channels 7158 that are in each cluster 7178*a/b/c/d* decreases the further the cluster 7178*a/b/c/d* is from the symmetry axis 7172. Put another way, the number of parallel channels 7158 that are in each cluster 7178*a/b/c/d* may generally decrease as a function of increasing flow path length from the corresponding fluidic inlet port 7128 to the corresponding inlet branch passage 7180 (although, in some instances, the number of parallel channels 7158 that are in some adjacent clusters may remain the same). Thus, a cluster 7178 of the clusters 7178*a/b/c/d* where gas travels along a longer inlet passage 7181 path length before reaching that cluster may have fewer parallel channels 7158 in it than a cluster 7178 of the clusters 7178*a/b/c/d* where gas travels along a shorter inlet passage 7181 path length before reaching it. Such a configuration allows for more even distribution of the gas that is flowed through the cathode flow field 7116. For example, due to the longer distance that gas must flow when flowing through the parallel channels 7158 that are in the clusters 7178*d* (due to the longer flow paths between the fluidic inlet ports 7128 and the inlet branch passages 7180 that connect with the parallel channels 7158 in the clusters 7178*d*), the overall flow resistance experienced by gas flowing through such parallel channels 7158 may be higher than with gas that flows through the parallel channels 7158 that are, for example, in the clusters 7178*a/b/c* (which flows along shorter flow path lengths and thus encounters lower flow resistance).

Figure 72:
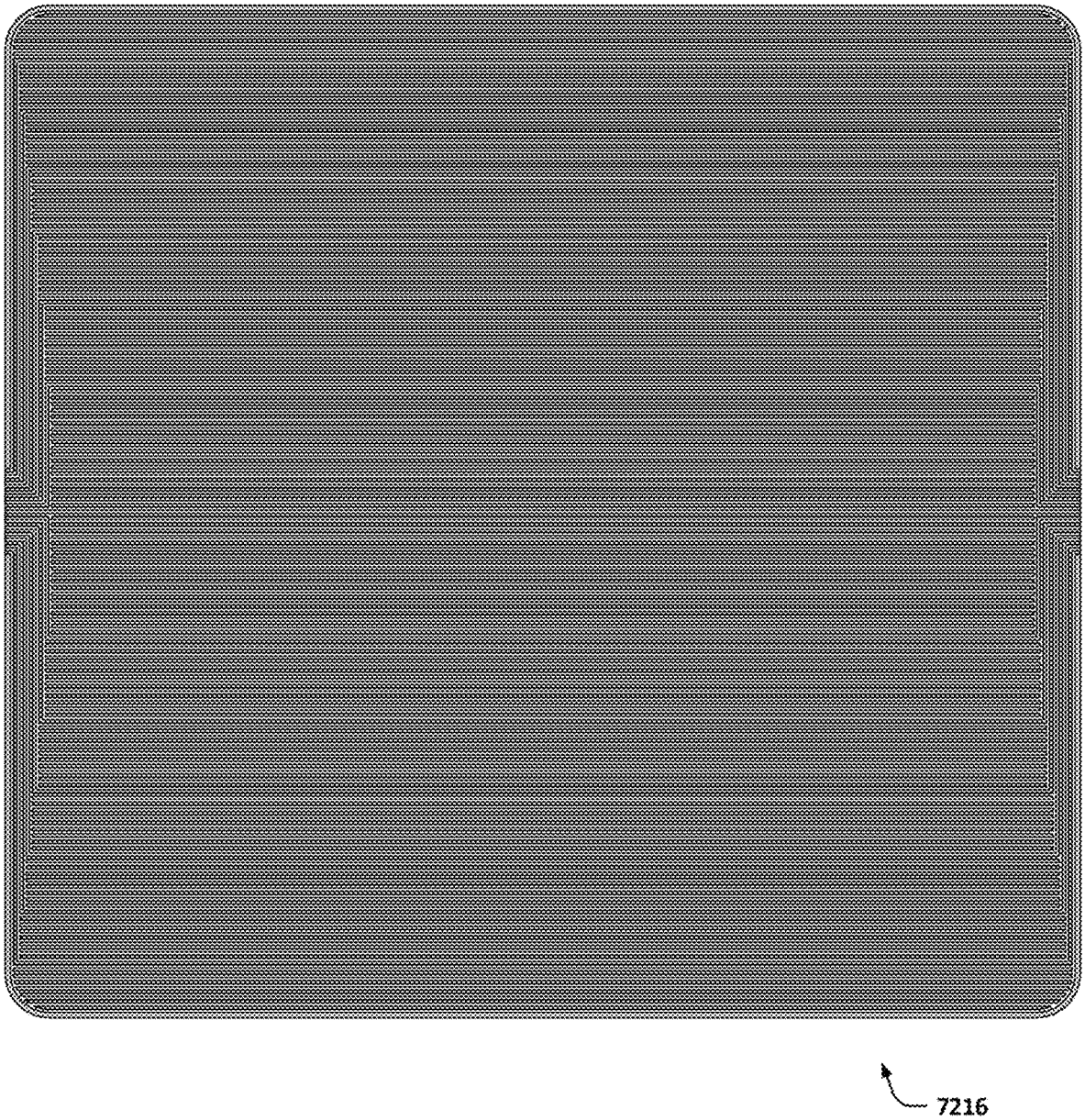
FIG. 72 depicts an example of a branching parallel channel flow field.
Figure 73:
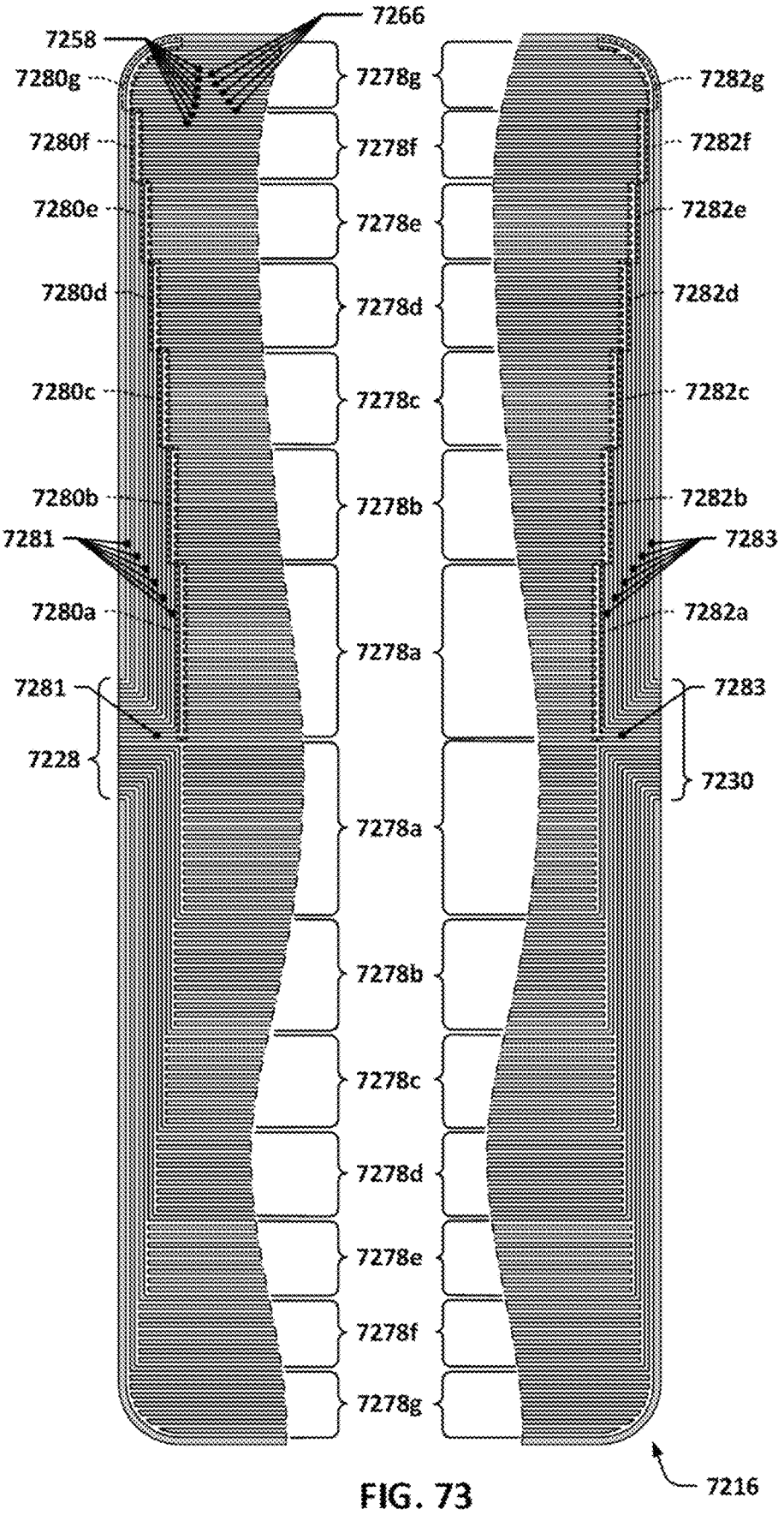
FIG. 73 depicts the same branching channel flow field as in FIG. 72 but in enlarged form and with the middles of the parallel channels omitted by way of a break section.

FIG. 72 depicts an example of a branching parallel channel flow field; FIG. 73 depicts the same branching channel flow field as in FIG. 72 but in enlarged form and with the middles of the parallel channels omitted by way of a break section.

In FIGS. 72 and 73, a cathode flow field 7216 with a parallel channel arrangement is shown. The cathode flow field 7216 includes 7 clusters 7278*a/b/c/d/e/f/g* of parallel channels 7258 on either side of a symmetry axis (not shown, but bisecting the cathode flow field 7216 horizontally with respect to the page orientation). The parallel channels 7258 are separated by partition walls 7266; further partition walls 7266 may define other channels of the cathode flow field 7216.

The parallel channels 7258 of each cluster 7278*a/b/c/d/e/f/g* are each connected at one end to corresponding inlet branch passages 7280*a/b/c/d/e/f/g* and at the other end to corresponding outlet branch passages 7282*a/b/c/d/e/f/g*, which generally extend along directions that are perpendicular to the parallel channels 7258 (only the inlet branch passages 7280 in the upper left quadrant and the outlet branch passages 7282 in the upper right quadrant of the depicted cathode flow field 7216 are called out, but it will be understood that additional inlet branch passages 7280 and outlet branch passages 7282 of similar design are visible in FIGS. 72 and 73). Each inlet branch passage 7280 may be connected via a corresponding inlet passage 7281 to one of the fluidic inlet ports 7228. Similarly, each outlet branch passage 7282 may be connected via a corresponding outlet passage 7283 to one of the fluidic outlet ports 7230.

The cathode flow field of FIGS. 72 and 73 may, for example, have an active area (generally corresponding to the area within the bounds of the depicted component in FIG. 72) on the order of 750-800 $cm^2$, e.g., 760-790 $cm^2$ or 770-780 $cm^2$, while the parallel channels 7258 themselves may, for example, each have a length of approximately 250 to 300 mm, e.g., 260 to 290 mm, 260 to 280 mm, 270 to 280 mm, 270 to 290 mm, or 270 to 280 mm. The parallel channels may each be generally rectangular or square in cross-section, e.g., having a transverse width (generally perpendicular to the direction of gas flow within the parallel channels) and/or depth that ranges from 0.5 mm to 2 mm, e.g., 0.5 mm, 0.6 mm, 0.7 mm, 0.8 mm, 0.9 mm, 1 mm, 1.1 mm, 1.2 mm, etc. In the depicted example, the parallel channels 7258 are each separated from adjacent parallel channels by partition walls 7266 that are, for example, 0.5 mm to 2 mm in transverse width, e.g., 0.5 mm to 2 mm, e.g., 0.5 mm, 0.6 mm, 0.7 mm, 0.8 mm, 0.9 mm, 1 mm, 1.1 mm, 1.2 mm, etc. For example, the parallel channels 6658 may be approximately 0.8 mm in width and 0.5 mm deep, separated from each other by partition walls of approximately 0.9 mm width, and each be approximately 270 mm in length.

Figure 74:
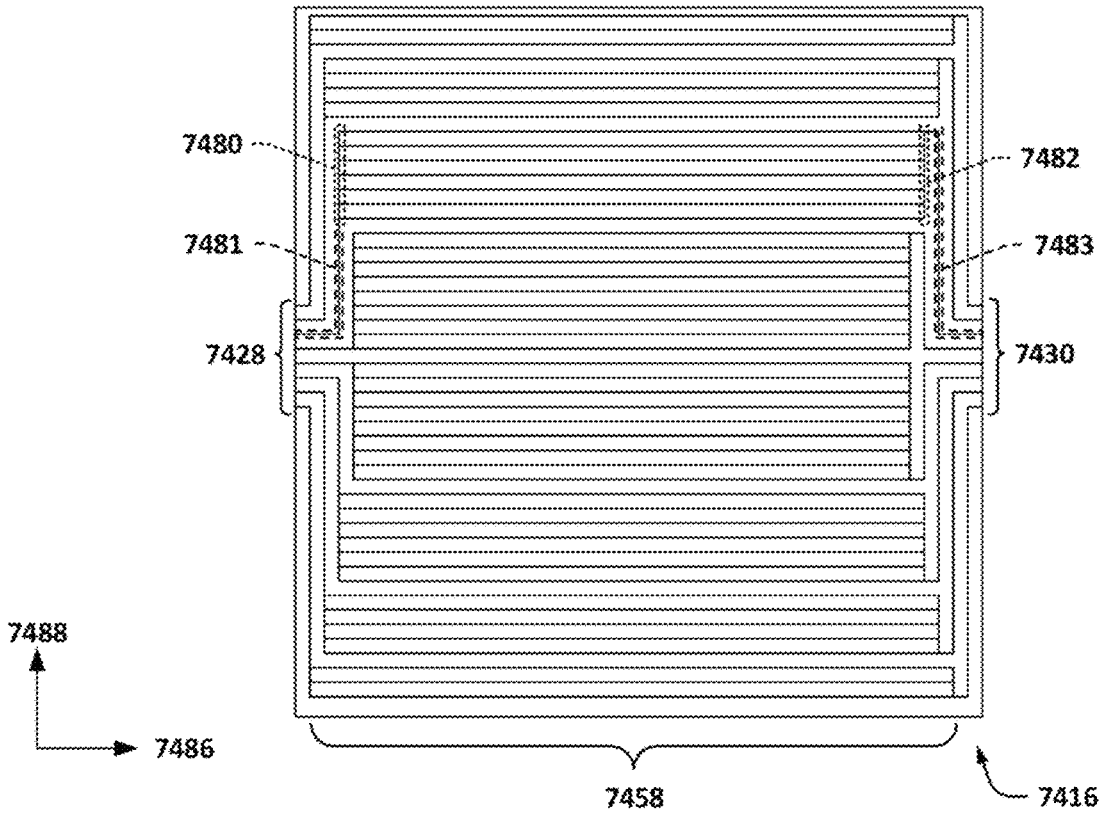
FIG. 74 depicts a schematic of another example of a branching parallel channel flow field.

FIG. 74 depicts a schematic of another example of a branching parallel channel flow field. In FIG. 74, a cathode flow field 7416 is shown in which there are multiple clusters of parallel channels 7458 (similar, for example, to the clusters 7178 depicted in FIG. 71). The parallel channels 7458 in each cluster of parallel channels 7458 may be connected at one end to an inlet branch passage 7480 and at the other end to an outlet branch passage 7482. Each inlet branch passage 7480 may be connected with a corresponding fluidic inlet port 7428 via a corresponding inlet passage 7481, and each outlet branch passage 7482 may be connected with a corresponding fluidic outlet port 7430 via a corresponding outlet passage 7483. In FIG. 74, only one inlet branch passage 7480, outlet branch passage 7482, inlet passage 7481, and outlet passage 7483 are indicated with callouts, but it will be understood that other pairs of inlet/outlet branch passages 7480/7482 and inlet/outlet passages 7481/7483 are present as well in association with each cluster of parallel channels 7458.

The arrangement of parallel channels 7458 and inlet/outlet branch passages 7480/7482 shown in FIG. 74 is very similar to that shown in FIG. 71. However, there is one significant difference—the inlet branch passages 7480 and the outlet branch passages 7482 for each cluster of parallel channels 7458 in FIG. 74 are each connected with a respective inlet passage 7481 or outlet passage 7483 at, in effect, opposite ends. For example, the inlet branch passage 7480 is connected to an inlet passage 7481 that leads to one of the fluidic inlet ports 7428, and the outlet branch passage 7482 is connected to an outlet passage 7483 that leads to one of the fluidic outlet ports 7430. However, the inlet passage 7481 leading to the fluidic inlet port 7428 connects to the inlet branch passage 7480 at a location along the inlet branch passage 7480 that is closest to that fluidic inlet port 7428, while the outlet passage 7483 leading to the fluidic outlet port 7430 connects to the outlet branch passage 7482 at a location along the outlet branch passage 7482 that is furthest from that fluidic outlet port 7430. It will be appreciated that the reverse arrangement may be used as well (essentially flipping the depicted arrangement left-to-right).

Another way of looking at this arrangement is that the inlet passage 7481 that leads from the fluidic inlet port 7428 connects with the inlet branch passage 7480 at a location that is proximate to one of the two outermost parallel channels 7458 in the cluster of parallel channels 7458 that the inlet branch passage 7480 provides gas to, while the outlet passage 7483 that leads to the fluidic outlet port 7430 connects with the outlet branch passage 7482 at a location that is proximate to the other of the two outermost parallel channels 7458 in the cluster of parallel channels 7458 that the outlet branch passage 7482 receives gas from. For clarity, the "outermost" parallel channels in a cluster of parallel channels are the two channels between which all of the other parallel channels in the cluster (if any) are located.

Such an arrangement may ensure that gas that flows into a given cluster of parallel channels 7458 will need to not only traverse along one of the parallel channels 7458 in that cluster in order to reach the fluidic outlet ports 7430, but will also need to traverse along, in aggregate, one of the inlet branch passages 7480. In effect, such an arrangement generally equalizes the flow path length from fluidic inlet port 7428 to fluidic outlet port 7430 for all of the parallel channels 7458 in a given cluster of parallel channels 7458. This serves to help equalize the flow resistance between the parallel channels 7458 within each cluster of parallel channels 7458, thereby enhancing flow uniformity within each cluster of parallel channels 7458.

Figure 75:
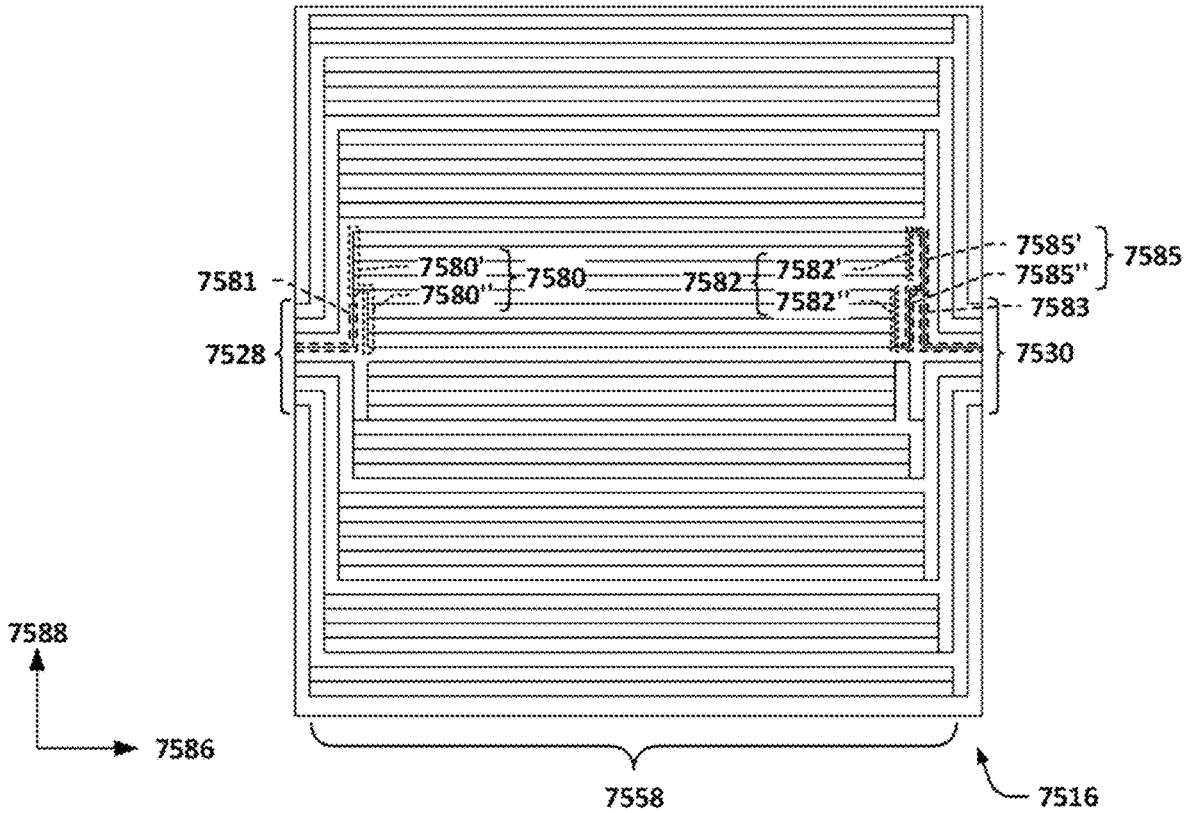
FIG. 75 depicts a schematic of yet another example of a branching parallel channel flow field.

FIG. 75 depicts a schematic of yet another example of a branching parallel channel flow field. In FIG. 75, a cathode flow field 7516 is shown in which there are multiple clusters of parallel channels 7558 (similar, for example, to the clusters depicted in FIG. 71). The parallel channels 7558 in each cluster of parallel channels 7558 may be connected at one end with inlet branch passages 7580 (7580' and 7580") and at the other end with outlet branch passages 7582 (7582' and 7582"). Each inlet branch passage 7580 may connect with a corresponding fluidic inlet port 7528 via a corresponding inlet passage 7581, and each outlet branch passage 7582 may connect with a corresponding outlet port 7528 via a corresponding outlet passage 7583. As shown, the outlet branch passage 7582 that is called out is actually split into two sub-portions 7582' and 7582", each of which is connected with the same outlet passage 7583 by a corresponding outlet branch passage extensions 7585 (7585' or 7585"). The lengths of these outlet branch passage extensions 7585' and 7585" may generally be equivalent. As in FIG. 74, only one inlet branch passage 7580, outlet branch passage 7582, inlet passage 7581, and outlet passage 7582 are indicated, but it will be understood that other instances of such passages may be associated with each cluster of parallel channels 7558.

The arrangement shown in FIG. 75 is similar to that shown in FIG. 74, although the inlet passages 7581 and outlet passages 7583 that connect the inlet branch passages 7580 and outlet branch passages 7582 with their respective fluidic inlet ports 7528 and fluidic outlet ports 7530 do not necessarily connect to either end of the inlet branch passages 7580 or the outlet branch passages 7582. For example, the inlet passage 7581 that connects the fluidic inlet port 7528 to the inlet branch passage 7580 connects with the inlet branch passage 7580 at a location approximately midway along its length, with some of the parallel channels 7558 in the associated cluster of parallel channels 7558 connecting with a first sub-portion 7580' of the inlet branch passage 7580 on one side of that connection point, and the other parallel channels 7558 in the associated cluster of parallel channels 7558 connecting with a second sub-portion 7580" of the inlet branch passage 7580 on the other side of that connection point. It will be noted that the outlet branch passage 7582 also follows this convention, although with the outlet branch passage 7582 sub-portions having outlet branch passage extensions 7585' and 7585" that allow the flow paths to take U-turns in between where the parallel channels 7558 connect therewith and where the outlet passage 7583 leading to the fluidic outlet port 7530 connects therewith. The outlet branch passage extensions 7585' and 7585" may, as may be seen, have lengths that are each generally equivalent to the corresponding lengths of the sub-portions 7582' and 7582" of the outlet branch passage 7582.

The inlet branch passages 7580 and the outlet branch passages 7582 of FIG. 75 may be generally characterized as having corresponding sub-portions, with the sub-portions in each pair of corresponding sub-portions being connected with opposing ends of a sub-group of parallel channels 7558 in the cluster of parallel channels 7558 associated with each of the inlet branch passages 7580 and each of the outlet branch channels 7582. Each pair of sub-portions may connect with the parallel channels 7558 that span between those sub-portions in a manner that is similar to how the parallel channels 7458 in each cluster of parallel channels connect with the corresponding inlet branch passage 7480 and outlet branch passage 7482 for that cluster of parallel channels 7458 in the implementation of FIG. 74.

For example, each inlet branch passage 7580 sub-portion and each outlet branch passage 7582 sub-portion may have a first end and a second end, with the first end of each such sub-portion being closest to the location where the corresponding inlet passage 7581 or outlet passage 7583 leading to the relevant fluidic inlet or outlet port 7528 or 7530 connects with the inlet branch passage 7580 or outlet branch passage 7582 having that sub-portion and the second end of that sub-portion being furthest along the path followed by that sub-portion from that location. The parallel channels 7558 that span between each pair of sub-portions may connect with each sub-portion at locations that are spaced-apart from one another. The sequence in which each sub-group of parallel channels 7558 connects with the two sub-portions that those parallel channels 7558 span between may be reversed between those two sub-portions. For example, the parallel channel 7558 that connects with one sub-portion at a location that is, of the various connection locations, closest to the first end of that sub-portion would connect with the other sub-portion at a location that is, of the various connection locations, furthest from the first end of the other sub-portion, and vice versa.

Such an arrangement of increased tortuosity is a refinement of the configuration discussed above with respect to FIG. 74 and allows for the gas flow across the cathode flow field 7516 to be even more evenly distributed as compared with the configuration of FIG. 74. It will be understood that while the sub-portion arrangement discussed above is only shown in FIG. 75 for the two innermost clusters of parallel channels, such a configuration may be implemented for any or all of the clusters in a branching parallel channel flow field. It will also be understood that the arrangement of FIG. 75 may be reversed from left-to-right, with the inlet branch passages having inlet branch passage extensions and the outlet branch passages having no outlet branch passage extensions.

Figure 76:
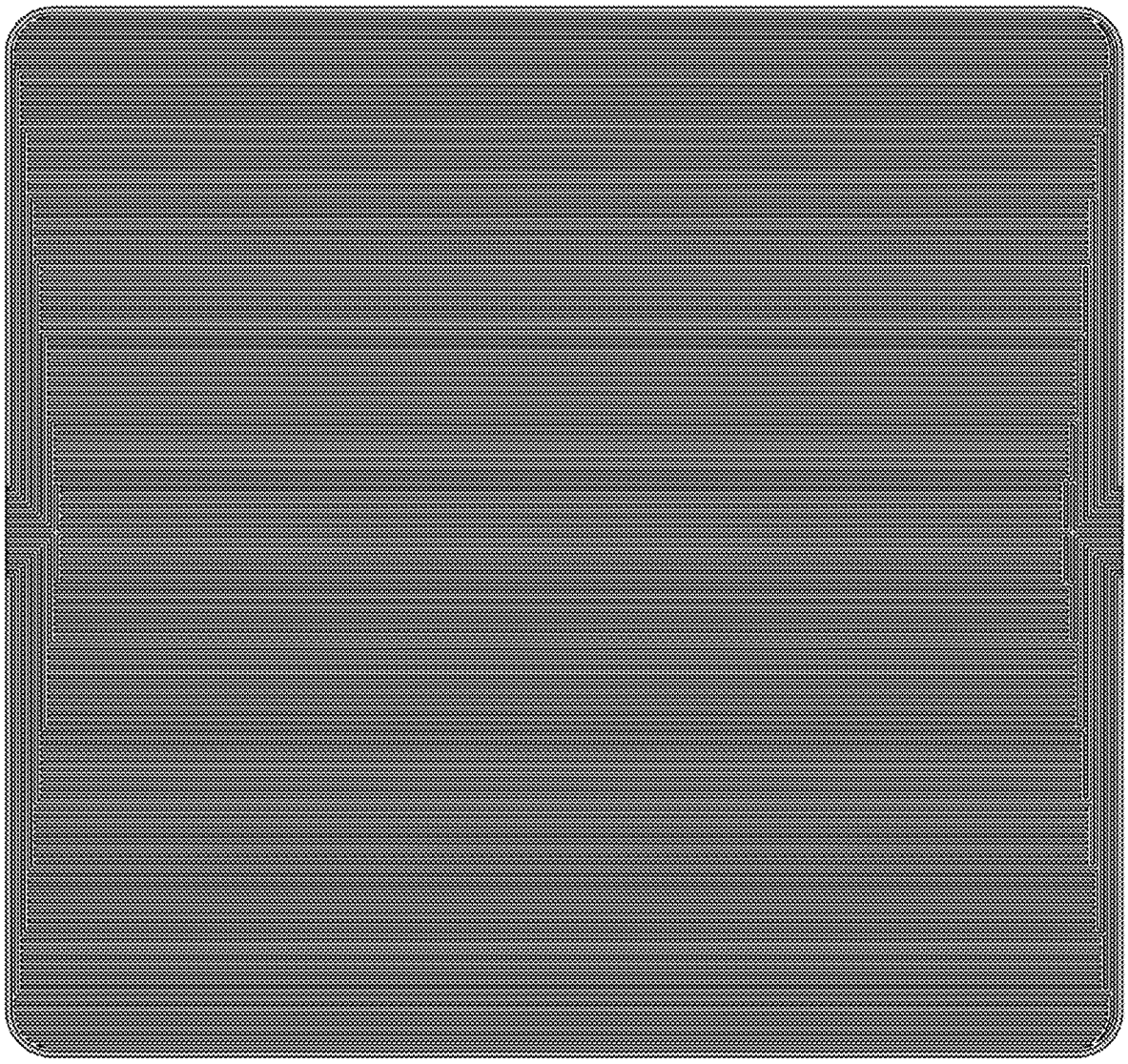
FIG. 76 depicts an example of a cathode flow field that features branching parallel channels.
Figure 77:
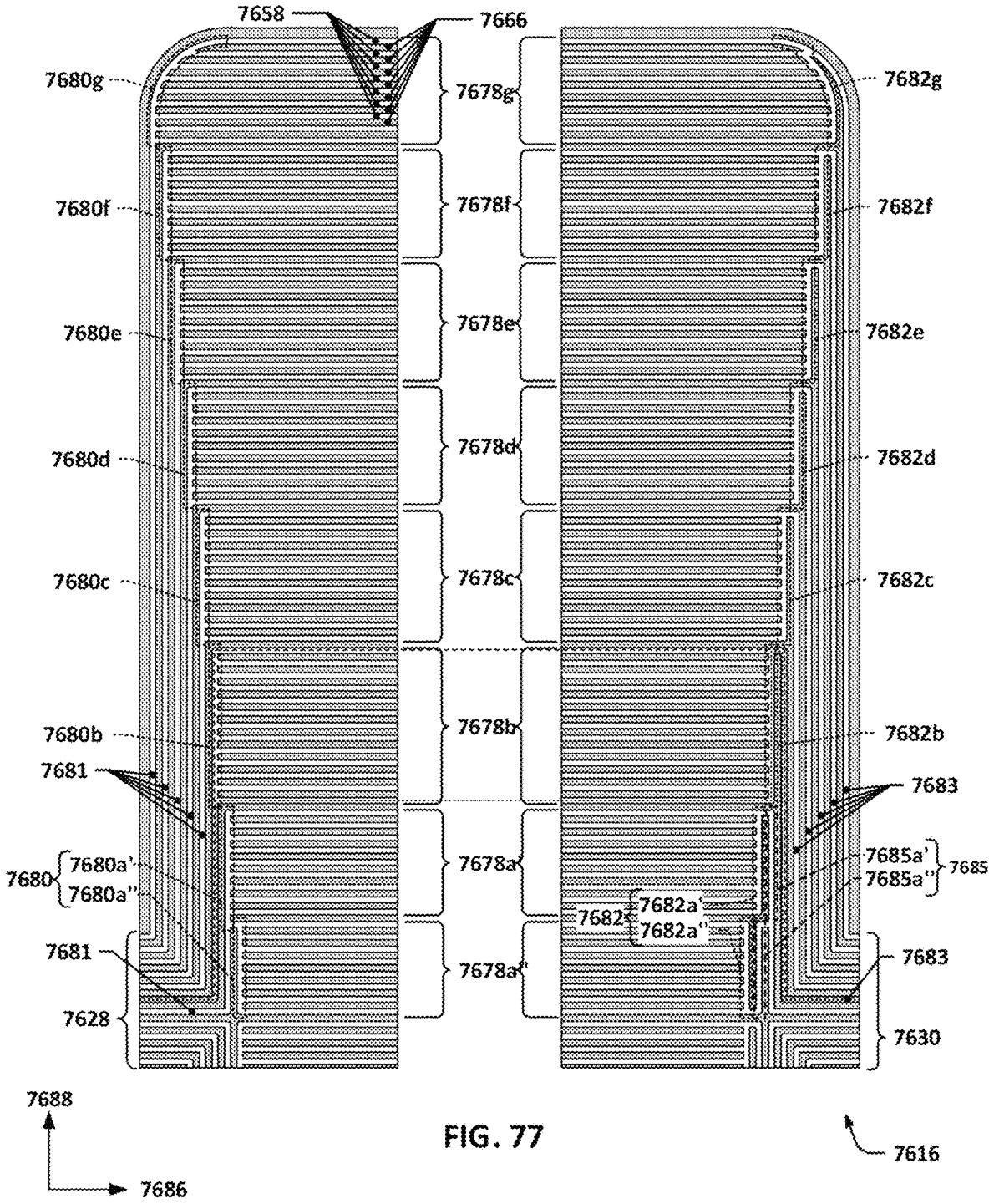
FIG. 77 depicts a detail view of the left and right sides of the upper half of the cathode flow field of FIG. 76, with the remainder of the flow field omitted from view.

FIG. 76 depicts an example of a cathode flow field that features branching parallel channels. FIG. 77 depicts a detail view of the left and right sides of the upper half of the cathode flow field of FIG. 76, with the remainder of the flow field omitted from view.

As can be seen in FIGS. 76 and 77, the cathode flow field 7616 features a plurality of clusters 7678*a/b/c/d/e/f/g* of parallel channels 7658. The cluster 7678*a* is actually formed of two sub-groups 7678*a'* and 7678*a"* of parallel channels 7658. The parallel channels 7658 in each cluster 7678 are each provided gas from one of the fluidic inlet ports 7628 by way of a corresponding inlet branch passage 7680*a/b/c/d/e/f/g* that is connected to one of the fluidic inlet ports 7628 by way of corresponding inlet passage 7681. The gas that is provided to each cluster of parallel channels 7658 then exits the corresponding cluster 7678*a/b/c/d/e/f/g* by way of the corresponding outlet branch passage 7680*a/b/c/d/e/f/g* that is connected to one of the fluidic outlet ports 7630 by way of a corresponding outlet passage 7683. The inlet branch passages 7680*a* outlet branch passages 7680*a* each have two sub-portions 7680*a'* and 7680*a"*, each of which is associated with a different one of the sub-groups of parallel channels 7658 in the sub-groups 7678*a'* and 7678*a"*, respectively, and the outlet branch passages 7682*a* similarly each have two sub-portions 7682*a'* and 7682*a"* (connected to outlet passage 7683 by corresponding outlet branch passage extensions 7685, e.g., 7685*a'* and 7685*a"*), each of which is associated with a different one of the sub-groups of parallel channels 7658 in the sub-groups 7678*a'* and 7678*a"*, respectively. This arrangement is generally similar to that shown in FIG. 75 and exhibits similar uniformity behavior. Dimensional values of the various depicted features that are within the ranges indicated for the cathode flow field 7216 may, for example, provide gas flow with high uniformity and sufficient water ejection capability for use in $CO_x$ electrolyzers.

Interdigitated Channel Flow Fields

Figure 78:
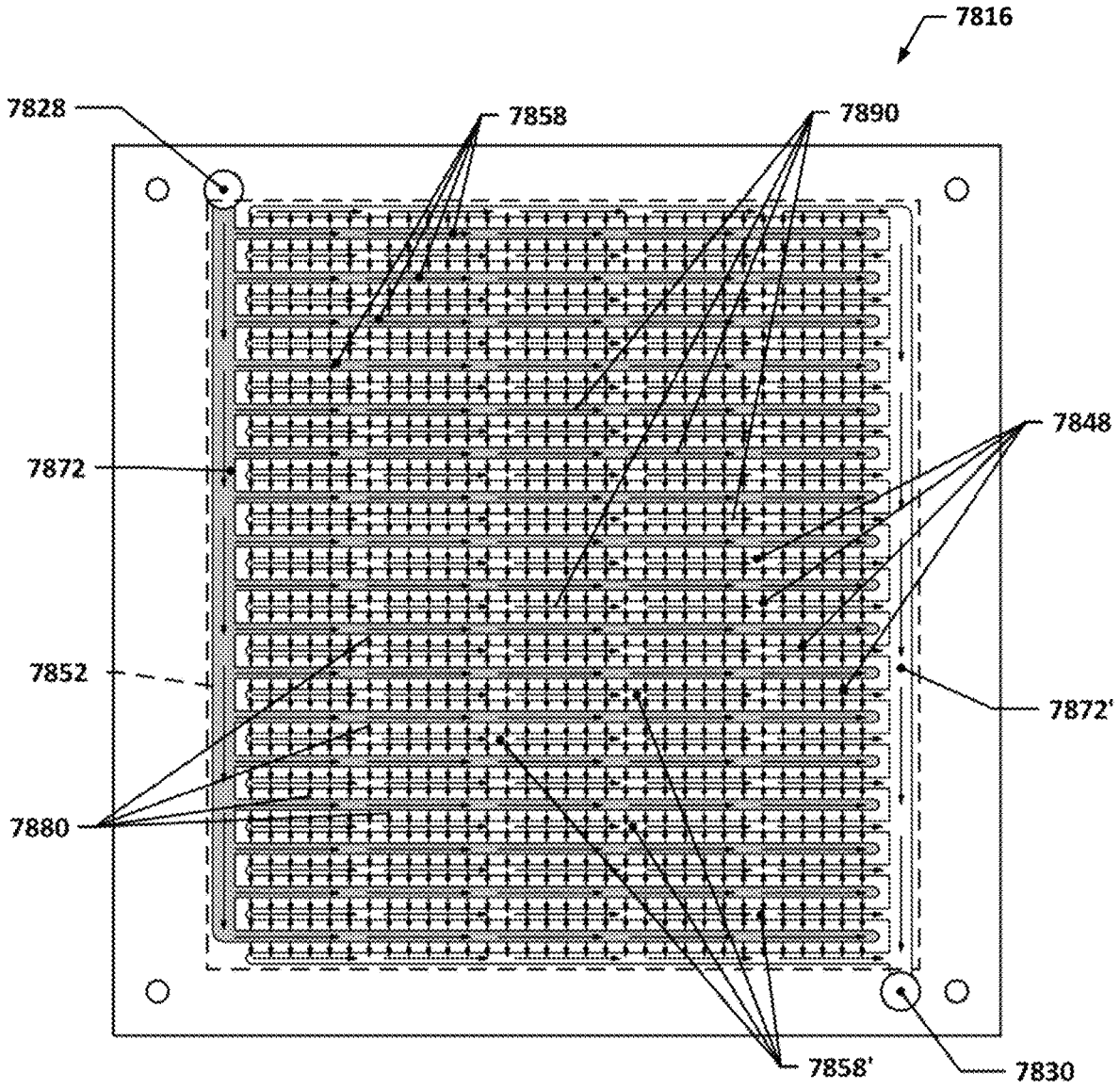
FIG. 78 depicts an example of a cathode flow field with an interdigitated channel arrangement.

Another type of channel arrangement that may be used in some cathode flow fields is an interdigitated channel arrangement. FIG. 78 depicts an example interdigitated channel cathode flow field. As can be seen, a cathode flow field 7816 is depicted that has a fluidic inlet port 7828 and a fluidic outlet port 7830. The fluidic inlet port 7828 and the fluidic outlet port 7830 may each be fluidically connected with a corresponding plenum passage 7872 or 7872', respectively. The plenum passages 7872 and 7872' may generally extend along directions that are parallel to one another and may have a plurality of channels 7858 or 7858' extending away from the corresponding plenum passage 7872 or 7872' and towards the other of plenum passage 7872' or 7872, respectively (for more easy reference, the plenum passage 7872 and the channels 7858 are shaded differently than the plenum passage 7872' and the channels 7858'). Each pair of adjacent channels 7858 may have a channel 7858' interposed therebetween, and each pair of adjacent channels 7858' may have a channel 7858 interposed therebetween (thus providing two sets of interdigitated channels). In such an arrangement, each channel 7858 may be a dead-end channel that does not fluidically connect with the channels 7858' within the cathode flow field 7816. Similarly, each channel 7858' may also be a dead-end channel that does not fluidically connect with the channels 7858 within the cathode flow field 7816. However, $CO_x$ gas is still able to pass between the two sets of channels 7858 and 7858' during use by passing underneath the walls 7848 by migrating through the cathode GDL (not shown) that is compressed between the cathode flow field 7816 and the MEA of the $CO_x$ electrolyzer in which the cathode flow field 7816 is to be used. This under-wall flow of $CO_x$ gas is indicated in FIG. 78 through the use of short arrows 7880 that lead from the channels 7858 to the channels 7858'. Gas flow from the fluidic inlet port 7828 and through the channels 7858, as well as gas flow from the channels 7858' to the fluidic outlet port 7830 is indicated using long arrows 7890.

Cathode flow fields with interdigitated channel arrangements may, similarly to parallel channel arrangements, offer more direct fluid flow paths than serpentine channel arrangements may provide for coverage areas that are similar to coverage area 7852, and the average distances that accumulated liquid water must be moved through in order to evacuate it from a channel in such arrangements are significantly shorter in an interdigitated channel than in a serpentine channel for a similarly sized $CO_x$ electrolyzer. While this is advantageous in that less energy is needed in order to evacuate liquid water from the channels, parallel channel arrangements will typically also include a larger number of potential alternate flow paths, e.g., tens or hundreds of flow paths, as compared with serpentine channel arrangements, which tend to include fewer numbers of flow paths, e.g., 2, 3, 4, or other relatively low numbers of flow paths. As discussed earlier, as the number of flow paths through a cathode flow field increases, it is increasingly likely that fluid flow that would normally flow through a blocked parallel channel will simply re-route itself and travel through one or more other unobstructed parallel channels within the cathode flow field rather than act to eject the liquid water that is obstructing fluid flow. By forcing gas flow under the walls 7848, interdigitated cathode flow fields may, in essence, force $CO_x$ gas to come into contact with portions of the cathode GDL and the MEA that are underneath the walls 7848, thereby ensuring that $CO_x$ gas reaches such regions—in parallel and serpentine channel arrangements, $CO_x$ gas may still come into contact with such portions of the MEA and the cathode GDL, but it is not necessarily forced to do so.

Interdigitated cathode flow fields $CO_x$ electrolyzers may have channels with various dimensional characteristics that may make them particularly well-suited to use in the $CO_x$ electrolyzer context, e.g., with respect to facilitating water removal from the cathode flow field.

By way of example, some interdigitated channel cathode flow fields may have interdigitated channels that have individual lengths on the order of between about 0.1 m and about 1.5 m, between about 0.1 m and about 0.8 m, between about 0.8 m and about 1.5 m, between about 0.1 m and about 0.45 m, between about 0.45 m and about 0.8 m, between about 0.8 m and about 1.15 m, between about 1.15 m and about 1.5 m, between about 0.1 m and about 0.275 m, between about 0.275 m and about 0.45 m, between about 0.45 m and about 0.625 m, between about 0.625 m and about 0.8 m, between about 0.8 m and about 0.975 m, between about 0.975 m and about 1.15 m, between about 1.15 m and about 1.32 m, or between about 1.32 m and about 1.5 m.

For example, such interdigitated channels may have widths that are between about 0.5 mm and about 2 mm, between about 0.5 mm and about 1.2 mm, between about 1.2 mm and about 2 mm, between about 0.5 mm and about 0.88 mm, between about 0.88 mm and about 1.2 mm, between about 1.2 mm and about 1.6 mm, between about 1.6 mm and about 2 mm, between about 0.5 mm and about 0.69 mm, between about 0.69 mm and about 0.88 mm, between about 0.88 mm and about 1.1 mm, between about 1.1 mm and about 1.2 mm, between about 1.2 mm and about 1.4 mm, between about 1.4 mm and about 1.6 mm, between about 1.6 mm and about 1.8 mm, or between about 1.8 mm and about 2 mm.

Such interdigitated channels may also have depths that are between about 0.3 mm and about 3 mm, between about 0.3 mm and about 1.6 mm, between about 1.6 mm and about 3 mm, between about 0.3 mm and about 0.98 mm, between about 0.98 mm and about 1.6 mm, between about 1.6 mm and about 2.3 mm, between about 2.3 mm and about 3 mm, between about 0.3 mm and about 0.64 mm, between about 0.64 mm and about 0.98 mm, between about 0.98 mm and about 1.3 mm, between about 1.3 mm and about 1.6 mm, between about 1.6 mm and about 2 mm, between about 2 mm and about 2.3 mm, between about 2.3 mm and about 2.7 mm, or between about 2.7 mm and about 3 mm.

Interdigitated channels with widths and depths such as those discussed above may result in each such interdigitated channel having an open surface area per channel of between about 150 $mm^2$ and about 3000 $mm^2$, between about 150 $mm^2$ and about 1600 $mm^2$, between about 1600 $mm^2$ and about 3000 $mm^2$, between about 150 $mm^2$ and about 860 $mm^2$, between about 860 $mm^2$ and about 1600 $mm^2$, between about 1600 $mm^2$ and about 2300 $mm^2$, between about 2300 $mm^2$ and about 3000 $mm^2$, between about 150 $mm^2$ and about 510 $mm^2$, between about 510 $mm^2$ and about 860 $mm^2$, between about 860 $mm^2$ and about 1200 $mm^2$, between about 1200 $mm^2$ and about 1600 $mm^2$, between about 1600 $mm^2$ and about 1900 $mm^2$, between about 1900 $mm^2$ and about 2300 $mm^2$, between about 2300 $mm^2$ and about 2600 $mm^2$, or between about 2600 $mm^2$ and about 3000 $mm^2$.

Such interdigitated channels may also have per-channel cross-sectional areas of between about 0.15 $mm^2$ and about 6 $mm^2$, between about 0.15 $mm^2$ and about 3.1 $mm^2$, between about 3.1 $mm^2$ and about 6 $mm^2$, between about 0.15 $mm^2$ and about 1.6 $mm^2$, between about 1.6 $mm^2$ and about 3.1 $mm^2$, between about 3.1 $mm^2$ and about 4.5 $mm^2$, between about 4.5 $mm^2$ and about 6 $mm^2$, between about 0.15 $mm^2$ and about 0.88 $mm^2$, between about 0.88 $mm^2$ and about 1.6 $mm^2$, between about 1.6 $mm^2$ and about 2.3 $mm^2$, between about 2.3 $mm^2$ and about 3.1 $mm^2$, between about 3.1 $mm^2$ and about 3.8 $mm^2$, between about 3.8 $mm^2$ and about 4.5 $mm^2$, between about 4.5 $mm^2$ and about 5.3 $mm^2$, or between about 5.3 $mm^2$ and about 6 $mm^2$ Such interdigitated channels may also have total channel volumes (per channel) of between about 100 μl and about 9000 μl, between about 100 μl and about 4600 μl, between about 4600 μl and about 9000 μl, between about 100 μl and about 2300 μl, between about 2300 μl and about 4600 μl, between about 4600 μl and about 6800 μl, between about 6800 μl and about 9000 μl, between about 100 μl and about 1200 μl, between about 1200 μl and about 2300 μl, between about 2300 μl and about 3400 μl, between about 3400 μl and about 4600 μl, between about 4600 μl and about 5700 μl, between about 5700 μl and about 6800 μl, between about 6800 μl and about 7900 μl, or between about 7900 μl and about 9000 μl.

In some such implementations, cathode flow fields with interdigitated channels may also have structural characteristics relating to the thickness of the walls that are interposed between adjacent interdigitated channels. For example, the wall thickness in between adjacent interdigitated channels (and thus the distance between surfaces of those channels that are closest to one another) may be selected to be between about 0.0002 and about 0.0067, between about 0.0002 and about 0.0034, between about 0.0034 and about 0.0067, between about 0.0002 and about 0.0018, between about 0.0018 and about 0.0034, between about 0.0034 and about 0.005, between about 0.005 and about 0.0067, between about 0.0002 and about 0.001, between about 0.001 and about 0.0018, between about 0.0018 and about 0.0026, between about 0.0026 and about 0.0034, between about 0.0034 and about 0.0042, between about 0.0042 and about 0.005, between about 0.005 and about 0.0059, between about 0.0059 and about 0.0067 times the average overall length of the two adjacent interdigitated channels.

In some such interdigitated channel implementations having dimensional characteristics like those discussed above, the wall thickness between adjacent channels may be, for example, between about 0.15 mm and 5 mm, between about 0.15 mm and about 2.6 mm, between about 2.6 mm and about 5 mm, between about 0.15 mm and about 1.4 mm, between about 1.4 mm and about 2.6 mm, between about 2.6 mm and about 3.8 mm, between about 3.8 mm and about 5 mm, between about 0.15 mm and about 0.76 mm, between about 0.76 mm and about 1.4 mm, between about 1.4 mm and about 2 mm, between about 2 mm and about 2.6 mm, between about 2.6 mm and about 3.2 mm, between about 3.2 mm and about 3.8 mm, between about 3.8 mm and about 4.4 mm, or between about 4.4 mm and about 5 mm.

In addition to the above characteristics, some implementations of the flow field channels discussed herein for use in cathode flow fields of $CO_x$ electrolyzers may also have certain relative dimensional constraints. For example, the ratio of the channel width to wall width of the walls in between each pair of adjacent channels or channel portions may be between about 0.08 and about 10, between about 0.08 and about 5, between about 5 and about 10, between about 0.08 and about 2.6, between about 2.6 and about 5, between about 5 and about 7.5, between about 7.5 and about 10, between about 0.08 and about 1.3, between about 1.3 and about 2.6, between about 2.6 and about 3.8, between about 3.8 and about 5, between about 5 and about 6.3, between about 6.3 and about 7.5, between about 7.5 and about 8.8, or between about 8.8 and about 10.

Similarly, the total open surface area for all channels in a flow field, or the channel if a single channel is used in the flow field, for some implementations may be between about 25% and about 80%, between about 25% and about 52%, between about 52% and about 80%, between about 25% and about 39%, between about 39% and about 52%, between about 52% and about 66%, between about 66% and about 80%, between about 25% and about 32%, between about 32% and about 39%, between about 39% and about 46%, between about 46% and about 52%, between about 52% and about 59%, between about 59% and about 66%, between about 66% and about 73%, or between about 73% and about 80%.

It will be noted that while the examples discussed herein and shown in the Figures have focused on generally square cell geometries, e.g., channels that extend across a square region defining, for instance, a cathode flow field, other implementations may feature non-square cell geometries, e.g., circular geometries, oval geometries, triangular geometries, rectangular geometries, pentagonal geometries, hexagonal geometries, etc.

It will also be noted that while the channels discussed thus far have generally had constant cross-sectional profiles (except perhaps at sharp corners, in which the profiles may grow and shrink when entering and exiting the corners, respectively), some implementations may feature channels that have variable widths and/or depths at various locations along their length. For example, in some implementations, a channel width and/or depth may be increased in a reduced flow speed region extending from the fluidic inlet port to a point in between the fluidic inlet port and the fluidic outlet port as compared with the channel width and/or depth in an increased flow speed region fluidically interposed in between the reduced flow speed region and the fluidic outlet port. The increased channel depth and/or width in the reduced flow speed region may act to expand the cross-sectional area of the channel(s) in the reduced flow speed region, thereby causing the gas flow velocity in the reduced flow speed region to decrease compared to what it is in the increased flow speed region. Similarly, the reduced channel depth and/or width in the increased flow speed region may act to reduce the cross-sectional area of the channel(s) in the increased flow speed region, thereby causing the gas flow velocity in the increased flow speed region to increase compared to what it is in the decreased flow speed region. The increased residence time of the gas in the decreased flow speed region that results from such lower flow speed may provide additional time for water that is present in the cathode GDL to evaporate and/or diffuse into the gas flowing through the channel(s) in the decreased flow speed region, thereby humidifying the gas before it flows downstream into the increased flow speed region. Such implementations may assist with reducing the likelihood that portions of the cathode GDL may dry out, thereby potentially compromising the performance of the GDL.

Pressure Considerations

More generally, cathode flow fields for $CO_x$ electrolyzers may benefit, e.g., in terms of providing a sufficiently high enough pressure drop that the liquid water that accumulates in the cathode flow fields at an increased rate in $CO_x$ reduction as compared with, for example, fuel cell operation, is able to be reliably ejected from the cathode flow fields by the pressure drop, from being designed to have physical structures that result in certain physical characteristics of the cathode field. For example, the cathode channels for a $CO_x$ electrolyzer cathode flow field may have channel dimensions, e.g., length, width, and depth, that, under the typical operating conditions of the $CO_x$ electrolyzer, result in a pressure drop between the fluidic inlet port(s) and fluidic outlet port(s) of the cathode flow field that is between about 0.001 psi and about 4 psi, between about 0.001 psi and about 2 psi, between about 2 psi and about 4 psi, between about 0.001 psi and about 1 psi, between about 1 psi and about 2 psi, between about 2 psi and about 3 psi, between about 3 psi and about 4 psi, between about 0.001 psi and about 0.5 psi, between about 0.5 psi and about 1 psi, between about 1 psi and about 1.5 psi, between about 1.5 psi and about 2 psi, between about 2 psi and about 2.5 psi, between about 2.5 psi and about 3 psi, between about 3 psi and about 3.5 psi, between about 3.5 psi and about 4 psi, between about 0.001 psi and about 0.25 psi, between about 0.25 psi and about 0.5 psi, between about 0.5 psi and about 0.75 psi, between about 0.75 psi and about 1 psi, between about 1 psi and about 1.3 psi, between about 1.3 psi and about 1.5 psi, between about 1.5 psi and about 1.8 psi, between about 1.8 psi and about 2 psi, between about 2 psi and about 2.3 psi, between about 2.3 psi and about 2.5 psi, between about 2.5 psi and about 2.8 psi, between about 2.8 psi and about 3 psi, between about 3 psi and about 3.3 psi, between about 3.3 psi and about 3.5 psi, between about 3.5 psi and about 3.8 psi, between about 3.8 psi and about 4 psi, between about 0.001 psi and about 0.13 psi, between about 0.13 psi and about 0.25 psi, between about 0.25 psi and about 0.38 psi, between about 0.38 psi and about 0.5 psi, between about 0.5 psi and about 0.63 psi, between about 0.63 psi and about 0.75 psi, between about 0.75 psi and about 0.88 psi, between about 0.88 psi and about 1 psi, between about 1 psi and about 1.1 psi, between about 1.1 psi and about 1.3 psi, between about 1.3 psi and about 1.4 psi, between about 1.4 psi and about 1.5 psi, between about 1.5 psi and about 1.6 psi, between about 1.6 psi and about 1.8 psi, between about 1.8 psi and about 1.9 psi, between about 1.9 psi and about 2 psi, between about 2 psi and about 2.1 psi, between about 2.1 psi and about 2.3 psi, between about 2.3 psi and about 2.4 psi, between about 2.4 psi and about 2.5 psi, between about 2.5 psi and about 2.6 psi, between about 2.6 psi and about 2.8 psi, between about 2.8 psi and about 2.9 psi, between about 2.9 psi and about 3 psi, between about 3 psi and about 3.1 psi, between about 3.1 psi and about 3.3 psi, between about 3.3 psi and about 3.4 psi, between about 3.4 psi and about 3.5 psi, between about 3.5 psi and about 3.6 psi, between about 3.6 psi and about 3.8 psi, between about 3.8 psi and about 3.9 psi, or between about 3.9 psi and about 4 psi. In some other implementations, such channels for $CO_x$ electrolyzers may have dimensions and operational conditions, e.g., fluidic inlet port pressures, that are selected so as to produce, during normal operational flow conditions for a $CO_x$ electrolyzer, a pressure drop of between about 4 psi and about 50 psi, between about 4 psi and about 27 psi, between about 27 psi and about 50 psi, between about 4 psi and about 16 psi, between about 16 psi and about 27 psi, between about 27 psi and about 38 psi, between about 38 psi and about 50 psi, between about 4 psi and about 9.8 psi, between about 9.8 psi and about 16 psi, between about 16 psi and about 21 psi, between about 21 psi and about 27 psi, between about 27 psi and about 33 psi, between about 33 psi and about 38 psi, between about 38 psi and about 44 psi, between about 44 psi and about 50 psi, between about 4 psi and about 6.9 psi, between about 6.9 psi and about 9.8 psi, between about 9.8 psi and about 13 psi, between about 13 psi and about 16 psi, between about 16 psi and about 18 psi, between about 18 psi and about 21 psi, between about 21 psi and about 24 psi, between about 24 psi and about 27 psi, between about 27 psi and about 30 psi, between about 30 psi and about 33 psi, between about 33 psi and about 36 psi, between about 36 psi and about 38 psi, between about 38 psi and about 41 psi, between about 41 psi and about 44 psi, between about 44 psi and about 47 psi, or between about 47 psi and about 50 psi. It will be understood that the pressure drop may exceed the above ranges under certain circumstances, e.g., if the exit stream from the fluidic outlet port(s) goes to an inlet port of another electrolyzer cell, if water accumulates within a channel and obstructs flow through the channel, if the cathode GDL bulges up into the flow field channels when compressed, etc. Pressure drops lower than 0.5 psi may also work but may also increase the risk of the $CO_x$ gas flows through the cathode flow field simply re-routing in instances where liquid water blocks a particular cathode channel (assuming multiple cathode channels are present) rather than acting to eject the liquid water from the blocked channel. Pressure drops higher than one or more of the ranges listed above may also work, but may not provide any additional performance benefit, i.e., may simply result in excess energy consumption by the $CO_x$ electrolyzer while providing gas distribution uniformity and water ejection capability that may be provided by lower pressure drops as well. Such pressure drops are, it is to be understood, to be evaluated in the context of typical operating conditions of a $CO_x$ electrolyzer, e.g., with a $CO_x$ gas pressure in the range of 50 psig to 400 psig or 75 psig to 400 psig range and a gas flow velocity of 0.019 m/s to 30 m/s within at least some portions of the channels. For example, cathode flow fields such as those discussed above, or ones similar thereto, may be used in a $CO_x$ electrolyzer cell in which $CO_x$-containing gas is flowed into the fluidic inlet ports of the cathode flow fields at a flow rate of between 2 sccm and 21 sccm per square centimeter of active cathode flow field area, inlet pressures of between 50 psig and 400 psig, and temperatures of between 30° C. and 80° C. Under such conditions, such cathode flow fields may develop a pressure drop between the fluidic inlet ports and the fluidic outlet ports thereof that is sufficient to reliably eject any liquid water that may accumulate within the cathode channels, while still providing sufficiently uniform gas flow across the cathode flow field, e.g., such as the pressure drops discussed herein.

GDL Design $CO_x$ electrolyzers may also benefit from use of cathode GDLs having particular characteristics and features that may assist with the transport of species between the MEA and flow field, including $CO_x$, dissolved bicarbonate/carbonate salts, water, and gaseous and dissolved generated byproducts. As noted earlier, a cathode GDL suitable for use in a $CO_x$ electrolyzer may include, for example, a fibrous substrate that provides structural support, e.g., to the catalyst layer in the MEA 1105 (see, e.g., FIG. 11A). In some implementations, the cathode GDL may include a fibrous substrate, e.g., backing paper, cloth, or felt, that is made of an electrically conductive material, e.g., carbon fiber, which provides structural support to a microporous layer (MPL). The fibrous substrate may, for example, be woven (cloth) or non-woven (paper or felt). The MPL may be a porous carbon layer that ensures intimate contact between the cathode GDL and the adjacent MEA (the MPL may be on a side of the cathode GDL that faces and contacts the MEA). Example MPL materials may include polymer-integrated or polymer-supported granular carbon layers, e.g., fluoropolymer-integrated or fluoropolymer-supported carbon particle layers.

Figure 79:
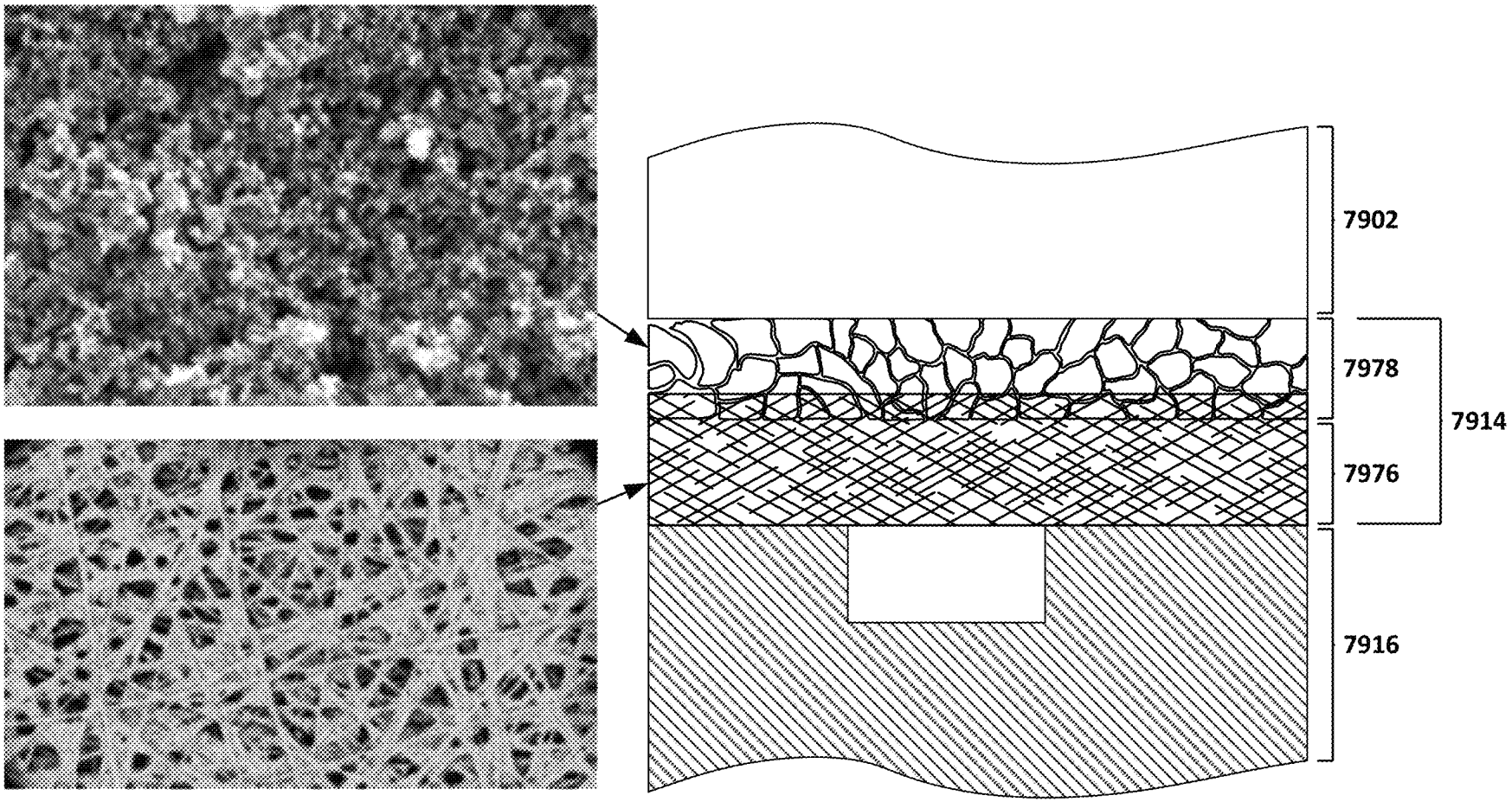
FIG. 79 depicts a side view of a gas diffusion layer.

FIG. 79 depicts a partial cross-section view of an example cathode GDL and portions of an MEA and cathode flow field. The MEA 7902 is shown without any internal or structural details, and the portion of the cathode flow field 7916 that is shown includes a representative channel cross-section. Sandwiched in between the cathode flow field 7916 and the MEA 7902 is the cathode GDL 7914, which includes a fibrous layer 7976 and a microporous layer 7978. The photographs at left are magnified views of representative examples of the fibrous layer 7976 and the microporous layer 7978.

During $CO_x$ electrolyzer operation, liquid water that is transported through the MEA from the anode side of the electrolyzer cell to the cathode side of the cell, as well as liquid water that is generated in the cathode side during $CO_x$ reduction, may pass through the cathode GDL and into the cathode flow field channels. The cathode GDL may be selected to have particular properties in order to facilitate and encourage such liquid water ejection from the cathode GDL while maintaining a plurality of open (not liquid-filled) passages for gas diffusion and convection through the GDL. For example, the cathode GDL may have polytetrafluoroethylene (PTFE) or other hydrophobic component(s) added to both the MPL and the fibrous substrate to make the MPL and the fibrous substrate more hydrophobic, which may promote liquid water ejection from the cathode GDL and prevent water in the flow field from diffusing or otherwise transporting back to the cathode layer.

The discussion below relates to GDLs used for the cathode GDL in a $CO_x$ electrolyzer, and, in some cases other electrolysis systems. In various of the embodiments described below the GDL includes one or more carbon components such as fibrous carbon, carbon powders at submicron scale, acetylene black, fullerene, Ketjen Black, polyacrylonitrile, and/or porous carbon. In certain embodiments, the carbon in a GDL has a density of about 75-1300 $m^2/g$.

As discussed above, GDLs may include a fibrous layer, also referred to as a backing layer, and a microporous layer (MPL). In some embodiments, the microporous layer may overlap with or extend into the backing layer to at least some extent. In some embodiments, the microporous layer and the backing layer are affixed to one another such that they resist delamination during handling, fabrication of an electrode, and/or electrolysis. In some $CO_x$ electrolyzers, the cathode GDL is arranged such that the MPL is in contact with or proximate to the MEA while the other side of the GDL is in contact with the cathode flow field.

There are commercial GDLs available that omit an MPL, but testing showed that in some $CO_x$ electrolyzers, such GDLs yielded poor performance. For example, in a test that was conducted using two similar GDLs, with one GDL having an MPL and the other not, the Faradaic yield of carbon monoxide (FY_CO) in the $CO_x$ electrolyzer dropped from about 90-100% to less than 75% in four hours and to less than 25% at around 9 hours when using the GDL without the MPL, whereas the $CO_x$ electrolyzer using the GDL with the MPL continuously produced at least about 90% FY_CO for 16 hours. At the same time, the electrolyzer cell voltage remained steady in the $CO_x$ cell when using the GDL with the MPL over 16 hours, while the voltage climbed steadily in the $CO_x$ electrolyzer when using the GDL without the MPL over the same duration of time. This difference is generally understood to be associated with improved access of $CO_2$ gas to the catalyst layer in the GDL having the MPL.

The GDL in a $CO_x$ electrolyzer, in combination with the cathode flow field, plays a significant role in the removal of water from the $CO_x$ electrolyzer cathode. GDLs that are selected or constructed so as to have particular characteristics may enhance the water ejection rates and/or capabilities of a $CO_x$ electrolyzer. As noted earlier, the ability of the MEA in a $CO_x$ electrolyzer to sustain the electrochemical reaction of $CO_2$ to $CO_x$ is hampered by the presence of liquid water, which is present in significant amounts during normal operation. If not adequately removed from the cathode, water degrades $CO_x$ electrolyzer performance by influencing the mass transport of gaseous species and facilitating the production of side products such as $H_2$ through the electrolysis of water.

GDLs are often designed for use in fuel cells, flow batteries, and/or water electrolyzers. While such GDLs are not optimized for use in $CO_x$ electrolyzers they can nonetheless sometimes be used in such contexts. The present inventors identified certain characteristics of GDLs that may be selected so as to provide a GDL that offers particularly effective performance in the $CO_x$ electrolyzer context. The performance of different GDLs in the $CO_x$ electrolyzer context often differs significantly from the performance of those same GDLs in other contexts, e.g., in fuel cells, flow batteries, and/or water electrolyzers. What works well in those other contexts may not work well in the $CO_x$ context, and vice-versa.

For example, in the fuel cell context, it is preferable to avoid the use of thick GDLs. Fuel cells, due to the conditions under which they operate, experience reduced diffusion of reactants through the GDL to the catalyst surface with increasing thickness of the GDL. As such, many GDLs that are commercially available are in the about 300 μm, e.g., 315 μm, or less thickness range, with some suppliers possibly offering GDLs up to about 400 μm, e.g., 410 μm. Higher-thickness GDLs are generally perceived to negatively impact the performance of fuel cells and manufacturers thus generally avoid making GDLs that are thicker than 300 μm, or at most 400 μm. It will be understood that references below to specific thicknesses or thickness ranges of cathode GDLs, unless indicated otherwise, refer to the uncompressed thicknesses of such GDLs. For commercially available GDLs, the uncompressed thicknesses thereof are the typical thickness parameters used to specify such GDLs.

In contrast, $CO_x$ electrolyzers employing thicker GDLs may not suffer from such performance degradation. $CO_x$ electrolyzers tend to operate at higher pressures and lower temperatures than fuel cells and, as such, may increase the production and/or retention of liquid water generation within the $CO_x$ electrolyzer cathode. However, somewhat unexpectedly, it was found that higher-thickness GDLs actually offer enhanced performance in the context of $CO_x$ electrolyzers.

For example, the present inventors tested and modeled the performance of several different types of GDLs in the context of $CO_x$ electrolyzers and found that increasing the thickness of the GDL, e.g., to thicknesses greater than those typically used in fuel cell GDLs, directly impacted the performance of $CO_x$ electrolyzers in a significant and beneficial way.

For example, when the thickness of a GDL was tripled from 252 μm to 756 μm (the GDL thickness in the model was representative of the compressed thickness of the GDLs, i.e., the thickness of the GDLs when preloaded/clamped within an electrolyzer stack) in the model and all other inputs were held constant (there were at least 11 parameters that could be changed or adjusted within the model), it was found that the model predicted a 12% increase in water vapor flux through the GDL and out the flow field. Water vapor can easily be evacuated from the $CO_x$ electrolyzer as part of the gaseous exhaust stream. While not wishing to be bound by theory, the increased water vapor flux was tied to the temperature gradient that the model indicated across the GDL. For example, the temperature at the interface between the cathode flow field and the GDL was 44° C. for both GDLs, but the temperature at the GDL/catalyst interface was 46.5° C. for the thinner GDL and 51.5° C. for the thicker GDL. The increased temperature differential may increase the water vapor flux.

Testing also showed that thicker GDLs, e.g., 350 μm or thicker (uncompressed and inclusive of MPL and backing layer) yielded more repeatable and higher performance than thinner, e.g., 200 μm (inclusive of MPL and backing layer) GDLs. For example, the Faradaic yield in a test $CO_x$ electrolyzer remained at about 95% or greater for three 45-hour performance runs for the thicker (350 μm or greater) GDL combinations while the thinner GDL (200 μm) saw an immediate reduction in performance from the beginning of the test, e.g., dropping below 90% within about 6 hours and below 85% within about 13 hours (and never recovering above 85% for the remainder of the test). All GDLs from this set of data had 25% by weight PTFE content in the backing layer and MPL. The thicker GDLs used in the tests included GDLs having uncompressed thicknesses in the 350 to 550 μm range, 950 to 1250 μm range, and 1350 to 1750 μm range (such GDLs were composed of multiple discrete GDLs that were arranged in a stacked configuration in order to obtain the desired thicknesses, as commercially available GDLs in such thicknesses were not available—presumably due to their detrimental performance in the context of fuel cells).

Testing also showed that thicker GDLs, e.g., 600 μm or thicker (uncompressed and inclusive of MPL and backing layer) yielded more repeatable and higher performance than thinner, e.g., 315 μm (inclusive of MPL and backing layer) GDLs. For example, the FY_CO in a test $CO_x$ electrolyzer remained at 95% or greater for two 28-hour performance runs for the thicker (600 μm) GDL while the thinner GDL (315 μm) saw comparable performance over a 15-hour period but then saw a significant and immediately apparent decrease in FY_CO performance when a second performance run was performed—dropping to 95% within about 6 hours, 90% within 11 hours, and about 85% within 21 hours. Both GDLs had 5% by weight PTFE content in the backing layer.

In this example, the thicker GDL was assembled by stacking two thinner, commercially available GDLs—one with an MPL and one without—so as to create a thicker GDL having MPL on one side (the side facing the MEA) and an expanse of backing layer on the other side (facing the cathode flow field). The backing layer portion of the stacked GDL had 5% by weight PTFE treatment throughout. The resulting 600 μm GDL was, to the inventors' knowledge and due to its thickness, a new type of GDL that was not previously available. The inventors thus created their own thick GDLs. The experiment revealed that such thicker GDLs, somewhat surprisingly, not only functioned when used in $CO_x$ electrolyzers, but also offered significant and unexpected performance benefits.

The increased thickness of the GDL, e.g., 400 μm or more uncompressed, results in a longer heat conduction path through the GDL, which may, in turn, lead to a higher temperature differential across the GDL due to heat generated in the MEA that travels through the GDL and into the cathode flow field. This increased temperature differential causes more heat to be transferred into liquid water that may be present within the GDL and causes an increased fraction of such liquid water to transition to (or remain in) the vapor phase, thereby facilitating its removal from the GDL and improving the Faradaic yield performance of the $CO_x$ electrolyzer.

A further test was performed with the 600 μm stacked GDL and another stacked GDL similar in construction to the 600 μm GDL but 880 μm thick (both uncompressed). In this further test, both GDLs were used in $CO_x$ electrolyzers for periods of nearly 70 consecutive hours. While both GDLs experienced performance drops of FY_CO over that timeframe, the thicker (880 μm thick) GDL dropped from about 97% to 90% FY_CO within about 20 hours compared to the about 45 hours that it took the somewhat thinner (but still comparatively thick) GDL to reach the same FY_CO. However, the 880 μm thick GDL then stabilized and consistently operated at between about 88% and about 90% FY_CO for 50 hours or more, while the 600 μm thick GDL's FY_CO performance never stabilized and, in fact, exhibited gradually accelerating degradation as time progressed. By 60 hours, the FY_CO of the 600 μm thick GDL had dropped below 88%, and by 68 hours it had dropped below 86%. Thus, the 880 μm thick GDL provided lower, although much more consistent, performance over the 70-hour test period as compared to the somewhat thinner 600 μm GDL, which offered increasingly lower FY_CO performance over time.

In accordance with various embodiments, a GDL on the cathode side of a $CO_x$ electrolyzer has an uncompressed thickness of at least about 300 μm, or at least about 400 μm, or at least about 501 μm. In some embodiments, a GDL on the cathode side of a $CO_x$ electrolyzer has a thickness of about 200 μm to 1000 μm, about 300 μm to 1000 μm, about 400 μm to 1000 μm, about 501 μm to 1000 μm, about 600 μm to 1000 μm, about 200 μm to 1600 μm, about 300 μm to 1600 μm, about 400 μm to 1600 μm, about 501 μm to 1600 μm, about 600 μm to 1600 μm, about 200 μm to 2000 μm, about 300 μm to 2000 μm, about 400 μm to 2000 μm, about 501 μm to 2000 μm, about 600 μm to 2000 μm, about 200 μm to 3000 μm, about 300 μm to 3000 μm, about 400 μm to 3000 μm, about 501 μm to 3000 μm, or about 600 μm to 3000 μm. In some alternative implementations, a GDL on the cathode side of a $CO_x$ electrolyzer may have an uncompressed thickness of about 350 to about 3000 μm, about 350 μm to about 1680 μm, about 1680 μm to about 3000 μm, about 350 μm to about 1010 μm, about 1010 μm to about 1680 μm, about 1680 μm to about 2340 μm, about 2340 μm to about 3000 μm, about 350 μm to about 681 μm, about 681 μm to about 1010 μm, about 1010 μm to about 1340 μm, about 1340 μm to about 1680 μm, about 1680 μm to about 2010 μm, about 2010 μm to about 2340 μm, about 2340 μm to about 2670 μm, or about 2670 μm to about 3000 μm. In some further alternative implementations, a GDL on the cathode side of a $CO_x$ electrolyzer may have an uncompressed thickness of about 400 to about 3000 μm, about 400 μm to about 1700 μm, about 1700 μm to about 3000 μm, about 400 μm to about 1050 μm, about 1050 μm to about 1700 μm, about 1700 μm to about 2350 μm, about 2350 μm to about 3000 μm, about 400 μm to about 725 μm, about 725 μm to about 1050 μm, about 1050 μm to about 1380 μm, about 1380 μm to about 1700 μm, about 1700 μm to about 2020 μm, about 2020 μm to about 2350 μm, about 2350 μm to about 2680 μm, or about 2680 μm to about 3000 μm. In some further alternative implementations, a GDL on the cathode side of a $CO_x$ electrolyzer may have a thickness of about 450 to about 3000 μm, about 450 μm to about 1720 μm, about 1720 μm to about 3000 μm, about 450 μm to about 1090 μm, about 1090 μm to about 1720 μm, about 1720 μm to about 2360 μm, about 2360 μm to about 3000 μm, about 450 μm to about 769 μm, about 769 μm to about 1090 μm, about 1090 μm to about 1410 μm, about 1410 μm to about 1720 μm, about 1720 μm to about 2040 μm, about 2040 μm to about 2360 μm, about 2360 μm to about 2680 μm, or about 2680 μm to about 3000 μm. In some implementations, GDLs having thicknesses as presented here include one or more MPLs and one or more backing layers.

Formation and Pre-Compression of GDL Stacks

Although the benefits of thicker GDLs are apparent, the use of multiple discrete GDLs arranged in a stacked configuration to produce such thicker GDLs presents challenges with consistently assembling and testing cells, whether in a single-cell structure or a multi-cell or cell stack configuration. For instance, due, at least in part, to the intentionally heterogenous nature of both the MPL layer and the fibrous substrate to ensure adequate porosity and permeability, commercially available GDLs typically exhibit thickness variations, which may range between about 0.0017 cm and about 0.04 cm with a porosity between about 70% and about 80% by volume. Such variance may be compounded when multiple discrete GDLs are stacked to form thicker GDLs. Not only do such thickness variations create obstacles in forming accurate stochastic microstructure models to computationally determine the efficacy of one GDL configuration over another, but the variations also thwart attempts to obtain consistent test results between similarly configured prototypes.

Moreover, the variability in thickness in commercially available GDLs can lead to undesirable dimensional changes when a stack of multiple discrete GDLs is compressed during cell assembly. For example, although an amount of dimensional change is to be expected when a porous or otherwise pliable medium is compressed, the variability in thickness of a GDL (or a stack of GDLs) can not only lead to eccentric axial loading, and thereby, uneven compression, but also lead to differences in localized breakage and displacement of fibers that exacerbate the issues discussed above. In addition, the eccentric axial loading and/or differences in localized breakage and displacement of fibers can lead to translational and/or rotational displacement of one or more GDLs relative to the active area of a cell during assembly. This can cause misalignments with or impingement of an adjacent flow field, adverse interaction with a gasket (e.g., reduction in fluidic seal), etc., that can degrade performance of a $CO_x$ electrolyzer cell. In the context of multi-cell stacks, unevenly compressed GDLs may cause compounding thickness inconsistencies that may result in assembly lean or flop, as well as the potential for over-compression to reduce such adverse conditions. It is also recognized that cell assembly may be accomplished more quickly and consistently when one thicker, pre-compressed GDL is utilized versus multiple discrete, uncompressed GDLs.

Figure 81:
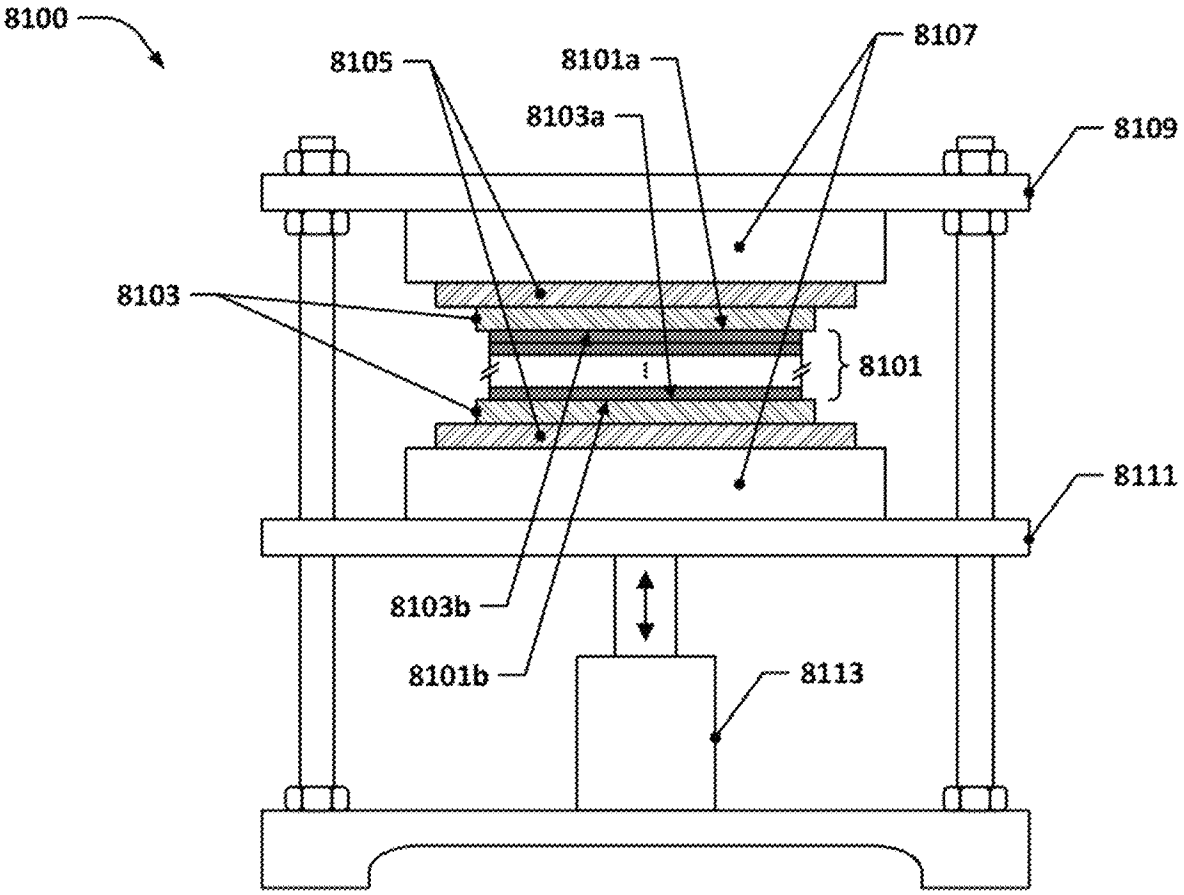
FIG. 81 depicts a partial cross-sectional view of an example apparatus to form a pre-compressed stack of gas diffusion layers.
Figure 82:
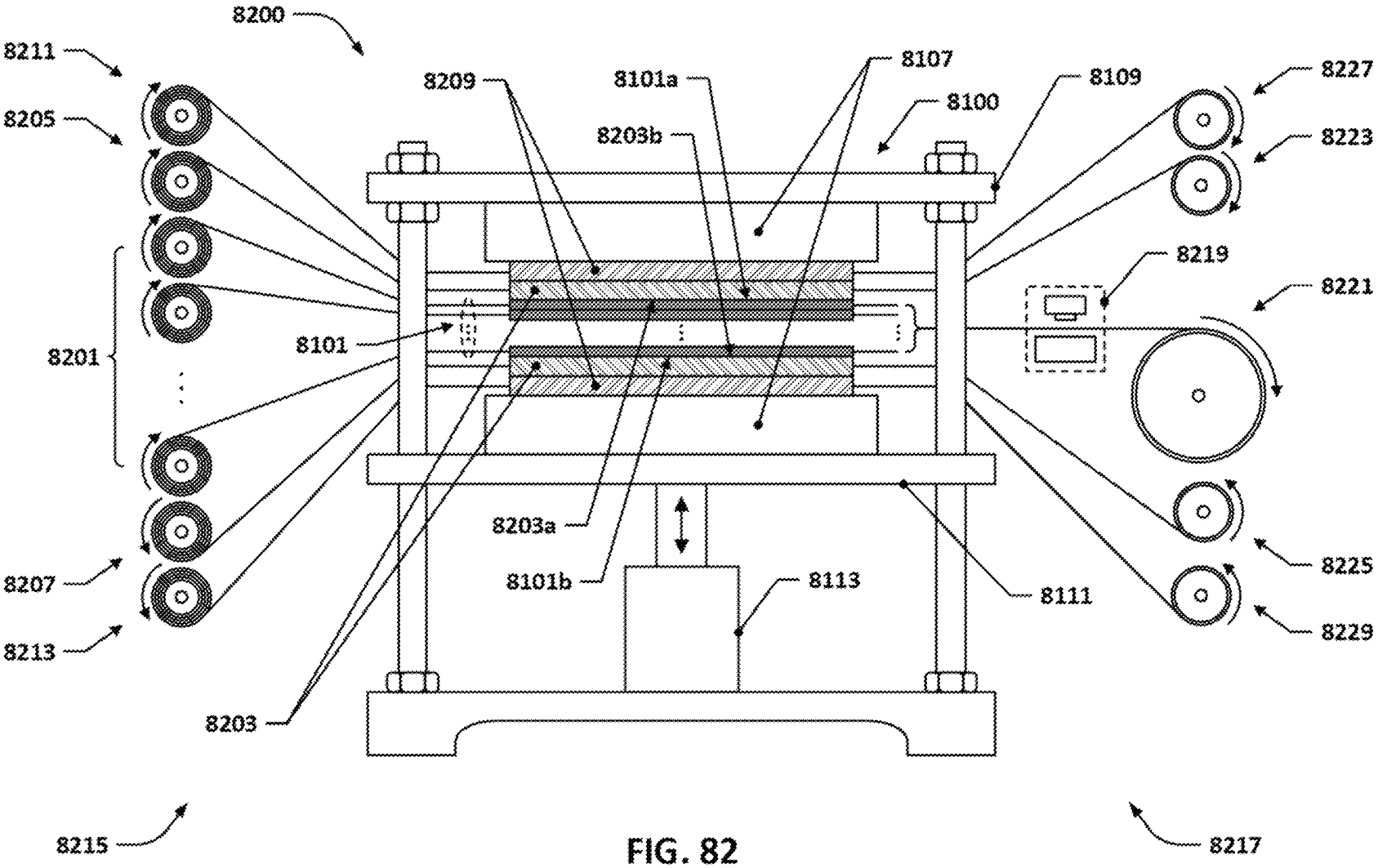
FIG. 82 depicts a partial cross-sectional view of an example roll-to-roll system to form a pre-compressed stack of gas diffusion layers.

In accordance with various embodiments, one or more compression operations may be performed on a stack of multiple discrete GDLs to adhere and pre-compress the GDLs before inclusion within a cell assembly. Adherence of the GDLs to one another prior to cell compression may mitigate the potential for translational and/or rotational displacement of one or more of the GDLs relative to another GDL or other GDLs in the stack. To that end, thickness variations can be reduced, and less dimensional change may occur as a cell is fully compressed as part of a stack assembly. In some implementations, compression operation(s) may be performed at ambient temperature. Testing has demonstrated that about 2 to 6 cycles of compression, with each cycle having a duration of about 3 minutes to about 7 minutes, typically yields a sufficient level of GDL adhesion, stack pre-compression, and thickness uniformity to address issues such as those noted above. In one specific example, testing demonstrated that 3 cycles of compression for a duration of about 5 minutes each yielded a sufficient level of GDL adhesion, stack pre-compression, and thickness uniformity to address the issues outlined above. In some embodiments, one or more hot press operations may be utilized to reflow (or at least soften), if present, the polyacrylonitrile, PTFE, and/or other hydrophobic (or hydrophilic) component(s) of the MPL and/or the fibrous substrate to enable more rapid pre-compression and adherence of the GDLs to one another. It is also contemplated that, if multiple compression cycles are performed, the stack of multiple discrete GDLs may be rotated between cycles to reduce the effects of non-parallelism between pressing platens and non-uniformity of heat application. In some cases, the application of a heated load to the stack of GDLs may be accomplished under similar conditions (e.g., orientation, pressure, temperature, etc.) as would exist when a cell is assembled or operated apart from the presence of other cell components. One or more example processes to form a pre-compressed stack of GDLs will be described in association with FIGS. 80, 81, and 82.

Figure 80:
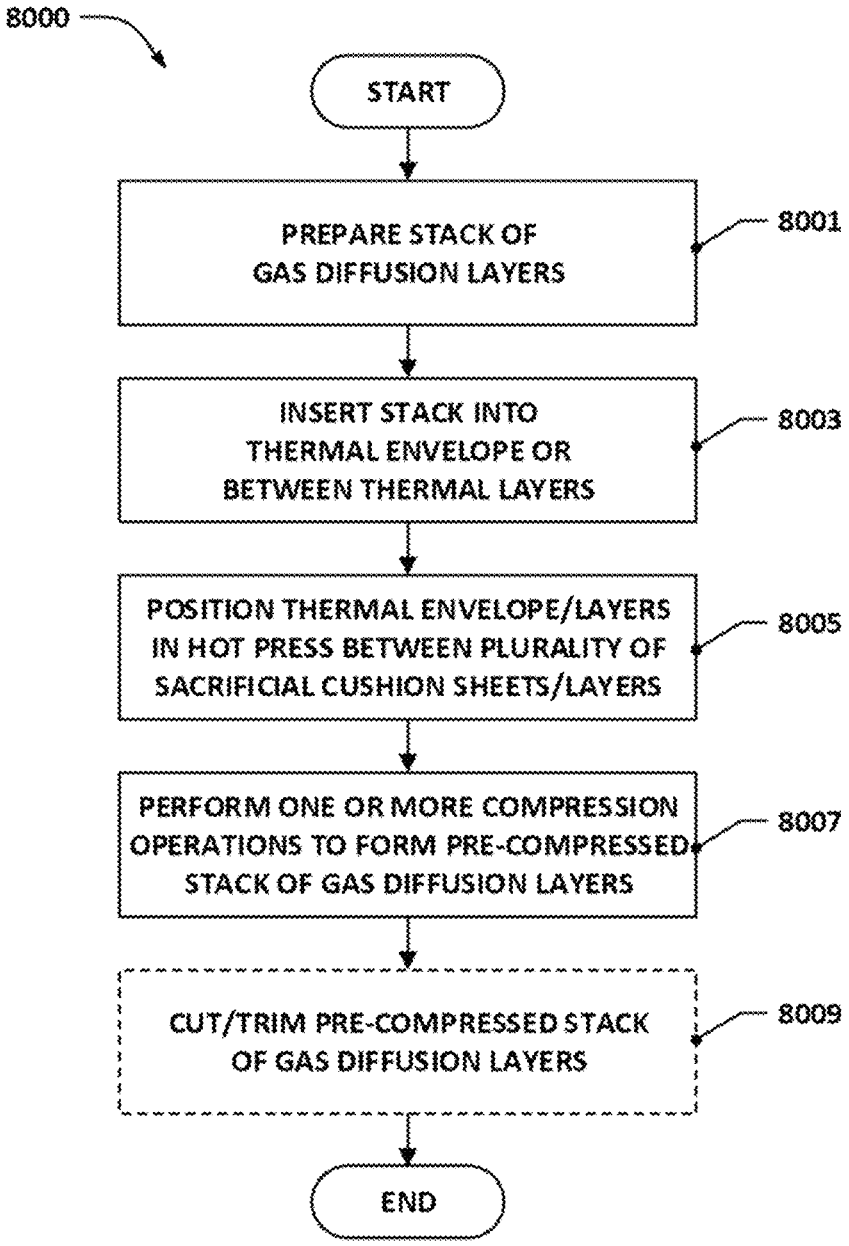
FIG. 80 depicts a flowchart of an example process to form a pre-compressed stack of gas diffusion layers.

FIG. 80 depicts a flowchart of an example process to form a pre-compressed stack of GDLs. Process 8000 of FIG. 80 will be described in association with FIGS. 81 and 82, which depict partial cross-sectional views of an example apparatus (e.g., apparatus 8100) and example system (e.g., roll-to-roll (R2R) system 8200) to form a pre-compressed stack of GDLs.

At step 8001, a stack of GDLs is prepared, such as stack 8101. For example, multiple discrete GDLs may be cut (e.g., die cut, laser cut, etc.) from a commercially available GDL source (such as a roll, sheet, etc.), and layered on one another in an orientation that would otherwise exist when the GDLs are assembled as part of a cell. For example, if the GDLs in question are directional, they may be stacked such that each GDL has a directionality that is orthogonal to the directionality of the GDL(s) immediately adjacent thereto. It is also contemplated that one or more discrete GDLs may be prepared as part of a stack with at least one pre-compressed GDL stack, or multiple pre-compressed GDL stacks may be utilized to prepare a thicker GDL stack. For descriptive convenience, it will be assumed that multiple discrete GDLs are prepared into stack 8101. In some embodiments, stack 8101 may be prepared from a plurality of input GDL rolls, such as input GDL rolls 8201, of R2R system 8200. This may not only increase manufacturing output but may also increase throughput via reductions in processing time. Depending on the type of commercially available GDL utilized and a desired thickness to be obtained, stack 8101 may include 2 to 10 discrete GDLs; however, any suitable number of GDLs may be utilized, such as 11 or more GDLs. In some embodiments, edges of the discrete GDLs may be aligned (or substantially aligned) with one another to form stack 8101.

Stack 8101 may be inserted, per step 8003, into thermal envelope 8103, such as an isothermal envelope, formed of a thermally reflective material(s). In some cases, thermal envelope 8103 may include opposing foil film covers formed of at least one of aluminum, copper, gold, silver, or the like. The foil film may have a thickness between about 0.006 mm and about 0.2 mm, between about 0.006 mm and about 0.1 mm, between about 0.1 mm and about 0.2 mm, between about 0.006 mm and about 0.054 mm, between about 0.054 mm and about 0.1 mm, between about 0.1 mm and about 0.15 mm, between about 0.15 mm and about 0.2 mm, between about 0.006 mm and about 0.03 mm, between about 0.03 mm and about 0.054 mm, between about 0.054 mm and about 0.079 mm, between about 0.079 mm and about 0.1 mm, between about 0.1 mm and about 0.13 mm, between about 0.13 mm and about 0.15 mm, between about 0.15 mm and about 0.18 mm, or between about 0.18 mm and about 0.2 mm. When inserted into thermal envelope 8103, exterior surfaces 8101*a* and 8101*b* of stack 8101 may be completely covered by corresponding interior surfaces 8103*a* and 8103*b* of thermal envelope 8103. In some embodiments, stack 8101 may be prepared between thermal layers 8203 provided via input rolls 8205 and 8207 of R2R system 8200. In this manner, exterior surfaces 8101*a* and 8101*b* of stack 8101 may be completely covered by surfaces 8203*a* and 8203*b* of thermal layers 8203. Thermal envelope 8103 and thermal layers 8203 may not only redirect and/or transfer heat uniformly (or substantially uniformly) during compression but may also prevent exterior surfaces 8101*a* and 8101*b* from adhering to surfaces 8103*a*, 8103*b*, 8203*a*, and 8203*b*. Further, it is not necessary that the layers of thermal envelope 8103 be attached to one another.

According to step 8005, thermal envelope 8103 including stack 8101 (or thermal layers 8203 with stack 8101 therebetween) may be positioned in apparatus 8100 between sacrificial cushion sheets 8105 (or sacrificial cushion layers 8209), which may be between compressing surfaces of apparatus 8100. In some embodiments, the compressing surfaces may be provided by platens (e.g., platens 8107), rollers, and/or any other suitable component. For descriptive convenience, it will be assumed that the compressing surfaces are provided by platens 8107. Sacrificial cushion layers 8209 may be provided via input rolls 8211 and 8213 of R2R system 8200. Sacrificial cushion sheets 8105 or layers 8209 may be formed of any suitably pliable material, such as PTFE, chlorotrifluoroethylene (E-CTFE), MIPELON™, perfluoroalkoxy (PFA), ethylene tetrafluoroethylene (ETFE), etc. A thickness of sacrificial cushion sheets 8105 or layers 8209 may be between about 0.254 mm and about 0.508 mm, between about 0.254 mm and about 0.38 mm, between about 0.38 mm and about 0.508 mm, between about 0.254 mm and about 0.32 mm, between about 0.32 mm and about 0.38 mm, between about 0.38 mm and about 0.44 mm, between about 0.44 mm and about 0.508 mm, between about 0.254 mm and about 0.29 mm, between about 0.29 mm and about 0.32 mm, or between about 0.32 mm and about 0.35 mm. In some implementations, the thickness of sacrificial cushion sheets 8105 or layers 8209 may be between about 0.35 mm and about 0.38 mm, between about 0.38 mm and about 0.41 mm, between about 0.41 mm and about 0.44 mm, between about 0.44 mm and about 0.48 mm, between about 0.48 mm and about 0.508 mm, between about 0.254 mm and about 0.27 mm, between about 0.27 mm and about 0.29 mm, between about 0.29 mm and about 0.3 mm, between about 0.3 mm and about 0.32 mm, between about 0.32 mm and about 0.33 mm, or between about 0.33 mm and about 0.35 mm. According to some embodiments, the thickness of sacrificial cushion sheets 8105 or layers 8209 may be between about 0.35 mm and about 0.37 mm, between about 0.37 mm and about 0.38 mm, between about 0.38 mm and about 0.4 mm, between about 0.4 mm and about 0.41 mm, between about 0.41 mm and about 0.43 mm, between about 0.43 mm and about 0.44 mm, between about 0.44 mm and about 0.46 mm, between about 0.46 mm and about 0.48 mm, between about 0.48 mm and about 0.49 mm, or between about 0.49 mm and about 0.508 mm. As such, sacrificial cushion sheets 8105 or layers 8209 may enable pressure applied to thermal envelope 8103 or layers 8203 (and, thereby, to stack 8101) via platens 8107 to be more uniformly (or substantially uniformly) distributed. This may mitigate issues associated with the variability in thickness of the multiple discrete GDLs of stack 8101 and/or some non-parallelism between platens 8107.

It is also noted that sacrificial cushion layers 8209 may reduce friction between platens 8107 and thermal layers 8203 in R2R system 8200. To this end, infeed portion 8215 of R2R system 8200, apparatus 8100, and/or outfeed portion 8217 of R2R system 8200 may include one or more mechanisms (e.g., brakes, motors, rollers, sensors, tensioners, etc.) to control web speed and tension in R2R system 8200, and, thereby, to control supply of source GDL, thermal layer, and sacrificial cushion layer materials to apparatus 8100.

In some embodiments, apparatus 8100 may be a hot press, such as a Carver™ hot press, a laminator, and/or any other suitable thermocompression device. As such, platens 8107 may be pre-heated to a setpoint between about 20° C. and about 80° C., between about 20° C. and about 50° C., between about 50° C. and about 80° C., between about 20° C. and about 35° C., between about 35° C. and about 50° C., between about 50° C. and about 65° C., between about 65° C. and about 80° C., between about 20° C. and about 28° C., between about 28° C. and about 35° C., between about 35° C. and about 42° C., between about 42° C. and about 50° C., between about 50° C. and about 57° C., between about 57° C. and about 65° C., between about 65° C. and about 72° C., between about 72° C. and about 80° C., between about 20° C. and about 24° C., between about 24° C. and about 28° C., between about 28° C. and about 31° C., between about 31° C. and about 35° C., between about 35° C. and about 39° C., between about 39° C. and about 42° C., between about 42° C. and about 46° C., between about 46° C. and about 50° C., between about 50° C. and about 54° C., between about 54° C. and about 57° C., between about 57° C. and about 61° C., between about 61° C. and about 65° C., between about 65° C. and about 69° C., between about 69° C. and about 72° C., between about 72° C. and about 76° C., or between about 76° C. and about 80° C.

According to step 8007, one or more compression operations may be performed to form a pre-compressed stack of GDLs. For example, apparatus 8100 may apply compressive force to stack 8101 by, for example, causing relative motion between press frames 8109 and 8111 via press 8113, which may be a hydraulically actuated cylinder. In some embodiments, one compression cycle is performed. In some implementations, multiple compression cycles are performed, such as 2 cycles to 10 cycles, e.g., 3 cycles to 7 cycles, for instance, 6 cycles to 8 cycles, such as 4 cycles, 5 cycles, or 9 cycles. To this end, compressive force of each cycle may be applied (e.g., progressively applied) to stack 8101 in any suitable fashion, e.g., linearly, stepwise, exponentially, or according to any other suitable pressure gradient. For example, pressure may be progressively applied from 0 psi to between about 100 psi and about 400 psi, between about 100 psi and about 250 psi, between about 250 psi and about 400 psi, between about 100 psi and about 180 psi, between about 180 psi and about 250 psi, between about 250 psi and about 320 psi, between about 320 psi and about 400 psi, between about 100 psi and about 140 psi, between about 140 psi and about 180 psi, between about 180 psi and about 210 psi, between about 210 psi and about 250 psi, between about 250 psi and about 290 psi, between about 290 psi and about 320 psi, between about 320 psi and about 360 psi, between about 360 psi and about 400 psi, between about 100 psi and about 120 psi, between about 120 psi and about 140 psi, between about 140 psi and about 160 psi, between about 160 psi and about 180 psi, between about 180 psi and about 190 psi, between about 190 psi and about 210 psi, between about 210 psi and about 230 psi, between about 230 psi and about 250 psi, between about 250 psi and about 270 psi, between about 270 psi and about 290 psi, between about 290 psi and about 310 psi, between about 310 psi and about 320 psi, between about 320 psi and about 340 psi, between about 340 psi and about 360 psi, between about 360 psi and about 380 psi, or between about 380 psi and about 400 psi. In some implementations, pressure may be progressively applied from 0 psi to between about 180 psi and about 220 psi, between about 180 psi and about 200 psi, between about 200 psi and about 220 psi, between about 180 psi and about 190 psi, between about 190 psi and about 200 psi, between about 200 psi and about 210 psi, between about 210 psi and about 220 psi, between about 180 psi and about 180 psi, between about 180 psi and about 190 psi, between about 190 psi and about 200 psi, between about 200 psi and about 200 psi, between about 200 psi and about 200 psi, between about 200 psi and about 210 psi, between about 210 psi and about 220 psi, between about 220 psi and about 220 psi, between about 180 psi and about 180 psi, between about 180 psi and about 180 psi, between about 180 psi and about 190 psi, between about 190 psi and about 190 psi, between about 190 psi and about 190 psi, between about 190 psi and about 200 psi, between about 200 psi and about 200 psi, between about 200 psi and about 200 psi, between about 200 psi and about 200 psi, between about 200 psi and about 200 psi, between about 200 psi and about 210 psi, between about 210 psi and about 210 psi, between about 210 psi and about 210 psi, between about 210 psi and about 220 psi, between about 220 psi and about 220 psi, or between about 220 psi and about 220 psi. For instance, pressure may be progressively applied from 0 psi to about 200 psi.

According to various embodiments, the maximum load of each cycle may be applied to stack 8101 for a total of between about 2 minutes and about 11 minutes, between about 2 minutes and about 6.5 minutes, between about 6.5 minutes and about 11 minutes, between about 2 minutes and about 4.2 minutes, between about 4.2 minutes and about 6.5 minutes, between about 6.5 minutes and about 8.8 minutes, between about 8.8 minutes and about 11 minutes, between about 2 minutes and about 3.1 minutes, between about 3.1 minutes and about 4.2 minutes, between about 4.2 minutes and about 5.4 minutes, between about 5.4 minutes and about 6.5 minutes, between about 6.5 minutes and about 7.6 minutes, between about 7.6 minutes and about 8.8 minutes, between about 8.8 minutes and about 9.9 minutes, between about 9.9 minutes and about 11 minutes, between about 2 minutes and about 2.6 minutes, between about 2.6 minutes and about 3.1 minutes, between about 3.1 minutes and about 3.7 minutes, between about 3.7 minutes and about 4.2 minutes, between about 4.2 minutes and about 4.8 minutes, between about 4.8 minutes and about 5.4 minutes, between about 5.4 minutes and about 5.9 minutes, between about 5.9 minutes and about 6.5 minutes, between about 6.5 minutes and about 7.1 minutes, between about 7.1 minutes and about 7.6 minutes, between about 7.6 minutes and about 8.2 minutes, between about 8.2 minutes and about 8.8 minutes, between about 8.8 minutes and about 9.3 minutes, between about 9.3 minutes and about 9.9 minutes, between about 9.9 minutes and about 10 minutes, or between about 10 minutes and about 11 minutes. For instance, the maximum load may be applied to stack 8101 for a total of about 5 minutes.

After stack 8101 is compressed for a set amount of time, a pre-compressed stack of GDLs is formed. The thickness and thickness variation of the pre-compressed stack of GDLs may be reduced relative to its uncompressed state by between about 1% and about 30%, between about 1% and about 16%, between about 16% and about 30%, between about 1% and about 8.2%, between about 8.2% and about 16%, between about 16% and about 23%, between about 23% and about 30%, between about 1% and about 4.6%, between about 4.6% and about 8.2%, between about 8.2% and about 12%, between about 12% and about 16%, between about 16% and about 19%, between about 19% and about 23%, between about 23% and about 26%, between about 26% and about 30%, between about 1% and about 2.8%, between about 2.8% and about 4.6%, between about 4.6% and about 6.4%, between about 6.4% and about 8.2%, between about 8.2% and about 10%, between about 10% and about 12%, between about 12% and about 14%, between about 14% and about 16%, between about 16% and about 17%, between about 17% and about 19%, between about 19% and about 21%, between about 21% and about 23%, between about 23% and about 25%, between about 25% and about 26%, between about 26% and about 28%, or between about 28% and about 30%. In some embodiments, the thickness and thickness variation of the pre-compressed stack of GDLs may be reduced relative to its uncompressed state by between about 15% and about 18%, between about 15% and about 16%, between about 16% and about 18%, between about 15% and about 16%, between about 16% and about 17%, between about 17% and about 18%, between about 15% and about 16%, between about 16% and about 17%, or between about 17% and about 18%. In some implementations, the thickness and thickness variation of the pre-compressed stack of GDLs may be reduced relative to its uncompressed state by between about 5.25% and about 9.5%, between about 5.25% and about 7.4%, between about 7.4% and about 9.5%, between about 5.25% and about 6.3%, between about 6.3% and about 7.4%, between about 7.4% and about 8.4%, between about 8.4% and about 9.5%, between about 5.25% and about 5.8%, between about 5.8% and about 6.3%, between about 6.3% and about 6.8%, between about 6.8% and about 7.4%, between about 7.4% and about 7.9%, between about 7.9% and about 8.4%, between about 8.4% and about 9%, or between about 9% and about 9.5%.

In some embodiments, the pre-compressed stack of GDLs may be optionally cut or trimmed to a predetermined size, per step 8009. For instance, a die cutter, laser cutter, wheel cutter, and/or the like may be utilized to cut or trim the pre-compressed stack of GDLs to a size appropriate for inclusion in a single or multi-cell stack assembly. In R2R system 8200, cutting mechanism 8219 may be positioned downstream from apparatus 8100 to cut appropriately sized pre-compressed stacks of GDLs from the output of apparatus 8100. Cutting mechanism 8219 may completely cut the appropriately sized pre-compressed stacks of GDLs from the output of apparatus 8100 or may form perforated cuts to enable the appropriately sized pre-compressed stacks of GDLs to be later removed from the output of apparatus 8100. Further, the output of apparatus 8100 and/or excess GDL material may be collected via output roller 8221. In a similar fashion, output rollers 8223 and 8225 may collect thermal layer material from the output of apparatus 8100. Output rollers 8227 and 8229 may collect sacrificial cushion material output from apparatus 8100.

Additional GDL Design Considerations

Another characteristic of GDLs that may be selected so as to enhance GDL performance in the $CO_x$ electrolyzer context is the thermal conductivity of the GDL. For example, the above-mentioned model was used to compare the predicted performance of two equal-thickness GDLs that only differed in their respective thermal conductivities, which was 0.2 W/mK in one GDL and doubled to 0.4 W/mK in the other. Halving the thermal conductivity resulted in an about 1.25 fold increase in temperature differential across the GDL, but also resulted in approximately a 105% increase in water vapor flux.

In accordance with various embodiments, a GDL on the cathode side of a $CO_x$ electrolyzer has an average thermal conductivity of at most about 0.5 W/mK or at most about 0.1 W/mK. In some embodiments, a GDL on the cathode side of a $CO_x$ electrolyzer has an average thermal conductivity of about 0.05 to 0.5 W/mK. In some implementations, GDLs having thermal conductivities as presented here include one or more MPLs and one or more backing layers.

In what may be at least somewhat related to the above observation regarding thermal conductivity, additional testing revealed that the presence of PTFE throughout the entire thickness of the backing layer of GDLs used in $CO_x$ electrolyzers provided a significant performance benefit. The inclusion of PTFE in the backing layer may have any of a number of beneficial effects, including, for example, altering the hydrophobicity of the backing layer. However, the inclusion of PTFE may also decrease the thermal conductivity of the backing layer since the PTFE has a significantly lower thermal conductivity than, for example, carbon fibers that may be used in the backing layer. The PTFE may, in effect, help insulate the carbon fibers, thus lowering the thermal conductivity of the GDL as a whole.

In tests of two thicker GDLs (both about 600 μm)—one of which had 5% by weight of PTFE throughout the backing layer material and one of which had about 280 μm of backing layer with no PTFE at all—and a thinner GDL (315 μm) with 5% by weight of PTFE in the backing layer, it was found that while both GDLs with 5% by weight PTFE throughout their entire backing layer thickness maintained relatively stable and high FY_CO performance over an 18 hour test interval (greater than 85% for the 315 μm GDL, but decreasing slowly over time; greater than 95% for the 600 μm GDL over the same period and decreasing at a much slower rate) as compared with the about 600 μm GDL having PTFE only within part of the backing layer thickness. The GDL that had a portion of the backing layer thickness PTFE-free saw its FY_CO level decrease to below 85% within less than 5 hours and below 60% before 7 hours had passed. The FY_CO using this GDL dropped to less than 20% by 12 hours.

Testing also suggested that increasing the weight percent/amount of PTFE that was present within the backing layer of a GDL provided a beneficial effect in $CO_x$ electrolyzers. In tests that were done with several GDLs, it was found that using GDLs with elevated levels of PTFE in the backing layer (e.g., 25% by weight as compared with 5% by weight) but comparable thicknesses resulted in a lower decay rate in Faradaic yield.

In accordance with various embodiments, a cathode side GDL of a $CO_x$ electrolyzer contains a hydrophobic additive. In some such cases, the GDL or a layer thereof includes a carbonaceous material and a hydrophobic additive. In some cases, the hydrophobic additive is a hydrophobic polymer such as a fluorinated or perfluorinated polymer (e.g., PTFE). In certain embodiments, a hydrophobic additive such as a perfluorinated polymer is present in both a GDL backing layer and an MPL (both contained in the GDL). In some configurations, the hydrophobic additive is present through the entire thickness of the GDL, including an MPL, a backing layer, and any other layer. In some embodiments, a hydrophobic additive such as a perfluorinated polymer is present in a GDL at concentration of at least about 5% by weight, or about 0.5% to 55% by weight.

In some instances, it may be beneficial to use layered GDLs that have different layers, each with a different morphology and/or a different composition. As an example, each of two or more layers may comprise a backing layer and a MPL. In some embodiments, two different layers have different hydrophobic additive contents, e.g., a GDL with an MPL and three different backing layers, each with a different hydrophobic additive content, e.g., MPL/layer A/layer B/layer C, with layer A having about 5%, layer B having about 10%, and layer C having about 20% (by weight) PTFE in them.

Based on the above results and various other observations, certain potentially desirable characteristics of GDLs for use in $CO_x$ electrolyzers were identified; these characteristics, summarized below, may be individually applicable but many or all of them may also be combinable to provide performance increases in excess of what any particular characteristic alone may be able to provide.

GDLs for use in $CO_x$ electrolyzers may, for example, provide enhanced performance when having characteristics such as any one or more of the following:

About 200 μm-2000 μm overall thickness, with thicknesses in the 400 μm to 2000 μm range, 501 μm to 2000 μm range, or 600 μm to 900 μm range being demonstrated to provide improved performance over thinner GDLs.

About 0.5%-55% by weight PTFE content in the backing layer, with PTFE content of at least about 25% by weight in the backing layer being shown to provide good performance.

An external water contact angle having a value of about 120° to 170°, and in some implementations greater than or equal to about 140°, measured within 60 seconds of application of water for the backing layer. While this characteristic may be governed by the PTFE content of the GDL backing layer, GDLs with backing layers containing a hydrophobic material other than PTFE (e.g., other fluorinated polymers) may offer performance similar to that obtained using GDLs having PTFE content as noted above if those non-PTFE GDLs have external water contact angles within the indicated range(s).

Backing layer or overall GDL porosity of about 35% to 90% or about 60% to 90%.

Backing layer fiber diameter of about 1 μm to 25 μm, e.g., about 5 μm to 15 μm.

GDL bulk density of about 0.1 $g/cm^3$ to 0.8 $g/cm^3$, with bulk densities of about 0.2 $g/cm^3$ to 0.4 $g/cm^3$, which showed increased performance over lower bulk densities.

GDL basic weight of about 50 $g/cm^2$ to 1000 $g/cm^2$, with basic weights of about 150 $g/cm^2$ to 300 $g/cm^2$ showing increased performance over lower basic weights.

GDL area-specific resistance of about 0.05 $m\Omega \cdot cm^2$ to 20 $m\Omega \cdot cm^2$ or about 0.05 $m\Omega \cdot cm^2$ to 5 $m\Omega \cdot cm^2$.

GDL in-plane resistivity of about 0.05 mΩ·m to 7 mΩ·m or about 0.05 mΩ·m to 2 mΩ·m.

GDL air permeability of about 1 Gurley-second to 1000 Gurley-seconds.

GDL compressibility of about 0% to 40%, e.g., 10% to 20%.

GDL thermal conductivity of about 0.05 W/mK to 0.5 W/mK or about 0.15 W/mK to 0.35 W/mK.

GDL break strength of about 1,000 N/m to 10,000 N/m, e.g. about 2,000 N/m to 4,501 N/m.

GDL stiffness of about 20 Taber stiffness units to 40 Taber stiffness units, e.g., 25-30 Taber stiffness units.

GDL tortuosity of about 1.5 to 5 (tortuosity being the ratio of actual path length taken by molecules through GDL between two points compared to straight-line distance between those two points).

Any of the above properties may apply separately to the MPL or backing layer. Or any of the above properties may apply to both the MPL and backing layer.

As noted above, $CO_x$ electrolyzers that use GDLs without MPLs may exhibit significantly degraded performance. Therefore, in some embodiments, at least one MPL is present in a GDL for use in a $CO_x$ electrolyzer. In some implementations, a GDL includes at least 1 MPL, such as 2, 3, 4, or 5 MPLs, but embodiments are not limited thereto.

In some implementations, MPLs for GDLs for $CO_x$ electrolyzer usage may have between about 15% and 55%, e.g., about 25%, by weight PTFE content. MPLs for GDLs for $CO_x$ electrolyzer usage may also have a thickness that is in the range of about 1% to 30% of the overall thickness of the GDL.

In some implementations, a GDL comprises a stack of GDL units, each stack comprising at least one MPL affixed to at least one backing layer. In some cases, a GDL comprises a stack of two GDL units, each containing at least one backing layer and one or both of the GDL units containing an MPL. In some cases, a GDL comprises a stack of three GDL units, each GDL unit containing at least one backing layer and at least one of the GDL units containing an MPL.

It will be understood that the GDLs discussed above, e.g., in the context of cathode GDLs, may be combined with the flow fields discussed above, e.g., in the context of cathode flow fields, in a $CO_x$ electrolyzer stack assembly. For example, the use of thicker GDLs (and/or GDLs with other characteristics discussed above) may result in higher water ejection rates from the MEAs of such an electrolyzer due to the higher water vapor flux that may occur in the context of $CO_x$ electrolyzer use. By coupling such GDLs with flow fields such as those discussed above, which may provide superior water removal capabilities, $CO_x$ electrolyzers may be made to operate more efficiently and with greater consistency and lower potential performance degradation due to decreased residual water retention.

One combination of the above GDL specifications that yields a high performing device has an uncompressed overall thickness of about 470-570 μm, with one microporous layer that is about 20-70 μm thick, with 25% PTFE dispersed within the microporous layer as well as the carbon fiber backing layer. This GDL may have a basis weight of about 85-90 g/m 2, bulk density of about 0.32-0.35 g/cm$^3$, break strength in the machine direction of about 2100-4200 N/m, stiffness in the machine direction of about 12-52 Taber, through-plane and in-plane air permeability of about 25-50 Gurley seconds, compressibility of about 11-17%, area-specific resistivity of about 11 mOhmcm 2, or any combination thereof. Note that combinations of these properties can describe various types of GDL arrangements including GDLs that comprise an MPL alone, a backing layer alone, and any stack including one or more backing layers and one or more MPLs. In some cases, the GDL having such combinations of properties comprises a stack of two more structures, each having at least one MPL and at least one backing layer.

PTL Design $CO_x$ electrolyzers may also benefit from use of anode PTLs having characteristics and features that may assist with the transport of species between an anode flow field (e.g., anode flow field 1111 in FIG. 11A) and an MEA (e.g., MEA 1105 in FIG. 11A), including an anolyte such as, for example, water and/or other aqueous solutions, as well as generated byproducts of one or more reduction processes. In general, an anode PTL (such as anode PTL 1109 in FIG. 11A) may exhibit basic characteristics of electrical conductivity, thermal conductivity, surface energy, mass transport, porosity, thickness, rigidity, tensile modulus/strength, corrosion resistance, elemental abundance and manufacturability (relating to cost) and the like; however, the anode PTL may exhibit some differences from a cathode GDL, such as cathode GDL 1121 in FIG. 11A.

For example, a PTL may have a thickness sufficient for mechanical support of an MEA under cathode-over-anode differential pressures and general compression when included as part of a stack (e.g., stack 500 in FIG. 5) and compressed via, for instance, stack hardware (e.g., tensioning members 527, threaded fasteners 529, first washers 531, and/or second washers 533). Accordingly, a structure of a PTL may be generally smooth and relatively flat so as to prevent (or otherwise reduce the likelihood of) puncturing of the MEA material under non-operating and operating conditions of a stack, such as stack 500 in FIG. 5. It is also noted that the environment adjacent to the anode side of an MEA may exhibit a pH of about 0 to about 7 and oxygen evolution potential of about 1.4 V to about 2.0 V. Such an environment may be rather oxidizing, and, consequently, can be relatively aggressive (or caustic) not only to typical carbon-based GDL materials, but also various transition metals, such as yttrium (Y), zirconium (Zr), molybdenum (Mo), technetium (Tc), tantalum (Ta), hafnium (Hf), ruthenium (Ru), rhodium (Rh), palladium (Pd), platinum (Pt), silver (Ag), cadmium (Cd), etc. This may lead to relatively high rates of corrosion. Thus, a PTL (such as anode PTL 1109 in FIG. 11A) may be formed of one or more relatively corrosion-resistant, electrically conductive materials, such as titanium (Ti), niobium (Nb), and/or the like. In some embodiments, the one or more relatively corrosion-resistant, electrically conductive materials may be pure (or substantially pure) materials, e.g., pure Ti, pure Nb, etc., but embodiments are not limited thereto. Further, the one or more materials of the PTL may be sintered, printed from particles, etched, drilled or otherwise fabricated into a porous structure.

According to various implementations, the porosity of the PTL (like anode PTL 1109 in FIG. 11A) may be configured to allow for sufficient wicking of water (or other anolyte) from the bulk of adjacent flow field channels (e.g., fluidic passages 8317 and 8525 in anode flow fields 1111 described in association with FIGS. 83, 84A, 84B, and 85A-85C) to an anode catalyst layer of an MEA (such as MEA 1105 in FIG. 11A). With this in mind, the one or more materials of a PTL may not be hydrophobic and may or may not have an electroplating coating, such as an electroplating coating of, for instance, platinum (Pt), iridium (Ir), ruthenium (Ru), and/or the like. It is noted, however, that an electroplating coating may provide benefits in decreasing the electrical contact resistance of a PTL, such as anode PTL 1109 in FIG. 11A.

In various embodiments, mean particle size (e.g., particle diameter) of one or more materials forming a PTL may be between about 25 μm and about 150 μm, and mean pore size (e.g., pore diameter) may, in some implementations, be between about 10 μm and about 120 μm. Porosity may, according to various embodiments, be between about 1% and about 90% by volume. In some cases, a contact resistance of the PTL may be between about 5 mΩ·cm$^{-2}$ and about 50 mΩ·cm$^{-2}$, and current density may, according to various implementations, be between about 0 mA·cm$^{-2}$ and about 2000 mA·cm$^{-2}$. An average thickness of the PTL may, according to some embodiments, be between about 100 μm and about 2000 μm.

Additional Implementations

As previously discussed, overall multi-cell stack performance may be at least partially affected by the uniformity of electrical efficiency and product selectivity across the plurality of cells of a multi-cell stack. This uniformity may very often be driven by the uniformity of gas flow delivery to/across each of the plurality of cells. To this point, the provisioning of input fluids (e.g., water, gaseous $CO_x$, etc.) to the plurality of cells, in that it relates to flow field pressure drop, may have a large effect on overall stack flow uniformity that may become more of an issue with increasing numbers of cells in a multi-cell stack. This is at least because the flow uniformity may improve when the pressure drop across/through the plurality of cells of a multi-cell stack is about an order of magnitude more than any pressure difference between discrete locations along a plenum where collective flow is distributed into individual cells within a multi-cell stack. Moreover, as more and more cells are included as part of a multi-cell stack, managing combined axial expansion of the plurality of cells may become more of an issue to ensure proper alignment between stack components and uniform fluid flow. Accordingly, one or more additional implementations, one or more of which may be utilized in association with stack 500 (see FIG. 6), will be described below and that may account for such considerations.

Figure 91:
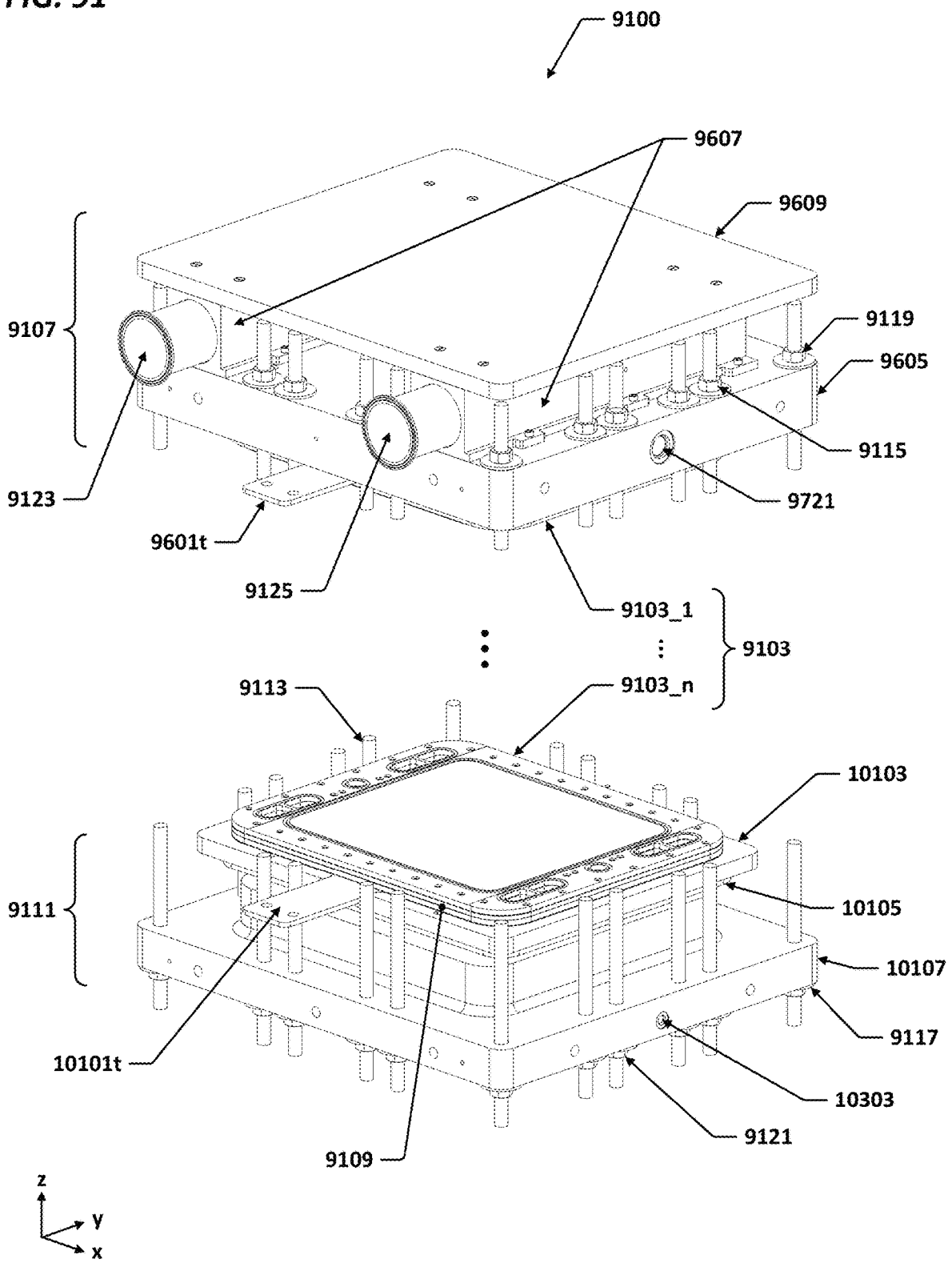
FIG. 91 depicts a perspective view of an example multi-cell $CO_x$ electrolyzer stack.
Figure 92:
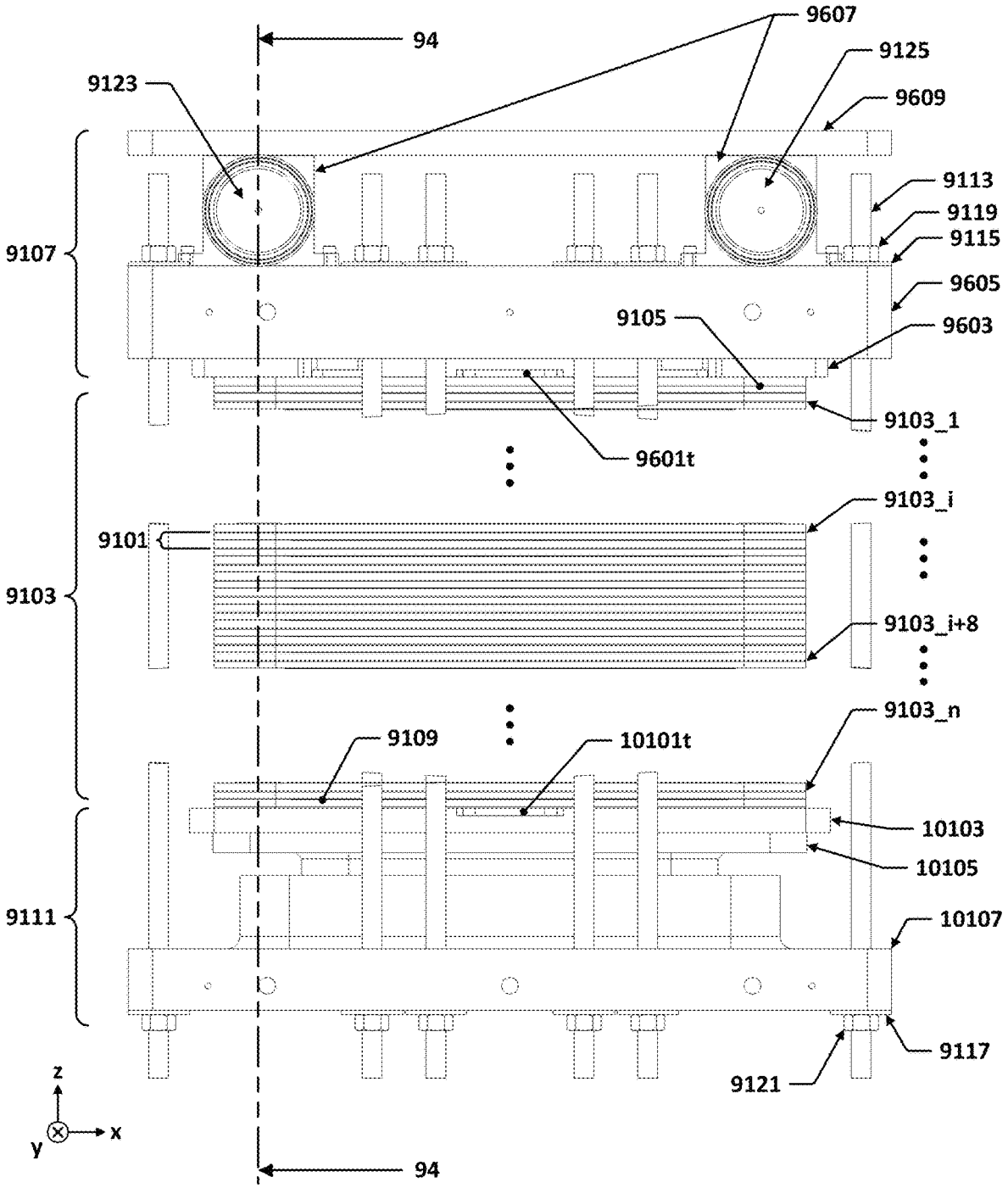
FIGS. 92 and 93 depict respective side views of the example multi-cell $CO_x$ electrolyzer stack of FIG. 91.
Figure 93:
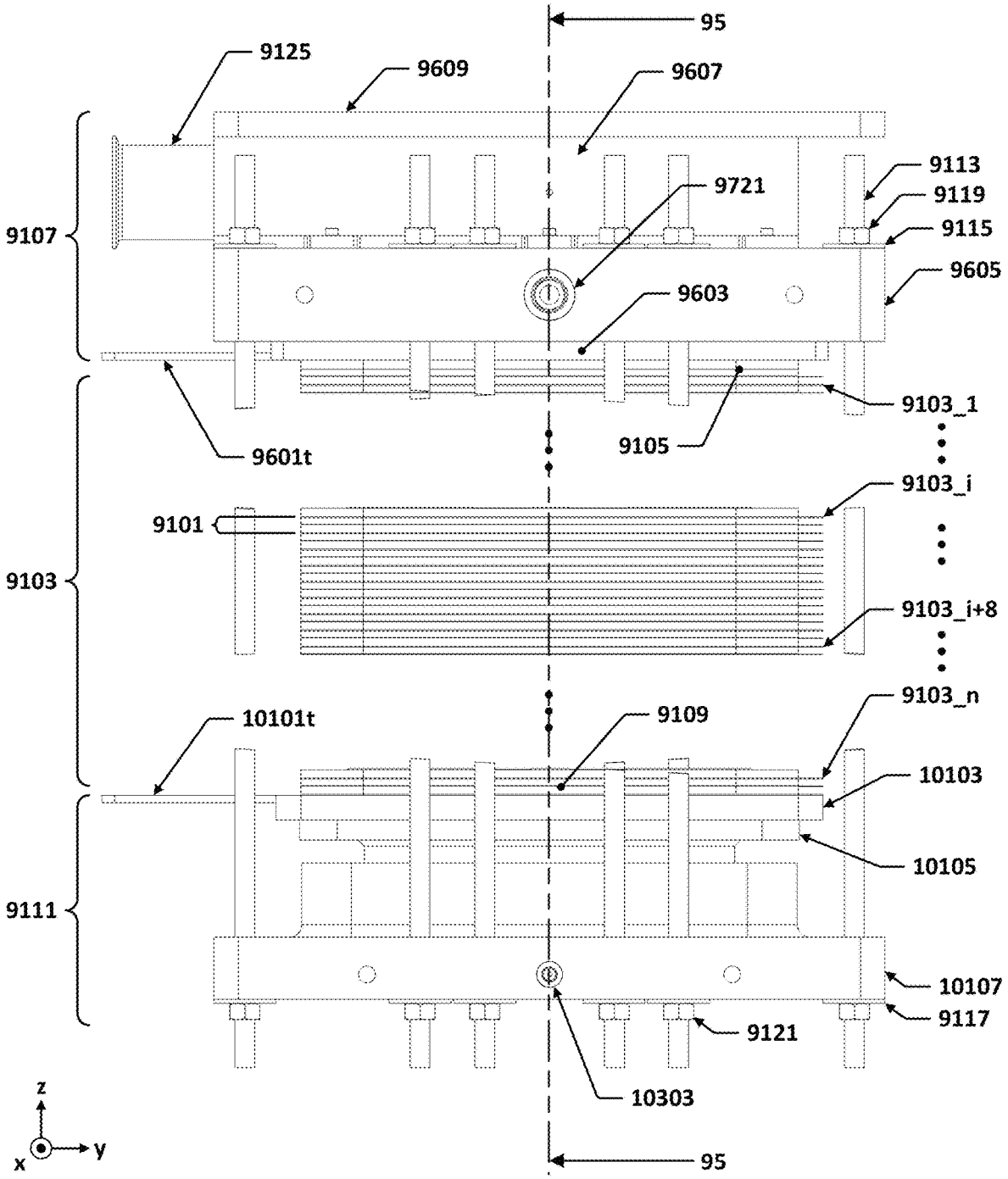
Figure 94:
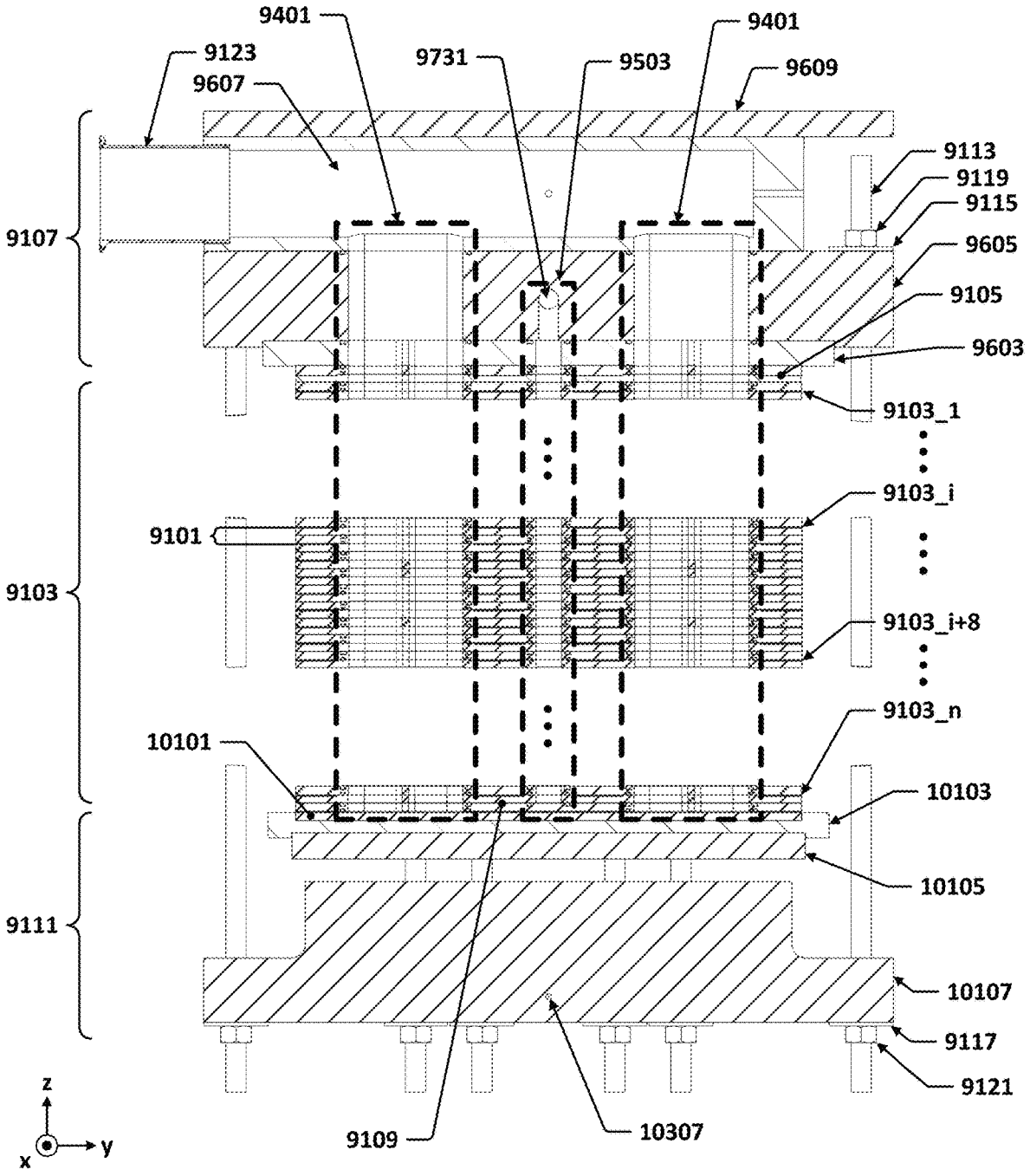
FIGS. 94 and 95 depict respective cross-sectional views the example multi-cell $CO_x$ electrolyzer stack of FIG. 91 respectively taken along sectional lines 94-94 and 95-95.
Figure 95:
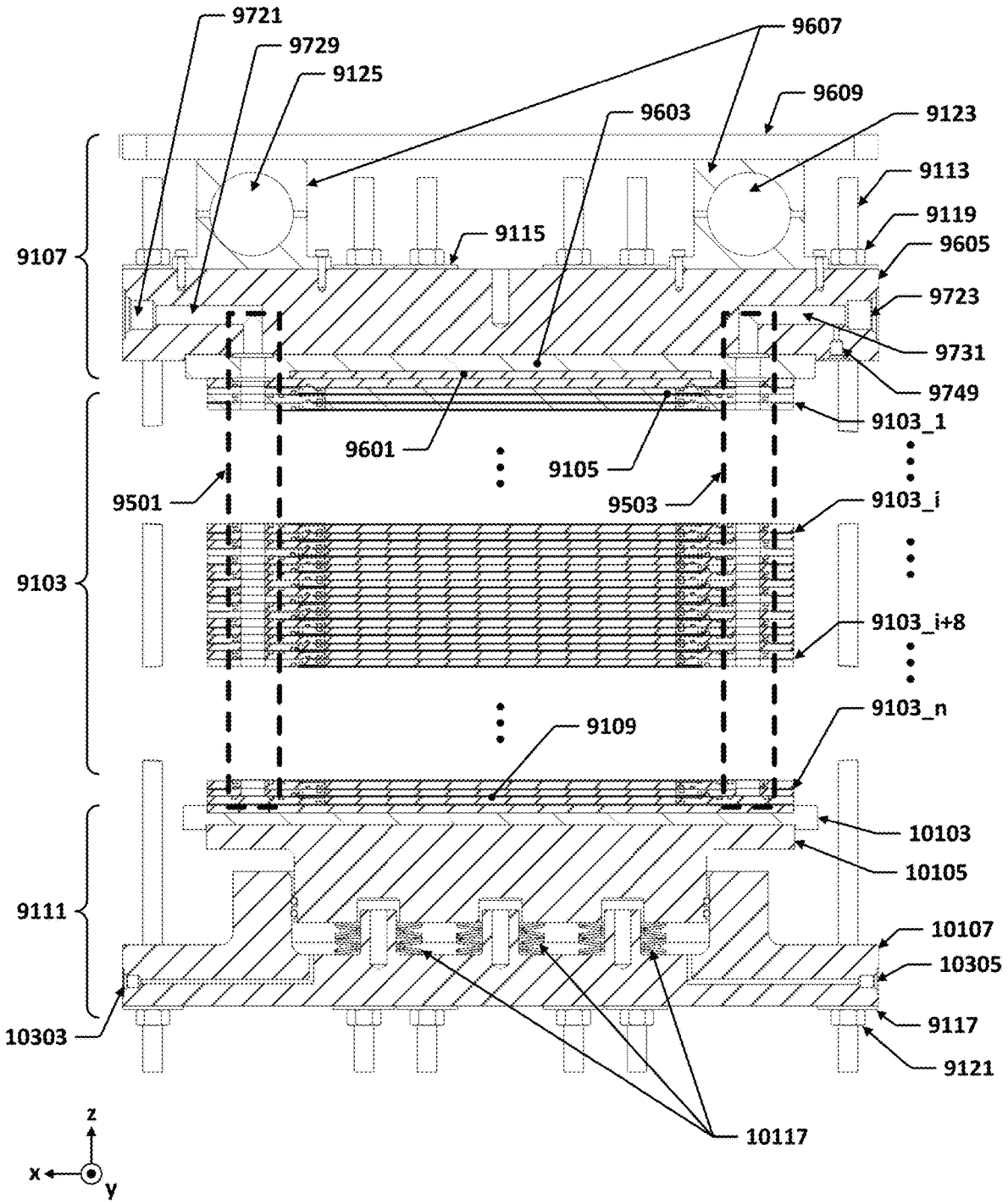

FIG. 91 depicts a perspective view of an example multi-cell $CO_x$ electrolyzer stack. FIGS. 92 and 93 depict respective side views of the example multi-cell $CO_x$ electrolyzer stack of FIG. 91. FIGS. 94 and 95 depict respective cross-sectional views the example multi-cell $CO_x$ electrolyzer stack of FIG. 91 respectively taken along sectional lines 94-94 and 95-95.

Referring to FIGS. 91-95, multi-cell $CO_x$ electrolyzer stack (or stack) 9100 includes a plurality of $CO_x$ electrolyzer cells (or cells), such as cell 9101, formed by stacking a plurality of repeat units 9103 (individually referenced as repeat units 9103_1 to 9103_*n*, where "n" is an integer greater than or equal to one and "i" is an integer greater than one and less than "n") between cathode interface assembly 9105 adjacent to port side assembly 9107 and anode interface assembly 9109 adjacent to piston side assembly 9111. In one embodiment, stack 9100 may include 50 or more repeat units 9103, but it is contemplated that any suitable number of repeat units 9103 may be utilized. In a manner similar to stack 500 described in association with at least FIGS. 5-10, any given cell among the plurality of $CO_x$ electrolyzer cells of stack 9100 may be formed by the conjunction of 1) cathode interface assembly 9105 (which includes MEA 1105 (see, e.g., cathode interface assembly 505 in FIGS. 17 and 18)) and anode components 1101 of repeat unit 9103_1 (see, e.g., anode components 1101 in FIG. 11A); 2) cathode components 1103 (which include MEA 1105 (see, e.g., cathode components 1103 in FIG. 11A)) of a first repeat unit (e.g., repeat unit 9103_1) and anode components 1101 (see, e.g., anode components 1101 in FIG. 11A) of a second repeat unit (e.g., repeat unit 9103_2) adjacent to the first repeat unit; or 3) cathode components 1103 (see, e.g., cathode components 1103 in FIG. 11A) of repeat unit 9103_*n* and anode interface assembly 9109. Accordingly, the MEA of any given cell among the plurality of $CO_x$ electrolyzer cells may be configured to facilitate a $CO_x$ reduction process, such as described in association with one or more of FIGS. 1 to 4.

It is to be appreciated that cell 9101, repeat units 9103, cathode interface assembly 9105, and anode interface assembly 9109 of stack 9100 may be configured and function equivalent (or substantially equivalent) to cell 501, repeat units 503, cathode interface assembly 505, and anode interface assembly 509 of stack 500 at least described in association with FIGS. 5-10. Further, tensioning members 9113, first and second washers 9115 and 9117, and threaded fasteners 9119 and 9121 may be configured and function equivalent (or substantially equivalent) to tensioning members 527, first and second washers 531 and 533, and threaded fasteners 529 of stack 500 at least described in association with FIGS. 5-10. As such, duplicative descriptions for cell 9101, repeat units 9103, cathode interface assembly 9105, anode interface assembly 9109, tensioning members 9113, first and second washers 9115 and 9117, and threaded fasteners 9119 and 9121 will be primarily omitted to avoid obscuring embodiments described herein. Moreover, some differences between the various components of port side assembly 9107 and piston side assembly 9111 of stack 9100 vis-à-vis port side assembly 507 and bladder side assembly 511 of stack 500 may be described below in association with FIGS. 96-109.

Port Side Assembly

Figure 96:
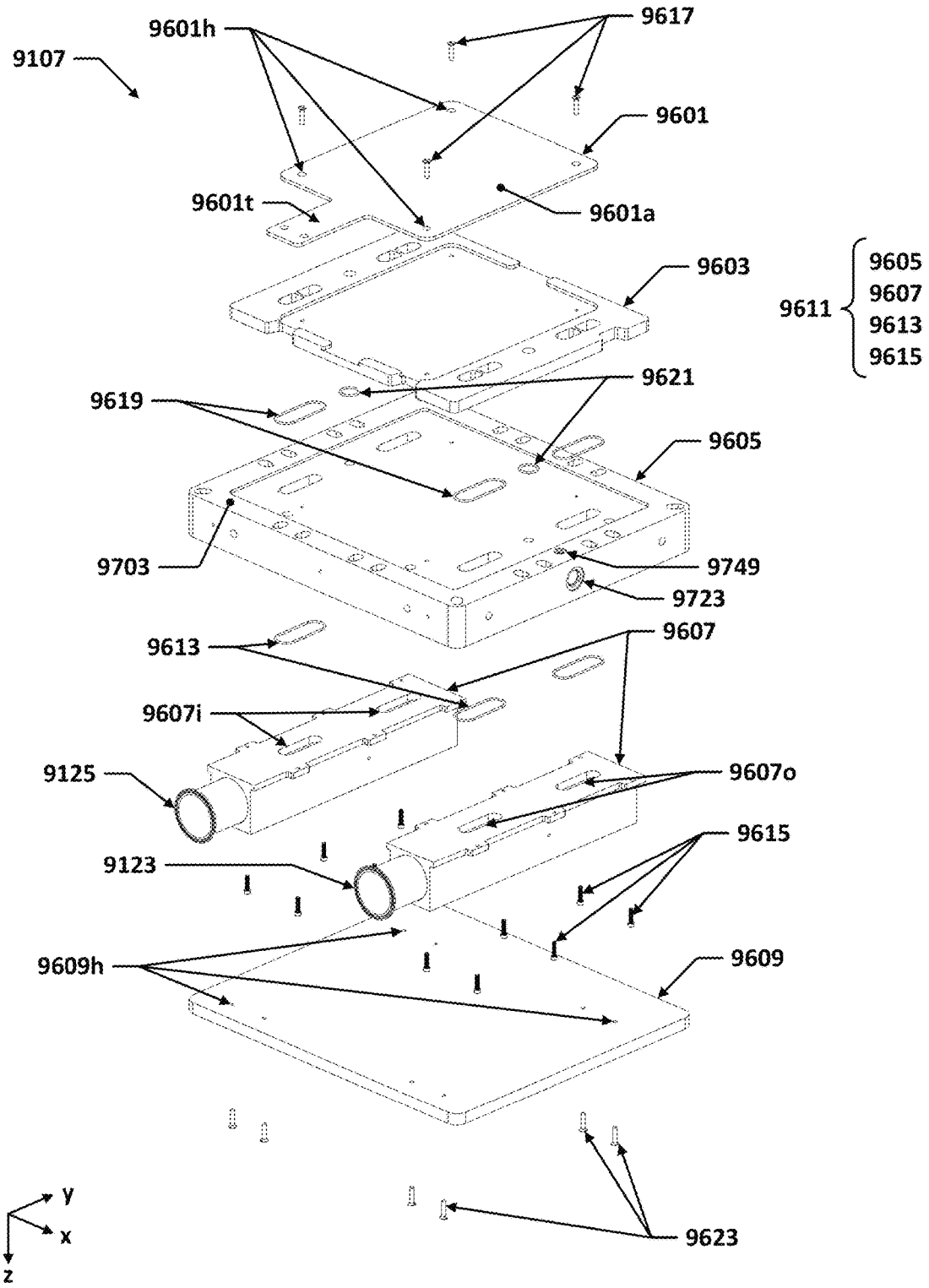
FIG. 96 depicts a perspective view of an example port side assembly of the example multi-cell $CO_x$ electrolyzer stack of FIG. 91.

FIG. 96 depicts a perspective view of an example port side assembly of the example multi-cell $CO_x$ electrolyzer stack of FIG. 91.

Referring to FIGS. 91-96, port side assembly 9107 may include bus plate 9601, insulation plate 9603, manifold block 9605, manifold runners 9607, and capping plate 9609 sequentially stacked from a first side of cathode interface assembly 9105 in a first direction, e.g., an axial direction, which may extend parallel to the z-axis direction shown in at least FIGS. 91-104 and 107. Hereinafter, reference to the axial direction should be understood as referring to the z-axis direction. It is noted that the first side of cathode interface assembly 9105 may face away from the plurality of repeat units 9103. Among other functions, port side assembly 9107 may at least be configured to provide one or more reactants to the cells to feed the $CO_x$ reduction process and output one or more byproducts from the cells in association therewith.

Bus plate 9601 may be equivalent (or substantially equivalent) to bus plate 513 of stack 500 (see, e.g., FIGS. 5-10), except bus plate 9601 may include a plurality of fastener orifices 9601*h*, which may be countersunk with respect to surface 9601*a* of bus plate 9601. Insulation plate 9603 may be equivalent (or substantially equivalent) to insulation plate 517 of stack 500 (see, e.g., FIGS. 5-10), but differences will be described below in association with FIGS. 99 and 100. Manifold assembly 9611 may be similar to manifold assembly 515 of stack 500 (see, e.g., FIGS. 5-10 and 12-16), but differences will be described below in association with FIGS. 96-98.

Port Side Assembly—Manifold Block

Figure 97:
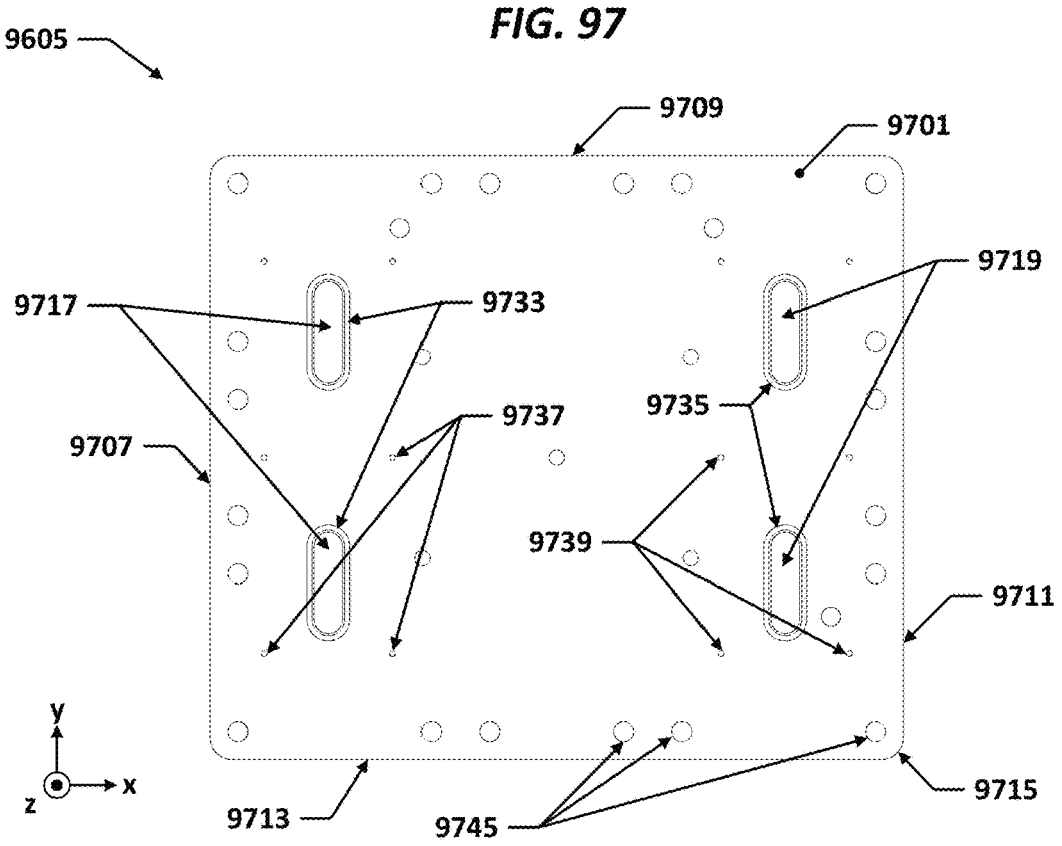
FIGS. 97 and 98 depict top and bottom plan views of an example manifold block of the example port side assembly of FIG. 96.
Figure 98:
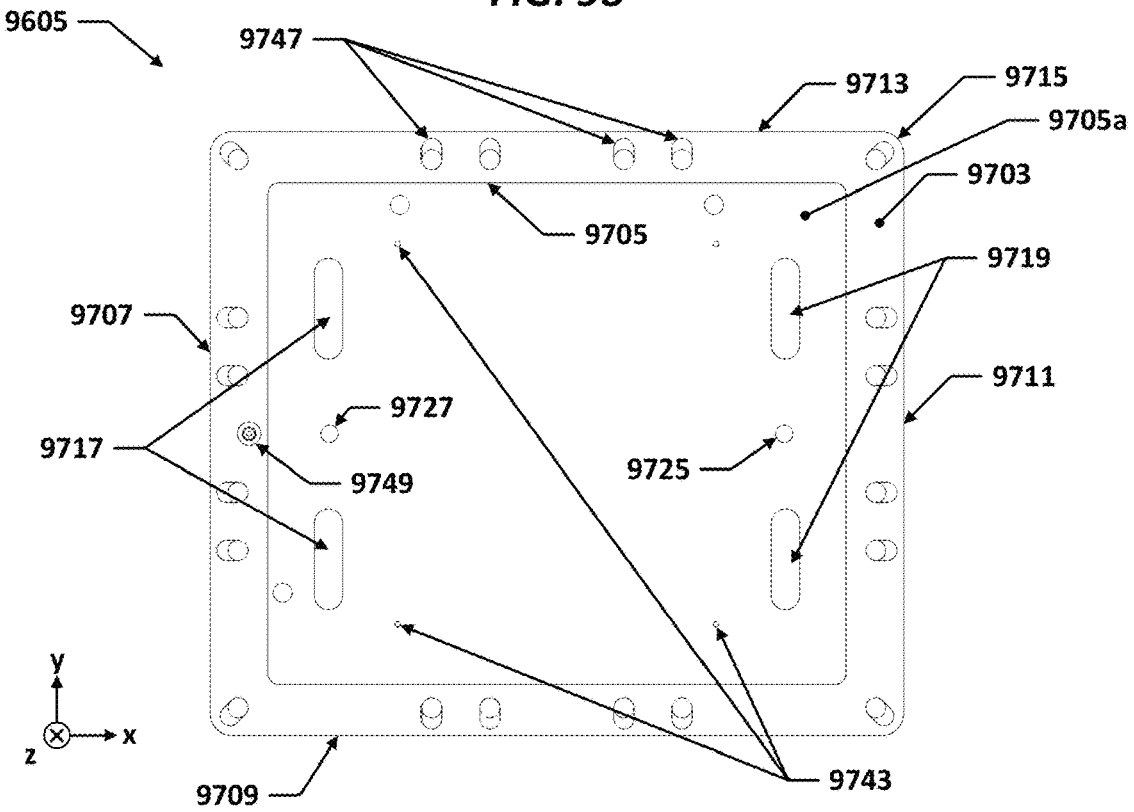

FIGS. 97 and 98 depict top and bottom plan views, respectively, of an example manifold block of the example port side assembly of FIG. 96.

Similar to manifold assembly 515 described in association with at least FIGS. 5-10 and 12-16, manifold assembly 9611 may be configured to provide one or more reactants to the plurality of cells of stack 9100 (see FIG. 91) to feed the $CO_x$ reduction process(es), as well as configured to expel one or more byproducts of the $CO_x$ reduction process(es) from the plurality of cells of stack 9100 (see FIG. 91). As such, manifold assembly 9611 may include manifold block (or main body) 9605, input and output manifold runners 9607, and one or more inlet and outlet connectors (or couplings) similar to second fluidic inlet and outlet connectors 547 and 549 of manifold assembly 515 of stack 500 (see, e.g., FIG. 5).

Referring to FIGS. 96-98, main body 9605 may be a generally rectangular plate-shaped body having first surface 9701 opposing second surface 9703 in the axial direction. Although main body 9605 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, main body 9605 will be described in association with a generally rectangular configuration. When assembled as part of stack 9100 (see FIG. 91), first surface 9701 may interface with input and output manifold runners 9607, whereas second surface 9703 may include recess 9705 configured to face and interface with insulation plate 9603. First and second surfaces 9701 and 9703 may be bounded by various peripheral surfaces (or surfaces) 9707, 9709, 9711, and 9713 that may be connected to one another via one or more other peripheral surfaces, such as peripheral surface (or surface) 9715. Embodiments, however, are not limited to the aforementioned configuration, and main body 9605 may be formed having any other suitable geometric configuration.

In some embodiments, main body 9605 may include first fluidic inlet and outlet ports 9717 and 9719 in surfaces 9701 and 9705*a* of recess 9705 that are configured to interface with corresponding outlet and inlet ports 9607*o* and 9607*i* of inlet and outlet manifold runners 9607, and second fluidic inlet and outlet ports 9721 and 9723 (see FIG. 95) in peripheral surfaces 9711 and 9707 that are configured to interface with fluidic inlet and outlet connectors similar to fluidic inlet and outlet connectors 547 and 549 of manifold assembly 515 (see FIG. 5). It is noted that inlet and outlet manifold runners 9607 may include inlet port 9123 as a start of one or more fluidic inlet passages 9401 (see FIG. 94) to supply, for instance, water to the anode sides of the plurality of cells of stack 9100 (see FIG. 91), and outlet port 9125 as an end of one or more fluidic outlet passages configured to expel, for instance, water from the anode sides of the plurality of cells of stack 9100 (see FIG. 91). It is noted that the one or more fluidic outlet passages may be similar to the one or more fluidic inlet passages 9401 (see FIG. 94), but may interface with outlet port 9125 versus inlet port 9123. Further, second fluidic inlet and outlet ports 9721 and 9723 may include corresponding threaded regions to engage with respective threaded regions of the inlet and outlet connectors similar to fluidic inlet and outlet connectors 547 and 549 (see, e.g., FIG. 5). Alternatively, the fluidic inlet and outlet connectors may be respectively welded, e.g., sweat welded, to second inlet and outlet ports 9721 and 9723 or otherwise coupled to second inlet and outlet ports 9721 and 9723. In this manner, second inlet port 9721 may form a starting portion of fluidic inlet passage 9501 (see FIG. 95) configured to supply, for example, gaseous $CO_x$ to the cathode sides of the plurality of cells of stack 9100 (see FIG. 91), and second outlet port 9723 may form an ending portion of fluidic outlet passage 9503 (see FIG. 95) configured to output one or more byproducts of the $CO_x$ reduction process of the plurality of cells of stack 9100 (see FIG. 91). Second fluidic inlet and outlet ports 9721 and 9723 (see FIG. 95) may be fluidically connected to corresponding third fluidic outlet and inlet ports 9725 and 9727 in surface 9705*a* via respective connecting passages 9729 and 9731 (see FIG. 95).

First surface 9701 may further include recesses 9733 and 9735 respectively encircling first fluidic inlet and outlet ports 9717 and 9719. Recesses 9733 and 9735 may be configured to receive and interface with corresponding ones of manifold runner gaskets 9613. As such, when inlet and outlet manifold runners 9607 are coupled to main body 9605 via, for example, threaded fasteners 9615, manifold runner gaskets 9613 may form corresponding fluidic seals between main body 9607 and manifold runners 9607, as well as form corresponding fluidic seals around first fluidic inlet and outlet ports 9717 and 9719. Although described as threaded fasteners, threaded fasteners 9615 may be any other suitable fastening mechanism(s), such as clips, latches, rivets, welds, etc. To this end, main body 9605 may further include fastener orifices 9737 and 9739 to engage with threaded fasteners 9615 when inlet and outlet manifold runners 9607 are coupled to main body 9605. In some cases, fastener orifices 9737 and 9739 may be threaded or otherwise configured to interface with threaded fasteners 9615.

In some embodiments, surface 9703 of main body 9605 may include recessed region 9705 configured to receive at least a portion of insulation plate 9603 therein when manifold assembly 9611 is incorporated as part of stack 9100 (see, e.g., FIGS. 91-95). Recessed region 9705 may terminate at surface 9705*a*, which may include one or more threaded openings 9743 extending into main body 9605 that are configured to threadedly engage with fasteners 9617 (e.g., flatheaded machine screws or any other suitable fastening mechanism(s)), which may be utilized to couple bus plate 9601 and insulation plate 9603 to manifold assembly 9611. Further, when manifold assembly 9611 is incorporated as part of stack 9100 and insulation plate 9603 is received in recessed region 9705 (see also FIGS. 91-95), respective fluidic seals may be formed between main body 9605 and insulation plate 9603 around first fluidic inlet and outlet ports 9717 and 9719 via gaskets 9619. Similarly, respective fluidic seals may be formed between main body 9605 and insulation plate 9603 around second fluidic outlet and inlet ports 9727 and 9725 via gaskets 9621.

Main body 9605 may further include first and second fastener orifices 9745 and 9747 arranged about a periphery of main body 9605 at one or more intervals. First and second fastener orifices 9745 and 9747 may be physically connected to one another to allow tensioning members 9113 (see, e.g., FIGS. 91-95) to pass therethrough. In this manner, main body 9605 may also function as a load-spreading member similar to end plate 519 in stack 500 (see, e.g., FIGS. 5-10). As such, main body 9605 and end plate 10107 of stack 9100 may be coupled to one another via tensioning members 9113, first and second washers 9115 and 9117, and threaded fasteners 9119 and 9121 (see, e.g., FIGS. 91-95). In some embodiments, first fastener orifices 9745 may form generally circular openings in surface 9701, and second fastener orifices 9747 may form generally oval (or generally elliptical) openings in surface 9703, but any other suitable geometric configuration may be utilized in association with first and second fastener orifices 9745 and 9747. During operation of stack 9100 (see FIG. 91), the oval shape of the openings of second fastener orifices 9747 may allow some lateral displacement of tensioning members 9113 to prevent undue stress being applied to the various components of stack 9100 as stack 9100 expands and contracts.

Main body 9605 may also include port 9749 fluidically connected to connecting passage 9731. In this manner, port 9749 may be coupled to one or more sensors to monitor a flow of fluid from the cathode sides of the plurality of cells of stack 9100 (see FIG. 95). Other features of main body 9605 (and manifold assembly 9611) may be similar to those described in association with main body 541 (and manifold assembly 515) (see FIGS. 5-10 and 12-16). It is also noted that capping plate 9609 may be coupled to manifold runners 9607 via fasteners 9623. In this manner, capping plate 9609 may include a plurality of fastener openings 9609*h* configured to respectively interface with fasteners 9623 and enable fasteners 9623 to engage with corresponding fastener openings in manifold runners 9607.

Port Side Assembly—Insulation Plate

Figure 99:
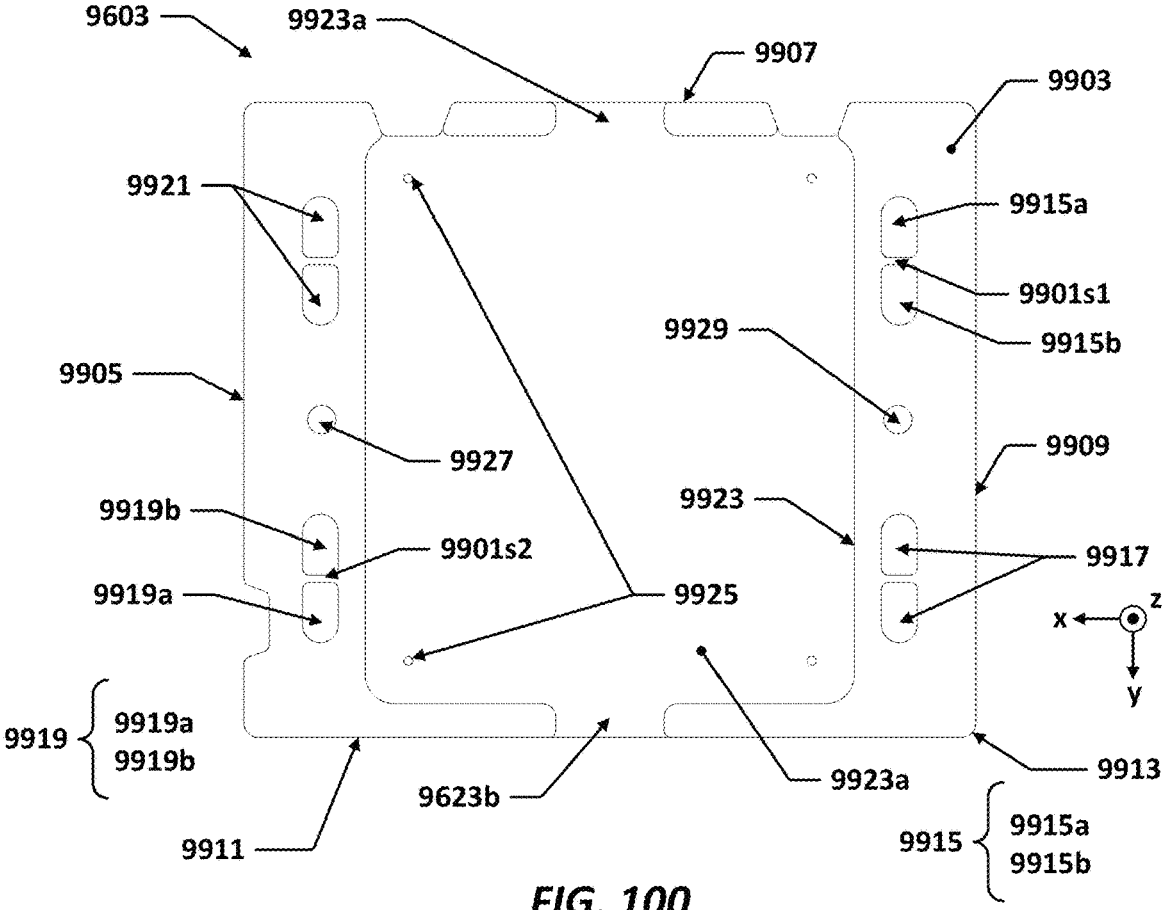
FIGS. 99 and 100 depict bottom and top plan views of an example insulation plate of the example port side assembly of FIG. 96.
Figure 100:
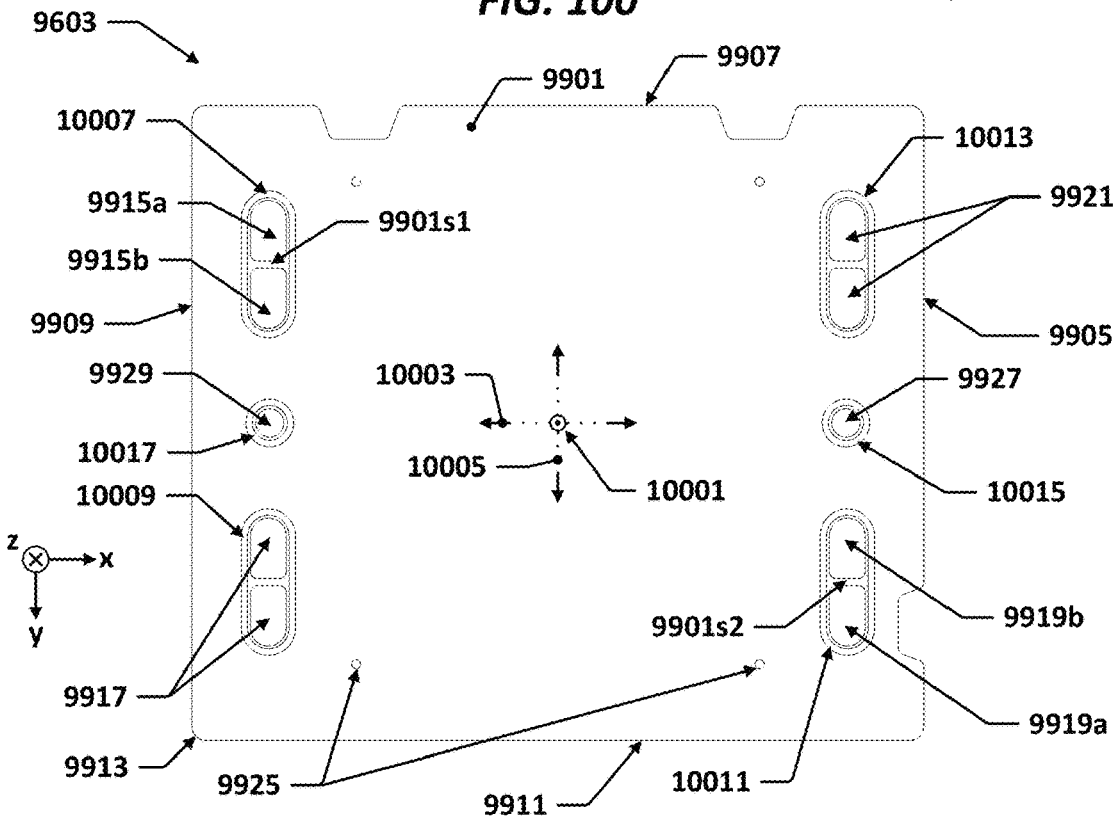

FIGS. 99 and 100 depict bottom and top plan views of an example insulation plate of the example port side assembly of FIG. 96.

Referring to FIGS. 96, 99, and 100, insulation plate 9603 may be a generally rectangular plate-shaped body having first surface 9901 (e.g., a top surface) opposing second surface 9903 (e.g., a bottom surface) in axial direction 10001, which may extend parallel (or substantially parallel) to the z-axis direction. Although insulation plate 9603 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, insulation plate 9603 will be described in association with a generally rectangular configuration. First and second surfaces 9901 and 9903 may be bounded by one or more peripheral surfaces, such as peripheral surfaces (or surfaces) 9905, 9907, 9909, and 9911 that may be connected to one another via one or more other peripheral surfaces, such as peripheral surface (or surface) 9913. In some embodiments, insulation plate 9603 may have a symmetrical configuration about one or more reference planes perpendicular to axial direction 10001. For instance, a configuration of insulation plate 9603 may be symmetrical about either or both of reference planes 10003 and 10005, but embodiments are not limited thereto.

According to various embodiments, first fluidic inlet passages 9915 and 9917 may be adjacent to peripheral edge 9909, and first fluidic outlet passages 9919 and 9921 may be adjacent to peripheral edge 9905. First fluidic inlet passages 9915 and 9917 may form portions of the one or more fluidic inlet passages 9401 (see FIG. 94) of stack 9100 in association with inlet port 9123 that provides, for instance, input water to the anode sides of the plurality of cells of stack 9100. First fluidic outlet passages 9919 and 9921 may form portions of the one or more outlet passages (that are similar to inlet passages 9401 (see FIG. 94)), but associated with output port 9125 that outputs, for instance, water from the anode sides of the plurality of cells of stack 9100. In some implementations, first fluidic inlet and outlet passages 9915-9921 may be defined by respective pluralities of orifices separated from one another via corresponding septal walls. For instance, first fluidic inlet passage 9915 may include first and second inlet orifices 9915*a* and 9915*b* separated from one another via septal wall 9901*s*1, whereas first fluidic outlet passage 9919 may include first and second outlet orifices 9919*a* and 9919*b* separated from one another via septal wall 9901*s*2. The presence of these septal walls, such as septal walls 9901*s*1 and 9901*s*2, may increase the structural rigidity and, thereby, reliability of insulation plate 9603 in the vicinity of first fluidic inlet and outlet passages 9915-9921.

According to various implementations, insulation plate 9603 may include recessed region 9923 terminating at recessed surface 9923*a* that is configured to receive at least a portion of bus plate 9601 (see, e.g., FIGS. 91-95) therein when bus plate 9601 and insulation plate 9603 are incorporated as part of stack 9100. Recessed region 9923 may include one or more portions (e.g., portions 9923*a* and 9923*b*) any one of which may receive terminal portion 9601*t* of bus plate 9601 therein. Additionally, recessed region 9923 may include one or more fastener orifices 9925 in recessed surface 9923*a* and extending through insulation plate 9603 that are configured to allow fasteners 9617 (e.g., flatheaded machine screws or any other suitable fastening mechanism(s)) to pass from bus plate 9601 through insulation plate 9603 and engage with fastener openings 9743 (see FIG. 98) in main body 9605 of manifold assembly 9611 to enable bus plate 9601, insulation plate 9603, and manifold assembly 9611 to be coupled to one another (see also FIGS. 91-95).

Insulation plate 9603 may also include second fluidic inlet and outlet passages 9927 and 9929, which form respective portions of inlet and outlet passages 9501 and 9503 (see FIG. 95) of stack 9100 in association with fluidic inlet and outlet ports 9721 and 9723 (see FIG. 95) of main body 9605 of manifold assembly 9611. Inlet passage 9501 (see FIG. 95) may supply one or more reactants (e.g., gaseous $CO_x$) to the various cathode sides of the plurality of cells of stack 9100 (see, e.g., FIGS. 91-95). Outlet passage 9503 (see FIG. 95), however, may enable one or more byproducts of the $CO_x$ reduction process to be expelled from the various cathode sides of the plurality of cells of stack 9100 (see, e.g., FIGS. 91-95).

According to various embodiments, recesses 10007-10017 may be formed in surface 9901 of insulation plate 9603 that may be configured to respectively receive corresponding portions of gaskets 9619 and 9621 therein when, for example, insulation plate 9603 is coupled to manifold assembly 9611 via fasteners 9617 (see also FIGS. 91-95). For instance, recesses 10007 and 10009 may be formed to encircle the corresponding peripheries of first fluidic inlet passages 9915 and 9917 and interface with corresponding ones of gaskets 9619, whereas recesses 10011 and 10013 may be formed to respectively encircle the corresponding peripheries of first fluidic outlet passages 9919 and 9921 and respectively interface with corresponding ones of gaskets 9619. Further, recesses 10015 and 10017 may be formed to encircle corresponding peripheries of second fluidic inlet and outlet passages 9927 and 9929 and interface with corresponding ones of gaskets 9621.

Piston Side Assembly

Figure 101:
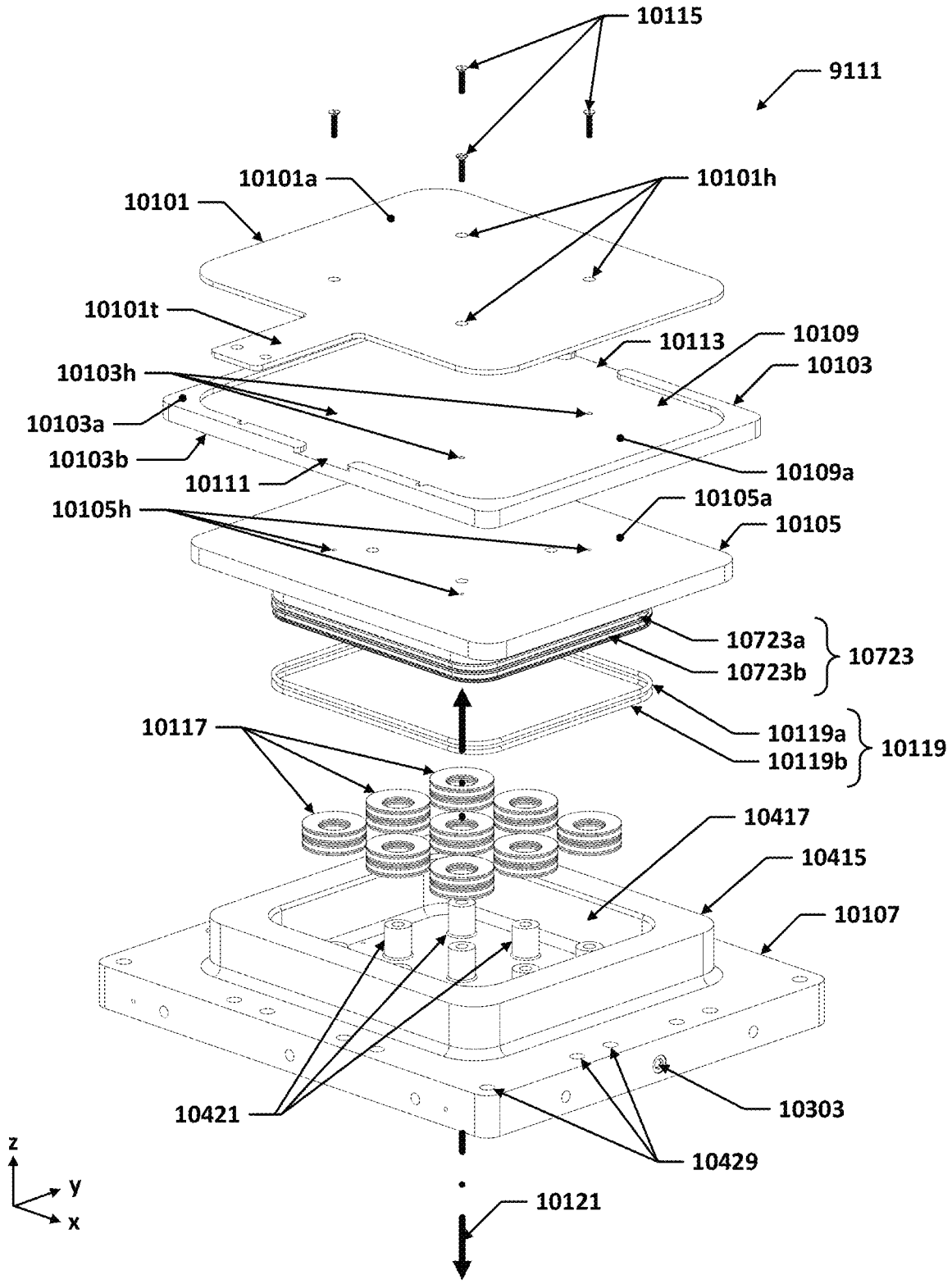
FIG. 101 depicts a perspective view of an example piston side assembly of the example multi-cell $CO_x$ electrolyzer stack of FIG. 91 in an exploded state.
Figure 102:
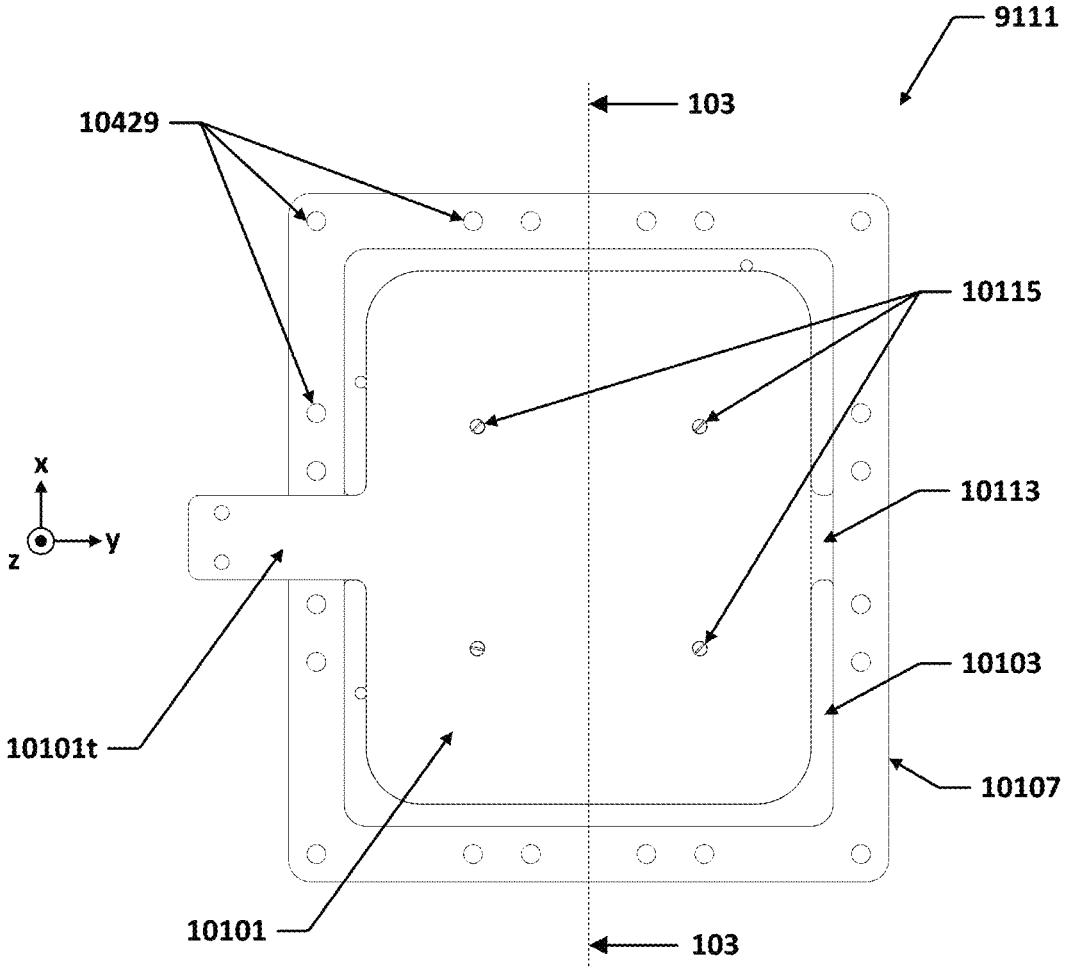
FIG. 102 depicts a top plan view of the example piston side assembly of FIG. 101 in an assembled state.
Figure 103:
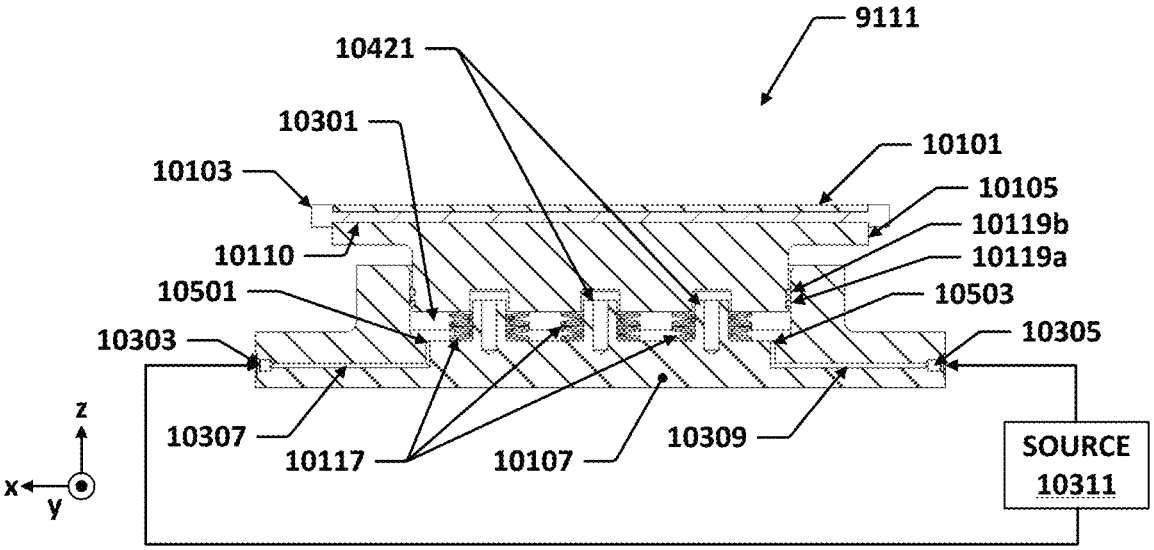
FIG. 103 depicts a cross-sectional view of the example piston side assembly of FIG. 102 taken along sectional line 103-103.

FIG. 101 depicts a perspective view of an example piston side assembly of the example multi-cell $CO_x$ electrolyzer stack of FIG. 91 in an exploded state. FIG. 102 depicts a top plan view of the example piston side assembly of FIG. 101 in an assembled state. FIG. 103 depicts a cross-sectional view of the example piston side assembly of FIG. 102 taken along sectional line 103-103.

Referring to FIGS. 91-95 and 101-103, piston side assembly 9111 may include bus plate 10101, insulation plate 10103, piston 10105, and end plate 10107 sequentially stacked from a first side of anode interface assembly 9109 in a direction opposite the axial direction, e.g., in a direction opposite the z-axis direction. It is noted that the first side of anode interface assembly 9109 may face away from the plurality of repeat units 9103. Among other functions, piston side assembly 9111 may be at least configured to constrain axial expansion of the cells of stack 9100 during the $CO_x$ reduction process(es) in a manner that prevents or reduces the likelihood of the plurality of cells from being overly compressed, but maintains corresponding fluidic seals and electrical conductivity between associated components of stack 9100.

Bus plate 10101 may be equivalent (or substantially equivalent) to bus plate 521 of stack 500 (see, e.g., FIGS. 5-10), except bus plate 10101 may include a plurality of fastener orifices 10101*h*, which may be countersunk with respect to surface 10101*a* of bus plate 10101. Bus plate 10101 may also include terminal portion 10101*t* similar to how bus plate 521 includes terminal portion 521*t* (see, e.g., FIGS. 5-10). Insulation plate 10103 may be equivalent (or substantially equivalent) to insulation plate 523 of stack 500 (see, e.g., FIGS. 5-10, 86, and 87), except insulation plate 10103 may exclude fastener orifices 523*h*, exclude fastener orifices 8633, exclude second recess 8629, include recess 10109 in surface 10103*a* instead of first recess 8621, and include recess 10110 (see FIG. 103) in surface 10103*b*. Recess 10109 may not only terminate at surface 10109*a*, but may also include portions 10111 and 10113 either of which may receive terminal portion 10101*t* of bus plate 10101 therein. Recess 10110 may be configured to receive a portion of piston 10105 therein when insulation plate 10103 and piston 10105 are incorporated as part of stack 9100. A plurality of fastener orifices 10103*h* corresponding to fastener orifices 10101*h* in bus plate 10101 may be formed in surface 10109*a* of recess 10109. Accordingly, when bus plate 10101 and insulation plate 10103 are assembled as part of stack 9100, at least a portion of bus plate 10101 may be received in recess 10109 of insulation plate 10103 and coupled to insulation plate 10103 via fasteners 10115 (e.g., threaded fasteners or any other suitable fastening mechanism(s)), which may extend through fastener orifices 10101*h* and 10103*h* and engage with corresponding fastener orifices 10105*h* formed in surface 10105*a* of piston 10105. As such, fastener orifices 10105*h* may be threaded or otherwise configured to engage with fasteners 10115. Other features, functions, materials, etc., of bus plate 10101 and insulation plate 10103 may correspond to features, functions, materials, etc., of bus plate 521 and insulation plate 517 described in association with stack 500 (see, e.g., FIGS. 5-10). End plate 10107 and piston 10105 will now be described in more detail in association with FIGS. 104-109.

Piston Side Assembly—End Plate

FIG. 104 depicts a perspective view of an example end plate of the example piston side assembly of FIG. 101. FIGS. 105 and 106 depict a top and bottom plan views of the example end plate of FIG. 104.

Referring to FIGS. 91-95, 101, and 104-106, end plate 10107 may be a generally rectangular plate-shaped body having first surface 10401 (e.g., a top surface) opposing second surface 10403 (e.g., a bottom surface) in axial direction 10601, which extend parallel (or substantially parallel) to the z-axis direction. Although end plate 10107 is described as having a generally rectangular plate-shaped configuration, embodiments are not limited thereto and any suitable geometric configuration may be utilized, such as a generally circular, generally elliptical, generally triangular, generally pentagonal, generally hexagonal, etc., configuration. For convenience, end plate 10107 will be described in association with a generally rectangular configuration. First and second surfaces 10401 and 10403 may be bounded by one or more peripheral surfaces, such as peripheral surfaces (or surfaces) 10405, 10407, 10409, and 10411, that may be connected to one another via one or more other peripheral surfaces, such as peripheral surface (or surface) 10413. In some cases, end plate 10107 may have a symmetrical configuration about one or more reference planes perpendicular to axial direction 10601. For instance, a configuration of end plate 10107 may be symmetrical about either or both of reference planes 10603 and 10605, but embodiments are not limited thereto.

According to some implementations, end plate 10107 may include a generally rectangular protrusion 10415 extending from a first central region of first surface 10401 in axial direction 10601. Although protrusion 10415 is described as having a generally rectangular configuration, embodiments are not limited thereto and any suitable geometric configuration may be utilized, such as a generally circular, generally elliptical, generally triangular, generally pentagonal, generally hexagonal, etc., configuration. For convenience, protrusion 10415 will be described in association with a generally rectangular configuration. Protrusion 10415 may include central opening 10417 exposing surface 10419 of end plate 10107. Surface 10419 may correspond with first surface 10401, e.g., surface 10419 may form a second central region of first surface 10401 that is encircled by the first central region of first surface 10401. A plurality of protrusions 10421 may extend from surface 10419 in axial direction 10601. For instance, end plate 10107 may include nine (9) protrusions 10421 extending from surface 10419 spaced apart from one another at one or more intervals. In some embodiments, protrusions 10421 may be evenly (or substantially evenly) distributed in the area exposed by opening 10417. It is contemplated, however, that end plate 10101 may include any suitable number of protrusions, such as less than nine (9) or more than nine (9). In some implementations, protrusions 10421 may be formed as cylindrical, annular protrusions respectively including corresponding central openings 10423, but other or additional geometric configurations may be utilized. Respective upper surfaces 10425 of protrusions 10421 may be recessed from upper surface 10427 of protrusion 10415. As will become more apparent below, protrusions 10421 may be sized, shaped, located, and/or otherwise configured to enable a corresponding plurality of biasing members (e.g., disk springs, such as Belleville springs, etc.) 10117 to be supported in opening 10417 when end plate 10107 is assembled as part of stack 9100.

End plate 10107 may also include fastener orifices 10429 through which tensioning members 9113 may pass. Tensioning members 9113 may be equivalent (or substantially equivalent) with tensioning members 527 (see, e.g., FIGS. 5-10), except tensioning members 9113 may be longer than tensioning members 527 to at least account for the presence of a greater number of repeat units 9103 than repeat units 503 in stack 500 (see, e.g., FIGS. 5-10). In some cases, fastener orifices 10429 may be arranged about a peripheral region of end plate 10107 at one or more intervals. The peripheral region may, in some implementations, be arranged between the outer surfaces of protrusion 10415 and peripheral surfaces 10405, 10407, 10409, 10411, and 10413 of end plate 10107. Some additional features of end plate 10107 will be described in association with the description of piston 10105.

Piston Side Assembly—Piston

FIG. 107 depicts a perspective view of an example piston of the piston side assembly of FIG. 101. FIGS. 108 and 109 depict top and bottom plan views of the example piston of FIG. 107.

Referring to FIGS. 91-95, 101-103, and 107-109, piston 10105 may be a generally rectangular plate-shaped body having first surface 10701 (e.g., a top surface) opposing second surface 10703 (e.g., a bottom surface) in axial direction 10801. Although piston 10105 is described as having a generally rectangular configuration, embodiments are not limited thereto and any suitable geometric configuration may be utilized, such as a generally circular, generally elliptical, generally triangular, generally pentagonal, generally hexagonal, etc., configuration. For convenience, piston 10105 will be described in association with a generally rectangular configuration. First and second surfaces 10701 and 10703 may be bounded by one or more peripheral surfaces, such as peripheral surfaces (or surfaces) 10705, 10707, 10709, and 10711, that may be connected to one another via one or more other peripheral surfaces, such as peripheral surface (or surface) 10713. In some cases, piston 10105 may have a symmetrical configuration about one or more reference planes perpendicular to axial direction 10801, which may extend parallel (or substantially parallel) to the z-axis direction (see, e.g., FIG. 107). For instance, a configuration of piston 10105 may be symmetrical about either or both of reference planes 10803 and 10805, but embodiments are not limited thereto.

According to some implementations, piston 10105 may include a generally rectangular protrusion 10715 extending from a first central region of second surface 10703 in a direction opposite the axial direction 10801 (see FIG. 108). Although protrusion 10715 is described as having a generally rectangular configuration, embodiments are not limited thereto and any suitable geometric configuration may be utilized, such as a generally circular, generally elliptical, generally triangular, generally pentagonal, generally hexagonal, etc., configuration. For convenience, protrusion 10715 will be described in association with a generally rectangular configuration. Protrusion 10715 may terminate at surface 10717, which may be bounded by a plurality of peripheral surfaces, such as peripheral surface 10719.

A plurality of blind openings 10721 may be formed in surface 10717 and extend in axial direction 10801 towards surface 10701. The number, location, and configuration of blind openings 10721 may correspond to the number, location, and configuration of protrusions 10421 of end plate 10107 (see also FIGS. 104 and 105) such that, when piston 10105 and end plate 10107 are incorporated as part of stack 9100, respective blind openings 10721 may be concentrically aligned (or substantially concentrically aligned) with corresponding protrusions 10421 (see, e.g., FIG. 103). Respective depths of blind openings 10721 from surface 10717 in axial direction 10801 may, in some implementations, be smaller than corresponding heights of protrusions 10421 from surface 10419 in axial direction 10601 (see FIGS. 104-106), which may correspond with axial direction 10801. As such, the respective depths of blind openings 10721 may correspond to a maximum (or substantially maximum) amount of axial expansion that stack 9100 may be permitted to experience when stack 9100 is pressured. It is also noted that respective widths of blind openings 10721 in a direction perpendicular to axial direction 10801 may be greater than corresponding widths of protrusions 10421 in a direction perpendicular to axial direction 10601 (see FIGS. 104-106), but smaller than corresponding widths of biasing members 10117 in a direction perpendicular to central axis 10121 (see FIG. 101). Thus, when piston 10105 is caused to axially translate along central axis 10121 towards end plate 10107, respective protrusions 10421 may be received in corresponding blind openings 10721, and biasing members 10117 may be compressed between surface 10717 of protrusion 10715 of piston 10105 and surface 10419 of end plate 10107. In this manner, biasing members 10117 may provide a first amount of axial compression to the plurality of cells of stack 9100 when stack 9100 is not pressurized, e.g., when stack 9100 is in a cooled, non-operational state.

Piston 10105 may also include a plurality of recesses 10723 formed in the peripheral surfaces (e.g., peripheral surface 10719) of protrusion 10715. Corresponding depths of recesses 10723 may extend inwards from a respective peripheral surface of protrusion 10715 towards blind openings 10721. In some embodiments, the plurality of recesses 10723 may include first and second recesses 10723*a* and 10723*b*, but embodiments are not limited thereto. For instance, protrusion 10715 may include one recess in some cases, or include three or more recesses in other cases. The plurality of recesses 10723 may be configured to interface with a corresponding plurality of piston gaskets 10119, which may include, for instance, first and second piston gaskets 10119*a* and 10119*b*.

With reference to FIGS. 91-109, when piston 10105, end plate 10107, and piston gaskets 10119 are incorporated as part of piston side assembly 9111 of stack 9100, at least a portion of protrusion 10715 of piston 10105 may be received in opening 10417 of end plate 10107 in a manner that protrusion 10715 and opening 10417 become aligned (or substantially aligned) along central axis 10121 of piston side assembly 9111. To this end, piston gaskets 10119 may form corresponding fluidic seals between recesses 10723 of piston 10105 and inner sidewalls (such as inner sidewall 10417*sw*) of opening 10417 of end plate 10107. As such, a fluidically sealed cavity (or cavity) 10301 may be formed between piston 10105 and end plate 10107. In a manner similar to bladder side assembly 511 (see, e.g., FIGS. 5-10 and 90), one or more control fluids (e.g., gaseous $CO_x$) may be introduced to cavity 10301 to regulate a distance between surface 10717 of protrusion 10715 of piston 10105 and surface 10419 of end plate 10107.

In some embodiments, the one or more control fluids may be flowed into cavity 10301 via fluidic inlet ports 10303 and 10305 formed in peripheral surfaces 10409 and 10405 of end plate 10107. Fluidic inlet port 10303 may be fluidically connected to blind orifice 10501 formed in surface 10419 of end plate 10107 via connecting passage 10307, whereas fluidic inlet port 10305 may be fluidically connected to blind orifice 10503 formed in surface 10419 of end plate 10107 via connecting passage 10309. In this manner, the one or more control fluids may be caused to flow into cavity 10301 via the conjunction of fluidic inlet ports 10303 and 10305, connecting passages 10307 and 10309, and blind orifices 10501 and 10503, as well as source 10311 of the one or more control fluids. In some embodiments, source 10311 of the one or more control fluids may be the same as the source of input providing, for instance, gaseous $CO_x$, to the cathode sides of the cells of stack 9100. Regardless of the source, the distance between surface 10717 of protrusion 10715 of piston 10105 and surface 10419 of end plate 10107 may be controlled based on an accumulated pressure of the one or more control fluids in cavity 10301. In this manner, regulating the distance between surface 10717 of protrusion 10715 of piston 10105 and surface 10419 of end plate 10107 may be utilized to constrain axial expansion of the plurality of cells, such as cell 9101, during operation. This may help maintain corresponding fluidic seals and electrical conductivity between associated components of stack 9100, and, thereby, provide a second amount of axial compression to the plurality of cells of stack 9100 when stack 9100 is pressurized, e.g., in an operational state of stack 9100.

According to some embodiments, when the accumulated pressure in cavity 10301 builds beyond a determined threshold, the distance between surface 10717 of piston 10105 and surface 10419 of end plate 10107 may increase to point at which fluidic seals formed in association with piston gaskets 10119 may become compromised. If and when the fluidic seals formed in association with piston gaskets 10119 become compromised, at least some of the one or more control fluids may escape (or bleed) from cavity 10301 that may cause the accumulated pressure to decrease, and, as such, the distance between surface 10717 of piston 10105 and surface 10419 of end plate 10107 to also decrease. Such a configuration may be utilized to prevent over compression of the various components of stack 9100.

As described above, fluidic inlet ports 10303 and 10305 may be utilized to introduce one or more control fluids to cavity 10301, but a corresponding fluidic outlet port may not be provided (apart from piston gaskets 10119 becoming compromised and allowing at least some of the one or more control fluids to escape from cavity 10301). In this manner, the conjunction of piston 10105, end plate 10107, and piston gaskets 10119 may form a "dead-headed" piston in which the one or more control fluids are caused to remain in cavity 10301 until a flow of the one or more control fluids is terminated and the one or more control fluids in cavity 10301 are allowed to backflow out of one or both of fluidic inlet ports 10303 and 10305. In some cases, one or both of fluidic inlet ports 10303 and 10305 (or another fluidic port) may be additionally (or alternatively) configured as a fluidic outlet port, which may interface with, for instance, a pressure relief valve configured to release, bleed-off, or otherwise exhaust accumulated pressure in cavity 10301 in response to the accumulated pressure reaching a threshold pressure and/or based on a control signal received from a controller. Such a configuration may enable finer regulation of the accumulated pressure in cavity 10301 that may, in turn, allow for finer control over the constriction of the axial expansion of the plurality of cells of stack 9100 when stack 9100 is pressurized.

According to some embodiments, source 10311 may be configured to supply the gaseous $CO_x$ to second fluidic inlet port 9721 (see, e.g., FIG. 95) at a first pressure and to supply the one or more control fluids (e.g., gaseous $CO_x$) to fluidic inlet ports 10303 and 10305 at a second pressure. In some implementations, the first and second pressures may be equivalent or substantially equivalent. In some cases, source 10311 may be configured to control (e.g., adjust) one or more of the first and second pressures based on conditions of stack 9100, e.g., based on an extent of expansion of one or more cells of stack 9100 in the axial direction, based on an accumulated pressure in cavity 10301, based on the temperature of one or more components of stack 9100, and/or the like. As such, the first and second pressures may reach equilibrium, such as, in response to steady state conditions. It is also noted that source 10311 may be configured to supply the gaseous $CO_x$ to second fluidic inlet port 9721 (see, e.g., FIG. 95) at a first time and to supply the one or more control fluids (e.g., gaseous $CO_x$) to fluidic inlet ports 10303 and 10305 at a second time. In some embodiments, the first and second times may occur simultaneously or substantially simultaneously. In some cases, source 10311 may be configured to delay the supply of the one or more control fluids to fluidic inlet ports 10303 and 10305 with respect to the provisioning of the gaseous $CO_x$ to second fluidic inlet port 9721 (see, e.g., FIG. 95). For example, source 10311 may be configured to delay the supply of the one or more control fluids to fluidic inlet ports 10303 and 10305 until one or more conditions are satisfied, e.g., an extent of expansion of one or more cells of stack 9100 in the axial direction reaches one or more defined thresholds, a temperature of one or more components of stack 9100 reaches one or more defined thresholds, flow of the gaseous $CO_x$ to second fluidic inlet port 9721 (see, e.g., FIG. 95) reaches steady state, and/or the like.

Additional and/or Alternative Embodiments

Unless otherwise specified, the illustrated embodiments are to be understood as providing example features of varying detail of some embodiments. Thus, unless otherwise specified, the features, components, regions, aspects, structures, etc. (hereinafter individually or collectively referred to as an "element" or "elements"), of the various illustrations may be otherwise combined, separated, interchanged, and/or rearranged without departing from the teachings of the disclosure.

The terminology used herein is for the purpose of describing some embodiments and is not intended to be limiting. As used herein, the singular forms, "a," "an," and "the" are intended to include the plural forms as well, unless the context clearly indicates otherwise. It is to be understood that the phrases "for each <item> of the one or more <items>," "each <item> of the one or more <items>," and/or the like, if used herein, are inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite dictionary definitions of "each" frequently defining the term to refer to "every one of two or more things") and would not imply that there must be at least two of those items. Similarly, the term "set" or "subset" should not be viewed, in itself, as necessarily encompassing a plurality of items—it is to be understood that a set or a subset can encompass only one member or multiple members (unless the context indicates otherwise). The terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art. Accordingly, the term "substantially" as used herein, unless otherwise specified, means within 5% of a referenced value. For example, substantially perpendicular means within ±5% of parallel.

It is also to be understood that the various dimensional parameter ranges provided herein may be combined with any other dimensional parameter ranges provided herein. For example, if a channel is described as potentially having a length in ranges A, B, or C, a width in ranges D, E, or F, and a depth in ranges G, H, or I, this is to be understood to explicitly contemplate channels having a length, width, and depth representing any combination of such ranges. For example, in the above scenario, such a channel may have a length, width, and height of AEI, AEJ, AEK, AEL, AFI, AFJ, AFK, AFL, AGI, AGJ, AGK, AGL, AHI, AHJ, AHK, AHL, BEI, BEJ, BEK, BEL, BFI, BFJ, BFK, BFL, BGI, BGJ, BGK, BGL, BHI, BHJ, BHK, BHL, CEI, CEJ, CEK, CEL, CFI, CFJ, CFK, CFL, CGI, CGJ, CGK, CGL, CHI, CHJ, CHK, CHL, DEI, DEJ, DEK, DEL, DFI, DFJ, DFK, DFL, DGI, DGJ, DGK, DGL, DHI, DHJ, DHK, or DHL, with the first letter of each letter triplet representing the length range of the channel, the second letter of each letter triplet representing the width range of the channel, and the third letter of each letter triplet representing the depth range of the channel.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an embodiment may be implemented differently, a specific process order may be performed differently from the described order. For example, two consecutively described processes may be performed substantially at the same time or performed in an order opposite to the described order.

When an element, such as a frame, is referred to as being "on," "connected to," or "coupled to" another element, it may be directly on, directly connected to, or directly coupled to the other element or at least one intervening element may be present. When, however, an element is referred to as being "directly on," "directly connected to," or "directly coupled to" another element, there are no intervening elements present. Other terms and/or phrases if used herein to describe a relationship between elements should be interpreted in a like fashion, such as "between" versus "directly between," "adjacent" versus "directly adjacent," "on" versus "directly on," etc. Further, the term "connected" may refer to physical, electrical, and/or fluid connection. To this end, for the purposes of this disclosure, the phrase "fluidically connected" is used with respect to volumes, plenums, holes, orifices, etc., that may be connected to one another, either directly or via one or more intervening components or volumes, to form a fluidic connection, similar to how the phrase "electrically connected" is used with respect to components that are connected to form an electric connection. The phrase "fluidically interposed," if used, may be used to refer to a component, volume, plenum, hole, orifice, passage, etc., that is fluidically connected with at least two other components, volumes, plenums, holes, orifices, passages, etc., such that fluid flowing from one of those other components, volumes, plenums, holes, orifices, passages, etc., to the other or another of those components, volumes, plenums, holes, orifices, passages, etc., would first flow through the "fluidically interposed" component before reaching that other or another of those components, volumes, plenums, holes, orifices, passages, etc. For example, if a pump is fluidically interposed between a reservoir and an outlet, fluid flowing from the reservoir to the outlet would first flow through the pump before reaching the outlet. The phrase "fluidically adjacent," if used, refers to placement of a fluidic element relative to another fluidic element such that no potential structures fluidically are interposed between the two elements that might potentially interrupt fluid flow between the two fluidic elements. For example, in a flow path having a first valve, a second valve, and a third valve arranged sequentially therealong, the first valve would be fluidically adjacent to the second valve, the second valve fluidically adjacent to both the first and third valves, and the third valve fluidically adjacent to the second valve.

For the purposes of this disclosure, "at least one of X, Y, . . . , and Z" and "at least one selected from the group consisting of X, Y, . . . , and Z" may be construed as X only, Y only, . . . , Z only, or any combination of two or more of X, Y, . . . , and Z, such as, for instance, XYZ, XYY, YZ, and ZZ. As used herein, the term "and/or" includes any and all combinations of one or more of the associated listed items.

Although the terms "first," "second," "third," etc., may be used herein to describe various elements, these elements should not be limited by these terms. These terms are used to distinguish one element from another element. Thus, a first element discussed below could be termed a second element without departing from the teachings of the disclosure. To this end, use of such identifiers, e.g., "a first element," should not be read as suggesting, implicitly or inherently, that there is necessarily another instance, e.g., "a second element." Further, the use, if any, of ordinal indicators, such as (a), (b), (c), . . . , or (1), (2), (3), . . . , or the like, in this disclosure and accompanying claims, is to be understood as not conveying any particular order or sequence, except to the extent that such an order or sequence is explicitly indicated. For example, if there are three steps labeled (i), (ii), and (iii), it is to be understood that these steps may be performed in any order (or even concurrently, if not otherwise contraindicated), unless indicated otherwise. For example, if step (ii) involves the handling of an element that is created in step (i), then step (ii) may be viewed as happening at some point after step (i). In a similar manner, if step (i) involves the handling of an element that is created in step (ii), the reverse is to be understood.

Spatially relative terms, such as "beneath," "below," "under," "lower," "above," "upper," "over," "higher," "side" (e.g., as in "sidewall"), and the like, may be used herein for descriptive purposes, and, thereby, to describe one element's spatial relationship to at least one other element as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" or "over" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The term "between," as used herein and when used with a range of values, is to be understood, unless otherwise indicated, as being inclusive of the start and end values of that range. For example, between 1 and 5 is to be understood as inclusive of the numbers 1, 2, 3, 4, and 5, not just the numbers 2, 3, and 4.

If used herein, the phrase "operatively connected" is to be understood as referring to a state in which two components and/or systems are connected, either directly or indirectly, such that, for example, at least one component or system can control the other. For instance, a controller may be described as being operatively connected with (or to) a source of, for instance, control fluid, which is inclusive of the controller being connected with a sub-controller of the source that is electrically connected with a relay that is configured to controllably connect or disconnect the source with a power source that is capable of providing an amount of power that is able to power the source so as to generate a desired flow of control fluid. The controller itself likely will not supply such power directly to the source due to the current(s) involved, but it is to be understood that the controller is nonetheless operatively connected with the source.

As used herein, the singular forms, "a," "an," and "the" are intended to include the plural forms as well, unless the context clearly indicates otherwise. It is also to be understood that the phrases "for each <item> of the one or more <items>," "each <item> of the one or more <items>," and/or the like, if used herein, are inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite dictionary definitions of "each" frequently defining the term to refer to "every one of two or more things") and would not imply that there must be at least two of those items. Similarly, the term "set" or "subset" should not be viewed, in itself, as necessarily encompassing a plurality of items—it is to be understood that a set or a subset can encompass only one member or multiple members (unless the context indicates otherwise). In addition, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various embodiments are described herein with reference to sectional views, isometric views, perspective views, plan views, and/or exploded illustrations that are schematic depictions of idealized embodiments and/or intermediate structures. As such, variations from the shapes of the illustrations as a result of, for example, manufacturing techniques and/or tolerances, are to be expected. Thus, embodiments disclosed herein should not be construed as limited to the particular illustrated shapes of regions, but are to include deviations in shapes that result from, for instance, manufacturing. To this end, regions illustrated in the drawings may be schematic in nature and shapes of these regions may not reflect the actual shapes of regions of a device, and, as such, are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and are not to be interpreted in an idealized or overly formal sense, unless expressly so defined herein.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the inventive concepts. Further, the blocks, units, and/or modules of some embodiments may be physically combined into more complex blocks, units, and/or modules without departing from the teachings of the disclosure.

Although the foregoing embodiments have been described in some detail for purposes of clarity of understanding, it will be apparent that certain changes and modifications may be practiced within the scope of the appended claims. It should be noted that there are many alternative ways of implementing the processes, systems, and apparatuses of the disclosed embodiments. Accordingly, embodiments are to be considered as illustrative and not as restrictive, and embodiments are not to be limited to the details given herein. To this end, it should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the subject matter disclosed herein. It should also be appreciated that terminology explicitly employed herein that also may appear in any disclosure incorporated by reference should be accorded a meaning most consistent with the particular concepts disclosed herein.

It is to be further understood that the above disclosure, while focusing on a particular example implementation or implementations, is not limited to only the discussed example, but may also apply to similar variants and mechanisms as well, and such similar variants and mechanisms are also considered to be within the scope of this disclosure. For the avoidance of any doubt, it is also to be understood that the above disclosure is at least directed to the following numbered implementations, as well as to other implementations that are evident from the above disclosure.

Implementation 1: A COx electrolyzer apparatus ("apparatus") includes a first end assembly, a second end assembly, a plurality of separator plates, and a plurality of COx electrolyzer cells ("cells"). The second end assembly is coupled to the first end assembly via a plurality of tensioning members. The cells are interposed between the first and second end assemblies and arranged in a stack along an axial direction. Each cell among the cells includes an instance of first components and an instance of second components. The first components include: a membrane electrode assembly ("MEA") having a cathodic part, an anodic part, and a separator between the cathodic part and the anodic part; a cathode frame adjacent to the cathodic part; and a cathode flow field at least partially disposed in a first opening in the cathode frame. The second components include: an anode frame adjacent to the anodic part of the MEA; and an anode flow field at least partially disposed in a second opening in the anode frame. The cathode and anode frames of adjacent cells among the cells are coupled to one another via a corresponding plurality of frame fasteners with a separator plate among the separator plates interposed therebetween. The frame fasteners are different from the tensioning members.

Implementation 2: The apparatus of implementation 1, in which the first components further include a cathode gas diffusion layer (GDL) adjacent to the cathode frame and covering the cathode flow field. The cathode GDL and the cathode flow field are configured to guide a flow of gaseous COx across the first opening in a first direction transverse to the axial direction and in a distributed manner with respect to at least a second direction transverse to each of the axial and first directions. The second components further include an anode porous transport layer (PTL) adjacent to the anode frame and covering the anode flow field. The anode PTL and the anode flow field are configured to guide a flow of anolyte across the second opening in a third direction transverse to the axial direction and in a distributed manner with respect to at least the second direction.

Implementation 3: The apparatus of either implementation 1 or implementation 2, in which the cathode frame includes: the first opening arranged in a central portion of the cathode frame; at least one first fluidic inlet passage fluidically connected to the anodic parts of the cells; at least one first fluidic outlet passage fluidically connected to the anodic parts of the cells; at least one second fluidic inlet passage fluidically connected to the first opening; and at least one second fluidic outlet passage fluidically connected to the first opening.

Implementation 4: The apparatus of any one of implementations 1-3, in which the anode frame includes: the second opening arranged in a central portion of the anode frame; at least one third fluidic inlet passage fluidically connected to the second opening; at least one third fluidic outlet passage fluidically connected to the second opening; at least one fourth fluidic inlet passage fluidically connected to the cathodic parts of the cells; and at least one second fluidic outlet passage fluidically connected to the cathodic parts of the cells.

Implementation 5: The apparatus of any one of implementations 1-4, in which each of the separator plates includes: a plurality of fastener orifices through which the frame fasteners respectively extend; at least one first hole through which an inlet anolyte flow path extends; at least one second hole through which an outlet anolyte flow path extends; at least one third hole through which an inlet gaseous COx flow path extends; and at least one fourth hole through which an outlet COx reduction byproduct flow path extends.

Implementation 6: The apparatus of any one of implementations 3-5, in which the cathode frame includes a first surface facing the MEA and a second surface facing away from the first surface. The second surface of the cathode frame includes: at least one first protrusion through which the at least one first fluidic inlet passage extends; at least one second protrusion through which the at least one first fluidic outlet passage extends; at least one third protrusion through which the at least one second fluidic inlet passage extends; and at least one fourth protrusion through which the at least one second fluidic outlet passage extends.

Implementation 7: The apparatus of implementation 6, in which the at least one first protrusion of the cathode frame is arranged and configured to extend through the at least one first hole in a first separator plate among the separator plates and abut against the anode frame of a first adjacent cell among the cells such that the at least one first fluidic inlet passage of the cathode frame is substantially aligned in the axial direction with the at least one third fluidic inlet passage of the anode frame of the first adjacent cell. The at least one second protrusion of the cathode frame is arranged and configured to extend through the at least one second hole in the first separator plate and abut against the anode frame of the first adjacent cell such that the at least one first fluidic outlet passage of the cathode frame is substantially aligned in the axial direction with the at least one third fluidic outlet passage of the anode frame of the first adjacent cell. The at least one third protrusion of the cathode frame is arranged and configured to extend through the at least one third hole in the first separator plate and abut against the anode frame of the first adjacent cell such that the at least one second fluidic inlet passage of the cathode frame is substantially aligned in the axial direction with the at least one fourth fluidic inlet passage of the anode frame of the first adjacent cell. The at least one fourth protrusion of the cathode frame is arranged and configured to extend through the at least one fourth hole in the first separator plate and abut against the anode frame of the first adjacent cell such that the at least one second fluidic outlet passage of the cathode frame is substantially aligned in the axial direction with the at least one fourth fluidic outlet passage of the anode frame of the first adjacent cell.

Implementation 8: The apparatus of implementation 7, in which at least one of the first to fourth protrusions is sized to form a clearance fit with a corresponding one of the first to fourth holes.

Implementation 9: The apparatus of any one of implementations 1-8, in which the cathode frame further includes a plurality of first cathode fastener orifices arranged about a peripheral area of the cathode frame. The peripheral area encircles the first opening of the cathode frame. The anode frame further includes a plurality of first anode fastener orifices and a plurality of first swage nuts. The first anode fastener orifices are arranged about a peripheral area of the anode frame. The peripheral area encircles the second opening of the anode frame. The first cathode fastener orifices are substantially aligned with the first anode fastener orifices in the axial direction. Each first swage nut among the first swage nuts is disposed in one or the other of a corresponding one of the first anode fastener orifices and a corresponding one of the first cathode fastener orifices. The first swage nuts are configured to interface with corresponding frame fasteners among the frame fasteners.

Implementation 10: The apparatus of implementation 9, in which each of the cathode fastener orifices and anode fastener orifices are counterbored. The counterbored portions of those cathode fastener orifices and/or anode fastener orifices not including a first swage nut among the first swage nuts is configured to form a clearance fit with a respective frame fastener among the frame fasteners.

Implementation 11: The apparatus of any one of implementations 1-10, in which the frame fasteners are shoulder screws.

Implementation 12: The apparatus of any one of implementations 2-11, in which the first components further include a first support frame and a second support frame. The first support frame is interposed between the cathode GDL and the cathode frame. The first support frame includes a first frame opening exposing a portion of the cathode GDL to the cathode flow field. The portion of the cathode GDL abuts against the cathode flow field. The second support frame is interposed between the MEA and the anode PTL. The second support frame includes a second frame opening exposing a portion of the MEA to the anode PTL. The portion of the MEA abuts against the anode PTL. The first support frame, the cathode GDL, the MEA, and the second support frame form a unitized MEA assembly.

Implementation 13: The apparatus of implementation 12, in which the first components further include a first cathode gasket interposed between the first support frame and the cathode frame. The first cathode gasket encircles the first opening in the cathode frame to form a first fluidic seal around the cathode flow field. The second components further include a first anode gasket set. The first anode gasket set includes: a first anode gasket interposed between the second support frame and the anode frame, the first anode gasket encircling the second opening in the anode frame to form a first fluidic seal around the anode flow field; at least one second anode gasket interposed between the cathode frame and the anode frame, the at least one second anode gasket encircling the at least one first fluidic inlet passage of the cathode frame and the at least one third fluidic inlet passage of the anode to form at least one fluidic seal; at least one third anode gasket interposed between the cathode frame and the anode frame, the at least one third anode gasket encircling the at least one first fluidic outlet passage in the cathode frame and the at least one third fluidic outlet passages in the anode frame to form at least one fluidic seal; at least one fourth anode gasket interposed between the cathode frame and the anode frame, the at least one third anode gasket encircling the at least one second fluidic inlet passage in the cathode frame and the at least one fourth fluidic inlet passage in the anode frame to form at least one fluidic seal; and at least one fifth anode gasket interposed between the cathode frame and the anode frame, the at least one fifth anode gasket encircling the at least one second fluidic outlet passage and the at least one fourth fluidic outlet passage in the anode frame to form at least one fluidic seal.

Implementation 14: The apparatus of implementations 5 and 12, in which the first components further include a second cathode gasket interposed between a first separator plate among the separator plates and the cathode frame. The second cathode gasket encircles the first opening in the cathode frame to form a second fluidic seal around the cathode flow field. The second components further include a second anode gasket set. The second anode gasket set includes: a sixth anode gasket interposed between the anode frame and a second separator plate among the separator plates, the sixth anode gasket encircling the second opening in the anode frame to form a second fluidic seal around the anode flow field; at least one seventh anode gasket interposed between the anode frame and the second separator plate, the at least one seventh anode gasket encircling the at least one first hole in the second separator plate and the at least one third fluidic inlet passage in the anode frame to form at least one fluidic seal; at least one eighth anode gasket interposed between the anode frame and the second separator plate, the at least one eighth anode gasket encircling the at least one second hole in the second separator plate and the at least one third fluidic outlet passage in the anode frame to form at least one fluidic seal; at least one ninth anode gasket interposed between the anode frame and the second separator plate, the at least one ninth anode gasket encircling the at least one third hole in the second separator plate and the at least one fourth fluidic inlet passage in the anode frame to form at least one fluidic seal; and at least one tenth anode gasket interposed between the anode frame and the second separator plate, the at least one ninth anode gasket encircling the at least one fourth hole in the second separator plate and the at least one fourth fluidic outlet passage in the anode frame to form at least one fluidic seal.

Implementation 15: The apparatus of any one of implementations 1-14, in which the cells are formed of a plurality of repeat units. Each repeat unit among the repeat units includes: an instance of the first components; an instance of the second components; and the separator plate that is interposed between the cathode frame of that instance of the first components and the anode frame of that instance of the second components. That separator plate is interposed between that instance of the first components and that instance of the second components.

Implementation 16: The apparatus of implementation 15, in which the first end assembly includes a first end plate and a cathode interface assembly. The cathode interface assembly includes an instance of the first components, and a cathode interface separator plate interposed between the first end plate and a first repeat unit among the repeat units. A first end cell is formed between the cathode interface assembly and the instance of the second components of the first repeat unit. The first end cell is interposed between the first end plate and the plurality of cells.

Implementation 17: The apparatus of implementations 5 and 16, in which the first end assembly further includes a first insulation plate, a manifold, and a first bus plate between the first end plate and the cathode interface assembly. The manifold includes at least one first inlet fluidically connected to the anodic parts of the cells via the inlet anolyte flow path, at least one first outlet fluidically connected to the anodic parts of the cells via the outlet anolyte flow path, at least one second inlet fluidically connected to the cathodic parts of the cells via the inlet gaseous COx flow path, and at least one second outlet fluidically connected to the cathodic parts of the cells via the outlet COx reduction byproduct flow path. The first bus plate is configured to receive a first electric potential. The first insulation plate is configured to electrically insulate the first end plate from the first bus plate.

Implementation 18: The apparatus of implementation 17, in which the first bus plate, the manifold, and the first insulation plate are sequentially stacked on the cathode interface assembly.

Implementation 19: The apparatus of either implementation 17 or implementation 18, in which the inlet anolyte flow path, the outlet anolyte flow path, the inlet gaseous COx flow path, and the outlet COx reduction byproduct flow path do not extend into the bus plate and the first insulation plate.

Implementation 20: The apparatus of implementation 17, in which the first bus plate, the insulation plate, and the manifold are sequentially stacked on the cathode interface assembly.

Implementation 21: The apparatus of implementation 19, in which the first end assembly further includes a capping plate, an inlet runner, and an outlet runner. The inlet and outlet runners are coupled to the manifold such that the inlet and outlet runners are stacked in the axial direction between the capping plate and the manifold.

Implementation 22: The apparatus of implementation 21, in which the inlet anolyte flow path, the outlet anolyte flow path, the inlet gaseous COx flow path, and the outlet COx reduction byproduct flow path extend through the first insulation plate.

Implementation 23: The apparatus of any one of implementations 17-20, in which the first bus plate is coupled to the manifold via a plurality of first fasteners different from the tensioning members and the frame fasteners. The first insulation plate is coupled to the first end plate via a plurality of second fasteners different from the tensioning members, the frame fasteners, and the first fasteners.

Implementation 24: The apparatus of any one of implementations 17, 21, and 22, in which the first bus plate is coupled to the first insulation plate via a plurality of first fasteners different from the tensioning members and the frame fasteners. The first insulation plate is coupled to the manifold via the first fasteners.

Implementation 25: The apparatus of any one of implementations 15-24, in which the second end assembly includes a second end plate and an anode interface assembly. The anode interface assembly includes an instance of the second components, and an anode interface separator plate interposed between a second repeat unit among the repeat units and the second end plate. A second end cell is formed between the instance of the first components of the second repeat unit and the anode interface assembly. The second end cell is interposed between the plurality of cells and the second end plate.

Implementation 26: The apparatus of implementation 25, in which the second end assembly further includes a second bus plate and a second insulation plate sequentially stacked in the axial direction between the anode interface assembly and the second end plate. The second bus plate is configured to receive a second electric potential. The second insulation plate is configured to electrically insulate the second end plate from the second bus plate.

Implementation 27: The apparatus of implementation 26, in which the second insulation plate is coupled to the second end plate via a plurality of third fasteners different from the tensioning members and the frame fasteners.

Implementation 28: The apparatus of any one of implementations 25-27, in which the second end assembly further includes a bladder gasket. The second insulation plate includes: a first recess formed in a central portion of the second insulation plate; a second recess encircling a central region of the central portion, the second recess supporting the bladder gasket therein; and an orifice configured to receive one or more control fluids. The bus plate is slidably disposed in the first recess and configured to abut against the bladder gasket and/or a surface of the first recess facing the bus plate in the axial direction. A distance in the axial direction between the bus plate and the surface of the first recess facing the bus plate in the axial direction is configured to increase in response to accumulation of the one or more control fluids in an area between the bus plate and the insulation plate that is fluidically sealed via at least the bladder gasket.

Implementation 29: The apparatus of implementation 26, in which the second end plate includes a first main body, a second end plate protrusion extending from the first main body in the axial direction, and a second end plate opening extending into a central portion of the second end plate protrusion in a direction opposite the axial direction and terminating at a recessed surface facing the cells. The second end assembly further includes a piston interposed between the second insulation plate and the second end plate. The piston includes a second main body, and a piston protrusion extending from the second main body in the direction opposite the axial direction and terminating at a protruded surface facing the recessed surface. At least a portion of the piston protrusion is slidably disposed in at least a portion of the second end plate opening.

Implementation 30: The apparatus of implementation 29, in which the second end assembly further includes a plurality of biasing members. The piston protrusion includes a plurality of piston protrusion openings extending into the protruded surface in the axial direction. The second end plate further includes a plurality of support protrusions extending in the axial direction from the recessed surface and arranged in correspondence with the piston protrusion openings. The biasing members are respectively supported in the second end plate opening via corresponding support protrusions among the support protrusions such that, in a first compressed state of the second end assembly, the biasing members are compressed between the protruded surface and the recessed surface and respective portions of the support protrusions at least partially extend into corresponding piston protrusion openings among the piston protrusion openings.

Implementation 31: The apparatus of either implementation 29 or implementation 30, in which the second end plate further includes one or more orifices fluidically connected to the second end plate opening. The one or more orifices are configured to receive one or more control fluids. The piston protrusion includes a plurality of piston gaskets encircling the piston protrusion and offset from one another in the axial direction. The piston gaskets interface with one or more inner sidewalls of the second end plate opening such that the second end plate opening, the piston protrusion, and the piston gaskets form a cavity within the second end assembly. A distance in the axial direction between the protruded surface and recessed surface is configured to increase in response to accumulation of the one or more control fluids in the cavity.

Implementation 32: The apparatus of any one of implementations 28, 30, and 31, in which the cells are configured to reduce input gaseous COx into one or more byproducts, and the one or more control fluids and the input gaseous COx are equivalent.

Implementation 33: The apparatus of implementation 31, further including a source of gaseous COx. The source is configured to input the gaseous COx to the cells and the second end assembly at substantially equivalent pressures.

Implementation 34: The apparatus of implementation 31, further including a source of gaseous COx. The source is configured to input the gaseous COx to the cells at a first pressure and to the second end assembly at a second pressure. The first and second pressures are, at steady state, in equilibrium.

Implementation 35: The apparatus of any one of implementations implementation 26-28, further including a plurality of datum rods extending in the axial direction along peripheral surfaces of the cells. The second insulation plate includes a plurality of openings configured to respectively support corresponding datum rods among the datums rods therein.

Implementation 36: The apparatus of any one of implementations 1-35, in which the cathode and anode frames are formed of one or more polymers.

Implementation 37: The apparatus of any one of implementations 1-36, in which the cathode and anode frames include at least one of polyethylene terephthalate (PET), polycarbonate (PC), polyimide (PI), polyamide (PA), poly (methylmethacrylate) (PMMA), polyethylene naphthalate (PEN), polyetherketone (PEK), polyetheretherketone (PEEK), polystyrene (PS), polyetherimide (PEI), polyphenylene sulfide (PPS), polyarylate (PAR), polyether sulfone (PES), cyclic olefin copolymer (COC), polyvinyl alcohol (PVA), ethylene chlorotrifluoroethylene (ECTFE), polytetrafluoroethylene (PTFE), polybutylene terephthalate (PBT), polychlorotrifluoroethylene (PCTFE), and polyethylene terephthalate glycol (PETG).

Implementation 38: The apparatus of any one of implementations 1-37, in which the separator plates are formed of one or more metals.

Implementation 39: The apparatus of any one of implementations 1-38, in which the separator plates include at least one of aluminum, aluminum alloy, copper, copper alloy, tin, tin alloy, titanium, titanium alloy, tungsten, tungsten alloy, zinc, zinc alloy, steel, and stainless steel.

Implementation 40: The apparatus of any one of implementations 1-39, in which, when viewed in the axial direction, the tensioning members encircle the cells such that the cells are spaced apart from the tensioning members.

Implementation 41: A COx electrolyzer frame ("frame") includes a main body portion, an opening, a first fluidic passage, a first recess, a second recess, and a first connecting riser. The main body portion has a first surface opposing a second surface in an axial direction. The opening extends through a central region of the main body portion in the axial direction. The first fluidic passage extends through the main body portion in the axial direction. The first recess is in the first surface. The first recess is fluidically connected to the opening and extends in a second direction transverse to the axial direction. The second recess is in the second surface. The second recess is fluidically connected to the first fluidic passage and extends in a third direction transverse to the axial direction. The first connecting riser extends in the axial direction and is fluidically interposed between the first recess and the second recess such that the opening is fluidically connected to the first fluidic passage.

Implementation 42: The frame of implementation 41, further including a third recess in the first surface. The third recess encircles the opening and the first recess.

Implementation 43: The frame of implementation 42, in which, when viewed in the axial direction, the second recess crosses underneath the third recess.

Implementation 44: The frame of either implementation 42 or implementation 43, further including a fourth recess in the first surface. The fourth recess encircles the first fluidic passage.

Implementation 45: The frame of implementation 44, in which, when viewed in the axial direction, the second recess crosses underneath the fourth recess.

Implementation 46: The frame of any one of implementations 41-45, further including a fifth recess in the second surface and encircling the opening. When viewed in the axial direction, the first recess crosses above the fifth recess.

Implementation 47: The frame of any one of implementations 41-43 and 46, in which the first recess includes a proximal end, a distal end, and a plurality of sidewalls connecting the proximal end and the distal end to one another. A first sidewall among the sidewalls extends in a first oblique direction with respect to the second direction. A second sidewall among the sidewalls extends in a second oblique direction with respect to the second direction. The second oblique direction is different from the first oblique direction.

Implementation 48: The frame of implementation 47, in which the first connecting riser extends into the proximal end of the first recess, and the distal end of the first recess extends into the opening.

Implementation 49: The frame of any one of implementations 41-43 and 46-48, further including a plurality of protrusions extending in the axial direction from a surface of the first recess. The surface is recessed from the first surface.

Implementation 50: The frame of implementation 49, in which at least one of the protrusions has a different cross-sectional area than at least another one of the protrusions.

Implementation 51: The frame of either implementation 49 or implementation 50, in which the protrusions include: one or more first protrusions having respective first cross-sectional areas in a plane perpendicular to the axial direction; one or more second protrusions having respective second cross-sectional areas in the plane perpendicular to the axial direction, the second cross-sectional areas being respectively smaller than the first cross-sectional areas; and at least one third protrusion having a third cross-sectional area in the plane perpendicular to the axial direction, the third cross-sectional area being smaller than each of the second cross-sectional areas. The one or more second protrusions are disposed closer to the proximal end of the first recess than each of the one or more first protrusions and the at least one third protrusion. A majority of the one or more first protrusions are disposed closer to the opening than each of the one or more second protrusions and the at least one third protrusion. The at least one third protrusion is disposed between the one or more second protrusions and the majority of the one or more first protrusions.

Implementation 52: The frame of implementation 42, in which the third recess includes first sides and second sides. The first sides extend generally in the second direction. The second sides extend between the first sides. Each of the second sides includes a first portion extending in a fourth direction transverse to the axial and second directions, a second portion extending from a first side of the first portion in a third oblique direction forming a first angle with the fourth direction, a third portion arcuately extending between and connecting the second portion to one of the first sides, a fourth portion extending from a second side of the first portion in a fourth oblique direction forming a second angle with the fourth direction, and a fifth portion arcuately extending between and connecting the fourth portion to another one of the first sides.

Implementation 53: The frame of any one of implementations 41-52, further including a second fluidic passage and a third fluidic passage. The second fluidic passage extends through the main body portion in the axial direction. The third fluidic passage extends through the main body portion in the axial direction. Within the frame, the second and third fluidic passages are fluidically isolated from the first fluidic passage and the opening.

Implementation 54: The frame of any one of implementations 41-43 and 46-53, further including a first protrusion extending from the second surface in the axial direction. The first fluidic passage, the second recess, and the first connecting riser are formed in the first protrusion.

Implementation 55: The frame of either implementation 53 or implementations 53 and 54, further including a second protrusion and a third protrusion. The second protrusion extends from the second surface in the axial direction. The third protrusion extends from the second surface in the axial direction. The second fluidic passage extends through the second protrusion. The third fluidic passage extends through the third protrusion.

Implementation 56: The frame of any one of implementations 53-55, in which the second fluidic passage is arranged adjacent to a first side of the first fluidic passage. The third fluidic passage is arranged adjacent to a second side of the first fluidic passage. The second side of the first fluidic passage opposes the first side of the first fluidic passage in a fourth direction transverse to the axial direction and the second direction.

Implementation 57: The frame of any one of implementations 41-46, further including a sixth recess in the first surface. The sixth recess is fluidically connected to the first connecting riser and a proximal end of the first recess. The sixth recess extends in a fourth direction transverse to the axial direction and the second direction.

Implementation 58: The frame of implementation 57, further including a second fluidic passage, a seventh recess, and a second connecting riser. The second fluidic passage extends through the main body portion in the axial direction. The seventh recess is in the second surface. The seventh recess is fluidically connected to the second fluidic passage and extends in a fifth direction transverse to the axial direction. The second connecting riser extends in the axial direction and is fluidically interposed between the seventh recess and the first recess such that the opening is fluidically connected to the second fluidic passage. The first connecting riser is fluidically connected to a first side of the sixth recess. The second connecting riser is fluidically connected to a second side of the sixth recess opposing the first side of the sixth recess in the fourth direction.

Implementation 59: The frame of any one of implementations 41-46. 57, and 58, in which the first recess is one of a plurality of first recesses in the first surface that extend parallel to one another in the second direction.

Implementation 60: The frame of implementation 59, in which the first recesses include a first group of the first recesses, a second group of the first recesses, and a third group of the first recesses. The first recesses of the first group are spaced apart from one another according to a first pitch. The second group of the first recesses is arranged adjacent to a first side of the first group of the first recesses. The first recesses of the second group are spaced apart from one another according to a second pitch different from the first pitch. The third group of the first recesses is arranged adjacent to a second side of the first group of the first recesses. The first recesses of the third group are spaced apart from one another according to a third pitch different from the first and second pitches.

Implementation 61: The frame of implementation 60, in which the first pitch is a constant pitch, the second pitch is a first variable pitch, and the third pitch is a second variable pitch.

Implementation 62: The frame of implementation 61, in which the first and second variable pitches increase in size with increasing distance from the first group of the first recesses.

Implementation 63: The frame of any one of implementations 41-46 and 57-62, in which the second recess is one of a plurality of second recesses in the second surface extending parallel to one another in the third direction.

Implementation 64: The frame of implementations 58 and 63, in which the seventh recess is one of a plurality of seventh recesses in the second surface extending parallel to one another in the fifth direction, and the third and fifth directions extend obliquely with respect to the second direction.

Implementation 65: The frame of implementation 64, further including a third fluidic passage, a fourth fluidic passage, eighth recesses, and ninth recesses. The third fluidic passage extends through the main body portion in the axial direction and is separated from the first fluidic passaged by a first septal wall. The fourth fluidic passage extends through the main body portion in the axial direction and is separated from the second fluidic passaged by a second septal wall. The eighth recesses are in the second surface and extend parallel to one another in a sixth direction. The eighth recesses are fluidically interposed between the third fluidic passage and the first connecting riser such that the third fluidic passage is fluidically connected to the opening. The ninth recesses are in the second surface and extend parallel to one another in a seventh direction. The ninth recesses are fluidically interposed between the fourth fluidic passage and the second connecting riser such that the fourth fluidic passage is fluidically connected to the opening.

Implementation 66: The frame of implementation 65, in which: the third direction forms a first oblique angle with respect to the second direction; the fifth direction forms a second oblique angle with respect to the second direction, the second oblique angle being different from the first oblique angle; the sixth direction forms a third oblique direction with respect to the second direction, the third oblique angle being different from the first and second oblique angles; and the ninth direction forms a fourth oblique direction with respect to the second direction, the fourth oblique angle being different from the first to third oblique angles.

Implementation 67: The frame of implementation 66, in which the first oblique angle is greater than the third oblique angle, the second oblique angle is greater than the fourth oblique angle, an absolute value of the first and second oblique angles are substantially equivalent, and an absolute value of the third and fourth oblique angles are substantially equivalent.

Implementation 68: The frame of any one of implementations 65-67, further including a tenth recess in the second surface, an eleventh recess in the second surface, and a twelfth recess in the first surface. The fourth recess encircles the first fluidic passage and the third fluidic passage. The tenth recess encircles the first fluidic passage, the third fluidic passage, the second recesses, the eighth recesses, and the first connecting riser. The eleventh recess encircles the second fluidic passage, the fourth fluidic passage, the seventh recesses, the ninth recesses, and the second connecting riser. The twelfth recess encircles the second fluidic passage and the fourth fluidic passage. When viewed in the axial direction: the second recesses and the eighth recesses cross underneath the fourth recess, and the seventh recesses and the ninth recesses cross underneath the twelfth recess.

Implementation 69: The frame of any one of implementations 58-68, further including a fifth fluidic passage extending through the main body portion in the axial direction. Within the frame, the fifth fluidic passage is fluidically isolated from the first fluidic passage, the second fluidic passage, and the opening.

Implementation 70: The frame of implementation 69, in which the first fluidic passage is arranged adjacent to a first side of the fifth fluidic passage, and the second fluidic passage is arranged adjacent to a second side of the fifth fluidic passage. The second side of the fifth fluidic passage opposes the first side of the fifth fluidic passage in the fourth direction.

Implementation 71: The frame of any one of implementations 41-70, further including a plurality of first fastener orifices arranged in a peripheral area of the main body portion and encircling the opening.

Implementation 72: The frame of implementation 71, further including a plurality of second fastener orifices arranged in an intermediate area interposed between the first opening and the peripheral area. A pitch between adjacent second fastener orifices among the second fastener orifices is smaller than a pitch between adjacent first fastener orifices among the first fastener orifices.

Implementation 73: The frame of implementation 72, in which the first and second fastener orifices are counterbored.

Implementation 74: The frame of any one of implementations 41-73, in which the frame is formed of one or more polymers.

Implementation 75: The frame of any one of implementations 41-74, in which the frame includes at least one of polyethylene terephthalate (PET), polycarbonate (PC), polyimide (PI), polyamide (PA), poly(methylmethacrylate) (PMMA), polyethylene naphthalate (PEN), polyetherketone (PEK), polyetheretherketone (PEEK), polystyrene (PS), polyetherimide (PEI), polyphenylene sulfide (PPS), polyarylate (PAR), polyether sulfone (PES), cyclic olefin copolymer (COC), polyvinyl alcohol (PVA), ethylene chlorotrifluoroethylene (ECTFE), polytetrafluoroethylene (PTFE), polybutylene terephthalate (PBT), polychlorotrifluoroethylene (PCTFE), and polyethylene terephthalate glycol (PETG).

Implementation 76: A COx electrolyzer apparatus ("apparatus") includes a first end assembly, a second end assembly, and a plurality of COx electrolyzer cells ("cells"). The second end assembly is coupled to the first end assembly. The cells are interposed between the first end assembly and the second end assembly and are arranged in a stack along an axial direction. Each cell among the cells is configured to reduce input gaseous COx into one or more byproducts. In an operational state of the COx electrolyzer apparatus in which the cells reduce the input gaseous COx into the one or more byproducts, the second end assembly is configured to expand in the axial direction in response to accumulation of one or more control fluids in an internal cavity of the second end assembly. The expansion of the second end assembly is configured to constrain expansion of the cells in the axial direction. A flow path of the one or more control fluids is fluidically connected to a flow path of the input gaseous COx.

Implementation 77: The apparatus of implementation 76, in which each cell among the cells includes: a membrane electrode assembly ("MEA") having a cathodic part, an anodic part, and a separator between the cathodic part and the anodic part; a cathode frame adjacent to the cathodic part; a cathode flow field at least partially disposed in a first opening in the cathode frame; a cathode gas diffusion layer (GDL) adjacent to the cathode frame and covering the cathode flow field; an anode frame adjacent to the anodic part of the MEA; an anode flow field at least partially disposed in a second opening in the anode frame; and an anode porous transport layer (PTL) adjacent to the anode frame and covering the anode flow field.

Implementation 78: The apparatus of either implementation 76 or implementation 77, in which the second end assembly includes a first plate, a first gasket, and a second plate. The first plate includes a recess in a central portion of the first plate, a second recess encircling a central region of the central portion, and a first orifice configured to receive one or more control fluids. The first gasket is at least partially disposed in the second recess. The second plate is slidably disposed in the first recess and configured to abut against the first gasket and/or a recessed surface of the first recess facing the second plate in the axial direction such that the first recess, the first gasket, and the second plate define a cavity internal to the second end assembly. A distance in the axial direction between the second plate and the recessed surface of the first recess is configured to increase in response to the accumulation of the one or more control fluids in the cavity.

Implementation 79: The apparatus of implementation 78, in which the second plate is a first bus plate configured to receive a first electric potential, and the first plate is an insulation plate configured to electrically insulate the first bus plate from at least one other component of the first and/or second end assemblies.

Implementation 80: The apparatus of either implementation 78 or implementation 79, in which the second end assembly further includes a second end plate. The first plate is interposed between the second plate and the second end plate.

Implementation 81: The apparatus of implementation 80, in which the first insulation plate is coupled to the second end plate via a plurality of first fasteners.

Implementation 82: The apparatus of either implementation 80 or implementation 81, in which the first orifice is formed in the recessed surface and extends through the first plate in the axial direction.

Implementation 83: The apparatus of implementation 82, in which the second end plate includes a second orifice having a proximal end fluidically connected to the first orifice in the first plate and a distal end fluidically connected to a fluidic inlet coupling.

Implementation 84: The apparatus of implementation 83, in which the first and second orifices are substantially aligned in the axial direction.

Implementation 85: The apparatus of either implementation 83 or implementation 84, further including a gasket interposed between the first plate and the second end plate. The gasket encircles the first and second orifices to form a fluidic seal.

Implementation 86: The apparatus of either implementation 76 or implementation 77, in which the second end assembly includes a first plate, a piston, and one or more gaskets. The first plate includes a first main body, a first protrusion extending from the first main body in the axial direction, a first blind opening extending into a central portion of the first protrusion in a second direction opposite the axial direction, and at least one first orifice fluidically connected to the first blind opening and configured to receive one or more control fluids. The piston includes a second main body and a second protrusion extending from the second main body in the second direction. At least a portion of the second protrusion is slidably received in at least a portion of the first blind opening in the first protrusion. The one or more gaskets encircle the second protrusion and are configured to interface with one or more outer sidewalls of the second protrusion and one or more inner sidewalls of the first blind opening such that the first opening, the second protrusion, and the at least one gasket define a cavity internal to the second end assembly. The first blind opening terminates at a first recessed surface. The second protrusion terminates at a first protruded surface facing the first recessed surface in the second direction. A distance in the axial direction between the first protruded surface and the first recessed surface is configured to increase in response to the accumulation of the one or more control fluids in the cavity.

Implementation 87: The apparatus of implementation 86, in which the one or more gaskets are a plurality of gaskets. The gaskets are offset from one another in the axial direction.

Implementation 88: The apparatus of either implementation 86 or implementation 87, in which the second protrusion includes one or more recesses extending into the one or more outer sidewalls of the second protrusion in one or more directions transverse to the axial direction. The one or more gaskets are respectively supported in corresponding recesses among the one or more recesses.

Implementation 89: The apparatus of implementation 86, in which: the second end assembly further includes a plurality of biasing members; the second protrusion further includes a plurality of second blind openings extending into the first protruded surface in the axial direction; the first plate further includes a plurality of third protrusions extending from the first recessed surface in the axial direction; and the biasing members are respectively supported in the first blind opening via corresponding third protrusions among the third protrusions such that, in a first compressed state of the second end assembly, the biasing members are compressed between the first protruded surface and the first recessed surface and respective portions of the third protrusions at least partially extend into corresponding second blind openings among the second blind openings.

Implementation 90: The apparatus of implementation 89, in which respective widths of the second blind openings in a direction perpendicular to the axial direction are greater than respective widths of the third protrusions in the direction perpendicular to the axial direction.

Implementation 91: The apparatus of either implementation 89 or implementation 90, in which respective heights of the third protrusions from the first recessed surface in the axial direction are greater than respective depths of the second blind openings from the first protruded surface in the axial direction.

Implementation 92: The apparatus of any one of implementations 86-91, in which the first plate is a second end plate of the apparatus configured to be coupled to the first end plate via a plurality of tensioning members extending in the axial direction.

Implementation 93: The apparatus of any one of implementations 86-92, in which the second end assembly further includes an insulation plate and a first bus plate sequentially stacked in the axial direction from the piston such that the first bus plate and the insulation plate are interposed between the cells and the piston, the first bus plate is configured to receive a first electric potential, and the insulation plate is configured to electrically insulate the first bus plate from at least one other component of the second end assembly and/or the first end plate.

Implementation 94: The apparatus of implementation 93, in which the first bus plate and the insulation plate are coupled to the piston via a plurality of fasteners.

Implementation 95: The apparatus of any one of implementations 86-94, in which the at least one first orifice is a plurality of first orifices configured to receive one or more control fluids.

Implementation 96: The apparatus of any one of implementations 86-95, in which, in the operational state of the apparatus, the cavity is dead-headed.

Implementation 97: The apparatus of any one of implementations 86-94, in which the first plate further includes at least one second orifice fluidically connected to the first blind opening. The at least one second orifice is configured to bleed off excess accumulation of the one or more control fluids in the cavity in response to the accumulation of the one or more control fluids exceeding a predefined threshold.

Implementation 98: The apparatus of any one of implementations 78-97, in which the one or more control fluids and the input gaseous COx are substantially equivalent.

Implementation 99: The apparatus of any one of implementations 78-98, further including at least one source configured to input the gaseous COx to the cells at a first pressure and the one or more control fluids to the second end assembly at a second pressure. The first and second pressures are substantially equivalent.

Implementation 100: The apparatus of any one of implementations 78-99, further including at least one source configured to input the gaseous COx to the cells at a first pressure and the one or more control fluids to the second end assembly at a second pressure. At steady state, the first and second pressures are in equilibrium.

Implementation 101: The apparatus of either implementation 99 or implementation 100, in which the at least one source is configured to input the gaseous COx to the cells and the one or more control fluids to the second end assembly substantially simultaneously.

Implementation 102: The apparatus of either implementation 99 or implementation 100, in which the at least one source is configured to delay the input of the one or more control fluids with respect to the input of the gaseous COx.

Implementation 103: The apparatus of implementation 102, in which the at least one source is configured to delay the input of the one or more control fluids until the expansion of the cells reaches a defined threshold.

Implementation 104: The apparatus of any one of implementations 76-103, in which the flow path of the one or more control fluids is not routed through the cells.

What is claimed is:

1. A $CO_x$ electrolyzer apparatus comprising:

a first end assembly comprising a first end plate and a cathode interface assembly;

a second end assembly coupled to the first end assembly by a plurality of tensioning members;

a plurality of repeat units stacked along an axial direction and positioned between the first end assembly and the second end assembly, each repeat unit comprising:

a cathode side comprising:

a cathode frame that defines a first opening; and a cathode flow field at least partially disposed in the first opening;

an anode side comprising:

an anode frame that defines a second opening; and an anode flow field at least partially disposed in the second opening;

a separator plate positioned between the cathode frame and the anode frame;

a plurality of frame fasteners that couple the cathode frame and the anode frame to one another, wherein the frame fasteners are different from the tensioning members;

a membrane electrode assembly (MEA) having a cathode layer, an anode layer, and a membrane positioned between the cathode layer and the anode layer, wherein the MEA is positioned between the cathode side of a first repeat unit among the plurality of repeat units and the anode side of a second repeat unit among the plurality of repeat units such that the cathode side of the first repeat unit is adjacent to the cathode layer of the MEA and the anode side of the second repeat unit is adjacent to the anode layer of the MEA;

the cathode side of the first repeat unit, the anode side of the second repeat unit, and the MEA positioned therebetween defining a COx electrolyzer cell such that the plurality of repeat units stacked along the axial direction result in a plurality of the COx electrolyzer cells stacked along the axial direction and positioned between the first end assembly and the second end assembly;

the cathode interface assembly comprising:

an instance of the components of the cathode side of one of the plurality of repeat units;

one of the MEAs;

a cathode interface separator plate interposed between the first end plate and an immediately adjacent one of the plurality of repeat units such that a first end cell is formed between the cathode interface assembly and the immediately adjacent one of the plurality of repeat units;

wherein each of the separator plates comprises:

a plurality of fastener orifices through which the frame fasteners respectively extend;

at least one first hole through which an inlet anolyte flow path extends;

at least one second hole through which an outlet anolyte flow path extends;

at least one third hole through which an inlet gaseous COx flow path extends; and at least one fourth hole through which an outlet COx reduction byproduct flow path extends;

the first end assembly further comprises a first insulation plate, a manifold, and a first bus plate between the first end plate and the cathode interface assembly;

the manifold comprising:

at least one first inlet fluidically connected to the anode sides of the plurality of COx electrolyzer cells via the inlet anolyte flow path;

at least one first outlet fluidically connected to the anode sides of the plurality of COx electrolyzer cells via the outlet anolyte flow path;

at least one second inlet fluidically connected to the cathode sides of the plurality of COx electrolyzer cells via the inlet gaseous COx flow path; and at least one second outlet fluidically connected to the cathode sides of the plurality of COx electrolyzer cells via the outlet COx reduction byproduct flow path;

the first bus plate is configured to receive a first electric potential; and the first insulation plate is configured to electrically insulate the first end plate from the first bus plate, the inlet anolyte flow path, the outlet anolyte flow path, the inlet gaseous COx flow path, and the outlet COx reduction byproduct flow path do not extend into the first bus plate and the first insulation plate.

2. The $CO_x$ electrolyzer apparatus of claim 1, wherein each repeat unit further comprises:

a cathode gas diffusion layer (cathode GDL) adjacent to the cathode frame and covering the cathode flow field, the cathode GDL and the cathode flow field being configured to guide a flow of gaseous $CO_x$ across the first opening in a first direction transverse to the axial direction and in a distributed manner with respect to at least a second direction transverse to each of the axial and first directions; and an anode porous transport layer (anode PTL) adjacent to the anode frame and covering the anode flow field, the anode PTL and the anode flow field being configured to guide a flow of anolyte across the second opening in a third direction transverse to the axial direction and in a distributed manner with respect to at least the second direction.

3. The $CO_x$ electrolyzer apparatus of claim 2, wherein:

each repeat unit further comprises:

a first support frame interposed between the cathode GDL and the cathode frame, the first support frame comprising a first frame opening exposing a portion of the cathode GDL to the cathode flow field, the portion of the cathode GDL abutting against the cathode flow field; and a second support frame interposed between the MEA and the anode PTL, the second support frame comprising a second frame opening exposing a portion of the MEA to the anode PTL, the portion of the MEA abutting against the anode PTL; and the first support frame, the cathode GDL, the MEA, and the second support frame form a unitized MEA assembly.

4. The $CO_x$ electrolyzer apparatus of claim 3, wherein:

each repeat unit further comprises:

a first cathode gasket interposed between the first support frame and the cathode frame, the first cathode gasket encircling the first opening in the cathode frame to form a first fluidic seal around the cathode flow field; and a second cathode gasket interposed between a first separator plate among the separator plates and the cathode frame, the second cathode gasket encircling the first opening in the cathode frame to form a second fluidic seal around the cathode flow field;

the anode side further comprises:

a first anode gasket set; and a second anode gasket set;

the first anode gasket set comprises:

a first anode gasket interposed between the second support frame and the anode frame, the first anode gasket encircling the second opening in the anode frame to form a first fluidic seal around the anode flow field;

at least one second anode gasket interposed between the cathode frame and the anode frame, the at least one second anode gasket encircling at least one first fluidic inlet passage of the cathode frame and at least one third fluidic inlet passage of the anode frame to form at least one fluidic seal;

at least one third anode gasket interposed between the cathode frame and the anode frame, the at least one third anode gasket encircling at least one first fluidic outlet passage in the cathode frame and at least one third fluidic outlet passage in the anode frame to form at least one fluidic seal;

at least one fourth anode gasket interposed between the cathode frame and the anode frame, the at least one third anode gasket encircling at least one second fluidic inlet passage in the cathode frame and at least one fourth fluidic inlet passage in the anode frame to form at least one fluidic seal; and at least one fifth anode gasket interposed between the cathode frame and the anode frame, the at least one fifth anode gasket encircling at least one second fluidic outlet passage and at least one fourth fluidic outlet passage in the anode frame to form at least one fluidic seal; and the second anode gasket set comprises:

a sixth anode gasket interposed between the anode frame and a second separator plate among the separator plates, the sixth anode gasket encircling the second opening in the anode frame to form a second fluidic seal around the anode flow field;

at least one seventh anode gasket interposed between the anode frame and the second separator plate, the at least one seventh anode gasket encircling at least one first hole in the second separator plate and at least one third fluidic inlet passage in the anode frame to form at least one fluidic seal;

at least one eighth anode gasket interposed between the anode frame and the second separator plate, the at least one eighth anode gasket encircling at least one second hole in the second separator plate and the at least one third fluidic outlet passage in the anode frame to form at least one fluidic seal;

at least one ninth anode gasket interposed between the anode frame and the second separator plate, the at least one ninth anode gasket encircling at least one third hole in the second separator plate and the at least one fourth fluidic inlet passage in the anode frame to form at least one fluidic seal; and at least one tenth anode gasket interposed between the anode frame and the second separator plate, the at least one ninth anode gasket encircling at least one fourth hole in the second separator plate and the at least one fourth fluidic outlet passage in the anode frame to form at least one fluidic seal.

5. The $CO_x$ electrolyzer apparatus of claim 1, wherein the cathode frame comprises:

the first opening arranged in a central portion of the cathode frame;

at least one first fluidic inlet passage fluidically connected to the anode sides of the plurality of $CO_x$ electrolyzer cells;

at least one first fluidic outlet passage fluidically connected to the anode sides of the plurality of $CO_x$ electrolyzer cells:

at least one second fluidic inlet passage fluidically connected to the first opening; and at least one second fluidic outlet passage fluidically connected to the first opening.

6. The $CO_x$ electrolyzer apparatus of claim 5, wherein:

the cathode frame comprises a first surface facing the MEA and a second surface facing away from the first surface; and the second surface of the cathode frame comprises:

at least one first protrusion through which the at least one first fluidic inlet passage extends;

at least one second protrusion through which the at least one first fluidic outlet passage extends;

at least one third protrusion through which the at least one second fluidic inlet passage extends; and at least one fourth protrusion through which the at least one second fluidic outlet passage extends.

7. The $CO_x$ electrolyzer apparatus of claim 6, wherein:

the at least one first protrusion of the cathode frame is arranged and configured to extend through at least one first hole in a first separator plate among the separator plates and abut against the anode frame of a first adjacent cell among the plurality of $CO_x$ electrolyzer cells such that the at least one first fluidic inlet passage of the cathode frame is substantially aligned in the axial direction with at least one third fluidic inlet passage of the anode frame of the first adjacent cell;

the at least one second protrusion of the cathode frame is arranged and configured to extend through at least one second hole in the first separator plate and abut against the anode frame of the first adjacent cell such that the at least one first fluidic outlet passage of the cathode frame is substantially aligned in the axial direction with at least one third fluidic outlet passage of the anode frame of the first adjacent cell;

the at least one third protrusion of the cathode frame is arranged and configured to extend through at least one third hole in the first separator plate and abut against the anode frame of the first adjacent cell such that the at least one second fluidic inlet passage of the cathode frame is substantially aligned in the axial direction with at least one fourth fluidic inlet passage of the anode frame of the first adjacent cell; and the at least one fourth protrusion of the cathode frame is arranged and configured to extend through at least one fourth hole in the first separator plate and abut against the anode frame of the first adjacent cell such that the at least one second fluidic outlet passage of the cathode frame is substantially aligned in the axial direction with at least one fourth fluidic outlet passage of the anode frame of the first adjacent cell.

8. The $CO_x$ electrolyzer apparatus of claim 1, wherein the anode frame comprises:

the second opening arranged in a central portion of the anode frame;

at least one third fluidic inlet passage fluidically connected to the second opening;

at least one third fluidic outlet passage fluidically connected to the second opening;

at least one fourth fluidic inlet passage fluidically connected to the cathode sides of the plurality of $CO_x$ electrolyzer cells; and at least one second fluidic outlet passage fluidically connected to the cathode sides of the plurality of $CO_x$ electrolyzer cells.

9. The $CO_x$ electrolyzer apparatus of claim 1, wherein:

the cathode frame further comprises a plurality of first cathode fastener orifices arranged about a peripheral area of the cathode frame, the peripheral area encircling the first opening of the cathode frame; and the anode frame further comprises:

a plurality of first anode fastener orifices arranged about a peripheral area of the anode frame, the peripheral area encircling the second opening of the anode frame, the first cathode fastener orifices being substantially aligned with the first anode fastener orifices in the axial direction; and a plurality of first swage nuts, each first swage nut among the first swage nuts being disposed in one or the other of a corresponding one of the first anode fastener orifices and a corresponding one of the first cathode fastener orifices, the first swage nuts being configured to interface with corresponding frame fasteners among the frame fasteners.

10. The $CO_x$ electrolyzer apparatus of claim 1, wherein:

the first end assembly further comprises a capping plate, an inlet runner, and an outlet runner; and the inlet and outlet runners are coupled to the manifold such that the inlet and outlet runners are stacked in the axial direction between the capping plate and the manifold.

11. The $CO_x$ electrolyzer apparatus of claim 1, wherein:

the second end assembly comprises a second end plate and an anode interface assembly;

the anode interface assembly comprises:

an instance of the components of the anode side of one of the plurality of repeat units; and an anode interface separator plate interposed between a second repeat unit among the repeat units and the second end plate; and a second end cell is formed between the anode interface assembly and the immediately adjacent other one of the plurality of repeat units, the second end cell being interposed between the plurality of $CO_x$ electrolyzer cells and the second end plate.

12. The $CO_x$ electrolyzer apparatus of claim 11, wherein:

the second end assembly further comprises a second bus plate and a second insulation plate sequentially stacked in the axial direction between the anode interface assembly and the second end plate;

the second bus plate is configured to receive a second electric potential; and the second insulation plate is configured to electrically insulate the second end plate from the second bus plate.

13. The $CO_x$ electrolyzer apparatus of claim 12, wherein:

the second end assembly further comprises a bladder gasket;

the second insulation plate comprises:

a first recess formed in a central portion of the second insulation plate;

a second recess encircling a central region of the central portion, the second recess supporting the bladder gasket therein; and an orifice configured to receive one or more control fluids;

the second bus plate is slidably disposed in the first recess and configured to abut against the bladder gasket and/or a surface of the first recess facing the second bus plate in the axial direction; and a distance in the axial direction between the second bus plate and the surface of the first recess facing the second bus plate in the axial direction is configured to increase in response to accumulation of the one or more control fluids in an area between the second bus plate and the insulation plate that is fluidically sealed via at least the bladder gasket.

14. The $CO_x$ electrolyzer apparatus of claim 12, wherein:

the second end plate comprises:

a first main body;

a second end plate protrusion extending from the first main body in the axial direction; and a second end plate opening extending into a central portion of the second end plate protrusion in a direction opposite the axial direction and terminating at a recessed surface facing the plurality of $CO_x$ electrolyzer cells;

the second end assembly further comprises a piston interposed between the second insulation plate and the second end plate, the piston comprising:

a second main body; and a piston protrusion extending from the second main body in the direction opposite the axial direction and terminating at a protruded surface facing the recessed surface;

at least a portion of the piston protrusion is slidably disposed in at least a portion of the second end plate opening;

the second end plate further comprises one or more orifices fluidically connected to the second end plate opening, the one or more orifices being configured to receive one or more control fluids;

the piston protrusion comprises a plurality of piston gaskets encircling the piston protrusion and offset from one another in the axial direction, the piston gaskets interfacing with one or more inner sidewalls of the second end plate opening such that the second end plate opening, the piston protrusion, and the piston gaskets form a cavity within the second end assembly; and a distance in the axial direction between the protruded surface and recessed surface is configured to increase in response to accumulation of the one or more control fluids in the cavity.

15. The $CO_x$ electrolyzer apparatus of claim 14, wherein:

the second end assembly further comprises a plurality of biasing members;

the piston protrusion comprises a plurality of piston protrusion openings extending into the protruded surface in the axial direction;

the second end plate further comprises a plurality of support protrusions extending in the axial direction from the recessed surface and arranged in correspondence with the piston protrusion openings;

the biasing members are respectively supported in the second end plate opening via corresponding support protrusions among the support protrusions such that, in a first compressed state of the second end assembly, the biasing members are compressed between the protruded surface and the recessed surface and respective portions of the support protrusions at least partially extend into corresponding piston protrusion openings among the piston protrusion openings;

the second end plate further comprises one or more orifices fluidically connected to the second end plate opening, the one or more orifices being configured to receive one or more control fluids;

the piston protrusion comprises a plurality of piston gaskets encircling the piston protrusion and offset from one another in the axial direction, the piston gaskets interfacing with one or more inner sidewalls of the second end plate opening such that the second end plate opening, the piston protrusion, and the piston gaskets form a cavity within the second end assembly; and a distance in the axial direction between the protruded surface and recessed surface is configured to increase in response to accumulation of the one or more control fluids in the cavity.

16. A $CO_x$ electrolyzer apparatus comprising:

a first end assembly comprising a first end plate;

a second end assembly coupled to the first end assembly by a plurality of tensioning members, the second end assembly comprising a second end plate and an anode interface assembly;

a plurality of repeat units stacked along an axial direction and positioned between the first end assembly and the second end assembly, each repeat unit comprising:

a cathode side comprising:

a cathode frame that defines a first opening; and a cathode flow field at least partially disposed in the first opening;

an anode side comprising:

an anode frame that defines a second opening; and an anode flow field at least partially disposed in the second opening;

a separator plate positioned between the cathode frame and the anode frame;

a plurality of frame fasteners that couple the cathode frame and the anode frame to one another, wherein the frame fasteners are different from the tensioning members;

a membrane electrode assembly (MEA) having a cathode layer, an anode layer, and a membrane positioned between the cathode layer and the anode layer, wherein the MEA is positioned between the cathode side of a first repeat unit among the plurality of repeat units and the anode side of a second repeat unit among the plurality of repeat units such that the cathode side of the first repeat unit is adjacent to the cathode layer of the MEA and the anode side of the second repeat unit is adjacent to the anode layer of the MEA;

the cathode side of the first repeat unit, the anode side of the second repeat unit, and the MEA positioned therebetween defining a COx electrolyzer cell such that the plurality of repeat units stacked along the axial direction result in a plurality of the COx electrolyzer cells stacked along the axial direction and positioned between the first end assembly and the second end assembly;

the anode interface assembly comprising:

an instance of the components of the anode side of one of the plurality of repeat units; and an anode interface separator plate interposed between the second end plate and an immediately adjacent one of the plurality of repeat units such that a second end cell is formed between the anode interface assembly and the immediately adjacent one of the plurality of repeat units, the second end cell being interposed between the plurality of COx electrolyzer cells and the second end plate;

the second end assembly further comprising:

a bladder gasket;

a second insulation plate comprising:

a first recess formed in a central portion of the second insulation plate;

a second recess encircling a central region of the central portion, the second recess supporting the bladder gasket therein; and an orifice configured to receive one or more control fluids;

a second bus plate slidably disposed in the first recess and configured to abut against the bladder gasket and/or a surface of the first recess facing the second bus plate in the axial direction, wherein the second bus plate and the second insulation plate are sequentially stacked in the axial direction between the anode interface assembly and the second end plate, wherein the second bus plate is configured to receive a second electric potential, and wherein the second insulation plate is configured to electrically insulate the second end plate from the second bus plate; and a distance in the axial direction between the second bus plate and the surface of the first recess facing the second bus plate in the axial direction is configured to increase in response to accumulation of the one or more control fluids in an area between the second bus plate and the insulation plate that is fluidically sealed via at least the bladder gasket.

17. The $CO_x$ electrolyzer apparatus of claim 16, wherein each repeat unit further comprises:

a cathode gas diffusion layer (cathode GDL) adjacent to the cathode frame and covering the cathode flow field, the cathode GDL and the cathode flow field being configured to guide a flow of gaseous $CO_x$ across the first opening in a first direction transverse to the axial direction and in a distributed manner with respect to at least a second direction transverse to each of the axial and first directions; and an anode porous transport layer (anode PTL) adjacent to the anode frame and covering the anode flow field, the anode PTL and the anode flow field being configured to guide a flow of anolyte across the second opening in a third direction transverse to the axial direction and in a distributed manner with respect to at least the second direction.

18. The $CO_x$ electrolyzer apparatus of claim 17, wherein: each repeat unit further comprises:

a first support frame interposed between the cathode GDL and the cathode frame, the first support frame comprising a first frame opening exposing a portion of the cathode GDL to the cathode flow field, the portion of the cathode GDL abutting against the cathode flow field; and a second support frame interposed between the MEA and the anode PTL, the second support frame comprising a second frame opening exposing a portion of the MEA to the anode PTL, the portion of the MEA abutting against the anode PTL; and the first support frame, the cathode GDL, the MEA, and the second support frame form a unitized MEA assembly.

19. The $CO_x$ electrolyzer apparatus of claim 16, wherein the cathode frame comprises:

the first opening arranged in a central portion of the cathode frame;

at least one first fluidic inlet passage fluidically connected to the anode sides of the plurality of $CO_x$ electrolyzer cells;

at least one first fluidic outlet passage fluidically connected to the anode sides of the plurality of $CO_x$ electrolyzer cells:

at least one second fluidic inlet passage fluidically connected to the first opening; and at least one second fluidic outlet passage fluidically connected to the first opening.

20. The $CO_x$ electrolyzer apparatus of claim 16, wherein the anode frame comprises:

the second opening arranged in a central portion of the anode frame;

at least one third fluidic inlet passage fluidically connected to the second opening;

at least one third fluidic outlet passage fluidically connected to the second opening;

at least one fourth fluidic inlet passage fluidically connected to the cathode sides of the plurality of $CO_x$ electrolyzer cells; and at least one second fluidic outlet passage fluidically connected to the cathode sides of the plurality of $CO_x$ electrolyzer cells.

21. The $CO_x$ electrolyzer apparatus of claim 16, wherein:

the cathode frame further comprises a plurality of first cathode fastener orifices arranged about a peripheral area of the cathode frame, the peripheral area encircling the first opening of the cathode frame; and the anode frame further comprises:

a plurality of first anode fastener orifices arranged about a peripheral area of the anode frame, the peripheral area encircling the second opening of the anode frame, the first cathode fastener orifices being substantially aligned with the first anode fastener orifices in the axial direction; and a plurality of first swage nuts, each first swage nut among the first swage nuts being disposed in one or the other of a corresponding one of the first anode fastener orifices and a corresponding one of the first cathode fastener orifices, the first swage nuts being configured to interface with corresponding frame fasteners among the frame fasteners.

* * * * *